US007370456B2

(12) United States Patent
Ichikawa et al.

(10) Patent No.: US 7,370,456 B2
(45) Date of Patent: May 13, 2008

(54) PACKAGING OBJECT SUPPLYING APPARATUS, BOX BODY SUPPLYING APPARATUS, BOXING APPARATUS, PACKAGING SYSTEM AND PACKAGING METHOD

(75) Inventors: Haruo Ichikawa, Kanagawa (JP); Makoto Shimizu, Kanagawa (JP); Kazuyuki Kosemura, Kanagawa (JP); Akira Wakabayashi, Kanagawa (JP); Katsutoshi Nakamura, Kanagawa (JP); Masaharu Minagi, Kanagawa (JP); Minoru Tamura, Kanagawa (JP); Seiichi Yamashita, Kanagawa (JP); Toshihide Sasaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 150 days.

(21) Appl. No.: 10/434,467

(22) Filed: May 9, 2003

(65) Prior Publication Data

US 2004/0000121 A1 Jan. 1, 2004

(30) Foreign Application Priority Data

| | | |
|---|---|---|
| May 9, 2002 | (JP) | 2002-134360 |
| Jul. 8, 2002 | (JP) | 2002-198947 |
| Dec. 4, 2002 | (JP) | 2002-352066 |
| Mar. 5, 2003 | (JP) | 2003-058188 |
| Mar. 27, 2003 | (JP) | 2003-088083 |
| May 1, 2003 | (JP) | 2003-126240 |

(51) Int. Cl.
*B65B 1/30* (2006.01)

(52) U.S. Cl. ..... 53/493; 53/155; 53/445; 53/498; 53/499; 53/500

(58) Field of Classification Search ..... 53/443, 53/445, 493, 494, 58, 52, 495, 498, 499, 53/500, 505, 147, 150, 151, 154, 155, 158, 53/531, 537, 540, 542, 544
See application file for complete search history.

(56) References Cited

U.S. PATENT DOCUMENTS

| | | | | |
|---|---|---|---|---|
| 3,589,096 | A * | 6/1971 | Podvin | 53/493 |
| 4,166,312 | A * | 9/1979 | Harigane et al. | 29/38 C |
| 4,231,461 | A * | 11/1980 | Hinchcliffe et al. | 198/347.3 |
| 4,287,992 | A * | 9/1981 | Takemori | 211/59.2 |
| 5,048,666 | A * | 9/1991 | Huggins et al. | 198/431 |
| 5,615,536 | A * | 4/1997 | Tanaka | 53/447 |

(Continued)

FOREIGN PATENT DOCUMENTS

JP 63-40414 Y2 10/1988

(Continued)

*Primary Examiner*—Christopher Harmon
(74) *Attorney, Agent, or Firm*—Sughrue Mion, PLLC

(57) ABSTRACT

A packaging object supplying apparatus for supplying a packaging object to a packaging unit for packaging the packaging object into a predetermined fashion and specifically, a packaging object supplying apparatus comprising a packaging object combining portion for forming a combination of the packaging objects by combining two or more kinds of the packaging objects by a predetermined quantity in a predetermined array and a packaging object introducing portion for introducing the packaging objects combined by the packaging object combining portion to the packaging unit, a boxing apparatus comprising foldable box body supplying means, opening forming means, box body holding means, packaging object loading means, and lid forming means, a box body supplying apparatus for supplying a box body to the boxing apparatus.

5 Claims, 140 Drawing Sheets

U.S. PATENT DOCUMENTS

| | | | | | |
|---|---|---|---|---|---|
| 5,647,583 | A * | 7/1997 | Emigh et al. | 270/52.04 |
| 5,784,861 | A * | 7/1998 | Kotsiopoulos | 53/435 |
| 5,863,576 | A * | 1/1999 | Guarino | 426/107 |
| 5,954,323 | A * | 9/1999 | Emigh et al. | 270/58.06 |
| 6,023,908 | A * | 2/2000 | Vetsch | 53/155 |
| 6,047,526 | A * | 4/2000 | Draghetti | 53/443 |
| 6,105,340 | A * | 8/2000 | Draghetti | 53/415 |
| 6,208,908 | B1 * | 3/2001 | Boyd et al. | 700/216 |
| 6,698,158 | B2 * | 3/2004 | Spatafora | 53/77 |

FOREIGN PATENT DOCUMENTS

| | | | |
|---|---|---|---|
| JP | 2-127226 | A | 5/1990 |
| JP | 3-33457 | Y2 | 7/1991 |
| JP | 6-50841 | U | 7/1994 |
| JP | 9-207919 | A | 8/1997 |
| JP | 10-500385 | A | 1/1998 |
| JP | 10115895 | | 5/1998 |
| JP | 10316102 | A1 | 12/1998 |
| JP | 3059761 | U | 3/1999 |

* cited by examiner 148
148A
148B
149
149A
150
151
152
154
156
158
122
124
134
146
C 6B10
6B12
6B8
6B
42
6B2
6B2
6A4
4A
6A
4
C
306
302
314
312
6A2
6A8
6A10
318
300
308
310
316
314
320
320
350
304
362
364
356
360
362
364
352
C
354
358

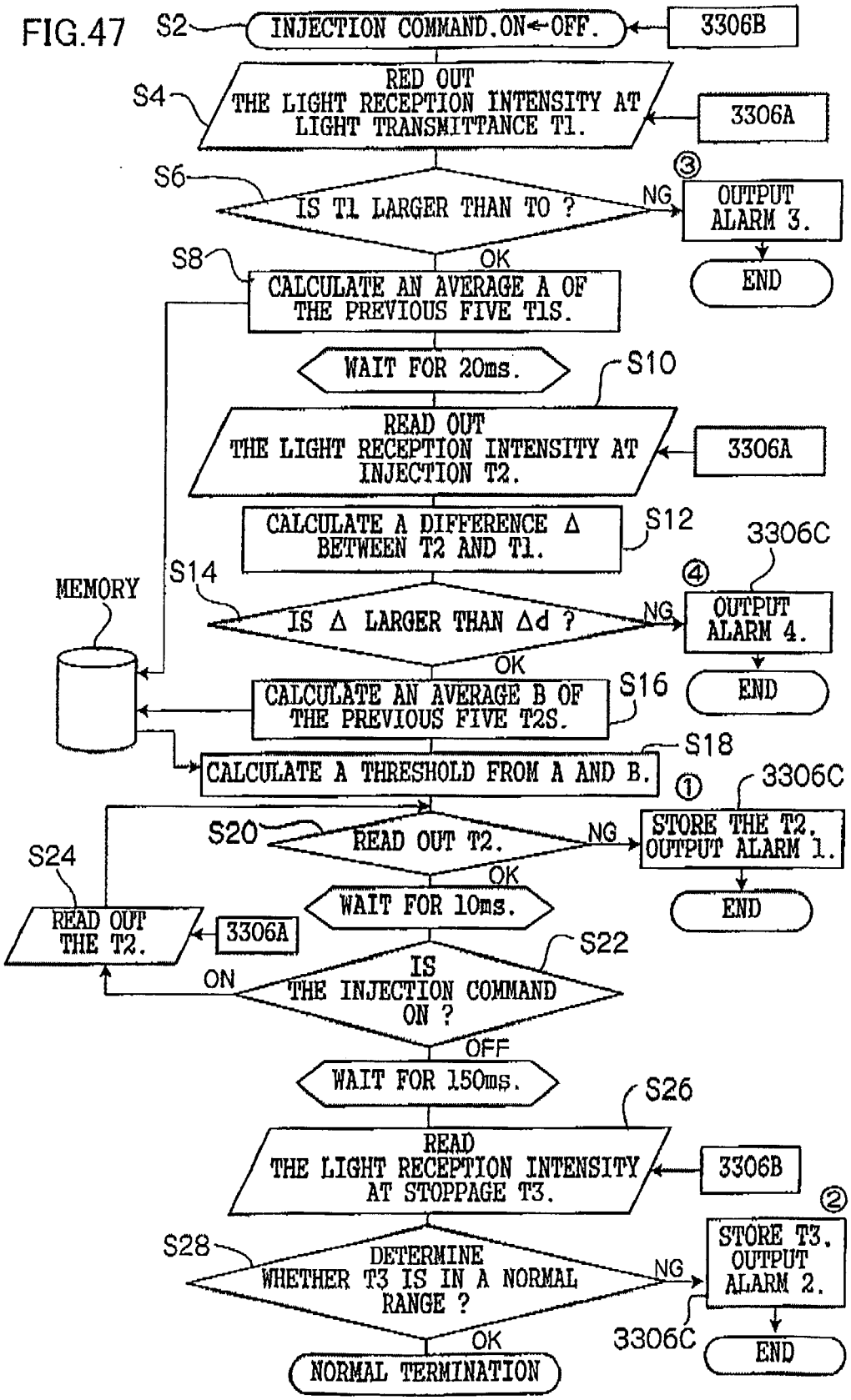
FIG.47
S2
INJECTION COMMAND.ON←OFF.
3306B
S4
RED OUT THE LIGHT RECEPTION INTENSITY AT LIGHT TRANSMITTANCE T1.
3306A
S6
IS T1 LARGER THAN T0 ?
NG
③
OUTPUT ALARM 3.
END
OK
S8
CALCULATE AN AVERAGE A OF THE PREVIOUS FIVE T1S.
WAIT FOR 20ms.
S10
READ OUT THE LIGHT RECEPTION INTENSITY AT INJECTION T2.
3306A
CALCULATE A DIFFERENCE Δ BETWEEN T2 AND T1.
S12
3306C
MEMORY
S14
IS Δ LARGER THAN Δd ?
NG
④
OUTPUT ALARM 4.
END
OK
CALCULATE AN AVERAGE B OF THE PREVIOUS FIVE T2S.
S16
S18
CALCULATE A THRESHOLD FROM A AND B.
①
3306C
S20
READ OUT T2.
NG
STORE THE T2. OUTPUT ALARM 1.
END
OK
S24
WAIT FOR 10ms.
READ OUT THE T2.
3306A
S22
ON
IS THE INJECTION COMMAND ON ?
OFF
WAIT FOR 150ms.
S26
READ THE LIGHT RECEPTION INTENSITY AT STOPPAGE T3.
3306B
②
S28
DETERMINE WHETHER T3 IS IN A NORMAL RANGE ?
NG
STORE T3. OUTPUT ALARM 2.
3306C
END
OK
NORMAL TERMINATION 835A
835B
832A
832
833A
833
834
834A
834B
834B
P
835A
835B
832C
834
834A
834B
834C
P
900
834C
832B
832
832A
P
831

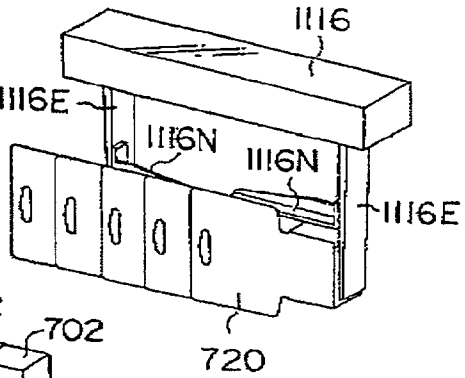
FIG.140D
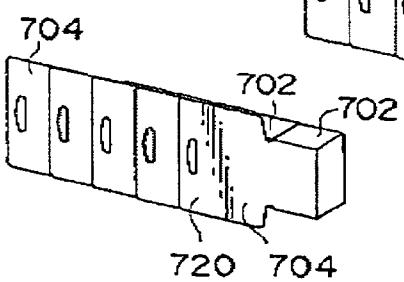
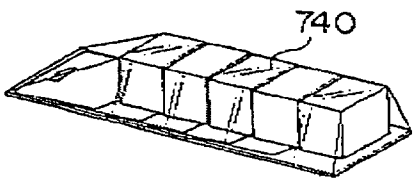
FIG.140G
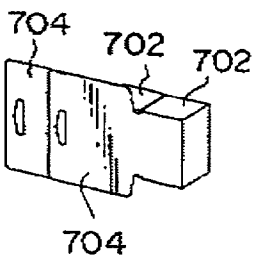
FIG.140C
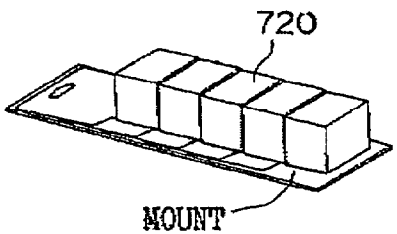
FIG.140F
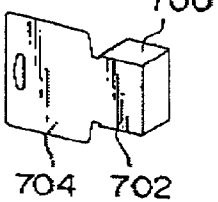
FIG.140B
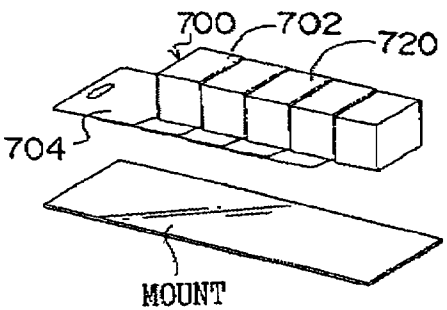
FIG.140E
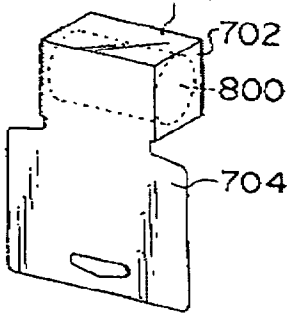
FIG.140A 702
700
800
704

704
702
700

704
702
700
722

702
700
720
704

1302
724

1302
724
722

1302
724
700
722
720

700
702
704
P
1116
1116E
1116N
720

PACKAGING OBJECT SUPPLYING APPARATUS, BOX BODY SUPPLYING APPARATUS, BOXING APPARATUS, PACKAGING SYSTEM AND PACKAGING METHOD

BACKGROUND OF THE INVENTION

1. Field of the Invention

The present invention relates to a packaging object supplying apparatus, box body supplying apparatus, boxing apparatus, packaging system and packaging method and particularly to a packaging object supplying apparatus for supplying two or more kinds of packaging objects to the packaging unit in a predetermined array, a box body supplying apparatus capable of treating boxes of various sizes and shapes with single equipment, a boxing apparatus having the box body supplying apparatus and a packaging system capable of automatically packing small boxes of various shapes and sizes into corrugated board boxes according to a predetermined pattern.

2. Description of the Related Art

Usually, a film cartridge containing a photographic roll film is incorporated in a plastic film case and the film case is sold in a form of a carton which is a sack carton made of coated board.

Although conventionally, a carton generally adopts a small box type in which one film case is accommodated in each small box, recently, production number of a package so-called multi-small box type package in which two or more film cases are accommodated therein have increased.

A small box with a single film-type package is a standard packaging style for a film cartridge and its production amount is large with a small deflection in its quantity. Thus, a small box with a single film-type package can be automatically manufactured.

On the other hand, as for a multi-small box type-package, although production amount for one packaging style is not so large, there is a huge deflection in production quantity between different packaging styles. Further, this type has various packaging styles depending on the quantity of the film cases accommodated therein, presence/absence of a header which is a tab-like member and position thereof.

Therefore, it is difficult to manufacture a multi-small box type-package automatically and thus, packages of this type often are manufactured by hand or a semi-automatic packaging machine. Therefore, there is such a problem that its production efficiency is not raised.

Although conventionally, a packaging unit capable of coping with various styles of the multi-small boxes has been demanded, there are following problems in realizing such kind of packaging unit.

(1) Sack cartons used for the conventional multi-small box, that is, small boxes made of coated board are separated into two types; a type in which a film case is loaded from opening portions on both ends, and a type in which a film case is loaded from an opening portion on the side face thereof. A cartoner, which is a packaging unit for packaging the film case in the sack carton, cannot cope with two kinds of the sack cartons easily.

(2) In a conventional multi-small box, bar code sizes and printing positions are not made uniform.

(3) Even among multi-small boxes in which the same number of film cases are loaded, there is a difference in header positions and sizes.

(4) Multi-small boxes are often gathered together in a specified number and shrink-packaged. Upon shrink packaging, the multi-small box needs to be assembled in a different pattern in accordance with a presence/absence of its mount paper, header position, size, number of film cases loaded therein and the like.

(5) When the multi-small boxes are packaged in a corrugated board box, they need to be packaged in a different pattern in accordance with a packaging style of the multi-small boxes.

Among the above-described problems, it is considered the problem (1) and the problem (2) can be solved by making uniform the direction of loading the film cases in the sack carton and unifying the size and printing position of the bar code to be printed on the multi-small box.

SUMMARY OF THE INVENTION

An object of the present invention is to provide a packaging system capable of solving the problems (3) to (5) and a corrugated board box for use in the packaging system.

Another object of the invention is to provide a packaging system and a packaging method by which packed products can be manufactured in a short period, which are efficient in there is no need of maintaining a large stock in manufacturing process, and which facilitates tracking if a defect is found in any package.

Still another object of the invention is to provide a packaging object supplying apparatus available for establishing a packaging system corresponding to a packaging configuration in which two or more kinds of plastic case packed products are loaded into a carton and a packaging system having the packaging object supplying apparatus and capable of corresponding to the packaging configuration.

To achieve the above-described objects, according to a first aspect, there is provided a packaging object supplying apparatus for supplying packaging objects to a packaging unit for packaging in a predetermined fashion, comprising: a packaging object combining portion for forming a combination of the packaging objects by combining two or more kinds of the packaging objects by a predetermined quantity thereof in a predetermined arrangement; and a packaging object introducing portion for introducing the packaging objects combined by the packaging object combining portion to the packaging unit.

An example in which three kinds of packaging objects, A, B, and C are packaged in an array of ABC by the packaging unit will be described below.

Each of the packaging objects A, B and C is introduced into the packaging object arraying portion, The packaging object arraying portion arrays the introduced packaging objects A, B and C in the array of ABC.

The packaging object introducing portion introduces the packaging objects A, B and C arrayed in the order of ABC to the packaging unit while maintaining the array of ABC.

Because the packaging unit packages the packaging objects A, B and C arranged in the array of ABC, the packaging objects A, B and C are packaged in an order of ABC.

It is permissible to introduce the packaging object into a small chamber in the packaging object combining portion, combine them into a predetermined array in the small chamber and introduce them into the packaging object introduction portion or it is permissible to form that combination by introducing the packaging objects to the packaging object introducing portion according to a predetermined array.

To achieve the above-described object, according to a second aspect of the invention, there is provided a boxing apparatus wherein a box body having folding portions, which are developed to form a rectangular parallelepiped-shaped structure, and having flap portions for forming an opening portion and a lid portion for covering the opening portion on both ends is constructed from a folded state so as to form the opening portions, with the box body having the opening portions held such that one of the opening portion faces upward while the other one faces downward, a packaging object is loaded into the main body through one of the opening portion and the flap portions are constructed to form the lid so that the packaging object is packaged in the box, the boxing apparatus comprising foldable box body supplying means, opening forming means, box body holding means, packaging object loading means and lid forming means, wherein: the foldable box body supplying means accommodates the box body in a folded state and supplying the accommodated box body to the box body holding means one by one, the opening forming means constructing a box body supplied by the foldable box body supplying means to the box body holding means from a folded state to form the opening portion, the box body holding means holding the foldable box body having the opening portion formed at the opening forming portion with one of the opening portions facing upward while the other one facing downward, the packaging object loading means loading the packaging object through an opening portion of the box body held by the box body supplying means, the lid forming means folding the flap portions of the foldable box body after the packaging object is loaded into the packaging object loading means, so as to form a lid portion for covering the opening portion.

In the above-described boxing apparatus, the box body accommodated in the folding condition by the foldable box body supplying means is opened by the opening forming means and then supplied to the box body holding means. Therefore, after the opening is formed, the box body is held by the box body holding means such that one of the opening portion faces upward while the other opening portion faces downward. Then, the packaging object loading means loads the packaging object into the box body and the lid portion is formed by the lid forming means and finally, the packaging object is packed into the box body.

In this way, the boxing apparatus is capable of automatically carrying out a sequential processing of formation of the opening in the box body, loading of the packaging object and formation of the lid portion.

According to a third aspect of the invention, there is provided a box body supplying apparatus for supplying the box body to the boxing apparatus, wherein the foldable box body supplying means comprises a foldable box body accommodating portion which accommodates the box body in a folded state and has a box body pickup port for picking up the accommodated box body at an end thereof and a box body supplying portion for supplying a box body accommodated in the foldable box body accommodating portion to the boxing apparatus one by one, the box body supplying portion comprising: box body holding means for holding the box body and capable of approaching/leaving the box body pickup port and the boxing apparatus; and box body moving means for moving the box body holding means between a box body pickup position for picking up the box body from the box body pickup port and a box body loading position in which the picked up box body is loaded on the boxing apparatus.

In the box body supplying apparatus of the present aspect, the box body holding means located at the box body pickup position approaches the box body pickup port and picks up the box body accommodated in the foldable box body accommodating portion from the box body pickup port. The box body holding means is moved from the box body pickup port to the box body loading position by the box body moving means while holding the picked up box body. After the box body holding means is moved to the box body loading position, it approaches the boxing apparatus and loads the held box body on the boxing apparatus.

The box body supplying apparatus automatically carries out all scanning from pick-up of the box body to loading on the boxing apparatus.

According to a fourth aspect of the invention, there is provided a packaging system comprising: a small box package forming portion for forming a small box package in which one or multiple packaging objects is/are accommodated in the small box thereof; an assembly forming portion for forming a small box assembly by assembling according to an assembly pattern indicating the presence/absence, position and size of a header of the small box package and the size of the small box package; and an exterior packaging forming portion for forming an exterior packaging by loading the small box assembly into an exterior packaging box according to a predetermined loading pattern set depending on the assembly pattern.

In the packaging system of the present aspect, the assembly forming portion assembles a predetermined quantity of the small boxes, for example, five small boxes into a predetermined fashion according to the assembling pattern. The exterior packaging forming portion loads the small box assembly into the exterior packaging box according to a predetermined loading pattern.

The small box mentioned here includes a small box of a type having a header which is a tab-like member, a small box of a type having no header, a small box of a type in which the header is provided on an edge, a small box of a type in which the header is provided on a side edge, a small box of a type in which the width of the header is equal to that of the small box, a small box of a type in which the width of the header is larger than that of the small box, a small box of a type accommodating only a packaging object such as a film case therein, a small box of a type accommodating two or more packaging objects and the like.

However, by the packaging system of the present aspect, small boxes can be automatically accommodated in the exterior packaging box according to the packaging pattern in accordance with absence/presence of a header, position and size of the header and the size of the small boxes themselves.

According to a fifth aspect of the invention, there is provided a corrugated board box comprising a rectangular parallelepiped-shaped box body including a rectangular bottom portion and four side plates formed continuously with the bottom portion at each side of the bottom portion, with a top face of the box body being open, an intermediate partition for dividing the interior of the box body into two sections and four flap portions formed continuously from the side plates along top edges of the four side plates and folded inward along the continuous portions so as to form lid portions for covering the open top face, the intermediate partition being fixed at an inside face of one side plate through an end portion thereof and extending toward another side plate opposing the one side plate, so that the other end is formed as a free end.

The corrugated board box has a partition. Therefore, when shrink packages are loaded, the positions of the loaded shrink packages are stabilized and the shrink packages never move laterally in the corrugated board box. Thus, the shrink packages never interfere with each other to be damaged.

Because the front end of the partition is free, if the assembly loading means of the packaging system contacts the partition during loading of the small box assembly or the shrink package, the partition is moved with little resistance. Then, as the small box assembly is loaded on both sides of the partition, the partition is moved to the central portion of the corrugated board box. Therefore, if the corrugated board box is employed in a packaging system which uses a multi-articulate robot as the assembly loading means, a stable loading is facilitated.

According to a sixth aspect of the invention, there is provided a packaging system comprising: a packaging object manufacturing portion for manufacturing a packaging object; and a packaging portion for packaging the packaging object manufactured by the packaging object manufacturing portion in a predetermined fashion, wherein the packaging object manufactured by the packaging object manufacturing portion is packaged by the packaging portion without being deposited between being manufactured and being packaged.

In the packaging system of the present aspect, the packaging object manufactured by the packaging object manufacturing portion is supplied to the packaging portion immediately without being deposited between being manufactured and being packaged, in other words, processing from manufacturing of the packaging object in the packaging object manufacturing portion to packaging of the packaging object by the packaging portion is executed as a sequential process.

Therefore, because no accumulating portion is necessary between the packaging object manufacturing portion and the packaging portion unlike a conventional plastic case packed product packaging unit, there is no room of producing any stock in the process. Thus, a period from reception of an order for the packaging object to shipment to a customer can be reduced largely. Further, because a time in which the packaging object remains in the process can be reduced, the efficiency of the entire packaging system is improved largely.

Additionally, because the packaging object manufactured by the packaging object manufacturing portion is supplied to the packaging portion immediately without being deposited between being manufactured and being packaged, a packaging object manufactured by the packaging object manufacturing portion first is supplied and packaged earlier than a packaging object manufactured later, so that so-called "first-in first-out" can be achieved completely.

Therefore, because tracking can be carried out easily if any defect is found out in inspection process after packaging at the packaging portion, the cause for that defect can be grasped easily.

The packaging object mentioned under the present invention includes commodity in which one or two products are accommodated in a small box package such as a film cartridge, various kinds of canned beverages, copier toner container, as well as the aforementioned plastic case packed product.

As for the style of packaging the packaging objects by the packaging portion, for example, one or multiple packaging objects are loaded in such a small box as the sack carton so as to form a small box package and then, the small box assembly is formed based on a predetermined pattern and packed into a corrugated board box.

BRIEF DESCRIPTION OF THE DRAWINGS

FIG. 47 is a block diagram showing a flow of signals in a CPU of the adhesive-injection inspection system shown in FIG. 44 and a scheme determinating whether hot melt adhesive is normally injected at the above-mentioned hot melt adhesive-injecting gun.

FIG. 71C is a perspective view of a portion of FIG. 71B.

FIG. 110 is a perspective view showing a detailed constitution of a hand portion of the product-loading robot shown in FIG. 109.

FIG. 111 is a perspective view showing a detailed constitution close to finger-like members of the hand portion shown in FIG. 110.

FIG. 112 is a flow chart showing a series of operation of the product-loading robot shown in FIG. 109 loading a carton assembly or a shrink-wrapped package.

FIGS. 113A and 113B are schematic diagrams showing operation of the finger-like members at the time when grasping a carton assembly or a shrink-wrapped package.

FIGS. 114A and 114B are schematic diagrams showing operation of the finger-like members at the time when loading the carton assembly or the shrink-wrapped package into a corrugated board box.

FIGS. 115 and 116 are perspective views showing a detailed constitution of an empty corrugated board box-transporting portion incorporated in the corrugated board-casing unit shown in FIG. 108.

FIG. 117 is a perspective view showing a detailed constitution of a corrugated board box-positioning portion incorporated in the corrugated board-casing unit shown in FIG. 108.

FIGS. 118 and 119 are perspective views showing a detailed constitution of a product-loaded corrugated board box-transporting portion incorporated in the corrugated board-casing unit shown in FIG. 108.

FIG. 120 is a block diagram showing a constitution of a control computer incorporated in the packaging system shown in FIG. 83.

FIG. 121 is a perspective view showing an example of a corrugated board box with a partition that can be employed in the packaging system shown in FIG. 83.

FIG. 122 is a plan view showing a view of the corrugated board box with a partition shown in FIG. 121 from an opening from which a carton assembly or a shrink-wrapped package is loaded.

FIG. 123 is a development of the corrugated board box with a partition shown in FIG. 121.

Figure 83:
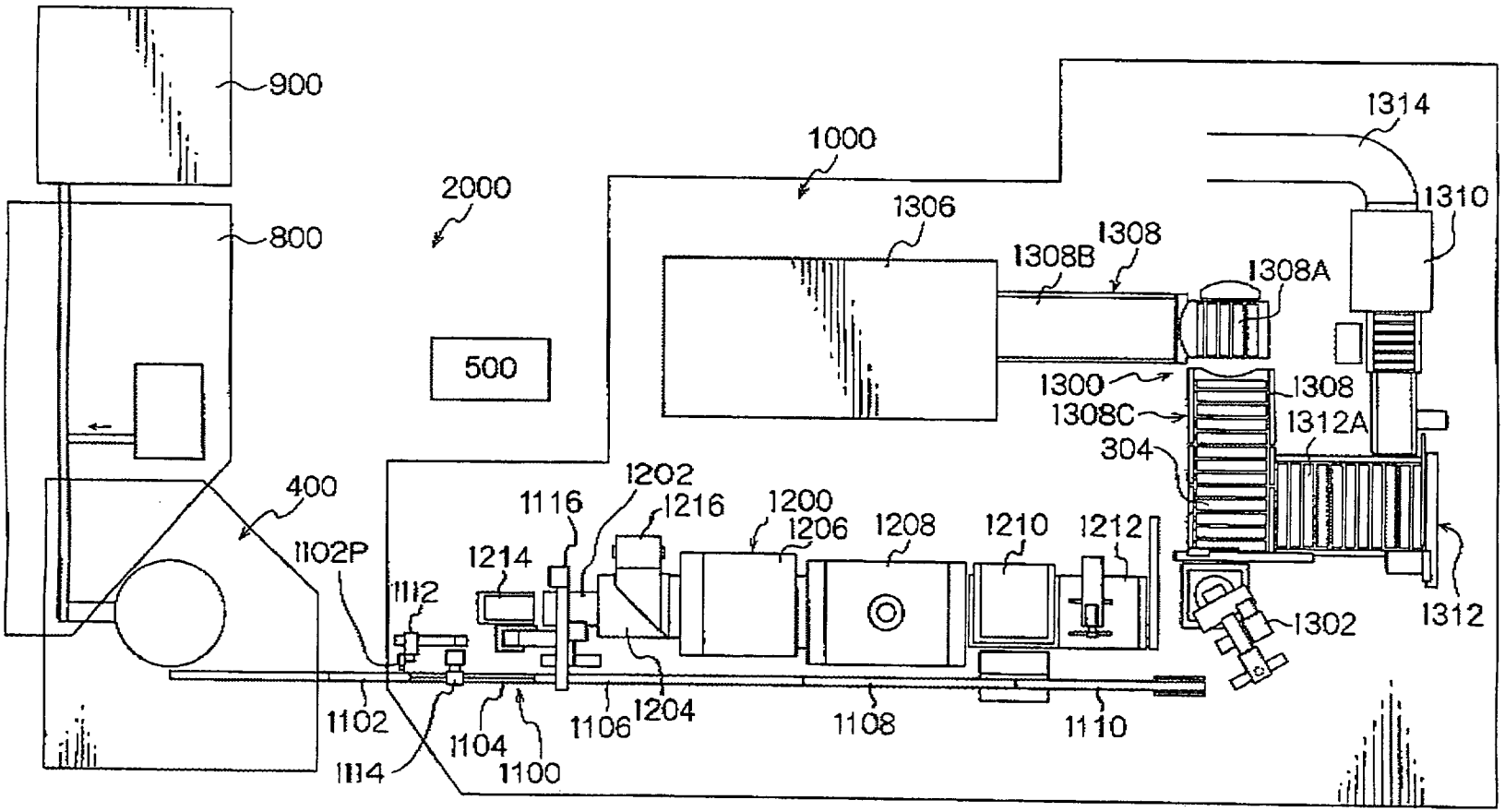
FIG. 83 is a plan view showing an entire constitution of a packaging system of a fifth embodiment.
Figure 124:
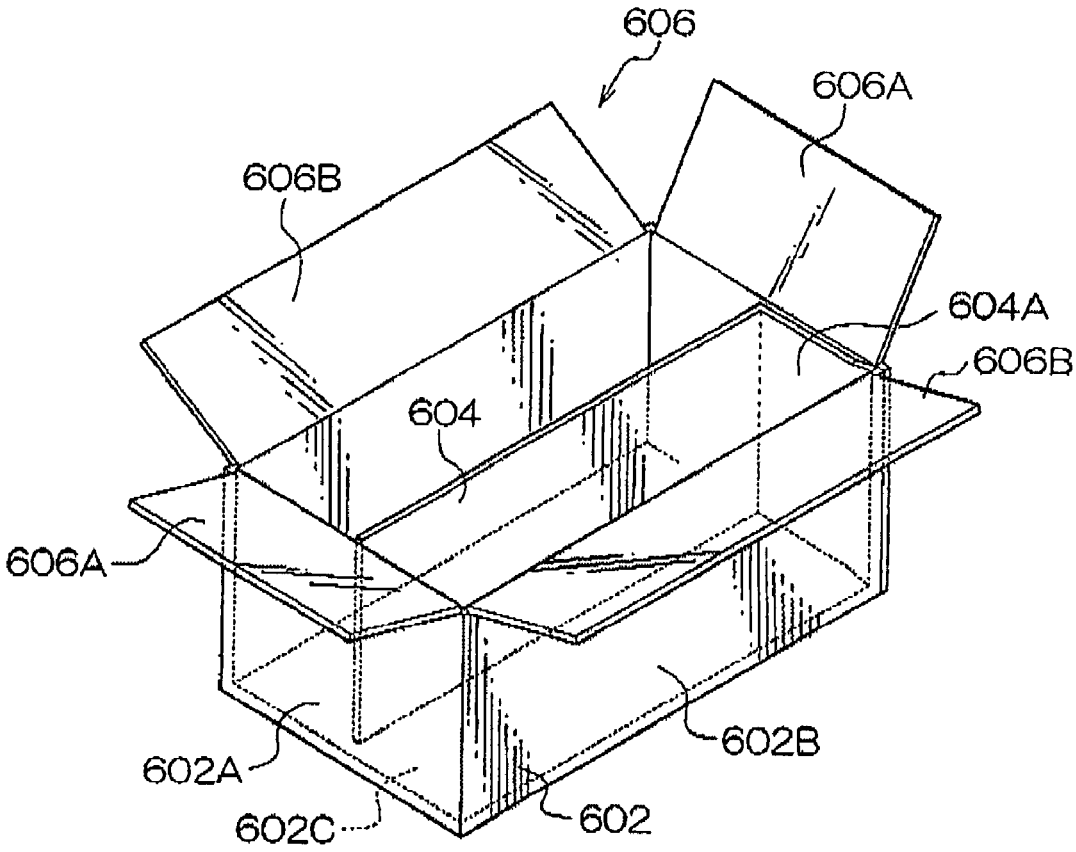

FIG. 124 is a perspective view showing another example of a corrugated board box with a partition that can be employed in the packaging system shown in FIG. 83.

Figure 125:
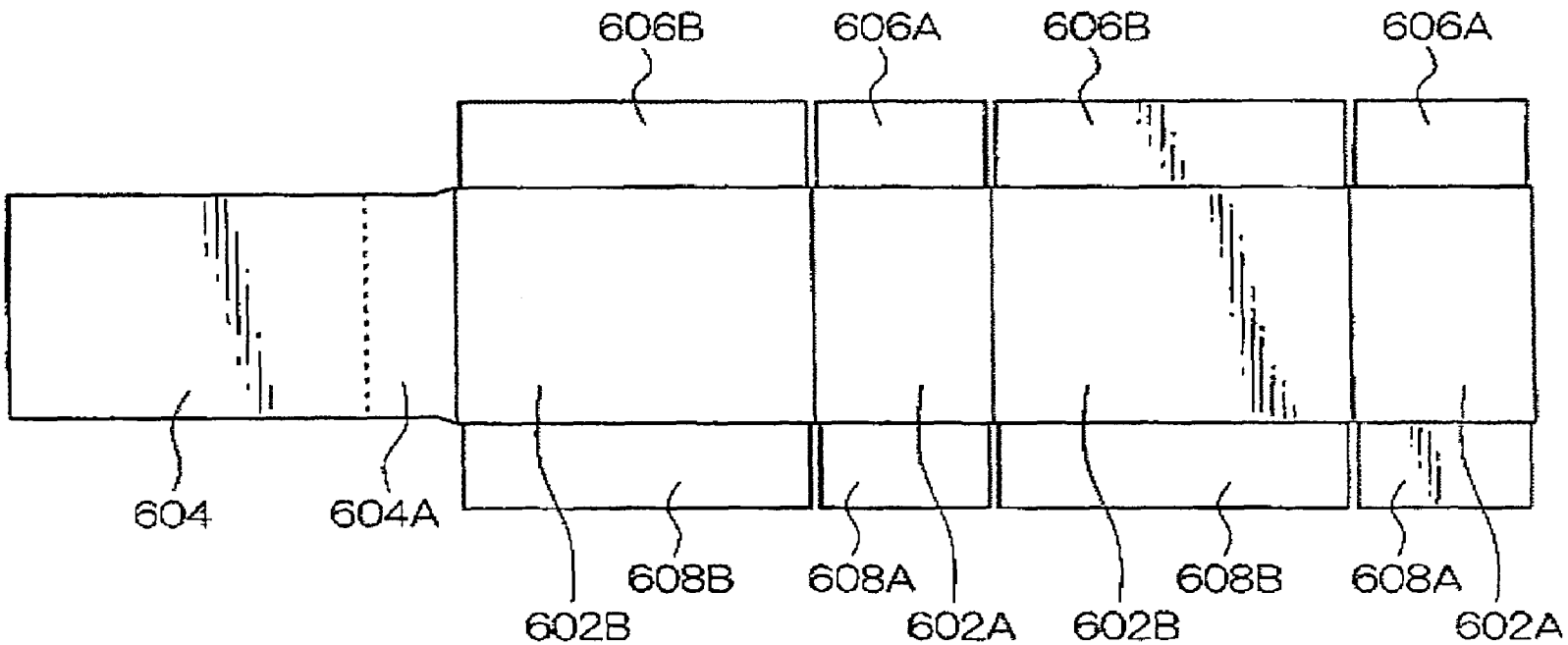

FIG. 125 is a development of the corrugated board box with a partition shown in FIG. 124.

FIGS. 126A through 126H are flow charts showing a process of loading shrink-wrapped packages or carton assemblies into a corrugated board box with a partition shown in FIG. 121 to 125.

Figure 127:
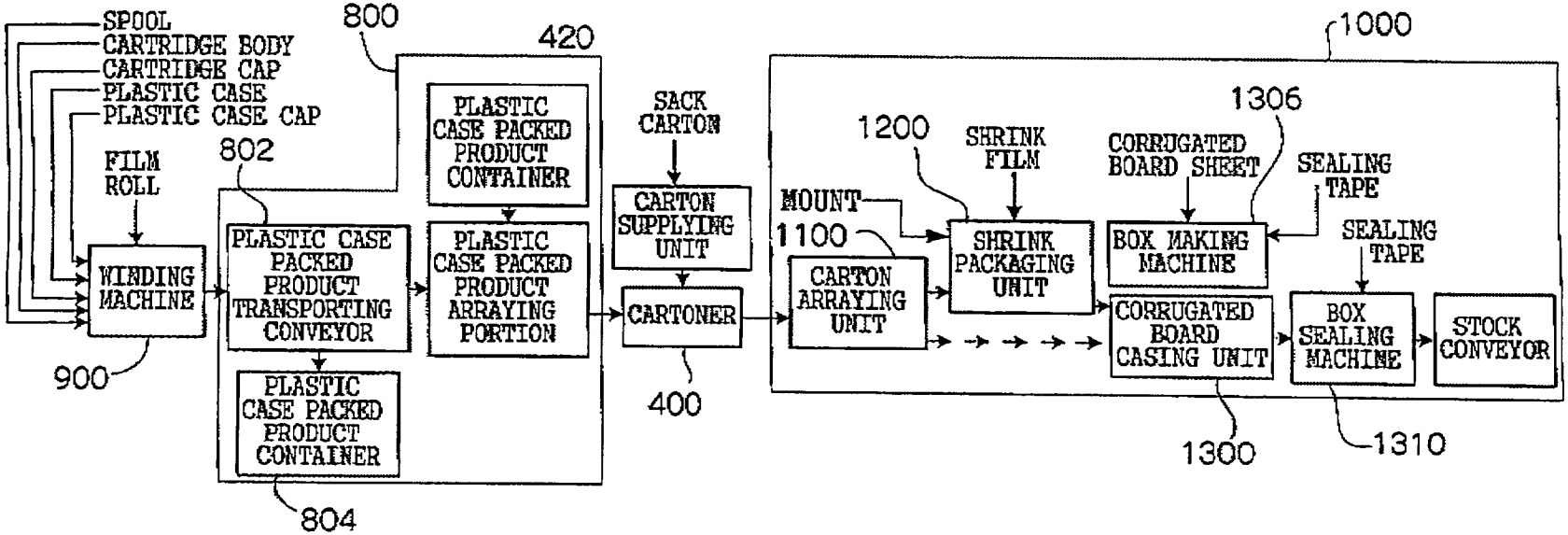

FIG. 127 is a flow chart showing a flow of materials in the packaging system shown in FIG. 83.

Figure 128:
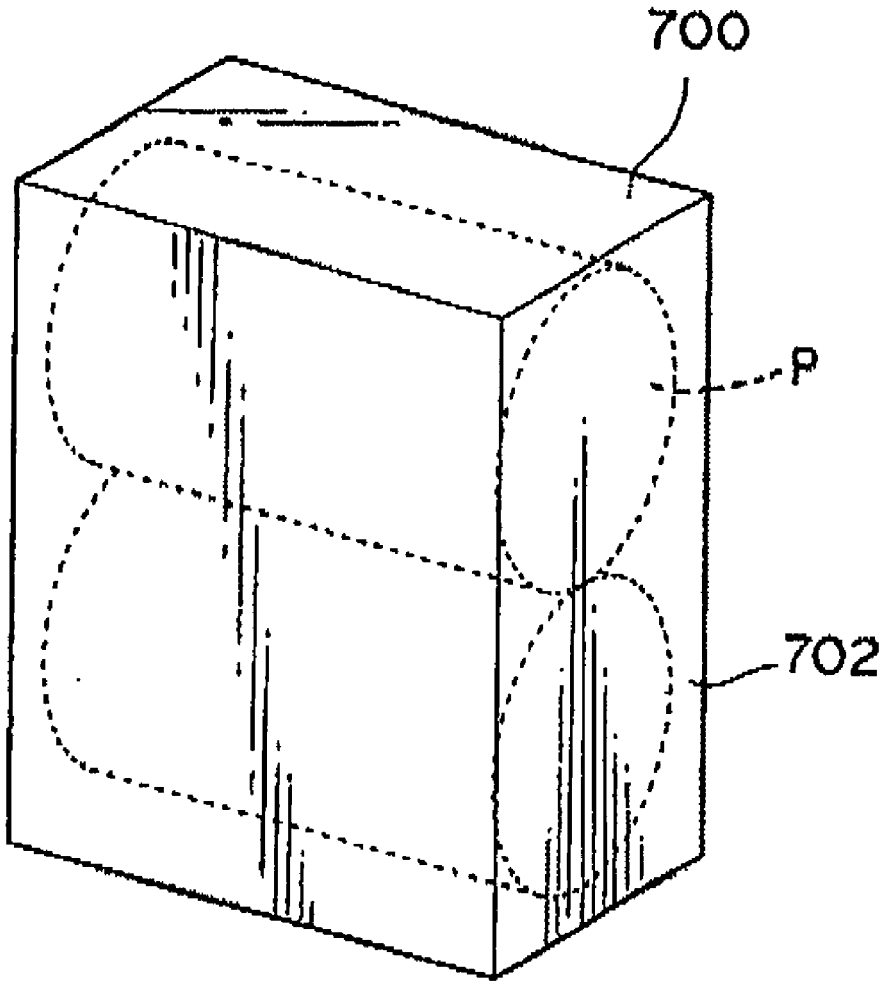

FIG. 128 is a perspective view showing an example of a carton having no header that is included in a carton that can be into a corrugated board box with a partition in the packaging system shown in FIG. 83.

Figure 129:
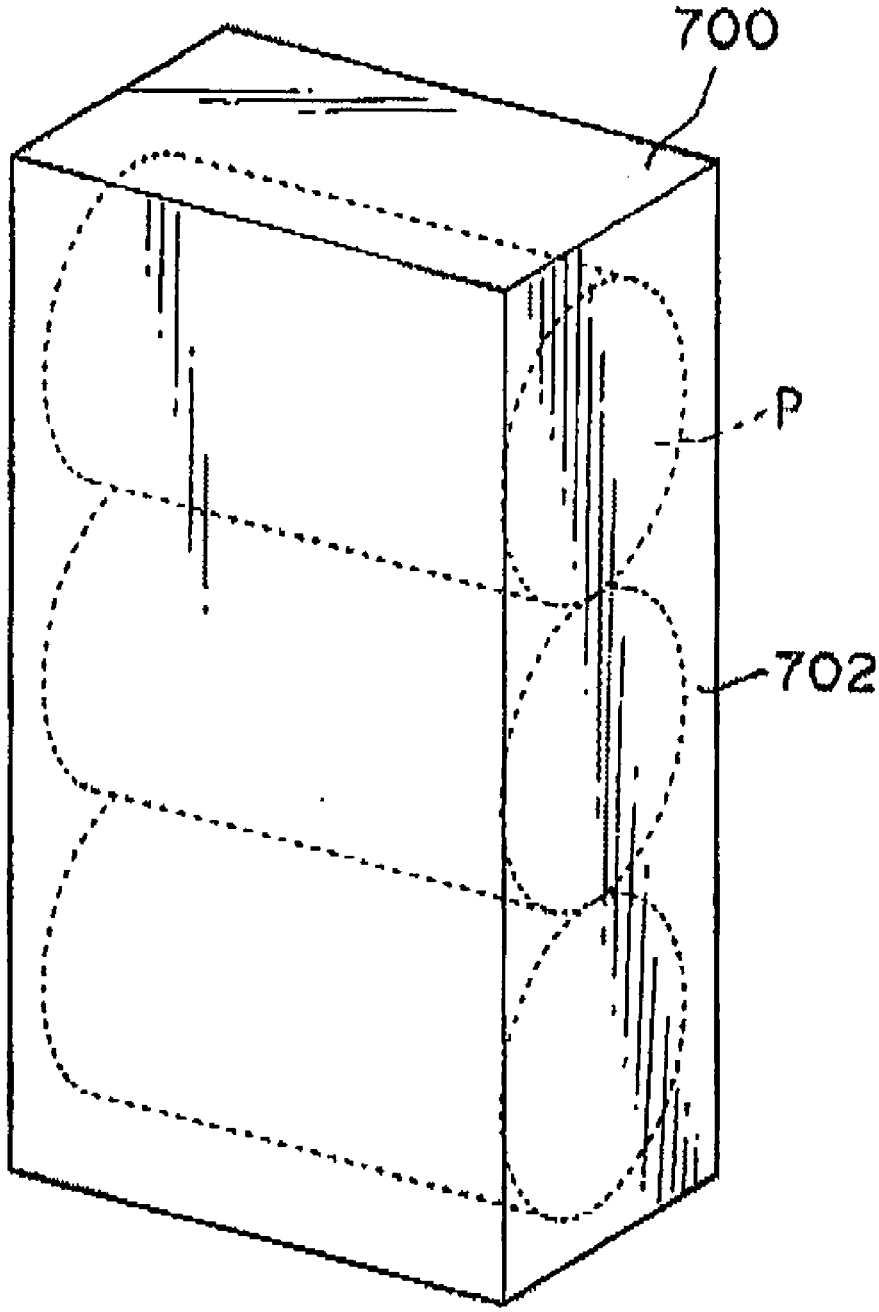

FIG. 129 is a perspective view showing another example of a carton having no header.

Figure 130:
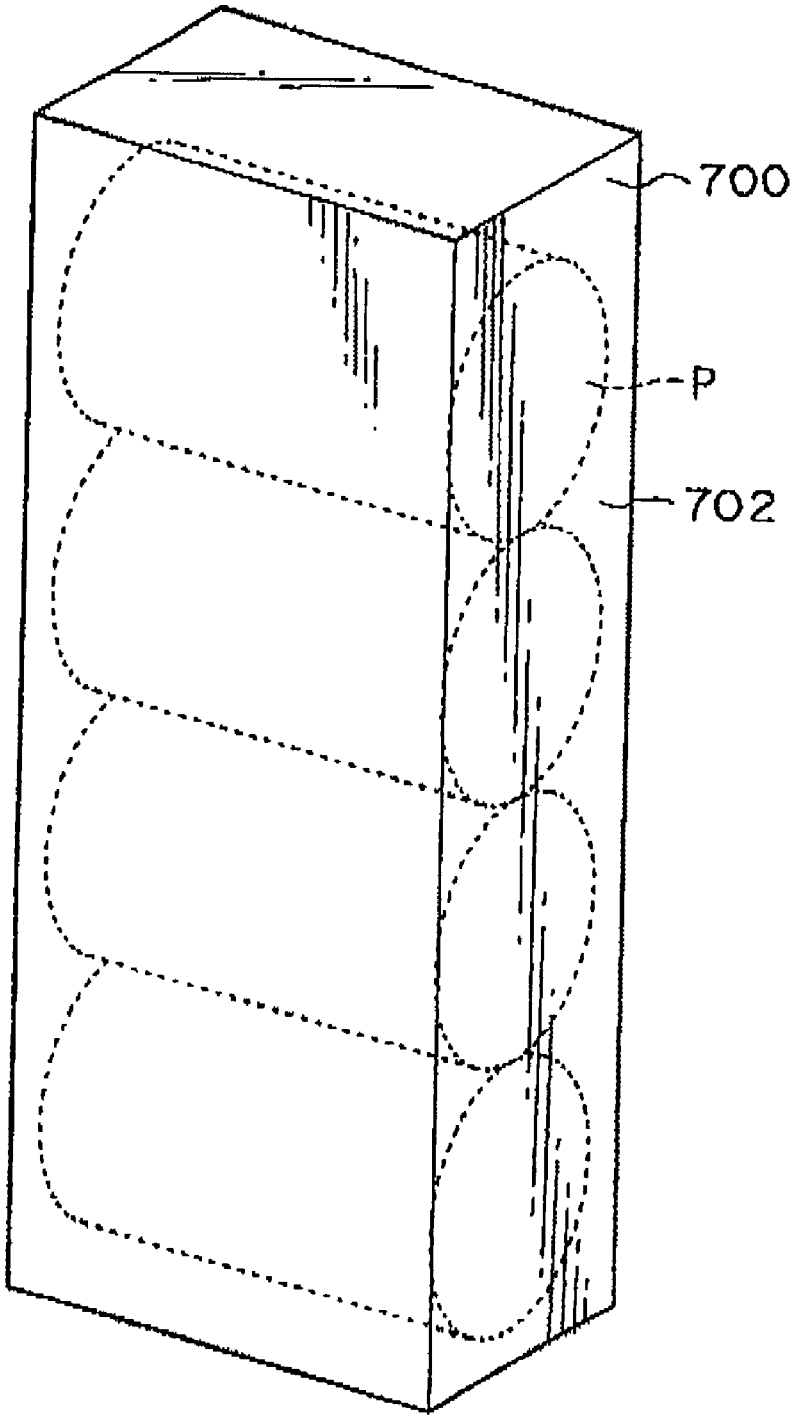

FIG. 130 is a perspective view showing a different example of a carton having no header.

Figure 131:
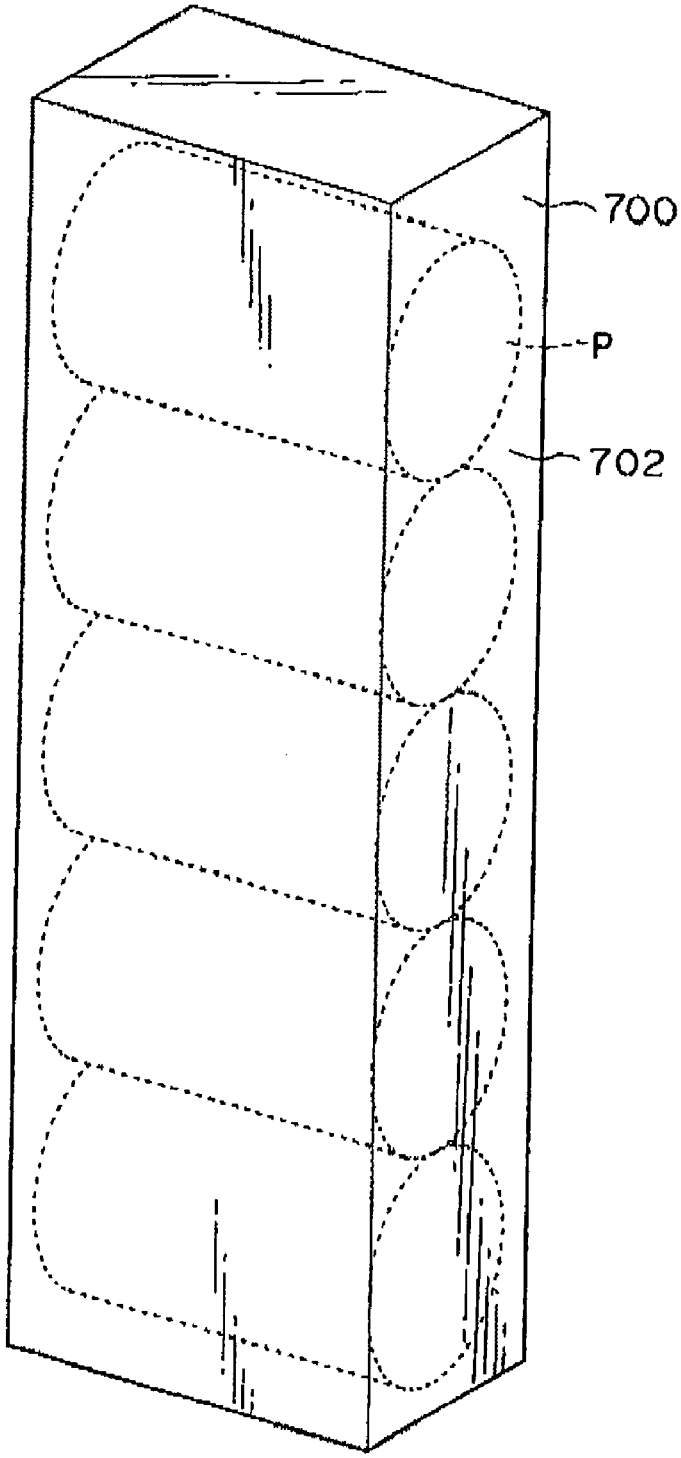

FIG. 131 is a perspective view showing a different example of a carton having no header.

Figure 132:
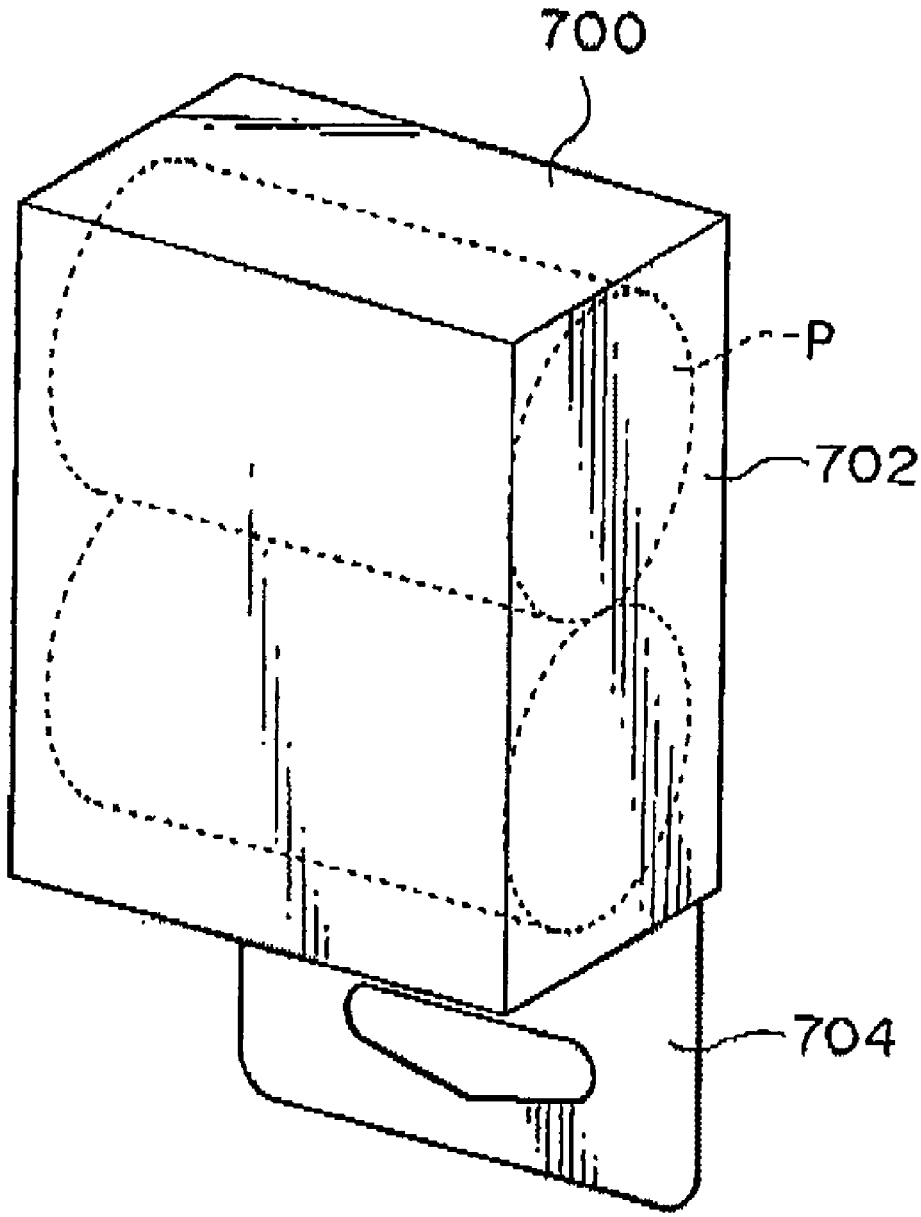

FIG. 132 is a perspective view showing an example of a carton having a header at an end surface of its main body that is included in a carton that can be loaded into a corrugated board box with a partition in the packaging system shown in FIG. 83.

Figure 133:
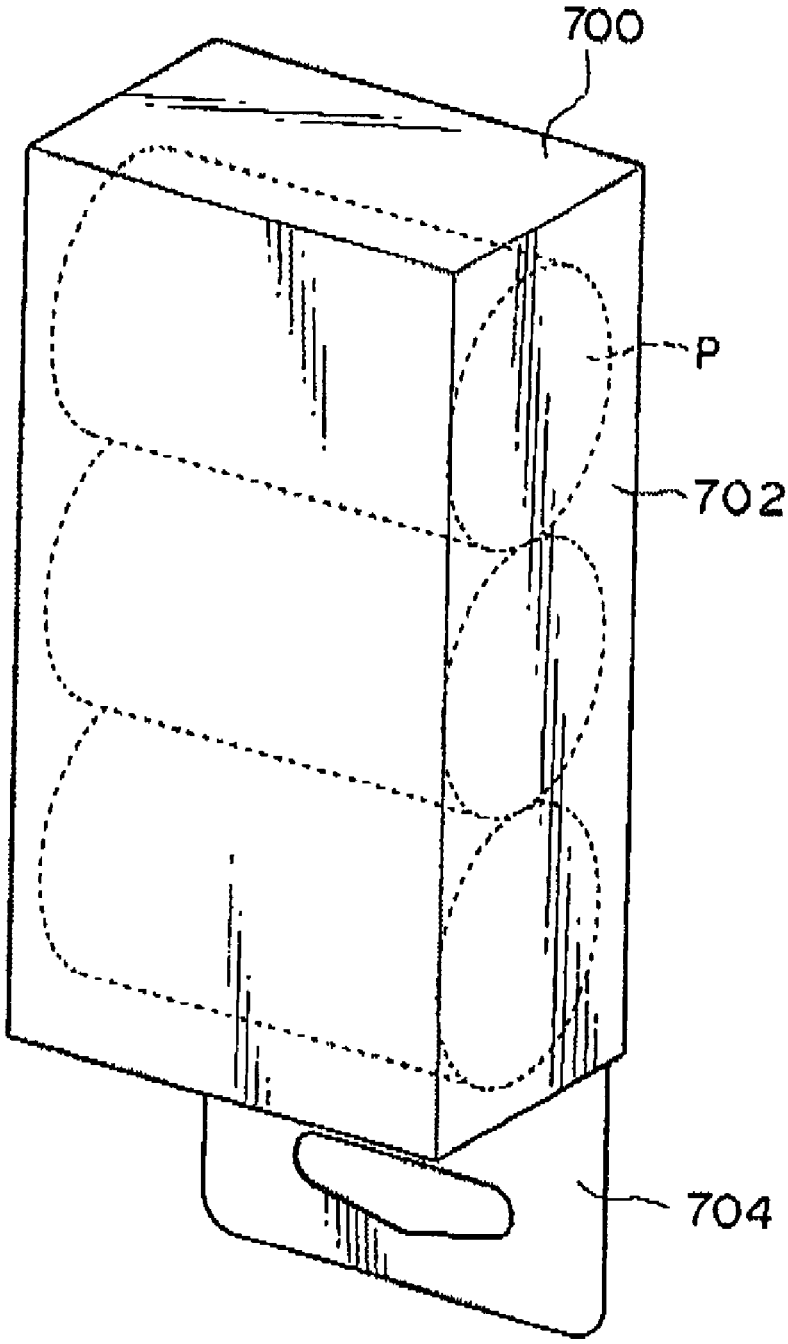

FIG. 133 is a perspective view showing another example of a carton having a header at its end surface.

Figure 134:
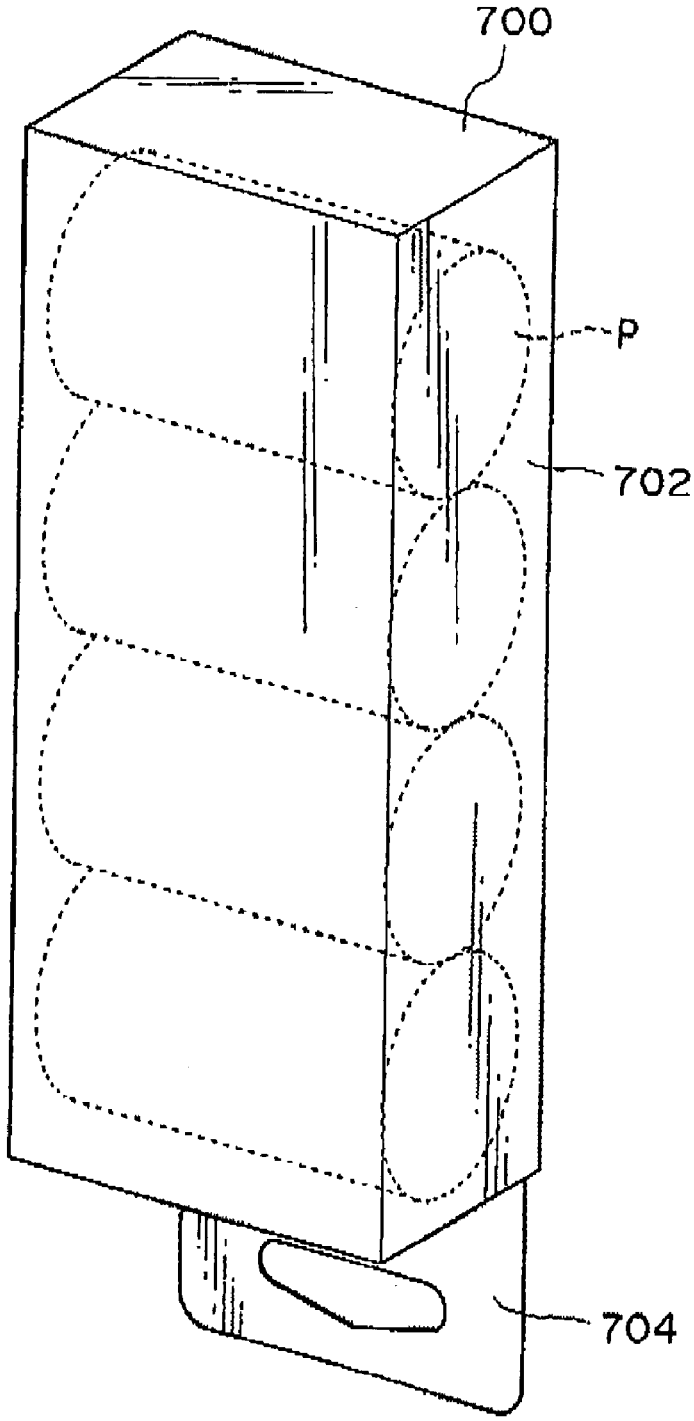

FIG. 134 is a perspective view showing a different example of a carton having a header at its end surface.

Figure 135:
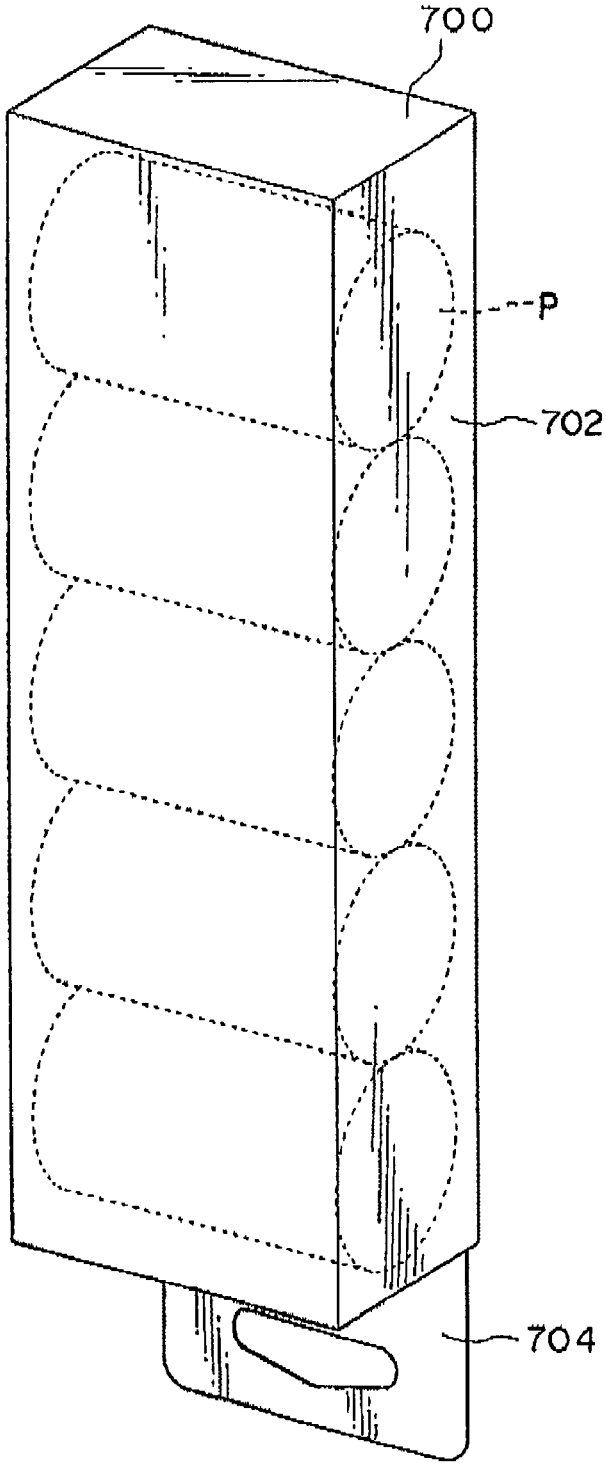

FIG. 135 is a perspective view showing a different example of a carton having a header at its end surface.

Figure 136:
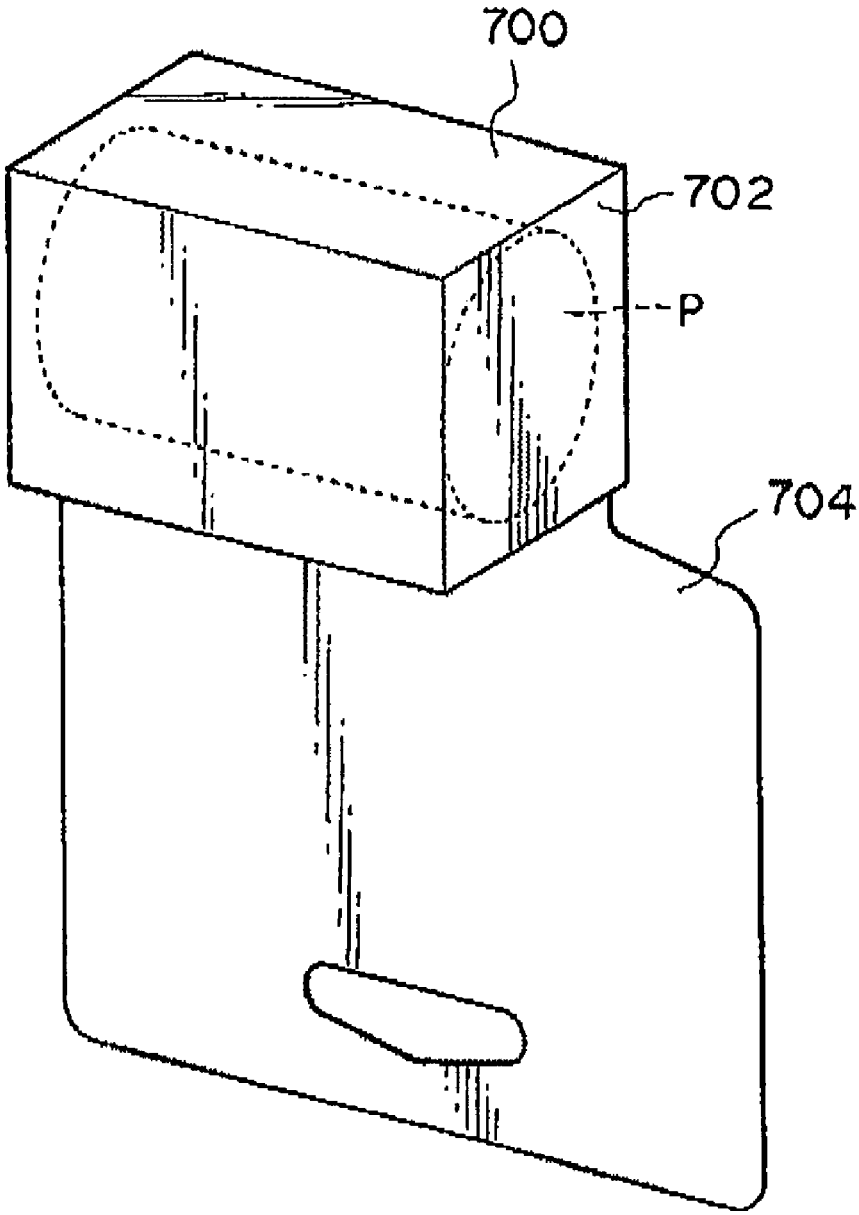

FIG. 136 is a perspective view showing an example of a carton having a header wider than its main body at an end surface thereof that is included in a carton that can be loaded into a corrugated board box with a partition in the packaging system shown in FIG. 83.

Figure 137:
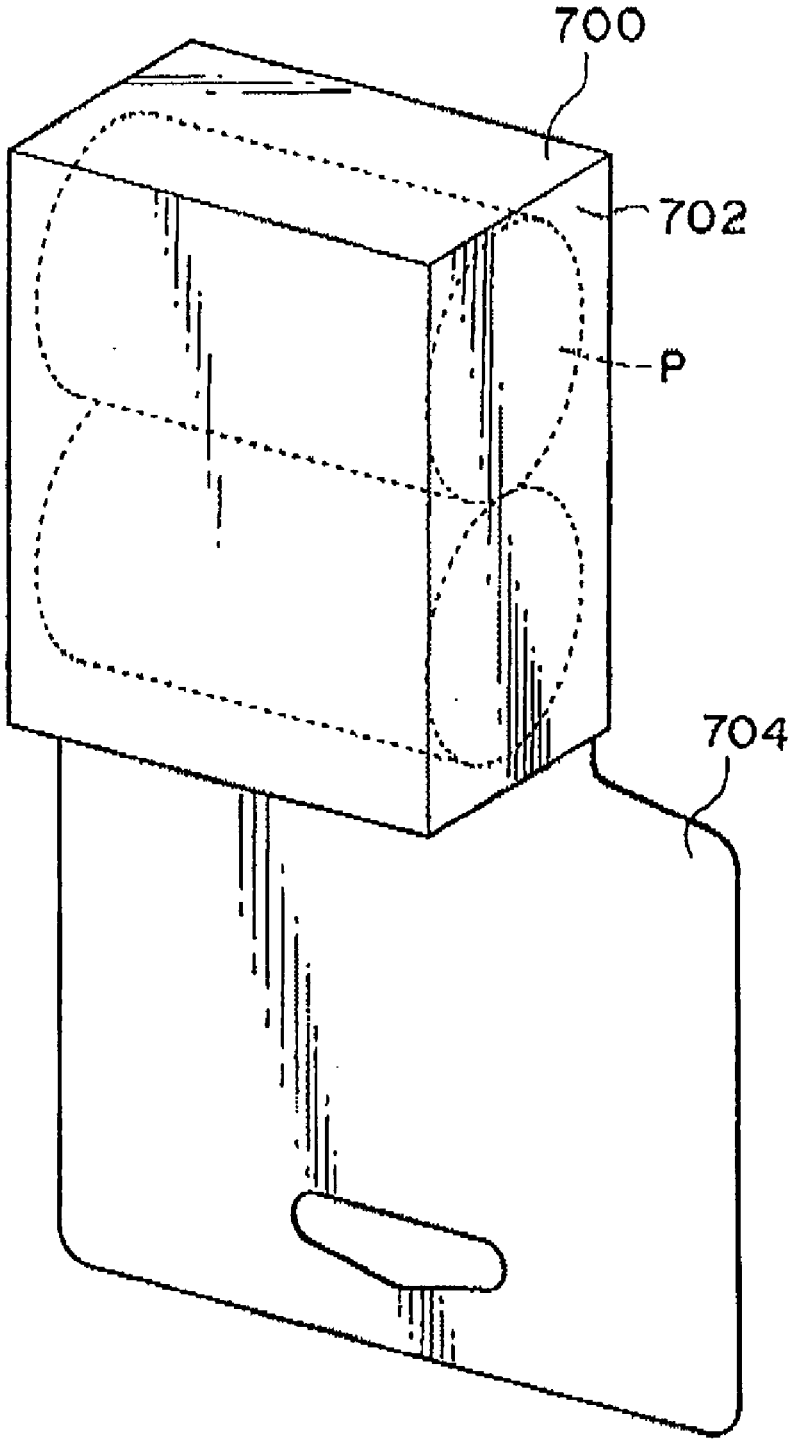

FIG. 137 is a perspective view showing another example of a carton having a header wider than its box body at its end surface.

Figure 138:
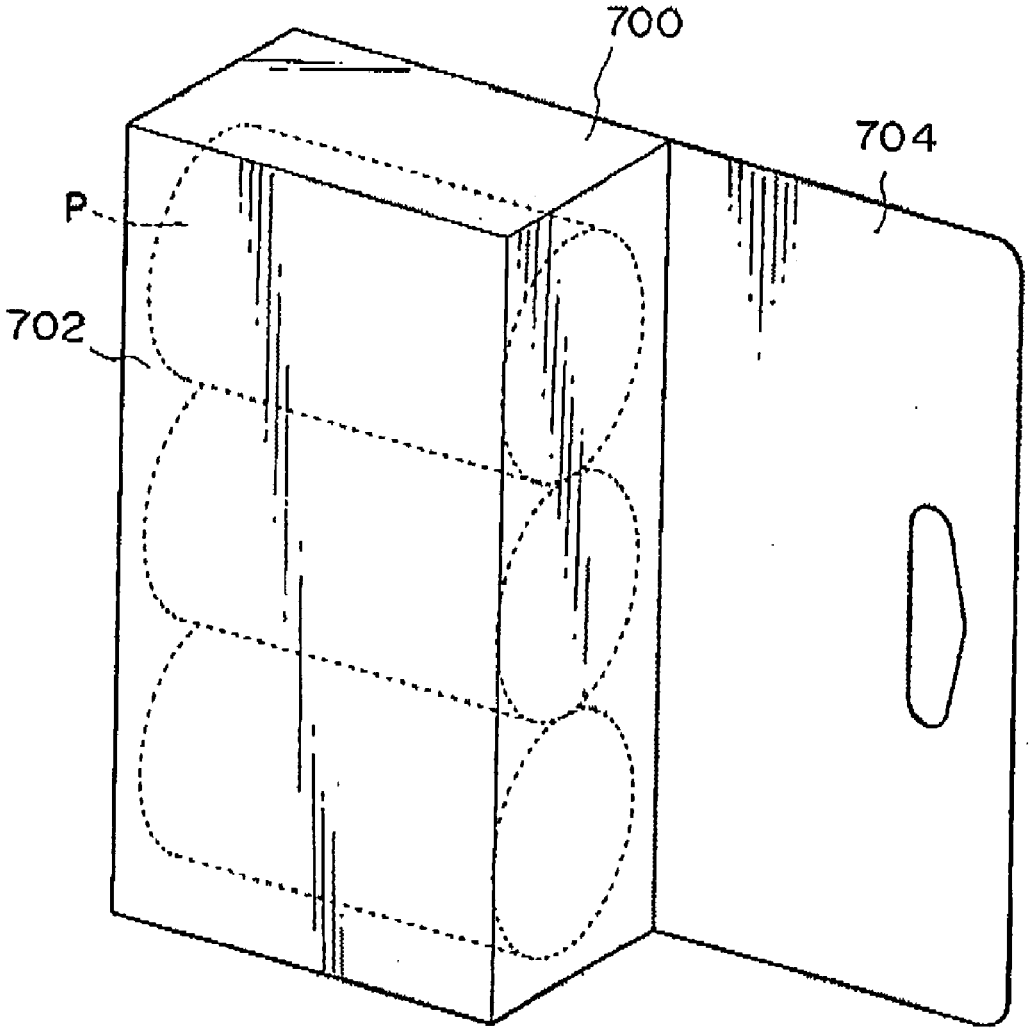

FIG. 138 is a perspective view showing a different example of a carton having a header at a side edge of its main body.

Figure 139:
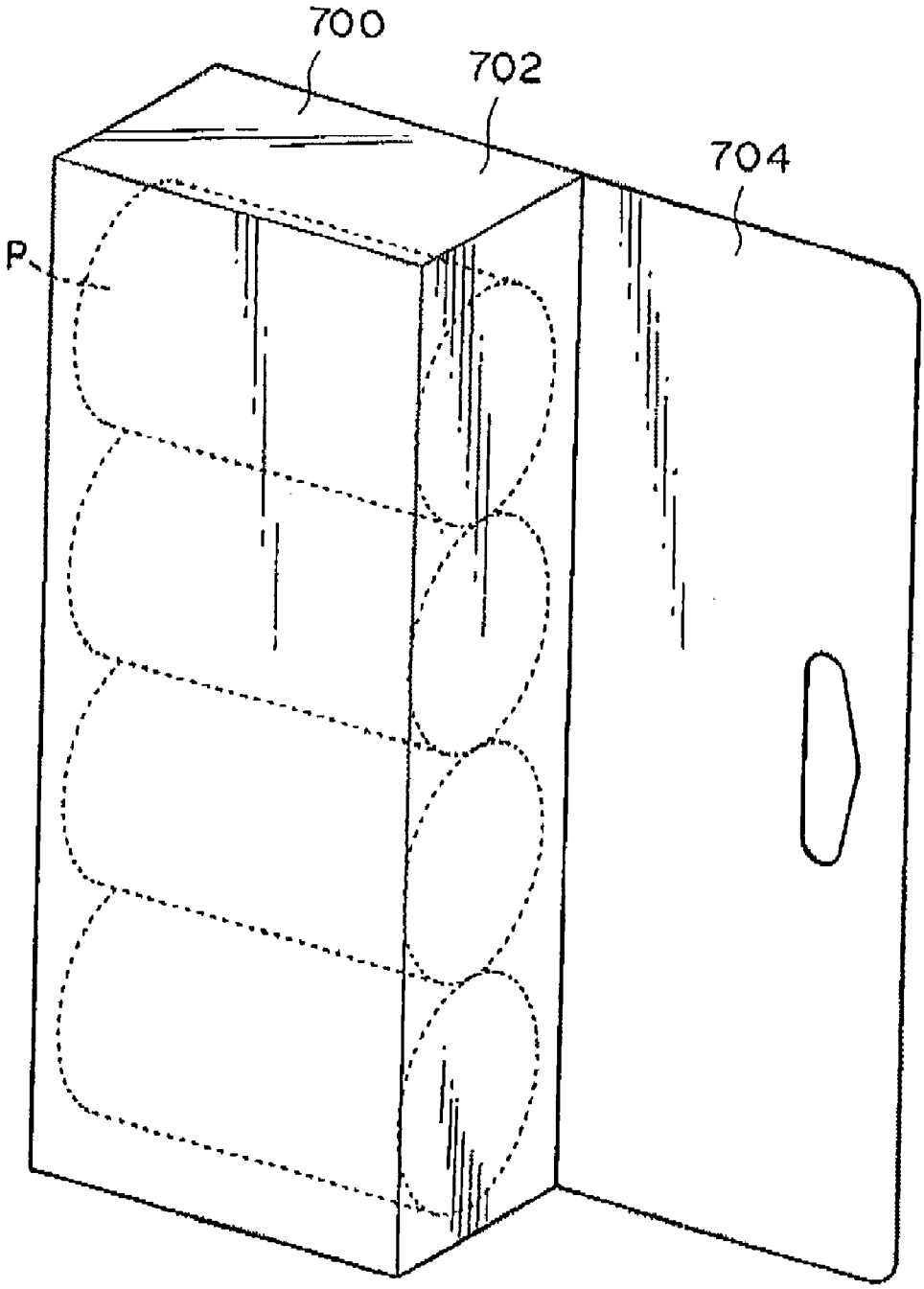

FIG. 139 is a perspective view showing a different example of a carton having a header at a side edge of its main body.

FIGS. 140A to 140G are flow charts showing a scheme of packing a carton shown in FIG. 136 accommodating 1 plastic case-packed products and having a header wider than its main body into a shrink-wrapped package and loading the shrink-wrapped package into a corrugated board box.

FIGS. 141A to 141E are flow charts showing a scheme of packing into a shrink-wrapped package and loading the shrink-wrapped package into a corrugated board box for a carton shown in FIG. 133 accommodating 3 plastic case-packed products and having a header of the same width as that of its main body.

FIGS. 142A to 142G are flow charts showing a scheme of packing into a carton assembly of ten cartons and loading the carton assembly into a corrugated board box in the packaging system relating to the fifth embodiment for a carton shown in FIG. 132 accommodating 2 plastic case-packed products and having a header of the same width of that o fits main body.

FIGS. 143A to 143H are flow charts showing a scheme of packing into a shrink wrapped package and loading the shrink wrapped package into a corrugated board box in the packaging system of the fifth embodiment for a carton shown in FIG. 138 accommodating 3 plastic case-packed products and having a header at the side edge of its main body.

DESCRIPTION OF THE PREFERRED EMBODIMENTS

A First Embodiment

A carton supplying unit, which is an example of the box body supplying apparatus of the present invention, and a cartoner which is an example of the boxing apparatus of the invention and has the carton supplying unit will be described as follows.

The cartoner refers to a boxing apparatus for packaging a film cartridge accommodated in a moisture-proof case in a sack carton and the carton supplying unit is a box body supplying apparatus for supplying the sack carton to the cartoner.

1-1 Cartoner

Figure 1:
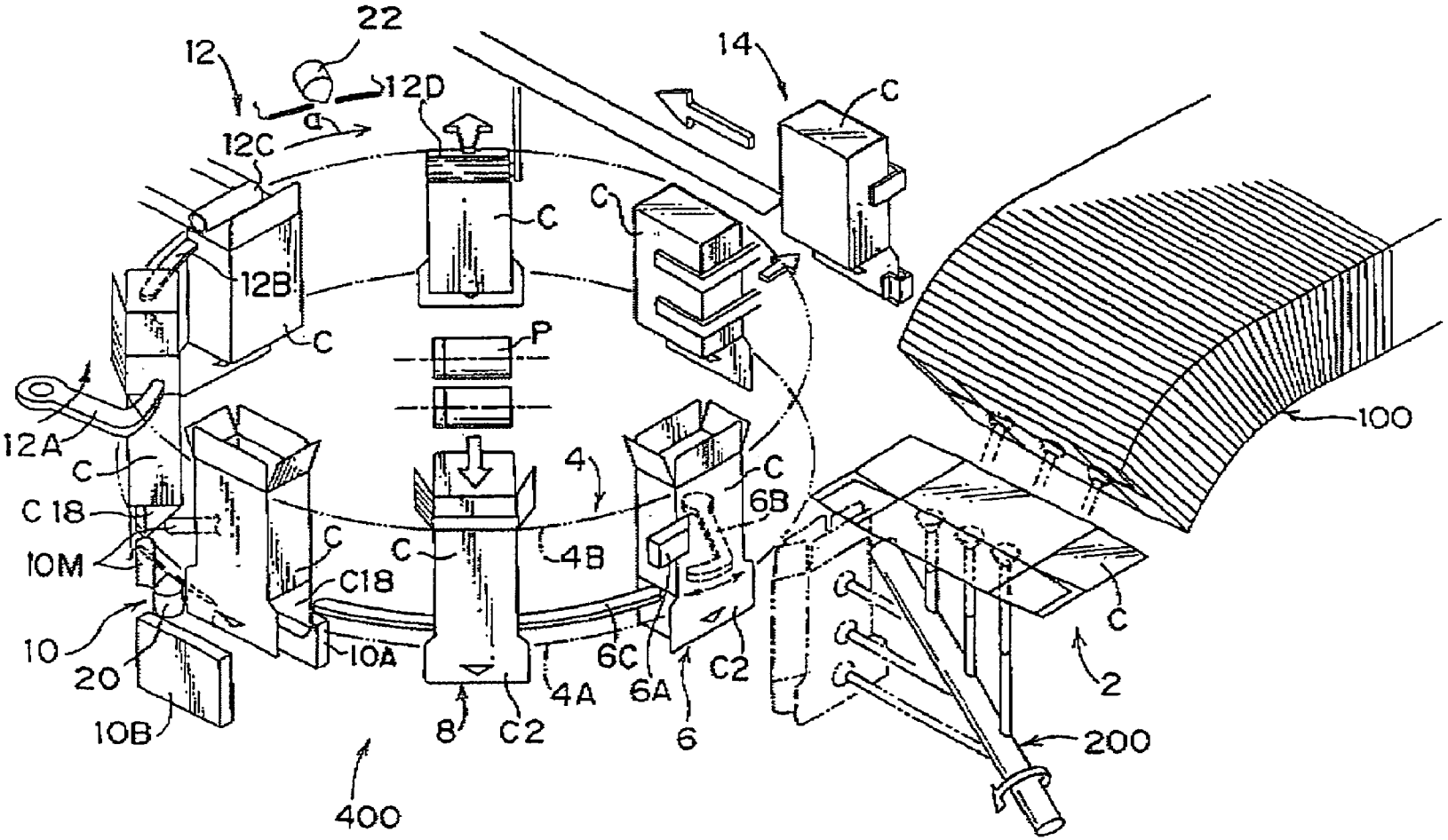
FIG. 1 is a schematic perspective view showing the structure of an example of a cartoner having the carton supplying unit according to a First Embodiment.
Figure 2:
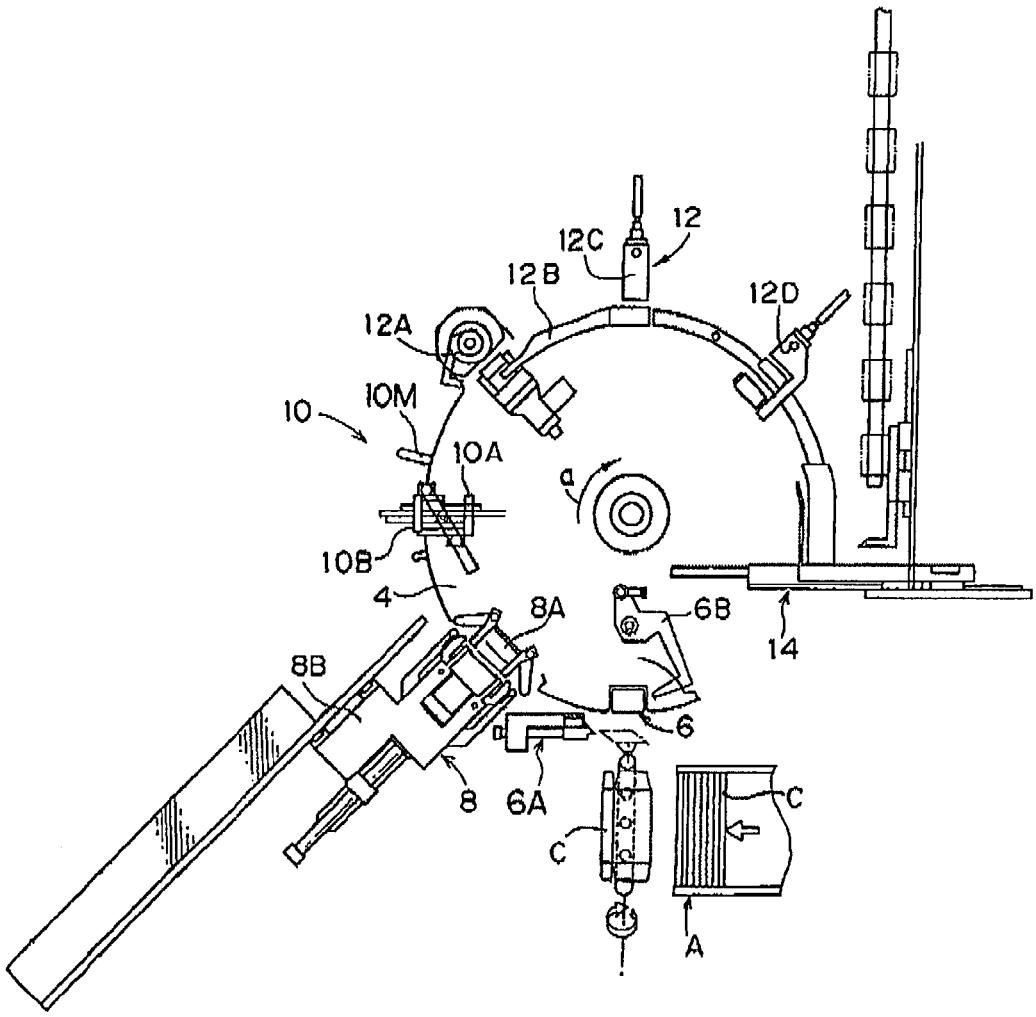
FIG. 2 is a schematic plan view of the cartoner shown in FIG. 1.

As shown in FIGS. 1 and 2, a cartoner 400 refers to a cartoner in which a cylindrical plastic case packed product is packaged inside the sack carton C which is a box body having flap portions forming an opening portion and a lid portion for covering the opening portion on both ends. The plastic case packed product refers to a cylindrical plastic case for accommodating a film cartridge.

As shown in FIGS. 1 and 2, the cartoner 400 comprises a carton supplying unit 2, a rotation table 4 which holds the sack carton C supplied from the carton supplying unit 2 on its outer peripheral portion and rotates intermittently clockwise as indicated by an arrow a, a carton opening forming portion 6 which is provided at a position opposing the carton supplying unit 2 in the vicinity of the rotation table 4 and after a sack carton C supplied from the carton supplying unit 2 is constructed from its folding condition and mounted on the outer peripheral portion of the rotation table 4 with an opening portion on the side in which a header C2 is provided facing downward, constructs a part of a flap portion on its bottom side and partially closes the bottom opening, a plastic case-packed product packing portion 8, which is provided adjacent to the downstream side (hereinafter referred to as "downstream side") along the rotation direction a relative to the carton opening forming portion 6 for loading a predetermined quantity of the plastic case packed products, for example, four products accommodating a cartridge in a lid provided cylindrical plastic case from an upper opening portion with the bottom opening of the sack carton C closed partially, an upper lid constructing portion 10 which is provided adjacent to the downstream side of the plastic case-packed product packing portion 8 for forming an upper lid by constructing a remainder of the flap portion on the bottom side, a bottom lid constructing portion 12 which is provided adjacent to the downstream side of the upper lid constructing portion 10 for forming a bottom lid for closing the upper opening portion of the sack carton C by constructing a flap portion or the upper side and a carton discharging portion 14 which is provided adjacent to the downstream side of the bottom lid constructing portion 12 for discharging the sack carton C in which the plastic case packed products are packaged outside.

A hot melt adhesive injecting gun 20 is disposed between the upper lid constructing portion 10 and the bottom lid constructing portion 12 to apply hot melt adhesive to a flap portion C12 constituting an upper lid C8 of the sack carton C. On the other hand, a hot melt adhesive injecting gun 22 is disposed between a first pusher 12C and a second pusher 12D located downstream thereto in the bottom lid constructing portion 12. The hot melt adhesive injecting gun 22 applies hot-met adhesive to an inside surface of an outside flap C22.

The rotation table 4, the carton opening forming portion 6, the a plastic case-packed product packing portion 8, the upper lid constructing portion 10, the bottom lid constructing portion 12 and the carton discharging portion 14 are mounted at a specific location on a base (not shown).

Figure 14B:
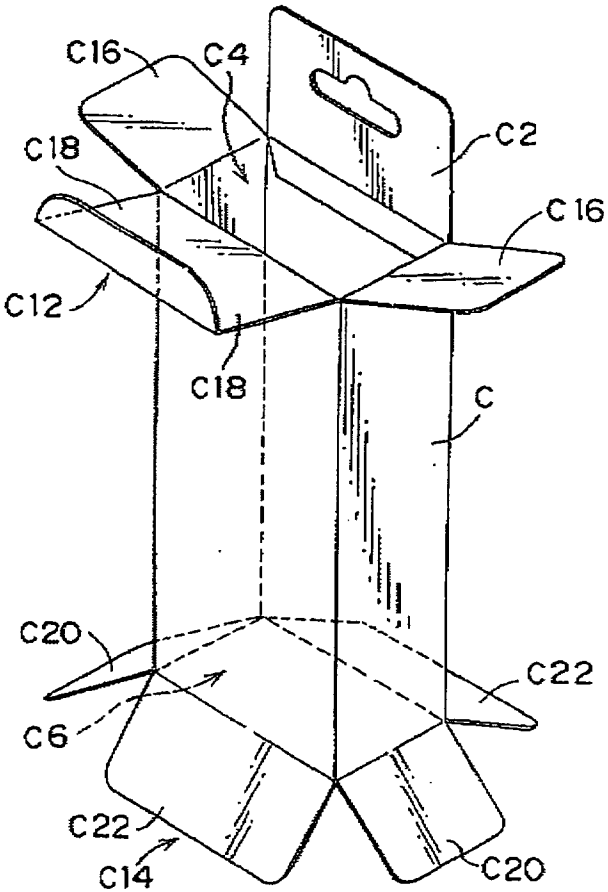
FIG. 14B is a perspective view showing conditions in which flap portions on both ends are constructed to form the upper and lower lids and in which the flap portions are opened in the sack carton for forming the carton shown in FIG. 14A.
Figure 14A:
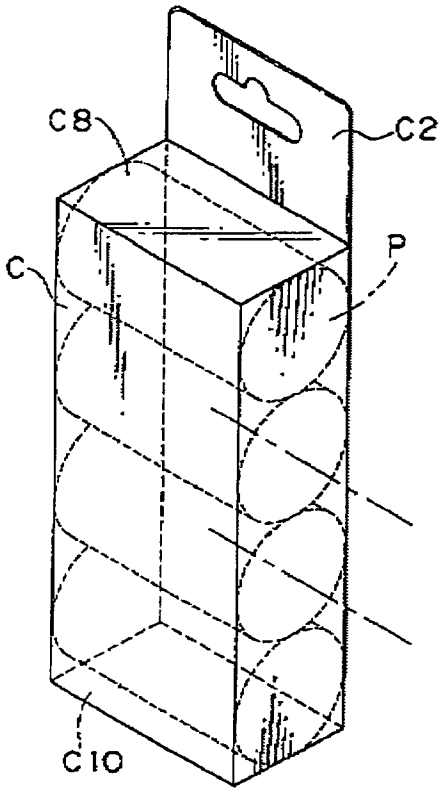
FIG. 14A is a perspective view showing an example of a carton manufactured by the cartoner shown in FIG. 1.

As shown in FIGS. 14A and 14B, the sack carton C is a square rod like box body in which a header C2, which is a tab-like member to be hung by a hook, is formed on an end portion and four plastic case packed products are accommodated at right angle relative to the longitudinal direction of the sack carton C.

As shown in FIG. 14B, opening portions C4, C6, the flap portion C12 which forms the upper lid C8 for covering the opening portion C4 and a flap portion C14 which forms a bottom lid C10 for covering the opening portion C6 are formed at each end portion.

The flap portion C12 has a pair of inner flaps C16 which form an inside portion of the upper lid C8 and a folding portion and further contains an outside flap C18 which forms an outside portion of the upper lid C8. The outside flap C18 is provided at a position opposing a header C2.

Likewise, the flap portion C14 has a pair of inside flaps C20 which form the inside portion of the bottom lid C10 and a pair of the outside flaps C22 which form an outside portion of the bottom lid C10.

Figure 15A:
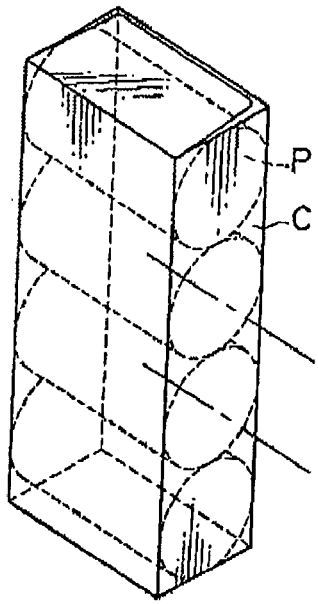
FIG. 15A is a perspective view showing another example of a carton manufactured by the cartoner shown in FIG. 1.
Figure 15B:
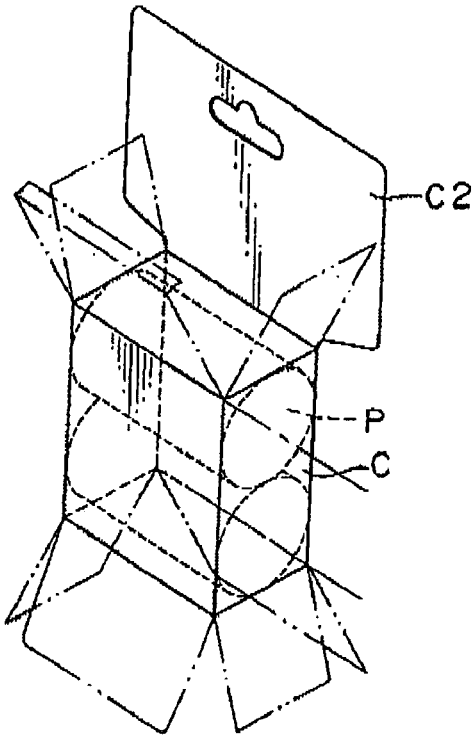
FIG. 15B is a perspective view showing still another example of a carton manufactured by the cartoner shown in FIG. 1.
Figure 15C:
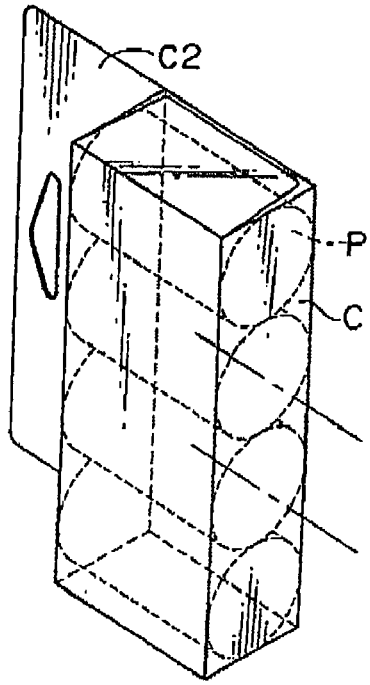
FIG. 15C is a perspective view showing still another example of a carton manufactured by the cartoner shown in FIG. 1.

As the sack carton C, in addition to the type shown in FIG. 14, a sack carton which accommodates four pieces of the plastic case packed products at right angle relative to the longitudinal direction and has no header as shown in FIG. 15A is also available and a sack carton which has a header C2 at the upper end and accommodates two pieces of the plastic case packed products at right angles relative to the longitudinal direction as shown in FIG. 15B and a sack carton which is provided with the header C2 adjacent to one of the folding portions forming a side edge and accommodates four pieces of the plastic case packed products at right angle relative to the longitudinal direction as shown in FIG. 15C also can be used.

As shown in FIG. 1, the rotation table 4 has substantially circular index tables 4A and 4B disposed coaxially in a vertical directions. The index table 4A located at the bottom side and the index table 4B located at the upper side relatively rotate intermittently along the rotation direction a around a center point while maintaining the upper end portion and the lower end portion of the sack carton C such that the header C2 is located outside on each outer peripheral portion. Consequently, the sack carton C is transported in the order of the carton opening forming portion 6, the plastic case-packed product packing portion 8, an upper lid constructing portion 10A, a bottom lid constructing portion 12 and a carton discharging portion 14.

The index tables 4A, 4B are constructed to be capable of approaching or leaving each other in the vertical direction so as to hold upper end and lower end of the carton when a carton of a different size is transported.

The carton opening forming portion 6 is, as shown in FIGS. 1 and 2, comprises an opening forming device 6A for constructing a carton supplied from the carton supplying unit 2 into a square rod like form which allows the plastic case packed products to be loaded by forming an opening, a flap folding arm 6B for folding an inside flap C16 located on the upstream side (hereinafter referred to as "upper stream side") relative to the rotation direction a of a pair of the inside flaps C16 included by the flap portion C12 in a direction covering the opening portion C4, and a flap folding plate 6C which is a circular plate-like member provided adjacent to the downstream side of the flap folding arm 6B and along the outer periphery of the index table 4A.

Figure 3:
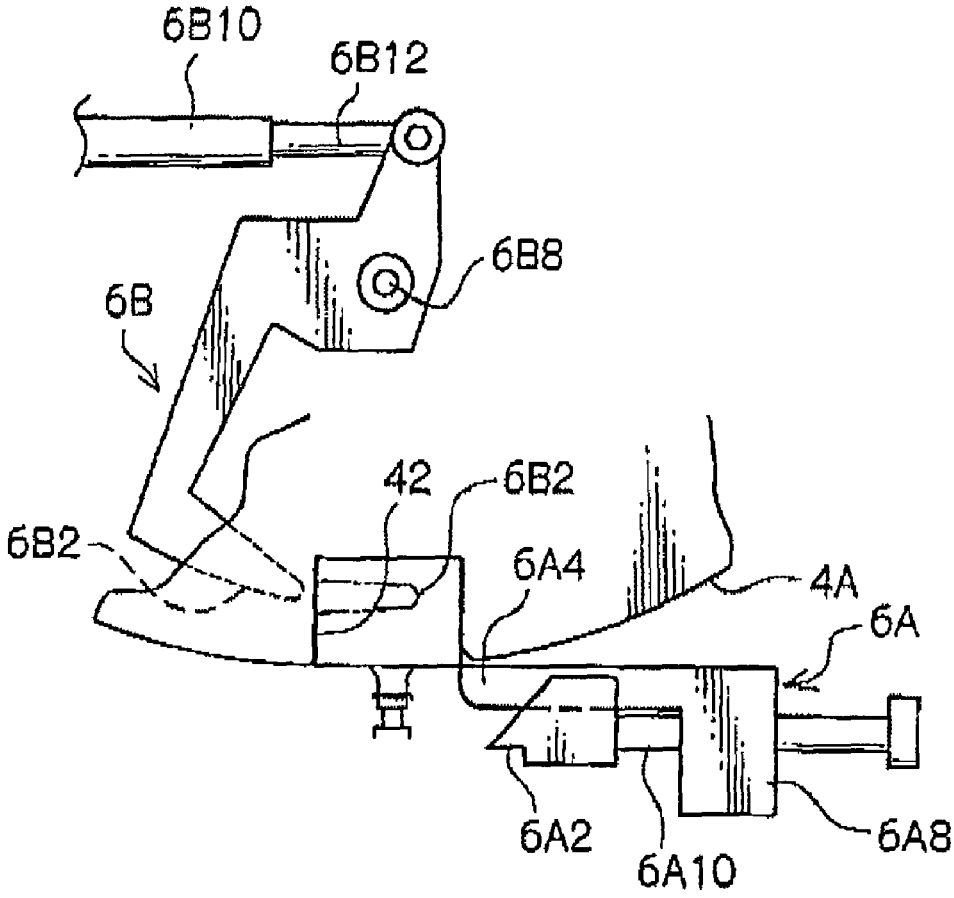
FIG. 3 is a plan view showing the detail of a carton opening forming portion included by the cartoner shown in FIG. 1.
Figure 4A:
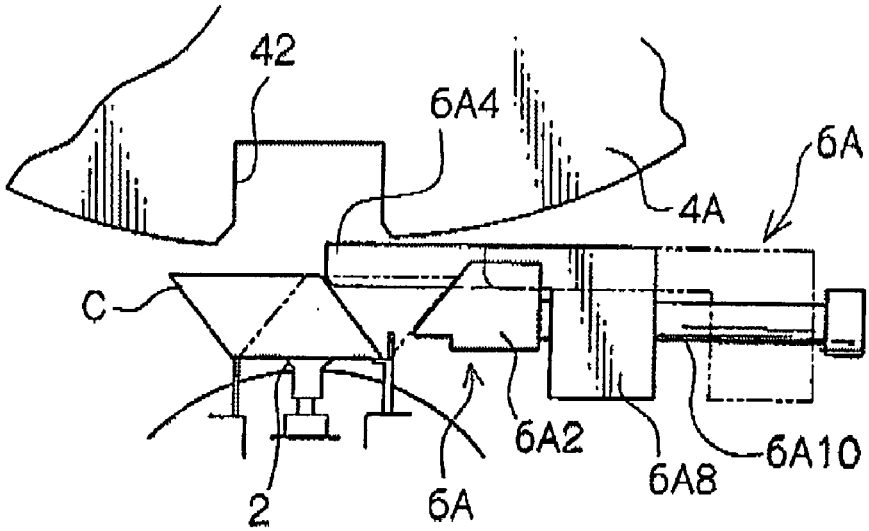
FIGS. 4A and 4B are plan views showing a condition in which an opening is formed in the sack carton by the carton opening forming portion shown in FIG. 3.
Figure 4B:
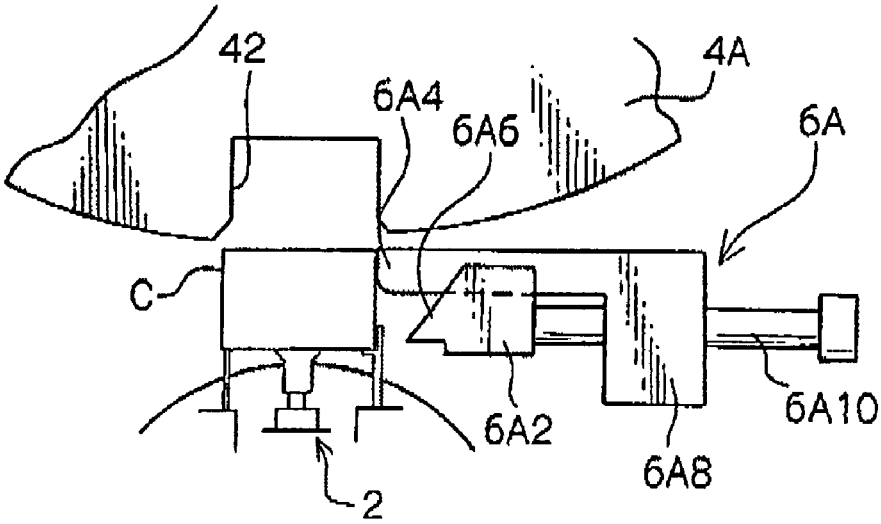

As shown in FIGS. 3, 4A and 4B, the opening-forming device 6A incorporates an opening-forming guide member 6A2 fixed so as to facing the index table 4A and a opening-forming pusher member 6A4 formed so as to move along the opening-forming guide member 6A2 to approach or part from the index table 4A.

The opening-forming guide member 6A2 has a guide surface 6A6 shaped in a taper at one end and is located at a location wherein a corner portion of a sack carton C supplied by the carton supplying unit 2 and shown in two-dot chain line in FIG. 4A rides on the guide surface 6A6 so that the guide surface 6A6 faces the index table 4A. On the other end of the opening-forming guide member 6A2, a slide guide 6A10 guiding the opening-forming pusher member 6A4 is disposed.

The opening-forming pusher member 6A4 is provided in a tangential direction to the index table 4A so as to push the sack carton C at its tip portion. At its root portion, a slider 6A8 sliding on the slide guide 6A10 is provided.

When a folded sack carton C is approaching to a carton-setting portion 42 of the index table 4 by the carton supplying unit 2, as shown in two-dot chain line in FIG. 4A, a corner portion of the sack carton C is pressed onto the guide surface 6A6 and the sack carton C is partially opened.

Them as shown in bold line in FIG. 4A, the opening-forming pusher member 6A4 moves to a location facing the carton-setting portion 42 to push the carton C so as to folded in an opposite direction. Thus, the carton C looses its shape-restoring force and is opened into a square box. After pushing the carton C, the opening-forming pusher member 6A4 returns to a location wherein not interrupting the setting of the sack carton C into the carton-setting portion 42. Thus, the sack carton is prevented from popping out of the carton-setting portion by its shape-restoring force.

As shown in FIGS. 1 to 3, the flap-folding arm 63 is protruded from inside of the index table 4A to outside, has a front-end portion 6B2 formed in a hook shape and directed to the downstream, and is mounted rotatably on the base (not shown) by an axis 6B8. The opposite end of the flap folding arm 6B is connected to a piston 6B12 of an air cylinder. Thus, the flap-folding arm 6B rotates around the axis 6B8 by a reciprocal action of the piston 6B12.

By retracting the piston 6B12, the flap folding arm 6B rotates in a direction that the front-end portion 6B2 approaches to an inner flap C16 located in the upstream side, and thus, the inner flap C16 is folded toward the downstream side so as to cover the opening portion C4.

The flap folding plate 6C is extended from the carton opening forming portion 6 to the upper lid constructing portion 10. When the rotation table 4 rotates in the direction of an arrow a, the inside flap C16 in the downstream side is folded to the upstream side so as to overlap the inside flap C16 in the upstream side. When the inside flap C16 on the downstream side is folded, the inside flap C16 is held from downward not so as to open until the sack carton C reaches the upper lid constructing portion 10 from the carton opening forming portion 6 through the plastic case-packed product packing portion 8.

Figure 5:
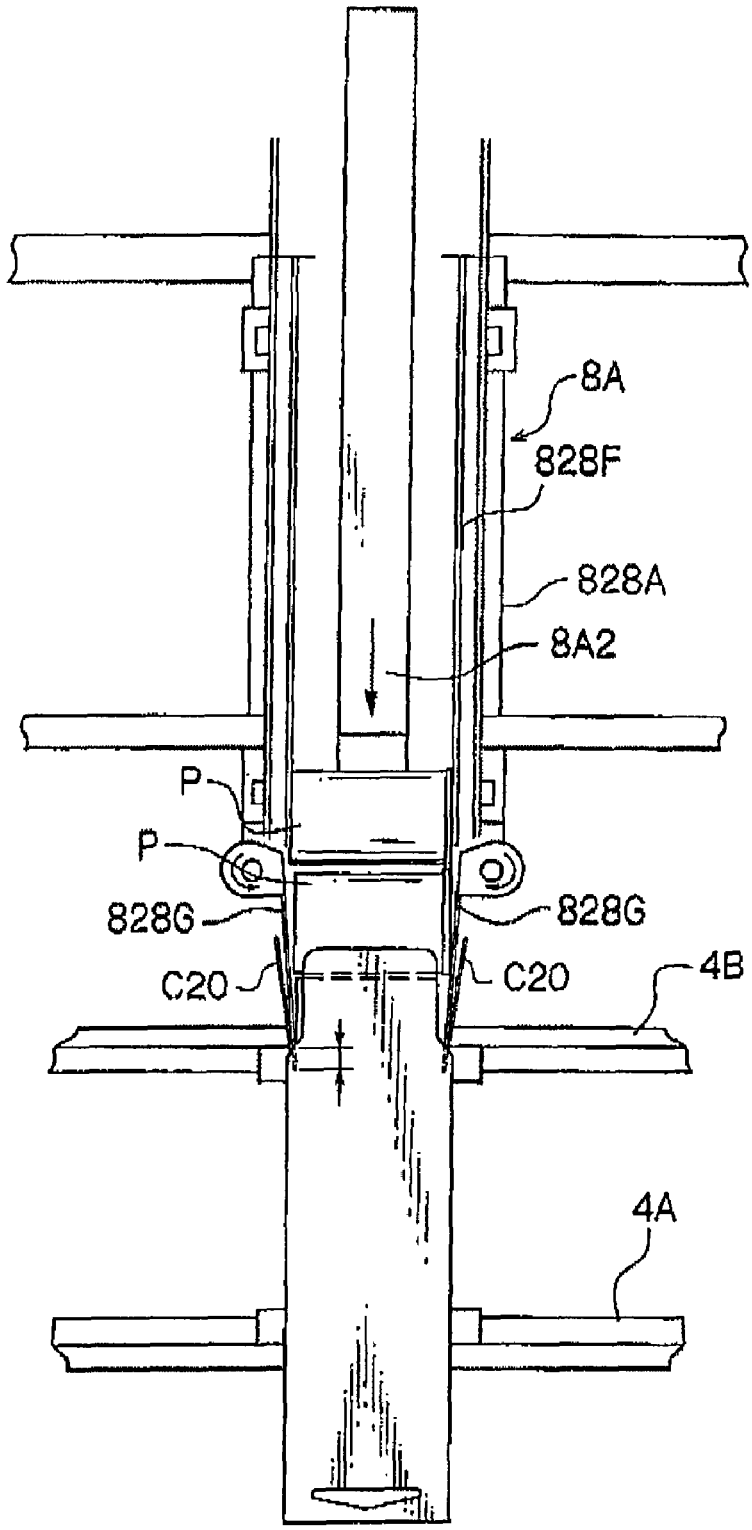
FIG. 5 is a front view showing a condition in which the plastic case packed product is loaded into the sack carton in the plastic case packed product loading portion included by the cartoner shown in FIG. 1.

As shown in FIGS. 1, 2 and 5, the plastic case-packed product packing portion 8 comprises a plastic case-packed product pressing device 8A which is located above the index table 4B and brings with a pressure a predetermined quantity, for example, four plastic case packed products into the inside of the sack carton C and a plastic case supplying unit 8B for supplying the predetermined quantity of the plastic case packed products to the plastic case pressing unit 8A. Because the inside flap C16 located downward is held from down by the flap folding plate 6C when the plastic case packed products are loaded into the plastic case pressing unit 8A, the loaded plastic case packed products never drop from the opening portion C4 of the sack carton C.

As shown in FIG. 5, the plastic case pressing unit 8A has a plastic case supplying shoot 828F that is provided on the index table in a vertical direction and has a C-shaped section opened toward the plastic case supplying device, an open-close accepting guide 828A surrounding the plastic case supplying shoot 828F, a pusher 8A2 going upward and downward in the plastic case supplying shoot 828F, and a pair of open-close guides 828G located at the bottom of the open-close accepting guide 828A. The open-close guides 828G are urged by a helical spring (not shown) upwardly, i.e., in a direction so that the open-close guides 828G close. The open-close guides 828G also form a bottom of the plastic case supplying shoot 828F when they close. When they open, the tip of the open-close guides 828G touches the inside wall of the sack carton C and functions as a guide guiding plastic case packed products falling in the plastic case supplying shoot 828F into the sack carton C. Additionally, the open-close guides 828G are preferably formed so that the tip portions thereof are inserted in the sack carton C in a length of 2 mm or more when the they open since the plastic case packed products P are introduced in the sack carton without being caught by the tip portions thereof.

When providing the plastic case packed products P from the plastic case supplying unit 8B to the plastic case pressing device, the open-close accepting guide 828A opens and the plastic case packed products P are delivered to the plastic case supplying shoot 828F in an specific number. At that time, the open-close guide 828G is closed.

After the plastic case packed products P are supplied to the plastic case supplying chute 828F, the open-close accepting guide 828A closes and the pusher 8A2 descends to press the plastic case packed product to the downward. Thus, the open-close guides open and the plastic case packed products in the plastic case supplying chute 828F are loaded in the sack carton C.

The upper lid constructing portion 10 comprises an outside flap folding member 10A which is located at a standby position inside of the flap folding plate 6C or a flap folding position outside of the flap folding plate 6C and folds the outside flap C18 of the flap portion C12 toward the header C2 when it moves from the standby position outward toward the flap folding position, a header supporting plate 10B which supports the header C2 from outside not so as to be folded outward when the outside flap C18 is folded by the outside flap folding member 10A, an upper lid folding unit 10M which forms the upper lid C8 by folding upward the outside flap C18 bent by the outside flap folding member 10A and the header supporting plate 10B.

Figure 6:
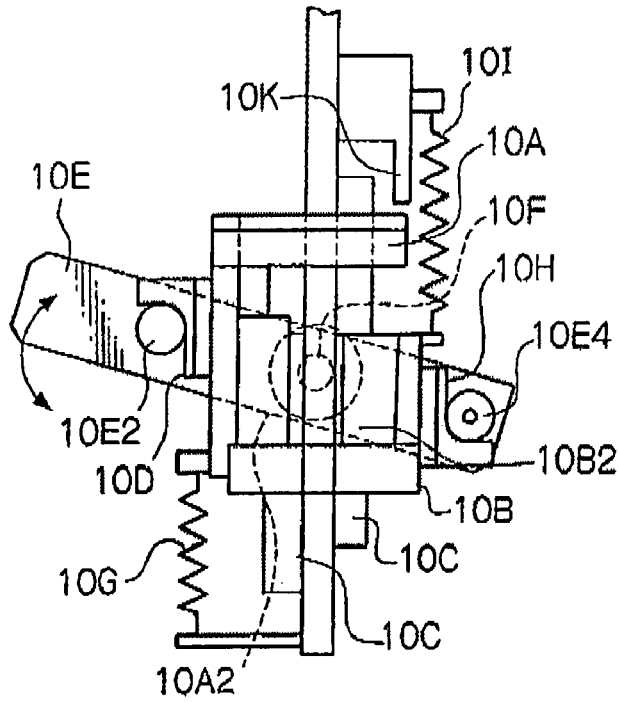
FIG. 6 is a plan view showing the detail of the structure of an upper lid constructing portion included by the cartoner shown in FIG. 1.
Figure 7:
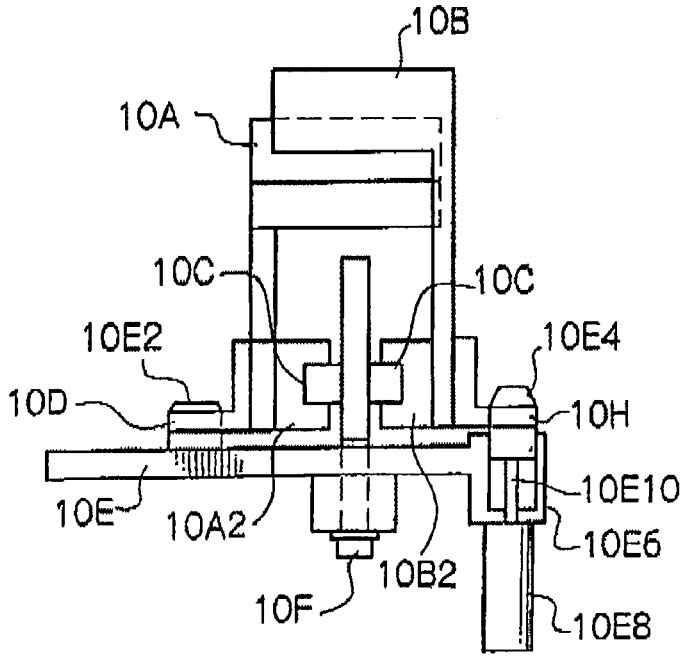
FIG. 7 is a side view of the upper lid constructing portion shown in FIG. 6.

AS shown in FIGS. 6 and 7, the outside flap folding member 10A and the header supporting plate 10B are fixed to sliders 10A2 and 10B2, respectively. The sliders 10A2 and 10B2 slides on the guide 10C disposed in a radial direction of the index table 4A.

Below the guide 10C, a swing arm 10E is mounted on the base by an axis 10F. At one end of the swing arm 10E, a pin 10E2 is disposed and at the other end thereof, a pin 10E4 is disposed.

An engaging portion 10D having an L-shape is provided on the slider 10A2 and a helical spring 10G is disposed between the slider 10A2 and the guide 10C and thus, the helical spring 10G urges the slider 10A2 and the outside flap folding member 10A so that the engaging portion 10D touches the pin 10E2.

The slider 10B2 incorporates an engaging portion 10H having an L-shape and a helical spring 1OI is provided between the slider 10B2 and the guide 10C. The helical spring 10I urges the slider 10B2 and the header supporting plate 10B so that the engaging portion 10H touches the pin 10E4.

A pocket 10E6 in which the pin 10E4 is retracted is provided on the swing arm 10E at a portion below the pin 10E4. Below the pocked 10E6, an air cylinder 10E8 popping and retracting the pin 10E4 is fixed. The pin 10E4 is fixed on the piston 10E10 of the air cylinder 10E8 so as to pop out of the pocket 10E6 when the piston 10E10 is expanded and to be retracted inside of the pocket 10E6 when the piston 10E10 is contracted.

Figure 8:
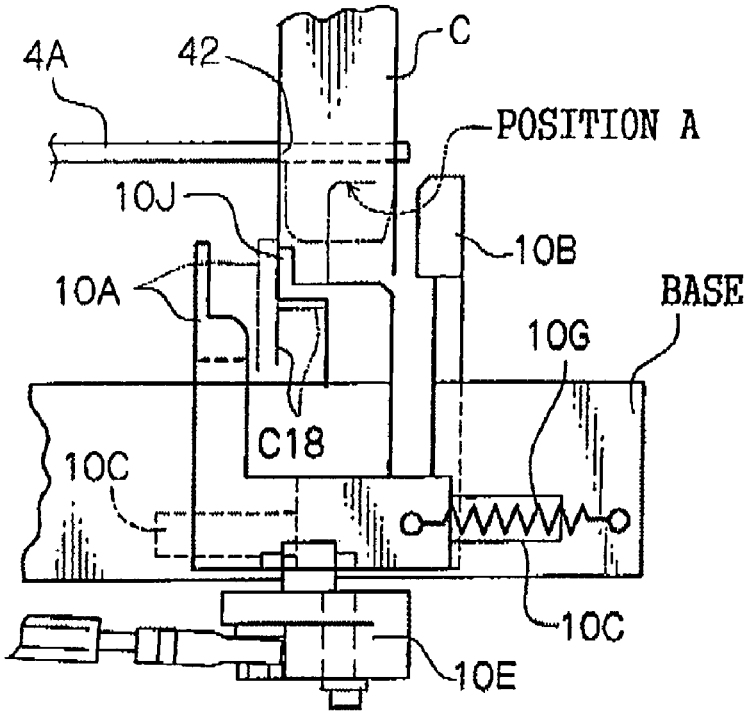
FIG. 8 is a front view of the upper lid constructing portion shown in FIG. 6.
Figure 9:
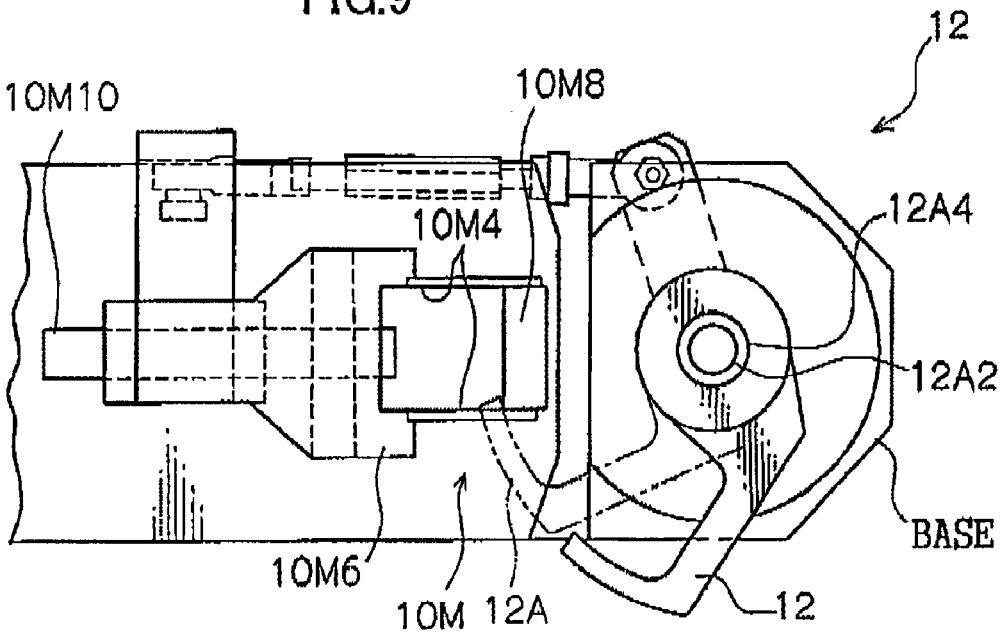
FIG. 9 is a plan view showing the detail of the structure of a lower lid constructing portion included by the cartoner shown in FIG. 1.

When the sack carton has a pair of outside flap C18 instead of the header C2 located adjacent to the upper lid C8, at the swing arm 10E, the piston 10E10 is expanded and the pin 10E4 pops over the swing arm 10E. Thus, when the swing arm 10E rotates contra-clockwisely in FIG. 6 around the axis 10F, the outside flap folding member 10A and the header supporting plate 10B approach each other as shown in FIG. 8 and fold entirely the outside flap C18 upward as well as the outside flap folding member 10A and the template 10J co-operate to fold an folding portion (tip portion) of the outside flap C18.

On the other hand, when the sack carton C has a header C2 adjacent to the upper lid C8, at the swing arm 10E, the piston 10E10 is contracted and the pin 10E4 is retracted into the pocket 10E6. Thus, the force of rotation from the swing arm 10E is not transferred to the header supporting plate 10B and therefore, the header supporting plate 10B is urged by the helical spring 10I to contact to the stopper 10K to stand at a location A in FIG. 8. Thus, the header C2 is supported from the outside by the header supporting plate 10B while the outside flap C18 is being folded.

Figure 10:
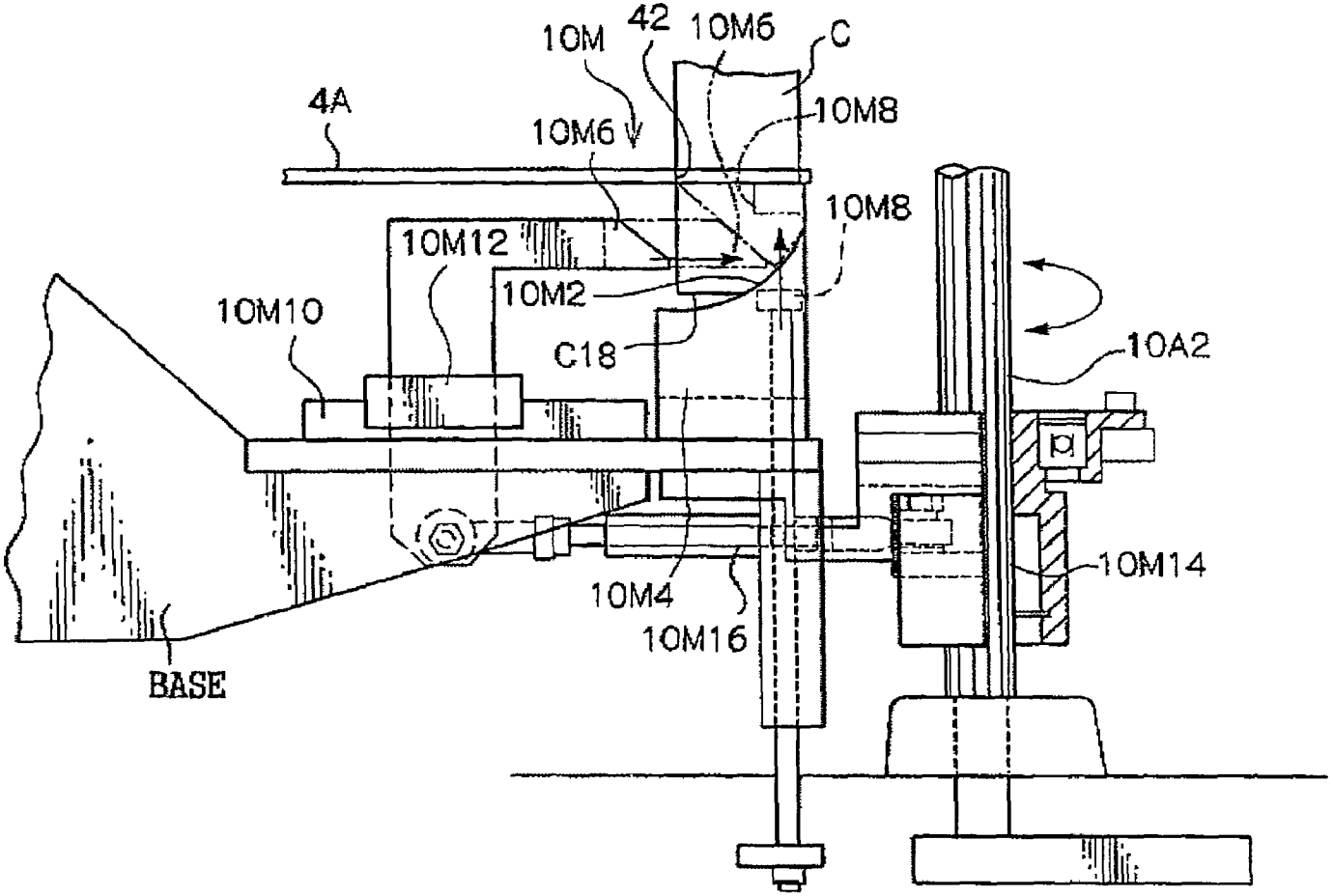
FIG. 10 is a side view of the lower lid constructing portion shown in FIG. 9.

As shown in FIG. 10, the upper lid folding unit 10M incorporates a pair of guide plates 10M4 having a cylindrical guild surface 10M2 guiding the outside flap C18, a horizontal pusher 10M6 pushing the outside flap C18 horizontally, and a vertical pusher pushing the outside flap C18 upward.

A guide 10M10 is fixed on the base and a slider 10M12 is fixed to the horizontal pusher 10M6. By the slider 10M12 sliding on the guide 10M10, the horizontal pusher 10M6 approaches and parts from the guide plate 10M4. Additionally, the horizontal pusher 10M6 is connected to the spline shaft 12A2 by a spline nut 10M14 and an arm 101M16. Thus, by the spline shaft 12A2 rotating, the horizontal pusher 10M6 moves reciprocally between a rest position shown in bold line and a folding position shown in two-dot chain line in FIG. 10.

By the horizontal pusher 10M6 moving from the rest position to the folding position, the outside flap C18 of the sack carton C is guided along the guide surface 10M2 of the guide plate 10M4 to a folding position shown in two-dot chain line in FIG. 10.

Then, the vertical pusher 10M8 ascends from a rest position shown in broken line to a folding position shown in two-dot chain line in FIG. 10. Thus, the outside flap is pushed by the vertical pusher 10M8 to be folded completely in an angle of 90 degree to complete the upper lid C8.

The bottom lid constructing portion 12 is provided such that it adjoins the index table 4B above the upper lid folding unit 10M. The bottom lid constructing portion 12 comprises a flap folding arm 12A which folds one inside flap 20 of the bottom lid C10 toward the opening portion C6, a flap folding plate 12B which is a circular plate-like member adjacent to the downstream side of the flap folding arm 12A and extended along the outer periphery of the index table 4B, a roller-like first pusher 12C adjacent to the downstream side of the flap folding plate 12B and a second pusher 12D adjacent to the downstream side of the first pusher 12C.

The flap folding arm 12A is a plate-like member which is extended from outside to inside of the index table 4B while its front end is formed in a hook like shape. Then, this is formed rotatably around the rotation axis provided on a root portion which is an end portion opposite to the side formed in the hook-like shape. When the flap folding arm 12A rotates toward downstream side, the hook-shaped end portion abuts on the inside flap C20 in the upstream so that it folds the inside flap C20 toward the downstream so as to cover the opening portion C6.

When the rotation table 4 rotates in the direction of an arrow a, the flap folding plate 12B folds the inside flap C20 on the downstream side of the sack carton C toward the upstream side so as to overlap the inside flap C20 on the upstream side. If the inside flap C20 on the downstream side is folded, the pair of the inside flaps C20 are held from upward not so as to open until the sack carton C reaches the first pusher 12C.

The first pusher 12C is formed so as to be capable of advancing or retracting along the radius direction of the index table 4B. When it advances toward the center of the index table 4B, one outside flap C22 located outside of the pair of the outside flaps C22 is folded inward so as to overlap the inside flap C20.

The second pusher 12D is also formed so as to be capable of advancing or retracting along the radius direction of the index table 4B similarly to the first pusher 12C. If it retracts toward the outer periphery of the index table 4B, it folds and bond the outside flap C22 so as to overlap the outside flap C22 thereby forming the bottom lid C10.

Figure 11:
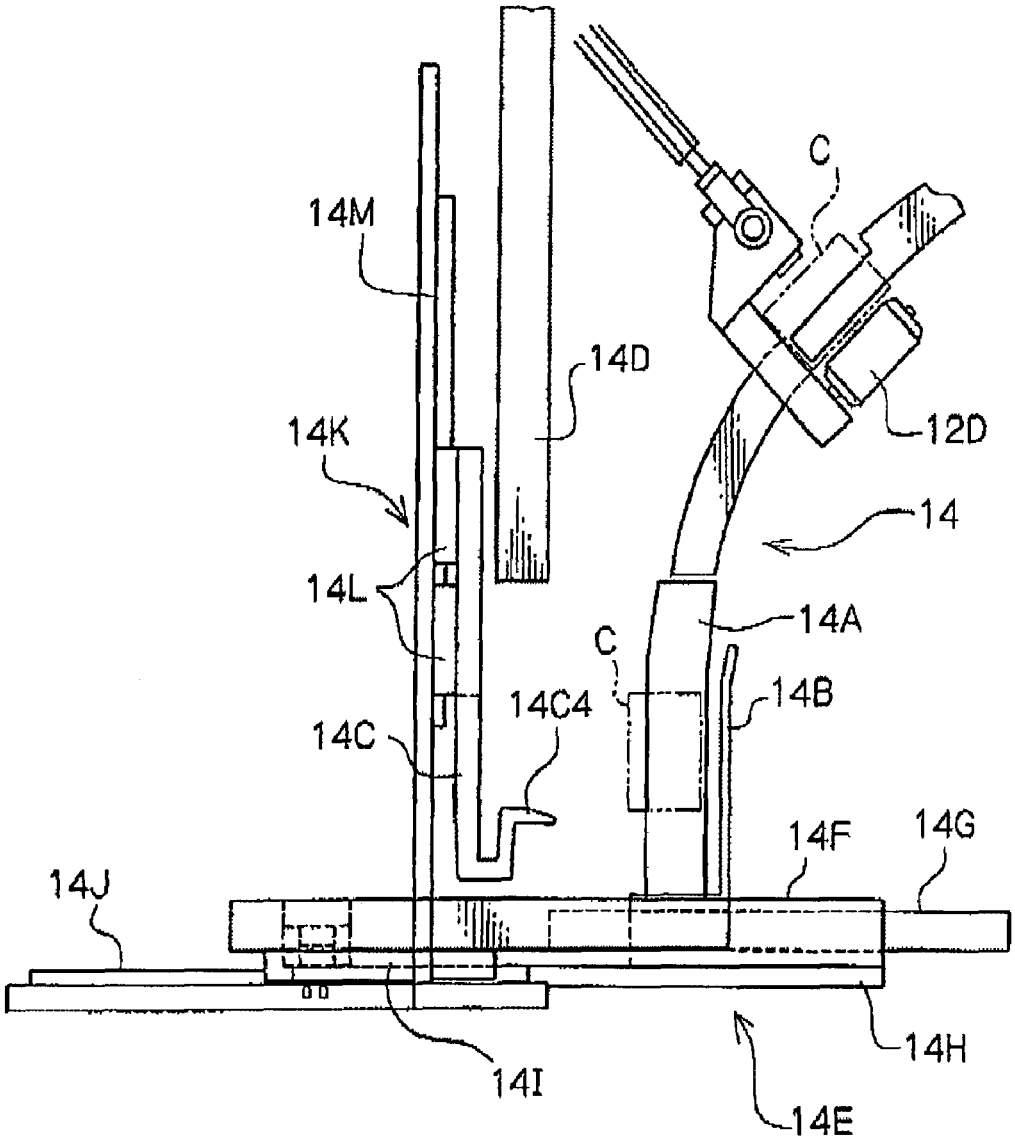
FIG. 11 is a plan view showing the structure of a carton discharging portion included by the cartoner shown in FIG. 1.
Figure 12:
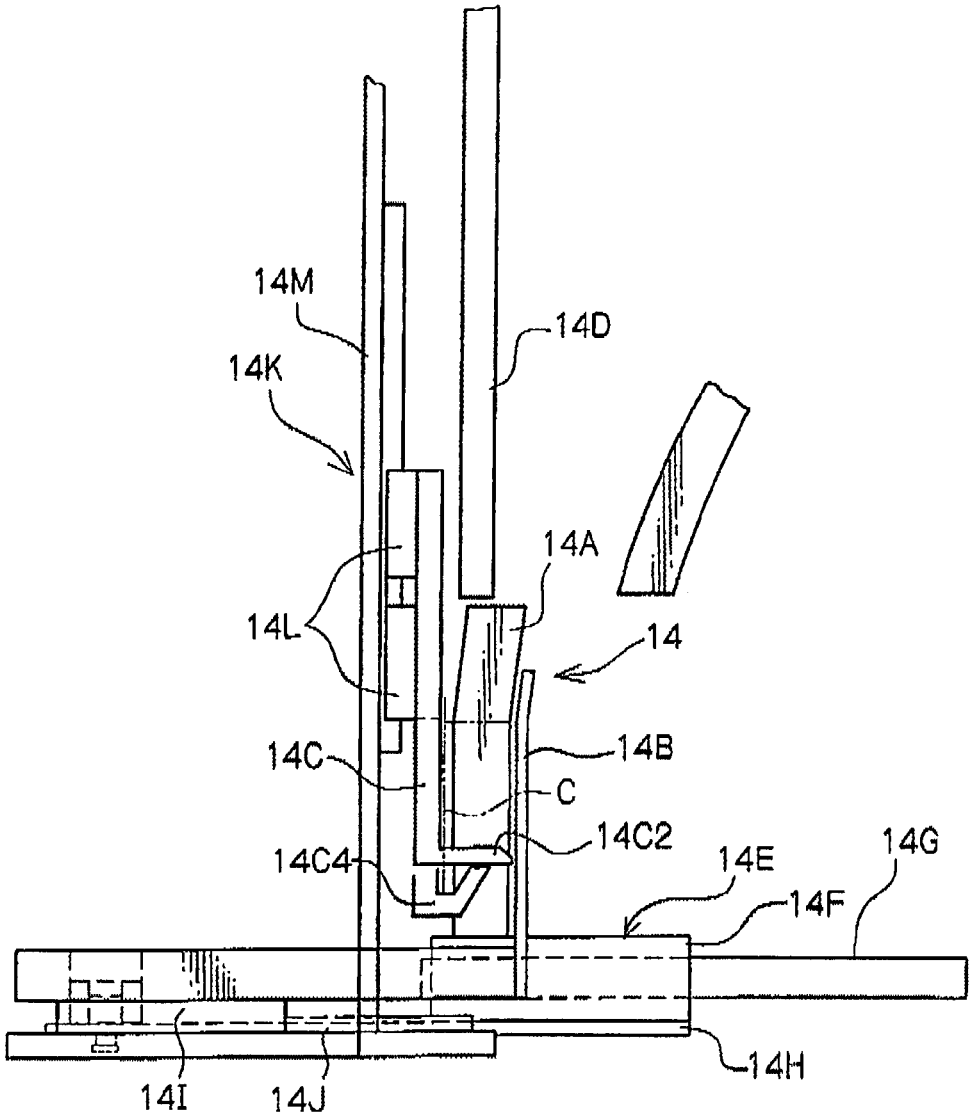
FIG. 12 is a plan view showing an operation of the carton discharging portion shown in FIG. 11.
Figure 13:
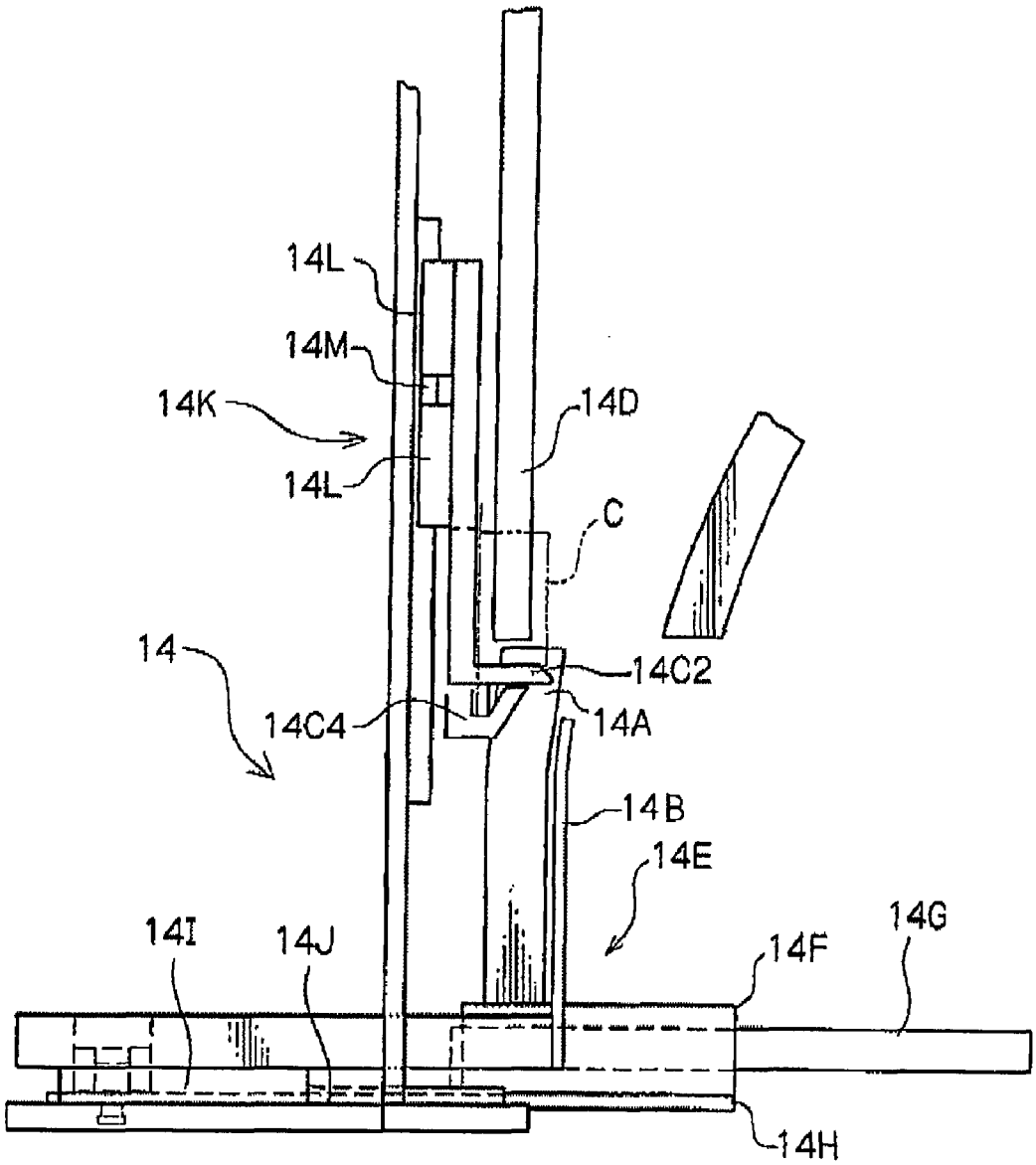
FIG. 13 is a plan view showing an operation of the carton discharging portion shown in FIG. 11.

As shown in FIGS. 11 to 13, the carton discharging portion 14 comprises a walking table 14A on which the sack carton C of which bottom lid C10 is constructed at the bottom lid constructing portion 12, a pair of pick-up forks 14B picking the sack carton C out of the carton setting portion 42 of the index tables 4A and 4B, a discharging fork 14C discharging the sack carton C picked out of the carton setting portion 42 to an discharging conveyer 14D, and the discharging conveyer discharging the sack carton C out of the cartoner 400.

The walking table 14A and the pick-up forks 14B walk in a synchronized manner between a sack carton accepting position shown in FIG. 11 and a sack carton delivering position shown in FIGS. 12 and 13 by a slider mechanism 14E provided in a radial direction of the index tables 4A and 4B.

The slider mechanism 14E comprises a linear guide 14G, a slider 14F with the walking table 14A and the pick-up fork 14B fixed thereon and sliding on the linear guide 14G, a driving lever 14H driving the slider 14F, a slider 14I fixed to the upper pick-up fork 14B and a linear guide 14J on which the slider 141 slides.

On the other hand, the discharging fork 14C walks by a slider mechanism 14K in a direction approaching the discharging conveyer 14D or in a direction parting therefrom.

The slider mechanism 14K has a linear guide extending in a direction parallel to the discharging conveyer 14D and a slider 14L with the discharging fork 14C fixed thereon and sliding on the linear guide 14M.

Additionally, at the tip portion of the discharging fork 14C, claws 14A2 and 14A4 are provided.

An operation of the carton discharging portion 14 is described in the below.

When the sack carton with its bottom lid C10 constructed at the bottom lid constructing portion 12 is moved to the carton discharging portion 14 by the index tables 4A and 4B, the walking table 14A and the pick-up forks are at the sack carton accepting position shown in FIG. 11.

When the sack carton C is mounted on the walking table 14A, the walking table 14A and the pick-up forks 14B moves by the slider mechanism 14E to the sack carton delivering position as shown in FIG. 12 and remove the sack carton from the carton setting portion 42 to the discharging fork 14C. Thus, as shown in FIG. 12, the discharging fork 14C is at a position parting from the discharging conveyer 14D.

Finally, as shown in FIG. 13, the discharging fork 14C moves toward the discharging conveyer 14D by the slider mechanism 14K and discharge the sack carton C to the discharging conveyer 14D.

The sack carton C discharged on the discharging conveyer 14D is discharged out of the cartoner 400 by the discharging conveyer 14D.

The entire operation of the cartoner 400 is described below. In the meantime, a flow of the carton and the plastic case packed products in the cartoner 400 is shown in FIG. 16.

Figure 16:
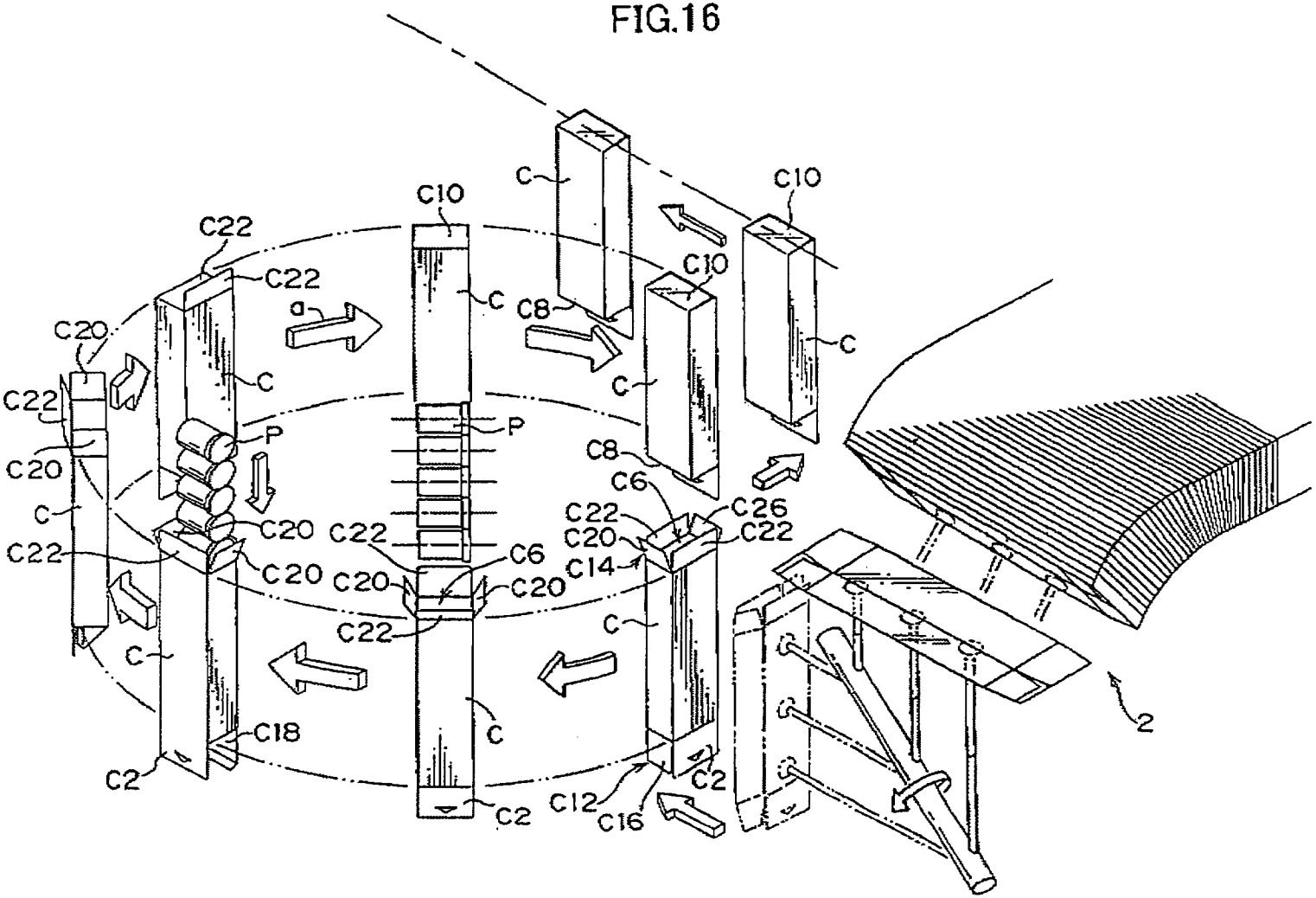
FIG. 16 is a flow chart showing a flow of the sack carton in the cartoner shown in FIG. 1.

As shown in FIGS. 1 and 16, in the sack carton C supplied to the cartoner 400 by the carton supplying unit 2, an opening is formed at the carton opening forming portion 6 and it is mounted on the rotation table 4. Then, an inside flap C16 is folded by the flap folding arm 6B and the flap folding plate 6C so as to cover the opening portion C4.

The opening is formed in the carton opening forming portion 6 and after the opening portion C8 is covered, the sack carton C is transported to the plastic case-packed product packing portion 8. Then, a predetermined quantity of the plastic case packed products are loaded in the plastic case packing portion C8.

After the predetermined quantity of the plastic case packed products are loaded in the plastic case packing portion C8, the sack carton C is transported to the upper lid constructing portion 10. There, the outside flap C18 is folded and bonded to the inside flap thereby forming the upper lid C8.

In the sack carton C, at the same time when the upper lid C8 is formed by the upper lid constructing portion 10, the inside flap C20 is folded at the bottom lid forming portion 12 so as to cover the opening portion C6. Then, the outside flap C22 is folded successively and bonded so as to form the bottom lid C10.

After the bottom lid C10 is formed, the sack carton C is transported to the carton discharging portion 14 and discharged from the cartoner 400 and sent to a post process.

1-2 Carton Supplying Unit

Figure 17:
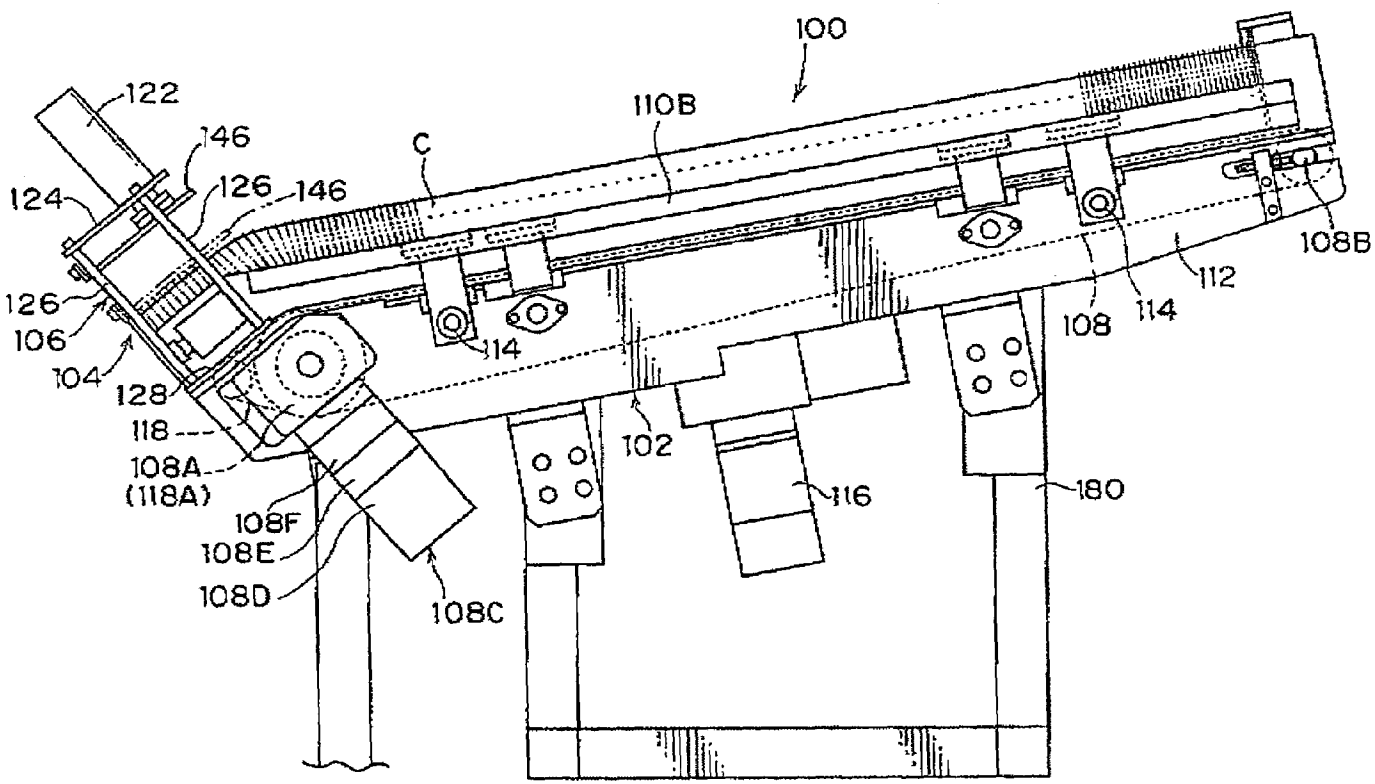
FIG. 17 is a front view showing the structure of a carton supplying chute in the carton supplying unit included by the cartoner shown in FIG. 1.

As shown in FIG. 17, the carton supplying unit 2 comprises a carton supplying chute 100 accommodating a number of the sack cartons C and a carton supplying portion 200 for bringing out the sack carton C from the carton supplying chute 100 and supplying to the carton opening forming portion 6.

(A) Carton Supplying Chute

Figure 18:
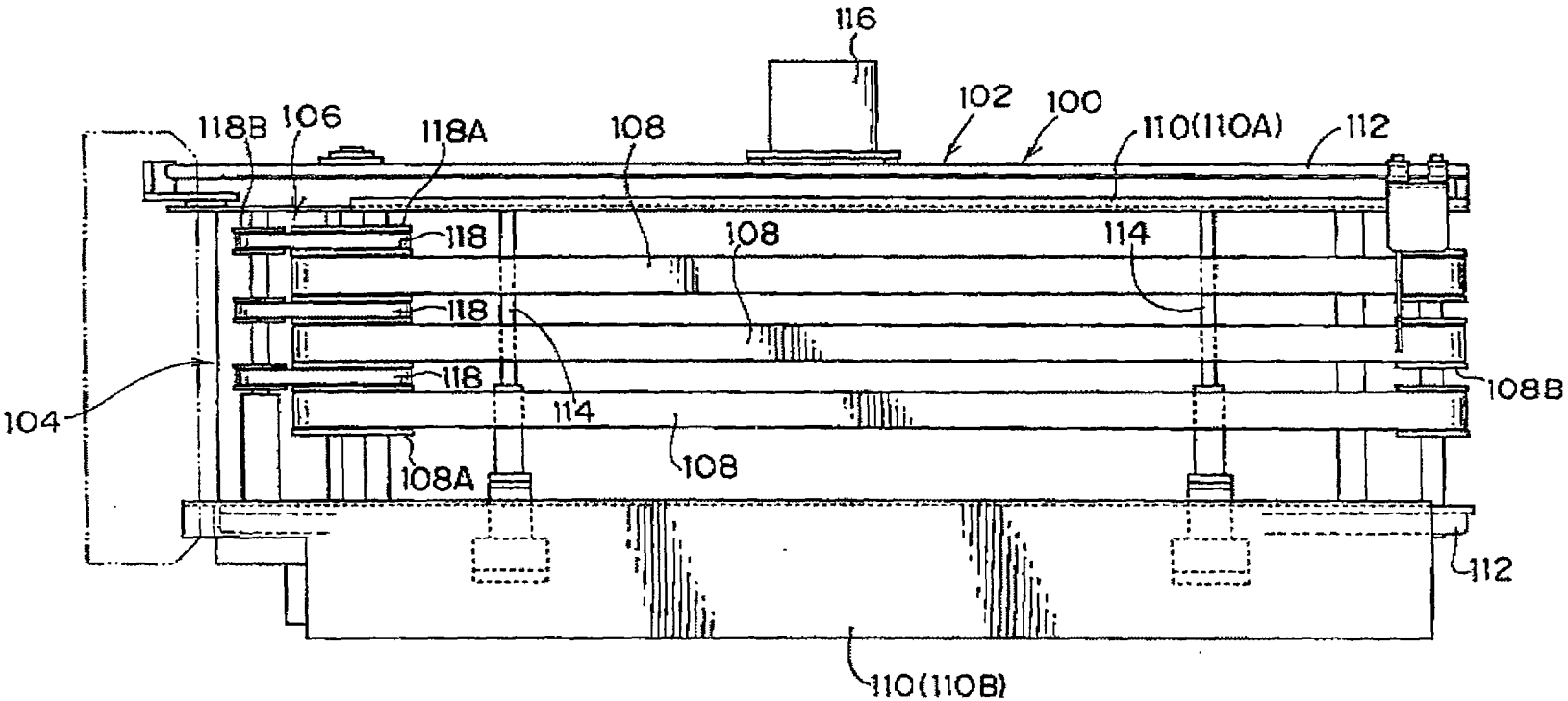
FIG. 18 is a plan view showing the structure of the carton supplying chute shown in FIG. 17 when seen from above.
Figure 19:
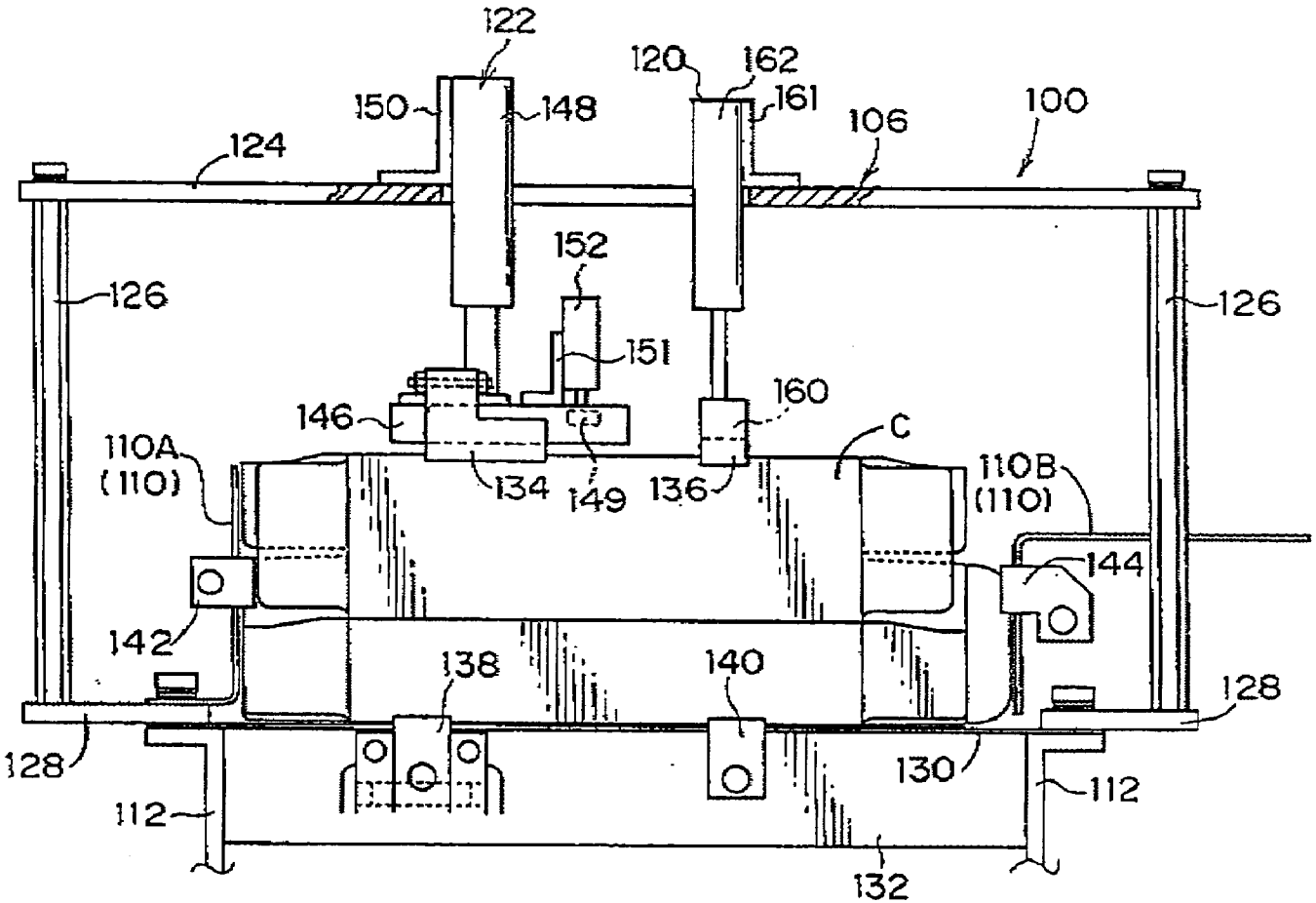
FIG. 19 is a front view of the carton supplying chute shown in FIG. 17 when seen from a carton pickup port.

The carton supplying chute 100 corresponds to the box body accommodating portion in the box body supplying unit of the invention. As shown in FIGS. 17 to 19, it comprises a carton supplying conveyor portion 102 which includes a carton pickup port 104 corresponding to a box body pickup port according to the invention provided at an end portion, accommodates the sack carton C and transports the sack carton C toward the carton pickup port 104 and a base 180 for supporting the carton supplying conveyor portion 102 from the below.

A supplying chute front end portion 106 is formed in the vicinity of the carton pickup port 104 of the carton supplying conveyor portion 102.

The carton supplying conveyor portion 102 comprises a main belt conveyor 108 constituted of three belt conveyors arranged in parallel, a pair of end plates 112 provided in parallel to the main belt conveyor 108 so as to sandwich the main belt conveyor 108 in the width direction and a horizontal guide 110 disposed between the end plate 112 and the main belt conveyor 108 in parallel to the main belt conveyor 108. The horizontal guide 110 corresponds to the horizontal guide member according to the invention. The carton supplying conveyor 102 is fixed on the base 180 at the end plate 112.

A drive roller 108A for supporting the main belt conveyor 108 and a driven roller 108B are pivoted by the end plate 112.

The horizontal guide 110 is comprised of a reference side guide member 110A fixed to the carton supplying conveyor portion 102 and a moving side guide member lion formed so as to be capable of approaching or leaving the reference side guide member 110A.

The horizontal guide 110 is provided with a width adjusting guide 114 for guiding the main belt conveyor 108 along the width direction when the moving side guiding member lion is moved relative to the reference side guiding member 110A such that it is at right angle to the main belt conveyor 108 when it passes through the main belt conveyor 108. Two pieces of the width adjusting guides 114 are arranged along the longitudinal direction of the main belt conveyor 108. An end of the width adjusting guide 114 is fixed on the reference side guide member 110A while the other end is fixed to the moving side guide member 110B. A horizontal guide width adjusting motor 1116 for moving the moving side guide member 110B is provided below the end plate 112.

As shown in FIGS. 17 to 19, the supplying shoot front end portion 106 has a function for feeding the sack carton C transported near the supplying shoot front end portion 106 by the main belt conveyor 108 to the carton pickup port 104 and includes an auxiliary belt conveyor 118 provided in parallel to the main belt conveyor 108.

Three auxiliary belt conveyors 118 are provided and two of them are provided in the main conveyor 108 while the other one is provided between the main conveyor 108 and the reference side guide member 110A. The auxiliary belt conveyor 118 is wound around the drive roller 118A and the driven roller 118B. The drive roller 118A has the same diameter as the drive roller 108A and is provided coaxially with the drive roller 108A such that it is sandwiched by the drive roller 108A.

The drive roller 108A and the drive roller 118A are driven by the belt conveyor drive unit 108C fixed to the end plate 112.

The belt conveyor drive unit 108C is formed such that one of rotating one of the drive roller 108A and the drive roller 118A, and rotating the both is selectable. Such a belt conveyor drive unit 108C comprises a motor 108D, a first clutch 108E for transmitting a rotation of the motor 108D to the drive roller 108A and a second clutch 108F for transmitting a rotation of the motor 108D to the drive roller 118A.

In the belt conveyor drive unit 108C, if the motor 108D is rotated with only the first clutch 108E set to "in contact", only the drive roller 108A is rotated and then only the main belt conveyor 108 is driven. If the motor 108D is rotated with only the second clutch 108F set to "in contact", only the drive roller 118A is rotated and then only the auxiliary belt conveyor 118 is driven. Then, if both the first clutch 108E and the second clutch 108F are set to "in contact", the drive rollers 108A and 118A are rotated at the same velocity, so that the main belt conveyor 108 and the auxiliary belt conveyor 118 are driven at the same transfer velocity.

If other transmission gear is employed instead of the first clutch 108E and the second clutch 108F, the main belt conveyor 108 and the auxiliary belt conveyor 118 are driven at different transfer velocities.

As the belt conveyor drive unit 108C, a first motor for driving the drive roller 108A and a second motor for driving the drive roller 118A, provided independently of the first motor may be provided.

Preferably, the auxiliary belt conveyor 118 is composed of material having a low friction coefficient such as fluororesin in order to protect the sack carton C from being damaged when it slips.

The actuator supporting base 124 is fixed on the end plate 112 by means of four supporting columns 126 above the auxiliary belt conveyor 118 and an upper guide plate 146, which will be described later, is mounted on an actuator supporting base 124 through the upper guide plate mounting portion 122 such that it is capable of rising or falling and an upper guide plate 160, which will be described later, is mounted through the upper guide plate mounting portion 120 such that it is capable of rising or falling. Two supporting columns 126 are mounted on a supporting column receiving plate 128 fixed on an upper edge of the end plate 112 such that they are located outside the horizontal guide 110.

An pickup port guide plate 130 is provided on the side of the carton pickup port 104 of the auxiliary belt conveyor 118 to prevent the sack carton C transported by the auxiliary belt conveyor 118 from dropping through a gap in the end plate 112. Edges on the side of the carton pickup port 104 of the end plate 112 are connected to each other through the end plate 132. An upper edge of the end plate 132 is in contact with the bottom face of the pickup port guide plate 130.

The upper guide plate 146 is held below the actuator supporting base 124 such that it is capable of rising or falling so as to form the carton pickup port 104.

An edge on the side of the carton pickup port 104 of the upper guide plate 146 is provided with upper pawls 134, 136 for holding an upper edge portion of the sack carton C as shown in FIG. 8. On the other hand, an edge on the side of the carton pickup port 104 of the pickup port guide plate 130 is provided with lower pawls 138, 140 for holding a lower edge portion of the sack carton C. Further, side pawls 142, 144 for gripping a side edge portion of the sack carton C are provided at or in the vicinity of an end edge (hereinafter referred to as front end) on the side of the carton pickup port 104 of each of the reference side guide member 110A and the moving side guide member 110B.

The side pawls 142, 144 can be provided at a front end of each of the reference guide member 110A and the moving side guide member 110B. However, if the sack carton C has a header C2 projecting from the flap portion C12, as shown in FIG. 12, preferably, the side pawls 142 and 144 are so provided that both the side pawls 142 and 144 are retracted about 1 to 10 mm from the front end and that a distance d1 from the front end of the side pawl 142 is larger than a distance d2 from the front end of the side pawl 144. Because the flap portions C12, C14 are retracted at substantially an equal angle relative to a pickup direction if the side pawls 142, 144 are provide on the aforementioned position, the sack carton C can be picked up easily in the vicinity of the carton pickup port 104.

Figures 20A, 20B, 20C:
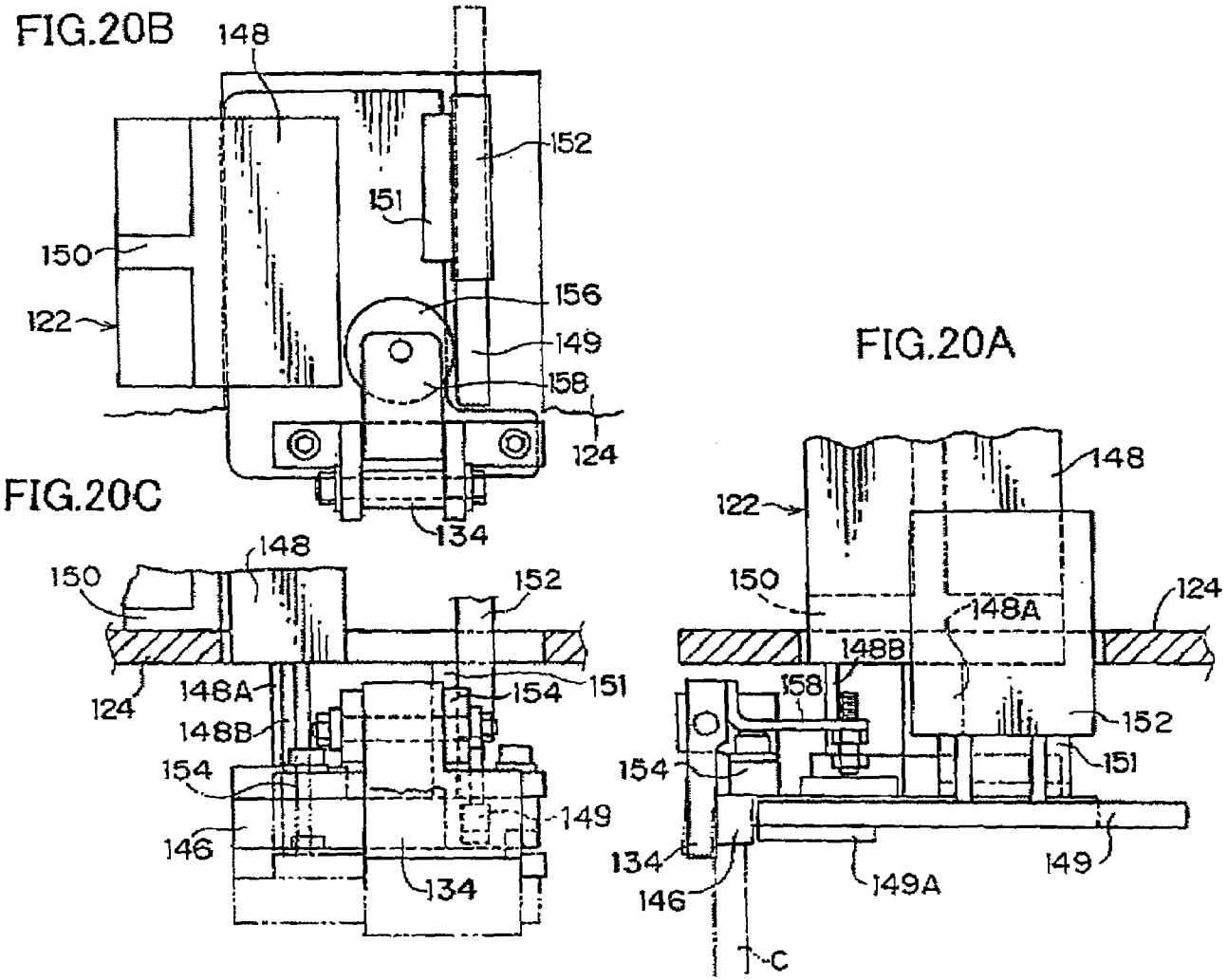
FIG. 20A is an enlarged side view showing the detail of the structure of an upper pawl on a side provided with a load sensor and the surrounding of the upper pawl, of a pair of the upper pawls included by the carton supplying chute shown in FIG. 17.
FIG. 20B is a plan view of the upper pawl shown in FIG. 20A and its surrounding.
FIG. 20C is a front view of the upper pawl shown in FIG. 20A and its surrounding.

The structure of the upper pawl 134 and an upper guide plate 146, which will be described later, and their surrounding portion are shown in FIG. 20. FIG. 20A indicates a side view of the upper guide plate 146, FIG. 20B indicates a top view and FIG. 20C indicates a view on the side of the carton pickup port 104 or a front view.

As shown in FIGS. 19 and 20, the upper guide plate mounting portion 122 comprises an actuator 148 which is fixed such that an actuator supporting base 124 is passed through an opening portion provided on a front edge of the actuator supporting base 124 in order to lift the upper guide plate 146 up and down and a fixing member 150 for fixing the actuator 148 at the aforementioned position of the actuator supporting base 124.

A rod-like ram member 148A and an auxiliary ram member 148B are projected from a bottom face of the actuator 148. The upper guide plate 146 is fixed to a bottom end of each of the ram member 148A and the auxiliary ram member 148B. The actuator 148 incorporates various kinds of actuator mechanisms for hydraulic pressure, air pressure and ball screws. The ram member 148A is raised and dropped by the actuator mechanism. The auxiliary ram member 1483 is a guide member which is provided adjacent to the ram member 148A for guiding the upper guide plate 146 in the vertical direction in order to prevent the upper guide plate 146 from rotating around the ram member 148A. If the ram member 148A rises or falls, the upper guide plate 146 is raised or dropped.

A carton arranging plate 149 is provided substantially in parallel to the upper guide plate 146 below the upper guide plate 146. A rubber plate 149A is fixed on a front edge of the carton arranging plate 149 in order to protect the sack carton C from slipping relative to the carton arranging plate 149.

An actuator 152 for lifting up and down the carton arranging plate 149 is fixed on a top face of the upper guide plate 146 through a fixing member 151. By moving the carton arranging plate 149 up and down by the actuator 152, heights of the upper edges of the sack cartons C can be arranged in line.

A bearing member 154 having a horizontal rotation axis is fixed on a front edge on the top face of the upper guide plate 146 and the upper pawl 134 is pivoted by a bearing member 154 so that its bottom portion is projected about 1 to 3 mm below an upper guide plate 146. Therefore, the upper pawl 134 rotates to approach or leave the front edge of the upper guide plate 146 as indicated with two-dot chain line in FIGS. 20A to 20C.

As shown in FIG. 20, a disc-like load sensor 156 is fixed between the bearing member 154 on the top face of the upper guide plate 146 and the actuator 152. A load transmission arm 158 for transmitting a load to the load sensor 156 is provided backward above a portion pivoted by the bearing member 154 on the rear face of the upper pawl 134 or on a face on the side in which the actuator 152 is provided. The upper pawl 134, the load transmission arm 158 and the load sensor 156 correspond to pressure detecting means in the box body supplying unit of the invention.

If a pressure is applied to the upper pawl 134 from the sack carton C, as indicated with two-dot chain line in FIG. 20A, a portion of the same upper pawl 134 below its portion pivoted by the bearing portion 154 in the upper pawl 134 is rotated forward while a portion above the aforementioned portion is rotated backward. Here, because the load transmission arm 158 is fixed to a portion above the aforementioned portion of the upper pawl 134 as described above, it is pressed backward by the upper pawl 134 and rotated downward, so as to press the load sensor 156. Consequently, the pressure is detected by the load sensor 156.

Figure 21:
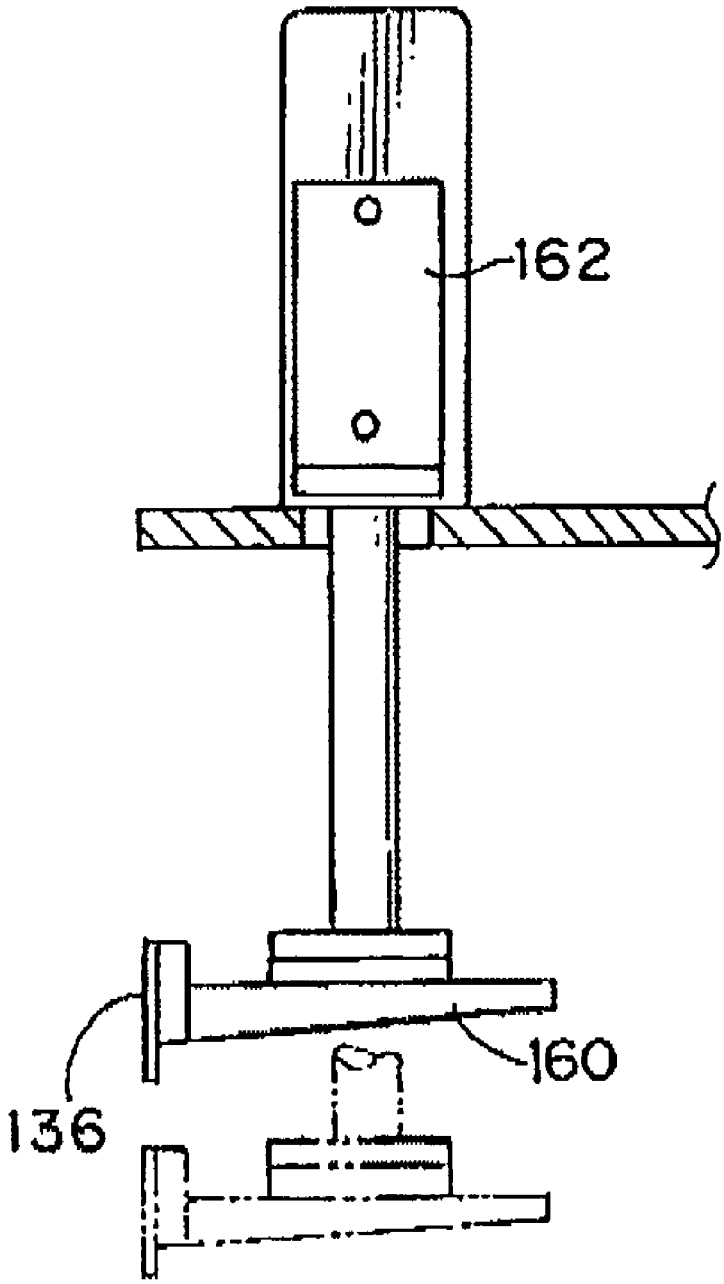
FIG. 21 is an enlarged view showing the detail of the structure of the other upper pawl and its surrounding.

The upper guide plate 160 is also a height direction guide member abutted on an upper edge of the sack carton C for guiding the sack carton C. As shown in FIGS. 19 and 21, the upper guide plate mounting portion 120 comprises an actuator 162 which is provided to oppose the actuator 148 at the opening portion of the actuator supporting base 124 so that the upper guide plate 160 is disposed adjacent to the upper guide plate 146 in order to lift up and down the upper guide plate 160 and a bracket 161 for fixing the actuator 162 onto an actuator supporting base 124 at the aforementioned position. As described above, the upper guide plate 160 is mounted on the actuator supporting base 124 through the upper guide plate mounting portion 120 so that it is capable of being lifted up and down.

The plate-like upper pawl 136 projected downward is fixed at a front end of the upper guide plate 160. Preferably, a projection amount of the upper pawl 136 is 1 to 3 mm.

Figure 22A:
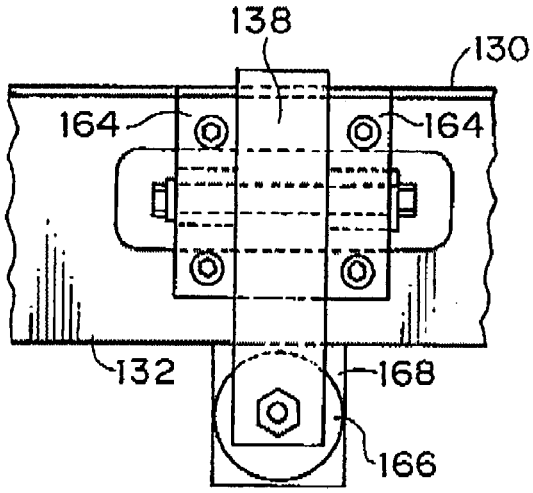
FIG. 22A is an enlarged front view showing the detail of the structure of a lower pawl on a side provided with a load sensor and the surrounding of the upper pawl, of a pair of the lower pawls included by the carton supplying chute shown in FIG. 17.
Figure 22B:
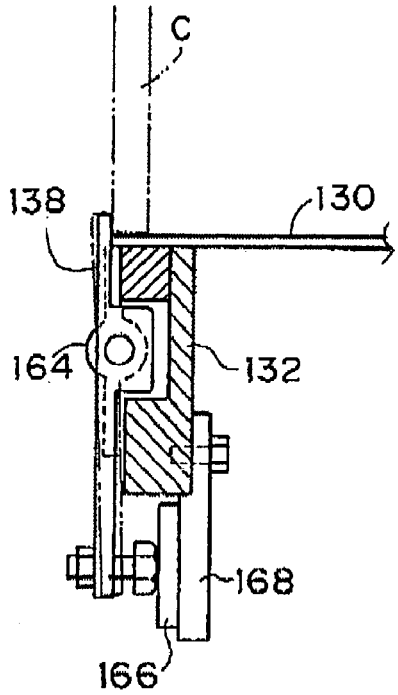
FIG. 22B is an enlarged side view showing the detail of the structure of a lower pawl on a side provided with a load sensor and the surrounding of the upper pawl, of a pair of the lower pawls included by the carton supplying chute shown in FIG. 17.
Figure 23A:
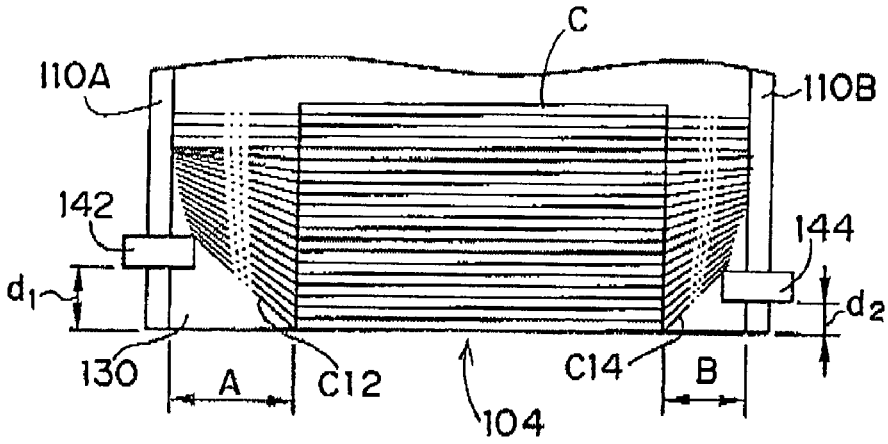
FIG. 23A is a plan view showing an example of a position in which the side pawl is provided of the carton supplying chute shown in FIG. 17.
Figure 23B:
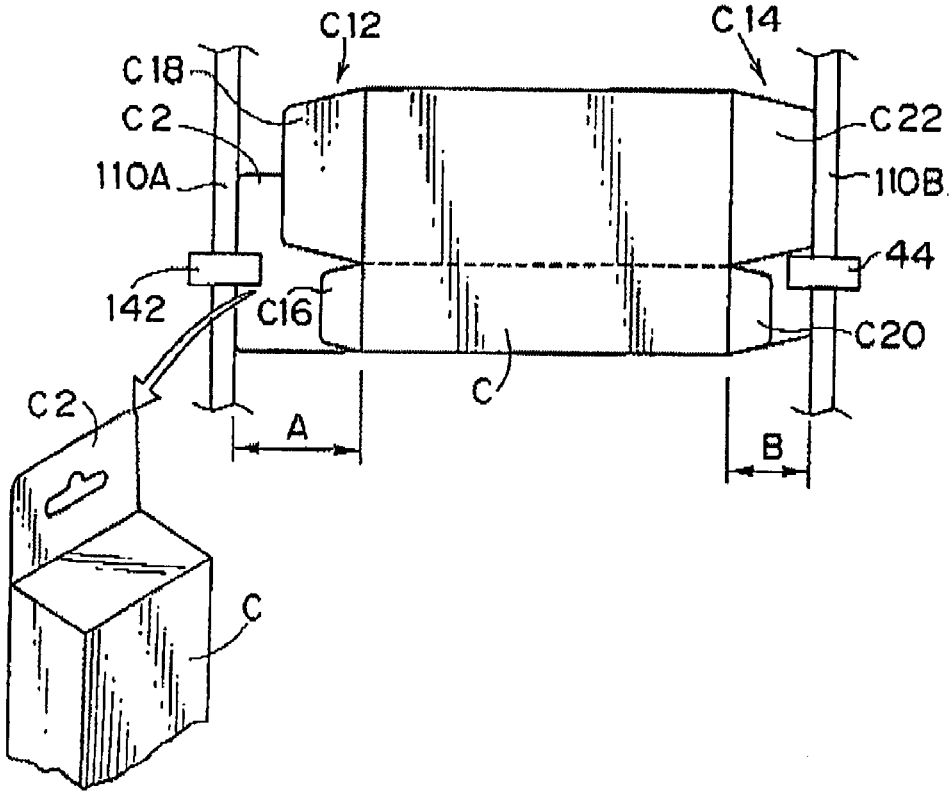
FIG. 23B is a front view of the carton supplying chute having the side pawls provided at a position shown in FIG. 23A.

FIG. 22 shows the structure of the lower pawl 138 and its surrounding portion. FIG. 22A indicates a front view of the lower pawl 138 and FIG. 22B indicates a side view thereof.

As shown in FIG. 22, a hearing member 164 for pivoting the lower pawl 138 around a horizontal rotation axis is fixed on a front face of the end plate 132. When no load is applied, a top end of the lower pawl 138 is projected 1 to 3 mm from the top face of the pickup port guide plate 130.

A load sensor fixing plate 168 is fixed below the end plate 132 and a load sensor 166 for detecting a pressure applied to the lower pawl 138 from the sack carton C is fixed on the load sensor fixing plate 168 so that it opposes a bottom end portion of the lower pawl 138. The lower pawl 138 and the load sensor 166 correspond to a pressure detecting means in the box body supplying apparatus of the invention.

If a pressure is applied from the sack carton C to the lower pawl 138, as indicated by two-dot chain line in FIG. 22, a portion above a portion pivoted by the bearing member 164 of the lower pawl 138 is rotated forward while a portion below that portion is rotated backward. Therefore, the bottom end portion of the lower pawl 138 presses the load sensor 166. Consequently, the pressure applied from the sack carton C to the lower pawl 128 is detected by the load sensor 166.

Figure 24:
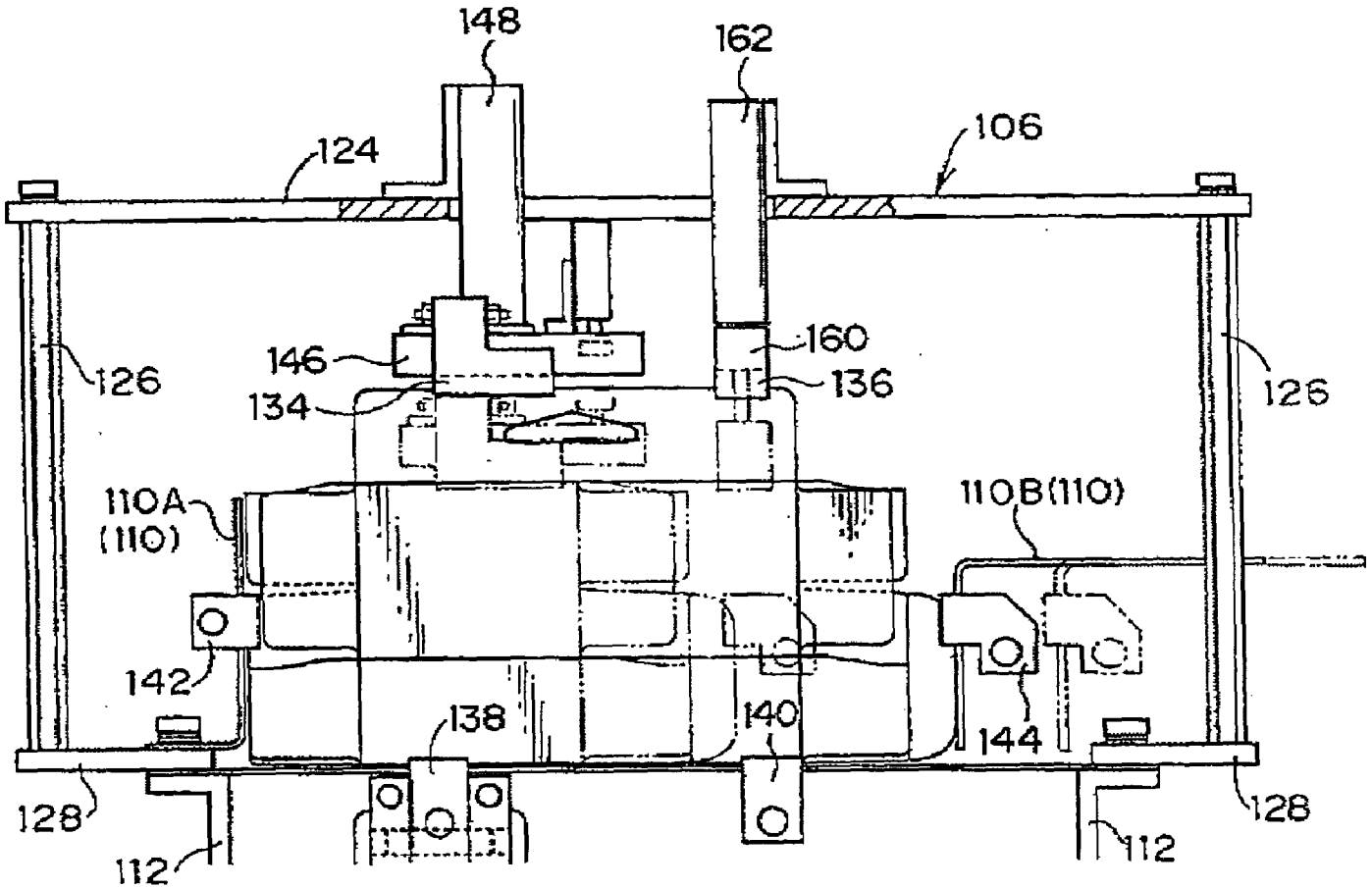
FIG. 24 is an end face view showing a condition in which the positions of the upper guide plate and horizontal guide are changed depending on the size and configuration of the sack carton to be accommodated in the carton supplying chute shown in FIG. 17.

FIG. 24 shows positions of the upper pawls 134, 136 and the side pawls 142, 144 for supplying the sack cartons C of various shapes and sizes in the carton supplying shoot 100 shown in FIGS. 17 to 19.

As shown in FIG. 24, the upper guide plate 146 and the upper guide plate 160 are lifted up and down by the actuator 148 and the actuator 162 depending on the height of the upper edge of the sack carton C, so that the bottom faces of the carton arranging plates 149, 160 abut on the upper edge of the sack carton C.

Further, the moving side guide member 110B moves in a direction approaching or leaving the reference side guide member 110A so as to abut on the side edge of one flap portion of the sack carton C.

Figure 25:
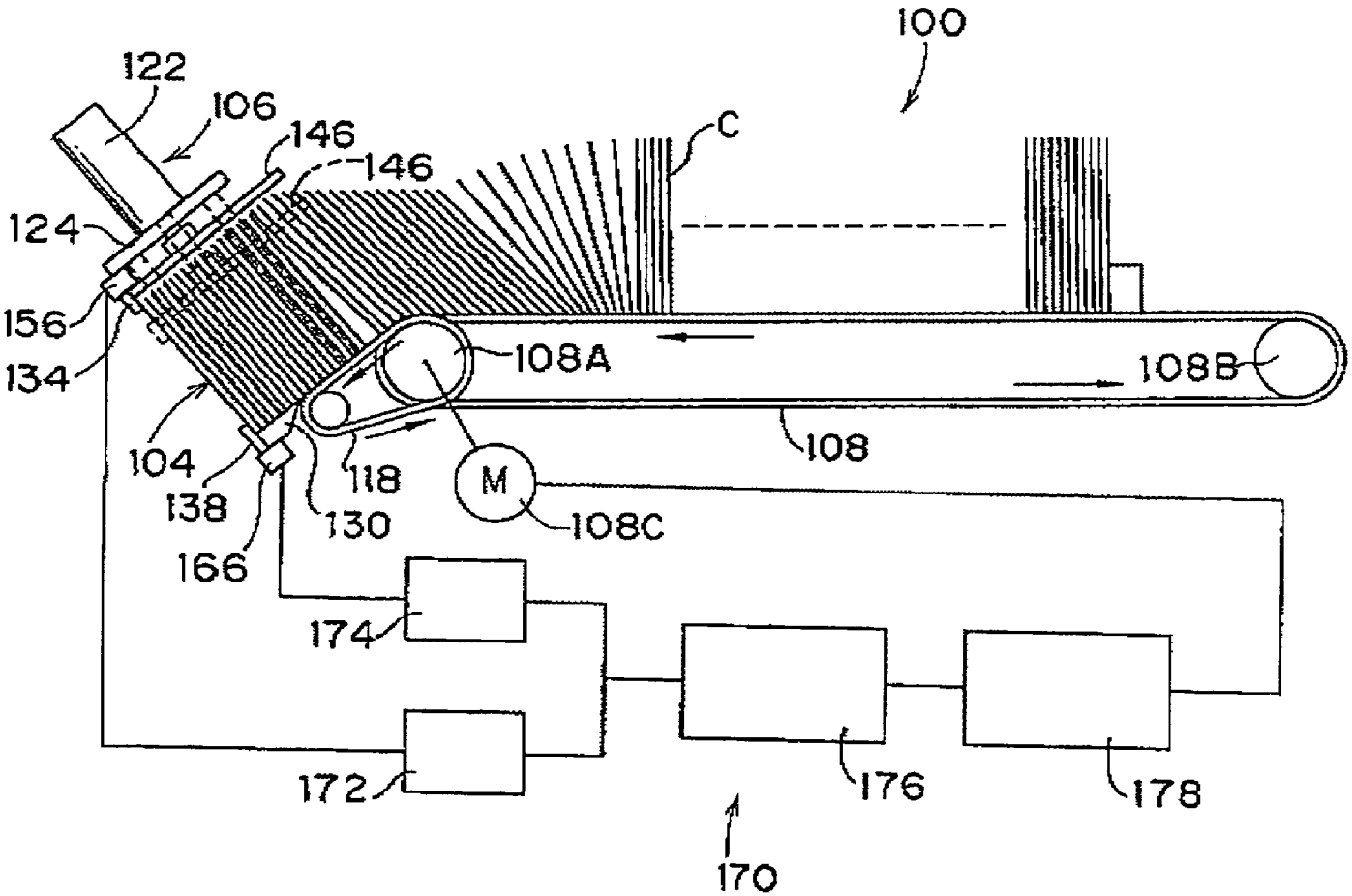
FIG. 25 is a block diagram showing the structure of transporting velocity control system for controlling the transporting velocities of a main belt conveyor and an auxiliary belt conveyor based on a signal from a load sensor in the carton supplying chute shown in FIG. 17.

The carton supplying shoot 100 includes a transporting velocity control system 170 for controlling the transfer velocities of the main belt conveyor 108 and the auxiliary belt conveyor 118 based on a signal from the load sensors 156, 166 as shown in FIG. 25. The transporting velocity control system 170 corresponds to box body feeding control means included by the box body supplying apparatus of the invention.

The transporting velocity control system 170 comprises an amplifier 172 for amplifying a voltage output from the load sensor 156, an amplifier 174 for amplifying a voltage output from the load sensor 166, a meter relay 176 for controlling output voltages amplified by the amplifiers 172, 174 with a reference voltage, a meter relay 176 for controlling a sequencer 178 based on a result of the aforementioned comparison and a sequencer 178 for controlling a belt conveyor drive unit 108C based on a control instruction from the meter relay 176.

Figure 26:
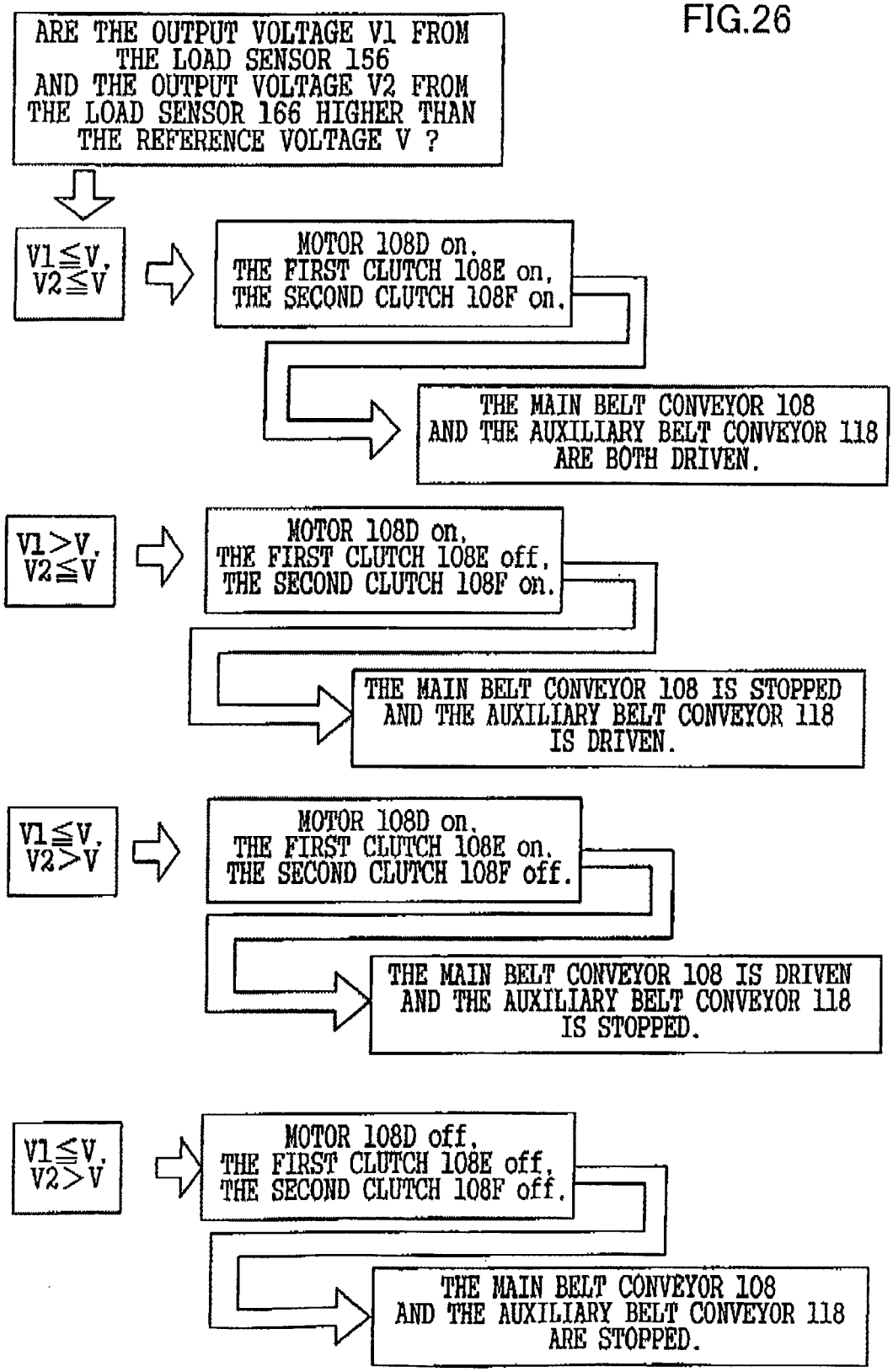
FIG. 26 is a flow chart showing a sequence for controlling the transporting velocities of the main belt conveyor and auxiliary belt conveyor based on a signal from the load sensor in a sequencer provided with the transporting velocity control system shown in FIG. 25.

AS shown in FIG. 26, the sequencer 178 compares output voltage V1 which is output from the load sensor 156 and amplified by the amplifier 174 and output voltage V2 which is output from the load sensor 166 and amplified by the amplifier 172 with reference voltage V. Then, one of following four sequences indicated below is executed depending on the relation between the output voltage V1, output voltage V2 and the reference voltage V.

If both the output voltage V1 and output voltage V2 are below the reference voltage V, no pressure over the reference pressure is detected by the load sensors 156, 166 so that the sequencer 178 judges that no pressure higher than the reference pressure is applied to the upper pawl 134 and the lower pawl 138.

Therefore, the sequencer 178 turns on the motor 108D of the belt conveyor drive unit 108C, the first clutch 108E and the second clutch 108F.

Consequently, both the drive rollers 108A and 118A are driven so that the main belt conveyor 108 and the auxiliary belt conveyor 118 are both driven at the same transfer velocity. Therefore, the sack carton C is transported to the carton pickup port 104 by the main belt conveyor 108 and the auxiliary belt conveyor 118.

If the output voltage V1 is higher than the reference voltage V and the output voltage V2 is below the reference voltage V, the load sensor 156 for detecting a pressure of the upper pawl 134 detects a pressure higher than the reference pressure and then the sequencer 178 judges that the sack carton C is inclined as if the top edge of the sack carton C falls forward or the sack carton C falls down forward at the supplying shoot front end portion 106.

Therefore, the sequencer 178 turns on the motor 108D and the second clutch 108F of the belt conveyor drive unit 108C and turns off the first clutch 108F so as to stop the drive roller 108A while rotating only the 118A. Consequently, transporting by the main belt conveyor 108 is stopped and only transporting by the auxiliary belt conveyor 118 is continued. Thus, the bottom edge of the sack carton C is transported to the carton pickup port 104 at the supplying shoot front end portion 106 so as to eliminate the forward inclination of the sack carton C.

If the output voltage V1 is below the reference voltage V while the output voltage V2 is higher than the reference voltage V, the load sensor 166 for detecting a pressure of the lower pawl 138 detects a pressure over the reference voltage and therefore the sequencer 178 judges that the sack carton is inclined as if the bottom edge of the sack carton C falls forward, that is, the sack carton C falls backward at the supplying shoot front end portion 10.

Therefore, the sequencer 178 turns on the motor 108D and the first clutch 108F of the belt conveyor drive unit 108C and turns off the second clutch 108F so as to stop the drive roller 118A while rotating only the drive roller 1 08A. Consequently, only transporting by the main belt conveyor 108 is continued and transporting by the auxiliary belt conveyor 118 is stopped. As a result, the bottom edge of the sack carton C is stopped at the supplying chute front end portion 106 and the upper half portion of the sack carton C is pressed forward by a pressure supplied from the main belt conveyor 108 so as to eliminate the backward falling.

If both the output voltage V1 and the output voltage V2 are higher than the reference voltage V, the load sensors 156, 166 detect a pressures over the reference pressure and therefore, the sequencer 178 judges that the sack carton C is pressed against the upper pawl 134 and the lower pawl 138 by an excessive pressure at the supplying chute front end portion 106.

Thus, the sequencer 178 turns off the motor 108D of the belt conveyor drive unit 108C, the first clutch 108F and the second clutch 108F so as to stop both the drive rollers 108A, 118A. Because the sack carton C is picked up one by one continuously from the carton pickup port 104 by means of the carton supplying portion 200, the quantity of the sack cartons C at the supplying chute front end portion 106 is decreased, so that a condition in which an excessive supply pressure is applied to the upper pawl 134 and the lower pawl 138 is eliminated.

Figure 27:
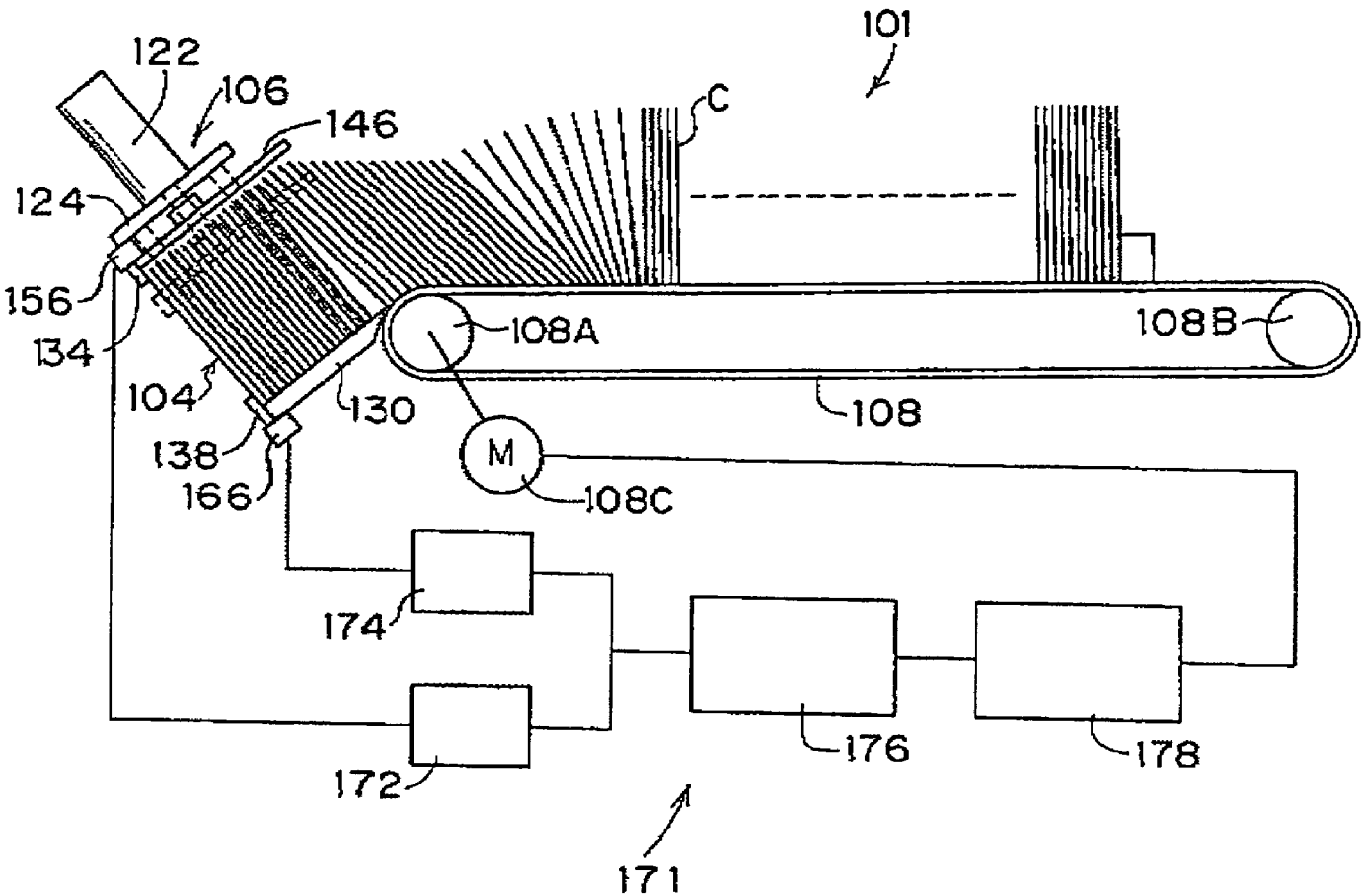
FIG. 27 is a block diagram showing a schematic structure of another example of the carton supplying chute.
Figure 28:
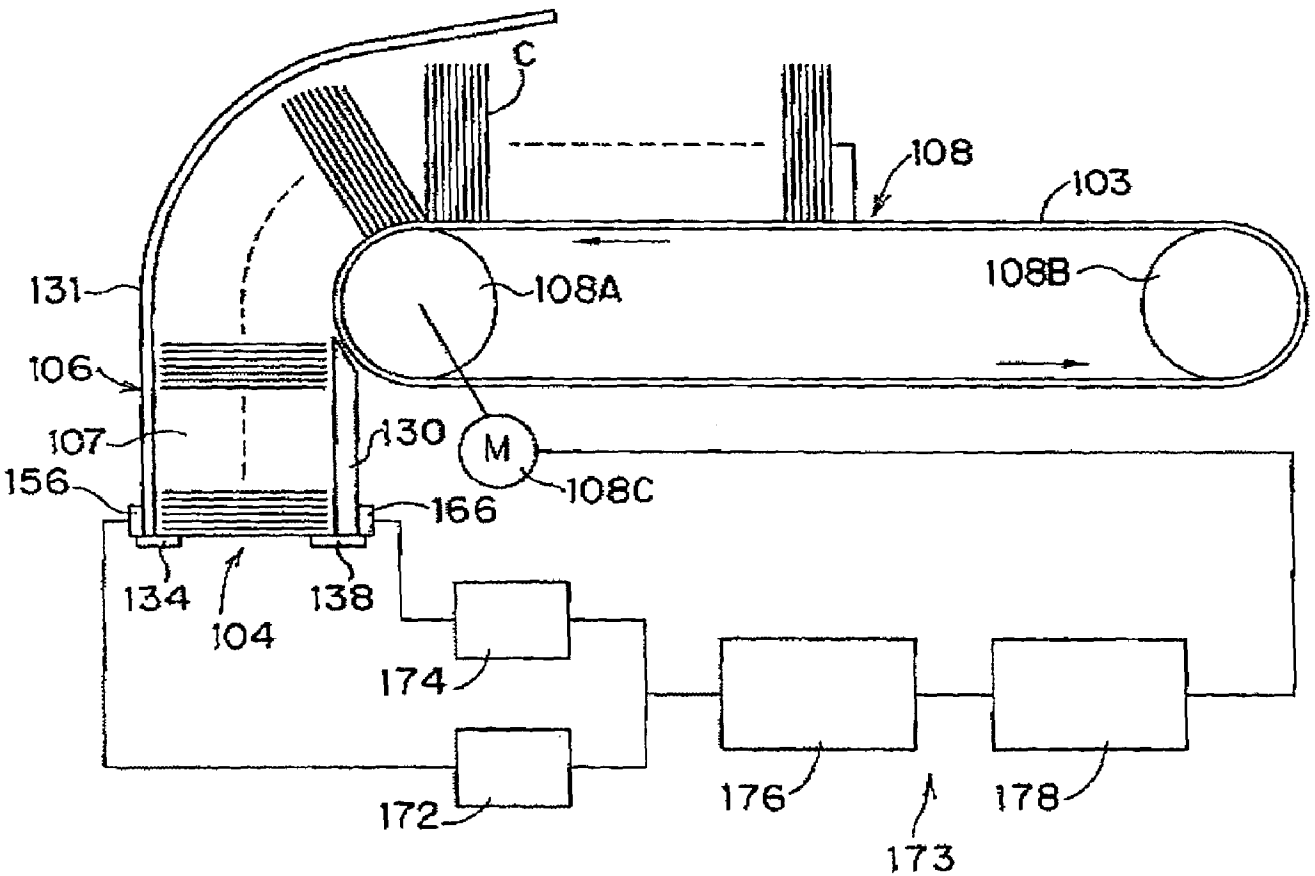
FIG. 28 is a block diagram showing a schematic structure of still another example of the carton supplying chute.

FIGS. 27 and 28 show another example of the carton supplying chute. The same reference numerals in FIGS. 27 and 28 as in FIGS. 17 to 19 indicate the same components as those in those Figures.

The carton supplying chute 101 shown in FIG. 27 is a carton supplying chute according to an aspect in which the auxiliary belt conveyor 118 in the carton supplying chute 100 is omitted and the pickup guide plate 130 is extended up to the vicinity of the drive roller 108A.

A transporting velocity control system 171 is equal to the transporting velocity control system 170 of the carton chute 100 in that it compares the output voltage V1 from the load sensor 156 and the output voltage V2 from the load sensor 166 with the reference voltage V so as to control the sequencer 178 based on a result of the aforementioned comparison. However, this is different from the transporting velocity control system 170 in that when any one of the output voltage V1 and the output voltage V2 is higher than the reference voltage V, the sequencer 178 turns off both the motor 108D and the first clutch 108E in the same manner as when both the output voltage V1 and the output voltage V2 are higher than the reference voltage V.

The carton supplying chute 101 has the same configuration as the carton chute 100 except the above-described points.

In the carton supplying chute 103 shown in FIG. 17, the supplying chute front end portion 106 is formed vertically and the carton pickup port 104 is directed downward. Further, the pickup port guide plate 130 is disposed along the vertical direction from the vicinity of the drive roller 108A toward the carton pickup port 104. Further, a transporting direction conversion guide 131 for guiding the sack carton C transported by the main belt conveyor 108 toward the carton pickup port 104 in the vertical direction is provided so as to oppose the main belt conveyor 108 and the pickup port guide plate 130. The transporting direction conversion guide 131 forms a square rod like vertical duct 107 for guiding the sack carton C downward in the vertical direction with the pickup port guide plate 130 at the supplying chute front end portion 106.

The carton supplying chute 103 has the same configuration as the carton supplying chute except these points.

The transporting velocity control system 173 has the same configuration as the transporting velocity control system 171 included by the carton supplying chute 101 and the sequencer 178 controls the belt conveyor drive unit 108C according to the same sequence.

(B) Carton Supplying Portion

Figure 29:
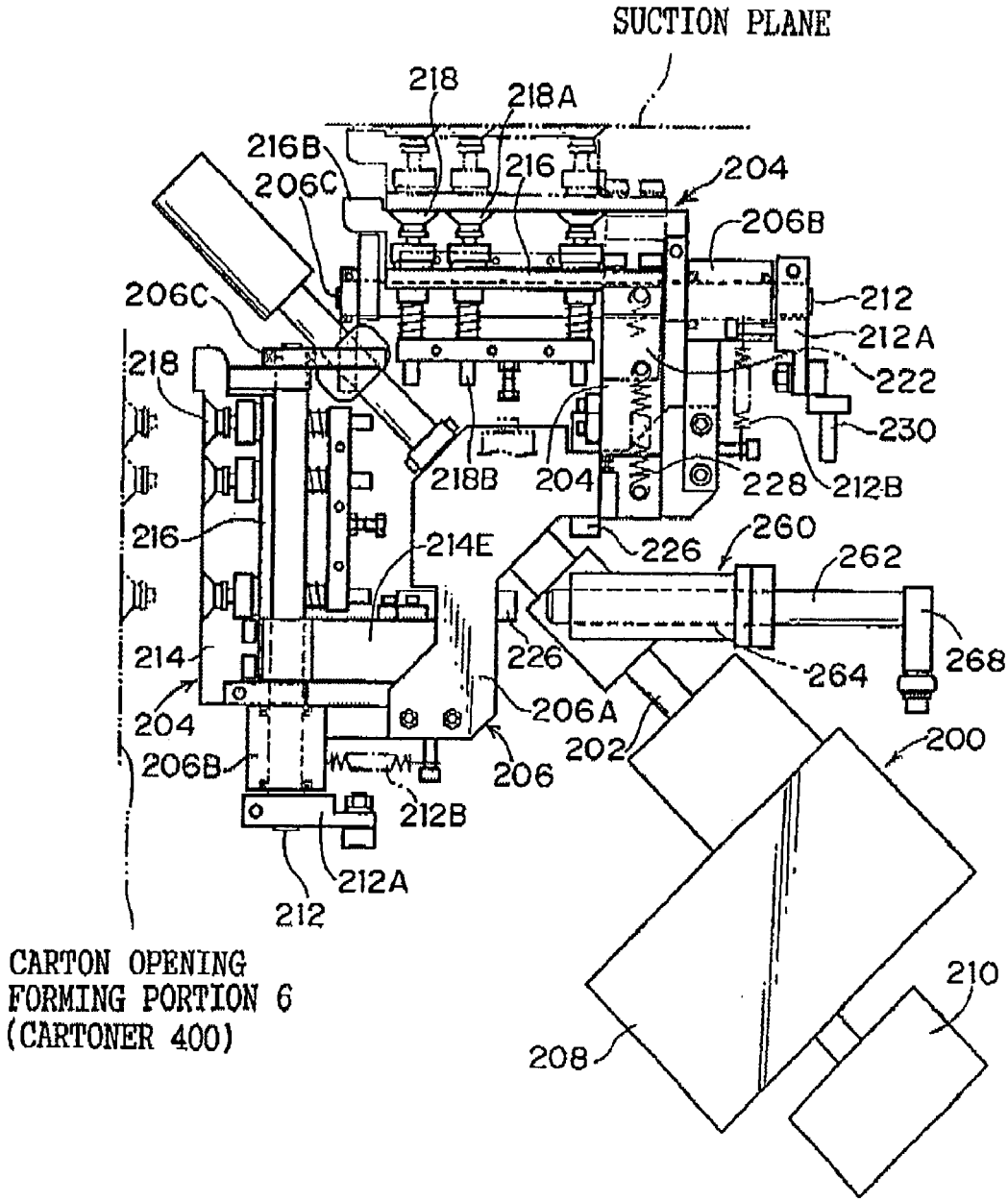
FIG. 29 is a structure diagram showing an entire structure of the carton supplying portion in the carton supplying unit included by the cartoner shown in FIG. 1.

FIG. 29 shows an entire structure of a carton supplying portion 200.

As shown in FIG. 29, the carton supplying portion 200 corresponds to a box body supplying means in the box body supplying apparatus of the invention and comprises a rotation shaft 202 which rises at an angle of 45° relative to a horizontal plane toward the cartoner 400, a pair of suction heads 204 which is provided on a flat plane including the rotation shaft 202 for sucking and holding the sack carton C along a suction plane which is a virtual plane inclined at an angle of 45° relative to the rotation shaft 202, in other words, a virtual plane in a horizontal or vertical direction, and a suction head supporting portion 206 supporting a suction head 204 rotatably around the rotation shaft 202. In the meantime, the aforementioned suction plane is indicated with two-dot chain line in FIG. 29.

An index unit 208 for rotating the rotation shaft 202 intermittently and a motor 210 for supplying the index unit with a rotation force are provided at a root of the rotation shaft 202.

The suction head 204 corresponds to box body holding means included by the box body supplying means of the invention, and the rotation shaft 202, the suction head supporting portion 206, the index unit 208 and the motor 210 correspond to a holding portion moving means included by the box body supplying means.

The suction head 204 is pivoted by a suction head supporting portion 206 on the shaft 212 provided in parallel to the suction plane.

FIGS. 30 to 34 show the detail of the structure of the suction head 204 and its surrounding portion.

The suction head supporting portion 206 comprises a suction head supporting plate 206A fixed on the rotation shaft 202 at its central portion, a pair of first holding member 206B whose end is fixed to both end portions of the suction head supporting plate 206A and a pair of second holding members 206C whose end is fixed to a portion nearer the front end portion than the suction head supporting plate 206A on the rotation shaft 202.

A pair of the shafts 212 are provided and each of them is held at an angle of 45° relative to the rotation shaft 202 by the first holding member 206B and the second holding member 206C.

An end of a crank member 212A is fixed on an end on the side of the first holding member 206B on the shaft 212. A spring 212B for urging the crank member 212A in a direction rotating the shaft 212 so as to turn the suction head 204 upward is provided between the crank member 212A and the first holding member 206B. A crank pushing member 230 for pushing the crank member 212A from downward and rotating the suction head 204 downward is provided adjacent to a bottom portion of the other end portion of the crank member 212A. Unless the crank member 212 is pushed by the crank pushing member 230 as indicated with two-dot chain line in FIG. 34, the suction head 204 is directed upward by an urging force from the spring 212B. On the other hand, if the crank member 212A is pushed by the crank pushing member 230 from downward, the shafi 212 is rotated downward resisting the urging force of the spring 212B as indicated with a solid line in FIG. 34, so that the suction head 204 stops in a condition in which it is inclined at an angle of about 40° relative to a horizontal plane and then opposes the carton pickup port 104 in the carton supplying chute 100.

As shown in FIGS. 30 to 34, the suction head 204 comprises a frame body 214 fixed to the rotation shaft 212 and a group of suction cups 218 and further includes a carton receiving portion 216 which slides along a slide rail 220 to be described later, provided inside the frame body 214 to advance or retract relative to the suction plane.

The frame body 214 comprises side plates 214A, 214B which are fixed on the shaft 212 inside of the portion held by the first holding member 206B and the second holding member 206C for forming a side wall of the frame body 214 and guide plates 214C, 214D which form a ceiling plate and a bottom plate of the frame body 214, are projected from the side plates 214A, 214B forward or in the direction toward the suction plane and guides the sack carton C toward the carton receiving portion 216. Here, the side plate 214A is a side plate adjacent to the first holding member 206B and the side plate 214B is a side plate adjacent to the second holding member 206C.

Figure 30:
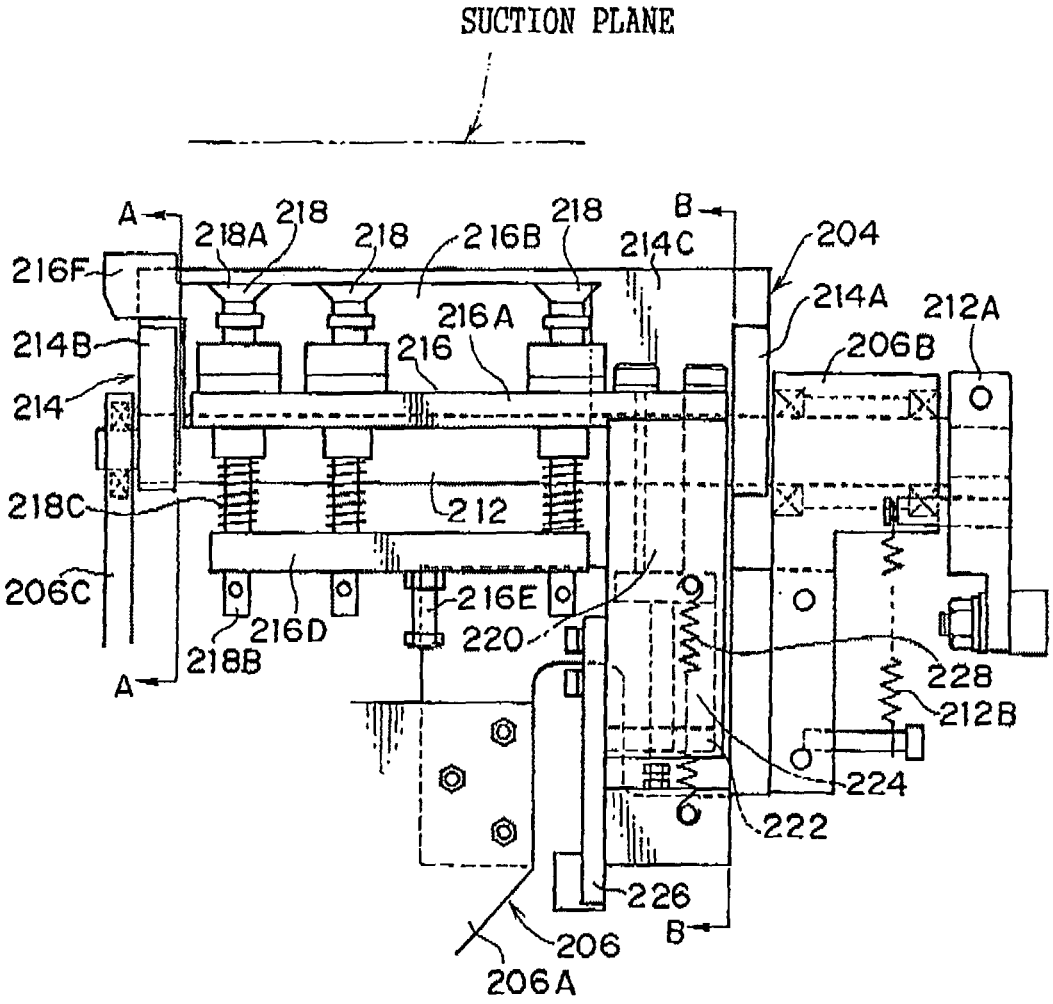
FIG. 30 is an enlarged plan view showing the detail of the structure of a suction head included by the carton supplying portion shown in FIG. 29.
Figure 31:
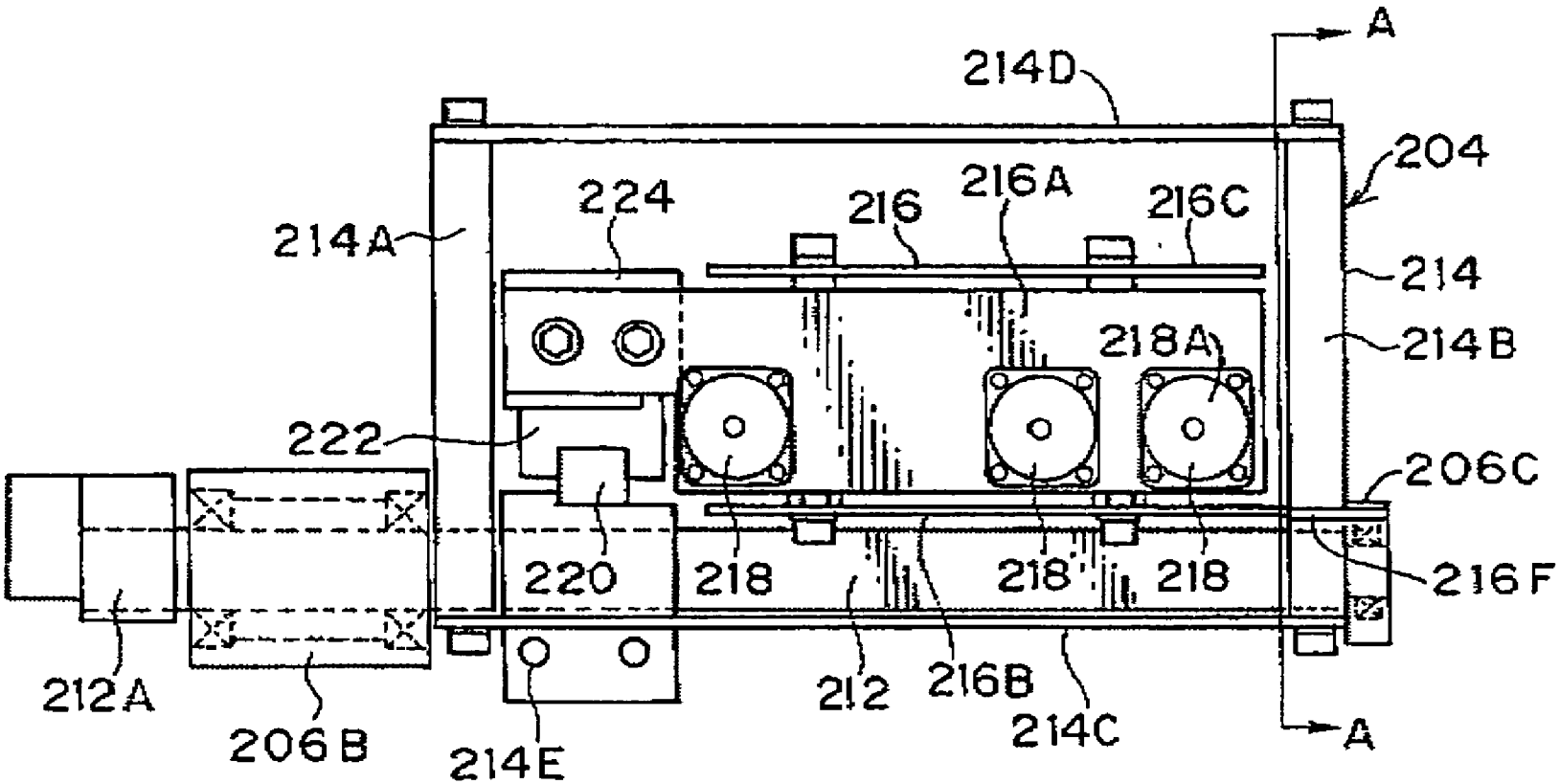
FIG. 31 is an enlarged view of the suction head shown in FIG. 30 seen from a side provided with the suction cup.
Figure 32:
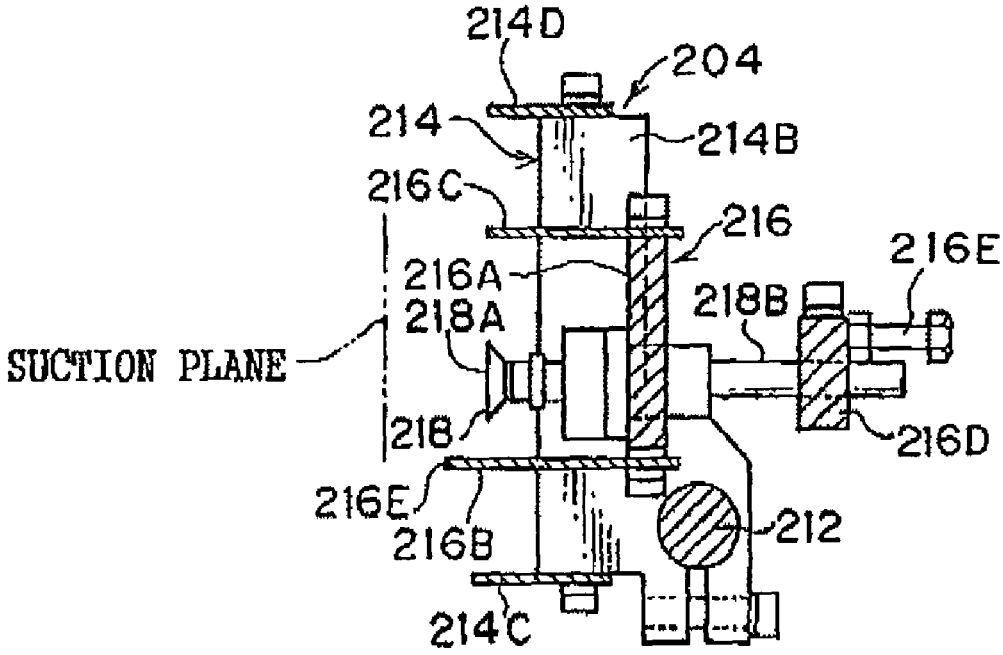
FIG. 32 is a sectional view of the suction head shown in FIG. 30 taken along the line A-A in FIG. 30.
Figure 33:
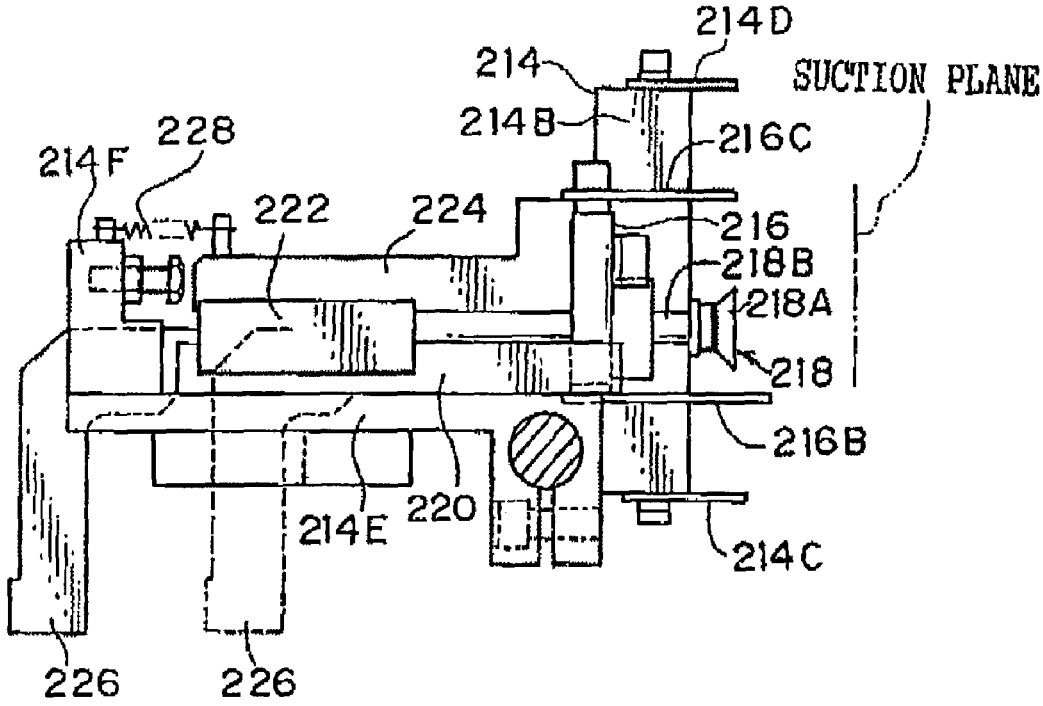
FIG. 33 is a sectional view of the suction head shown in FIG. 30 taken along the line B-B in FIG. 30.

As shown in FIGS. 30, 31 and 33, an end of a slide rail mounting member 214E is fixed on a portion inside of the frame body 214 on the shaft 212 such that it is extended in parallel to the side plates 214A and 214B and in a direction parting from the suction plane. A slide rail 220 for guiding the carton receiving portion 216 in the advancement/retraction direction in cooperation with a slide guide member 222, which will be described later, is fixed on a top face of the slide rail mounting member 214E. A slide guide receiver 214F for receiving the slide guide member 222 from backward is fixed on the other end of the slide rail mounting member 214E.

As shown in FIGS. 30 to 34, the carton receiving portion 216 comprises a group of the suction cups 218 for sucking and holding the sack carton C at an end thereof, a suction cup mounting plate 216A which is provided in parallel to the shaft 1212F or holding the suction cup 218 slidably in the advancement/retraction direction, guide plates 216B, 216C which are provided on upper and lower edges of the suction cup mounting plate 216A and projected forward and a suction cup pressing member 216D which is fixed on the other end portion of the suction cup 218 and pressed forward by a first suction cup receiving drive unit 240 to be described later so as to advance or retract the carton receiving portion 216 and the suction cup 218. A pressing pin 216E for receiving a pressing force from the suction cup receiving drive unit 240 is projected from the central portion of the cup pressing member 216D.

In the suction cup 218, a trumpet like cup portion 218A for sucking and holding the sack carton C is formed at an end thereof and a tubular portion 218B extending from the cup portion 218A to the other end is formed at the other end. Further, a spring 218C for urging the suction cup 218 backward is mounted between the suction cup mounting plate 216A and the suction cup pressing member 216D in the suction cup 218.

As shown in FIGS. 30 to 34, an end of a slide guide connecting member 224 which connects the carton receiving portion 216 with the slide guide 222 is coupled to a portion adjacent to a group of the suction cups 218 on a face opposite to a side in which the cup portion 218A is open of the suction cup mounting plate 216A. The other end portion of the slide guide member 224 is fixed to the slide guide 222 and coupled to the pressing portion 226. The pressing portion 226 is projected to an opposite direction to the side in which the slide rail 220 of the slide rail mounting member 214E is fixed and advances or retracts the carton receiving portion 216 by receiving a pressing force from a suction cup mounting drive unit 260, which will be described later.

A spring 228 for urging the carton receiving portion 216 in a direction parting from the suction plane is provided between the rear end portion of the slide guide member 224 and the slide guide receiver 214F.

A projecting portion 216F projecting forward is formed on an opposite side of the slide guide member 224 across the suction cup 218 in the guide plate 216B.

Figure 35:
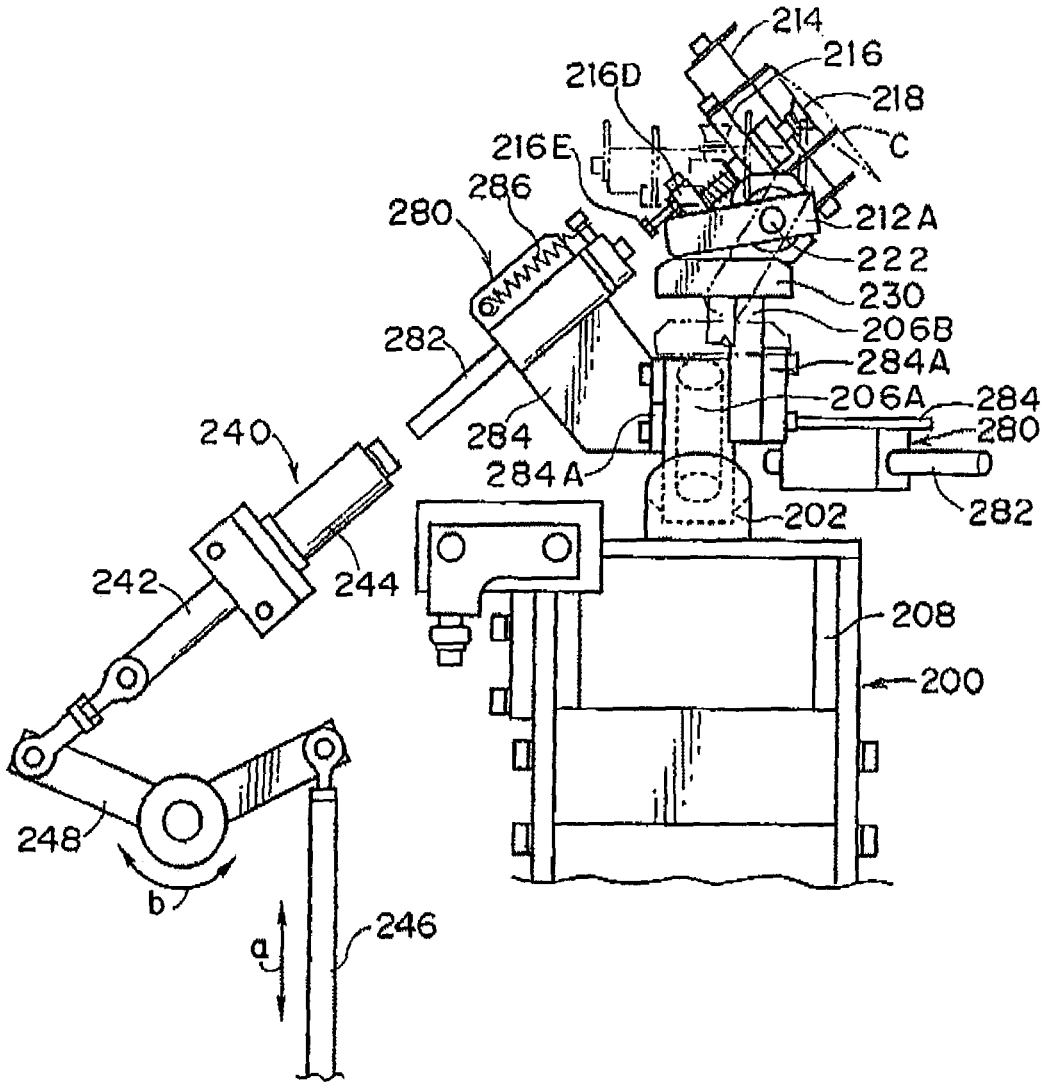
FIG. 35 is a schematic diagram showing a positional relation between a suction cup receiving drive unit and a suction head when the suction head included by the carton loading unit shown in FIG. 29 is located at a carton receiving position opposing a suction pickup port of the suction supplying shoot.
Figure 36:
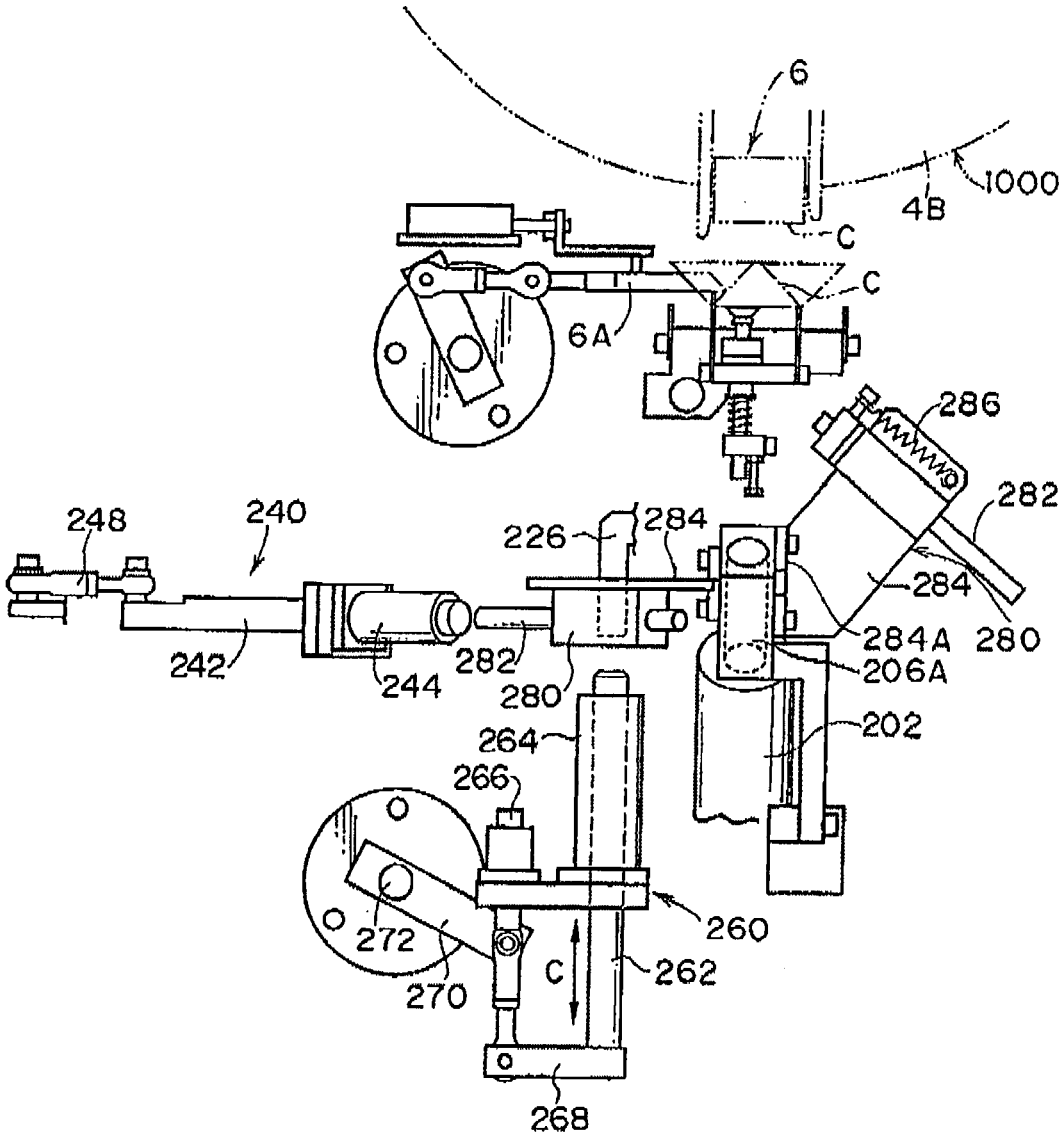
FIG. 36 is a schematic diagram showing a positional relation between the suction cup mounting drive unit and suction head when the suction head is located at the carton mounting position opposing an opening forming portion in the cartoner shown in FIG. 1.

As shown in FIGS. 29, 35 and 36, a suction cup receiving drive unit 240 and a suction cup mounting drive unit 260 for advancing or retracting the suction head 204 are provided adjacent to the rotation shaft 202 and the index unit 208. When the suction head 204 is located at a carton receiving position opposing the carton pickup port 104 of the carton supplying chute 100 as shown in FIG. 35, the suction cup receiving drive unit 240 advances or retracts the suction head 204. On the other hand, when the suction head 204 is located at a carton mounting position opposing the carton opening forming portion 6 in the cartoner 400 as shown in FIGS. 29 and 36, the suction cup mounting drive unit 260 advances or retracts the suction head 204.

As shown in FIGS. 35 and 36, when the suction head 204 is located at a carton receiving position, a receiving drive force transmission unit 280 for transmitting a pressing force from the suction cup receiving drive unit 240 to the pressing pin 216E of the suction cup pressing member 216D is provided on each of both faces of the suction head supporting plates 206A.

The receiving drive force transmission unit 280 comprises a pressing rod 282 which presses the pressing pin 216E of the suction head 204 toward the carton pickup port 104 with a pressing force from the suction cup receiving drive unit 240, a pressing rod supporting member 284 having a leg portion 284A fixed to the suction head supporting plate 206A and for supporting the pressing rod 282 slidably relative to the pressing pin 216E and a spring 286 for urging the pressing rod 282 in a direction parting from the pressing pin 216E.

The suction cup receiving drive unit 240 comprises a receiving drive rod 242 for pressing the pressing pin 216E through the pressing rod 282, a receiving drive rod supporting member 244 for supporting the receiving drive rod 242 slidably along the axial direction at an angle inclined at 40° upward from a horizontal plane, a reciprocating rod 246 for reciprocating vertically as indicated with an arrow a in FIG. 35 and a bell crank mechanism 248 which is swung as indicated with an arrow b in the same Figure for transmitting a motion of the reciprocating rod 246 to the receiving drive rod 242.

As shown in FIG. 36, the suction cup mounting drive unit 260 comprises a main drive rod 262 which reciprocates, a drive rod supporting member 264 for supporting the main drive rod 262 reciprocatingly, an auxiliary drive rod 266 which is provided in parallel to the main drive rod 262 and reciprocates integrally with the main drive rod 262, a linking member 268 for linking the main drive rod 262 with the auxiliary drive rod 266 at the end portion and a drive crank 270 which is connected rotatably to the auxiliary drive rod 266 and reciprocates the auxiliary drive rod 266 around the rotation shaft 272.

In the suction cup mounting drive unit 260, the swing motion of the drive crank 270 is converted to a reciprocating motion indicated with an arrow c in FIG. 36 by the auxiliary drive rod 266. The reciprocating motion of the auxiliary drive rod 266 is transmitted to the main drive rod 262 through the linking member 268 so that the main drive rod 262 reciprocates with the auxiliary drive rod 266. Consequently, the main drive rod 262 presses the pressing portion 226 forward at a predetermined cycle so as to bring the suction head 204 near the carton opening forming portion 6.

(C) Operation

If a predetermined quantity of the sack cartons C are accommodated in the carton supplying chute 100 and the main belt conveyor 108 is driven, the sack carton C is moved to the supplying chute front end portion 106.

In the supplying chute front end portion 106, the sack carton C tries to be moved further toward the carton pickup port 104 by the auxiliary belt conveyor 118. Therefore, at the carton pickup port 104, the sack carton C is pressed by the upper pawls 134, 136 and the lower pawls 138, 140 so that a pressure along the direction of picking out the sack carton C is applied to the upper pawls 134, 136 and the lower pawls 138, 140. The aforementioned pressure is detected by the load sensors 156, 166 and then, the feedings of the main belt conveyor 108 and the auxiliary belt conveyor 118 are controlled by the transporting velocity control system 170 so that the aforementioned pressure is below a predetermined value.

Since as shown in FIGS. 29, 34 to 36, a pair of the suction heads 204 included by the carton supplying portion 200 are disposed symmetrically across the rotation shaft 202, when one is located at a carton receiving preparation position directed upward, the other one is located at the carton mounting position.

Figure 34:
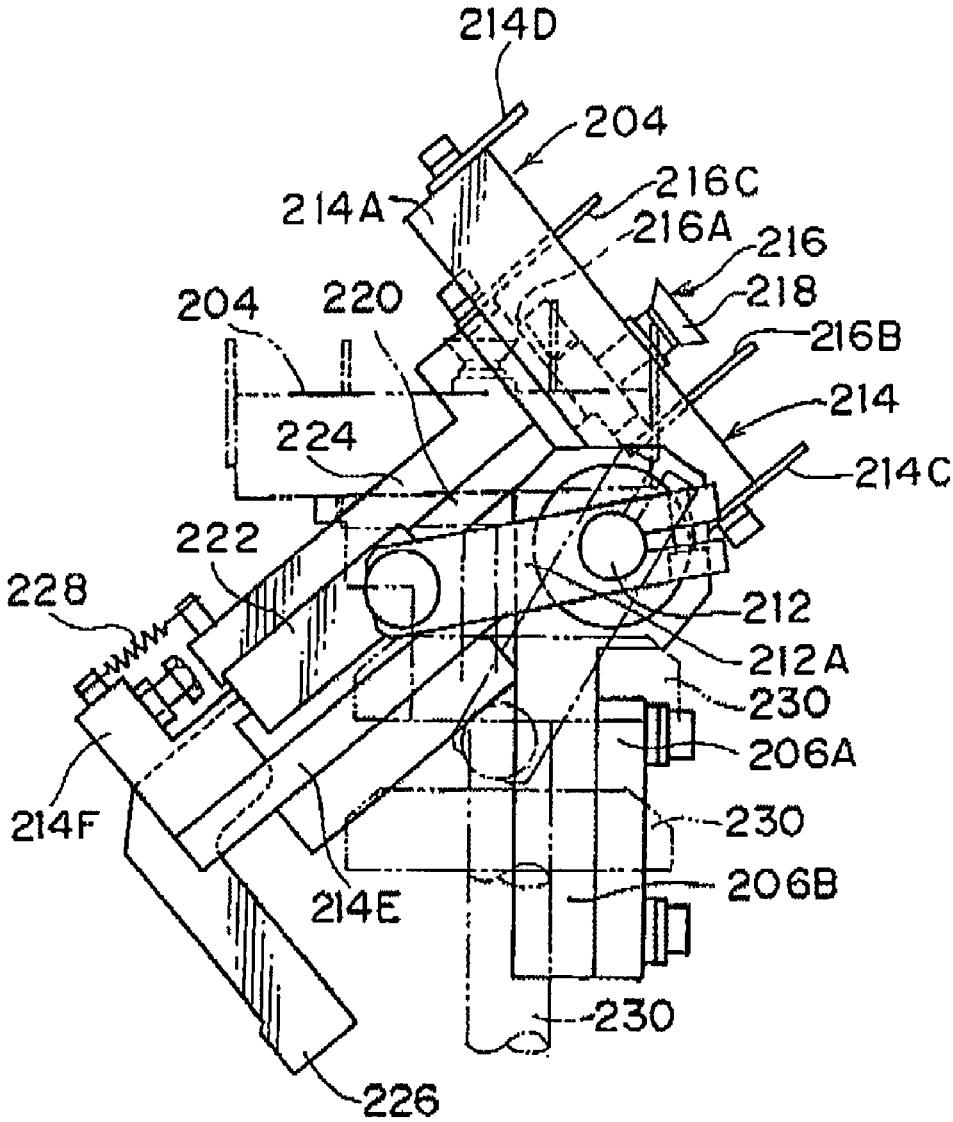
FIG. 34 is a side view showing a condition in which the suction head shown in FIG. 30 is rotated around a rotation axis.

If the crank pushing member 230 rises and pushes the crank member 212A included by the suction head 204, the suction head 204 is moved from the carton receiving preparation position to a carton receiving position opposing the carton pickup port 104 as shown in FIG. 34.

If the suction head 204 is located at the above-described carton receiving position, the receiving drive rod 242 in the suction cup receiving drive unit 240 is projected toward the suction head 204 as shown in FIG. 35 so that the pressing pin 216E of the carton receiving portion 216 included by the suction head 204 is pressed through the pressing rod 282. Consequently, the carton receiving portion 216 is pushed out to the carton pickup port 104 and then, the cup portion 218A of the suction cup 218 provided on the carton receiving portion 216 is sucked to a side face of the sack carton C on a forward side of the carton receiving portion 216 (hereinafter referred to as "forward side").

Figure 37A:
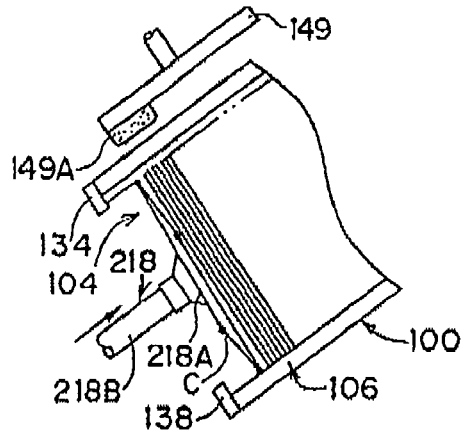
FIGS. 37A through 37D are flow charts showing an operation of the suction cup and sack carton in the vicinity of a carton pickup port when the carton is received.
Figure 37B:
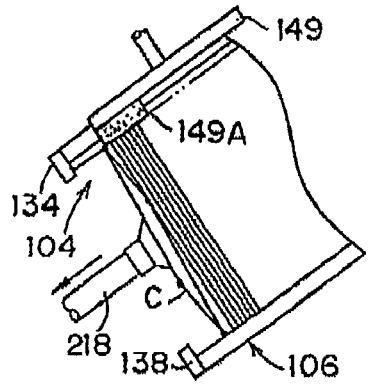

After the sack carton C is sucked by the suction cup 218, the receiving drive unit 240 presses the carton receiving portion 216 inward of the supplying chute front end portion 106 as shown in FIG. 37A.

If the carton receiving portion 216 is pressed, the sack carton C is pressed into the inside of the supplying chute 100.

With this condition, the carton arranging plate 149 is descended to the sack carton C by the actuator 152. Consequently, the second or third and following sack cartons C from the most forward side are pressed and held by the rubber plate 149A of the carton arranging plate 149. If the heights of the top edges of the sack cartons C are not in line, the heights of the top edges of the sack cartons C can be arranged by pressing the top edges of the sack cartons C by means of the carton arranging plate 149.

Figure 37C:
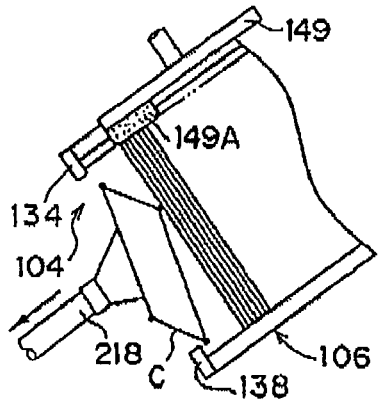
Figure 37D:
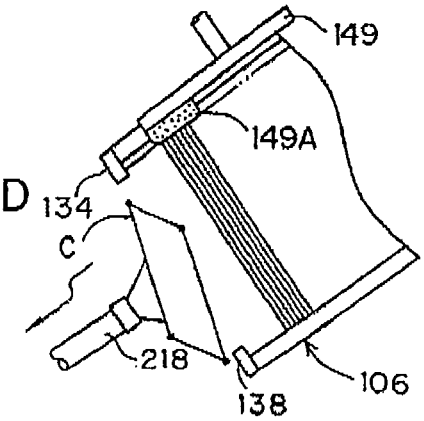

If the sack carton C is pressed and held by the carton arranging plate 149, the receiving drive rod 242 is moved in a direction leaving the suction head 204 and then, as shown in FIG. 37C, the carton receiving portion 216 is departed from the carton pickup port 104 by an urging force from the spring 228. Since the carton receiving portion 216 leaves the carton pickup port 104 drawing a S-shaped trajectory when viewed from a side as shown in FIG. 37D, the sack carton C on the most forward side is taken out of the carton pickup port 104 with a condition that an opening is formed halfway.

An operation of the carton receiving portion when taking out the sack carton C will be described further.

Figure 38:
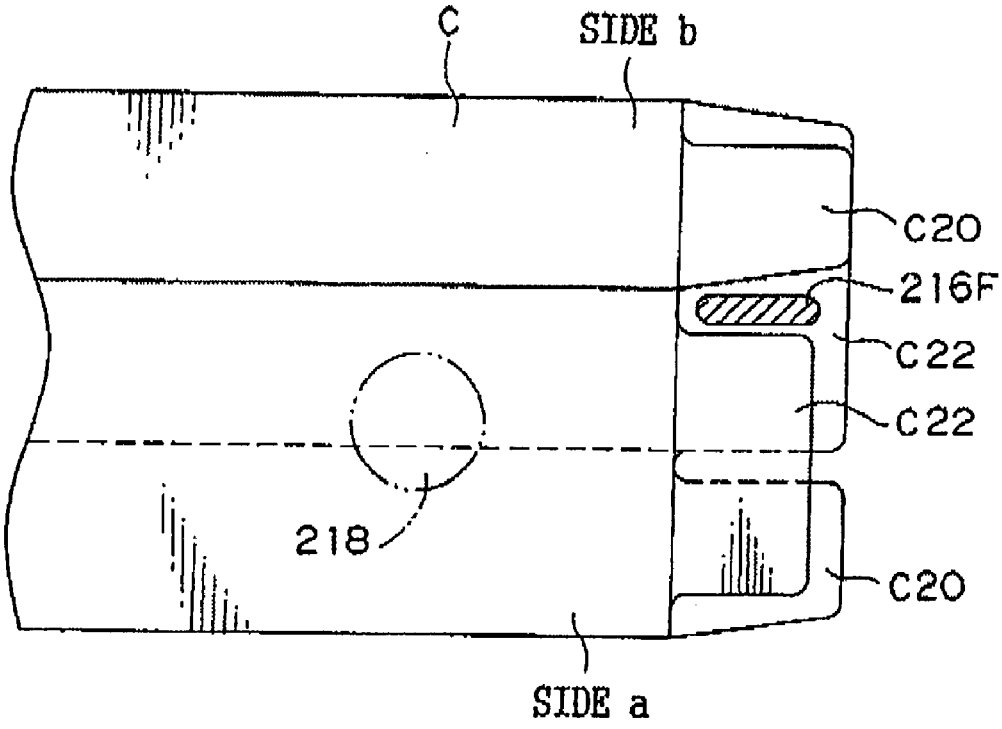
FIG. 38 is a schematic plan view showing a positional relation among a projecting portion provided in a guide plate of the carton receiving portion, an inside flap of the sack carton and an outside flap thereof when the carton receiving portion included by the suction head approaches the sack carton located at the carton pickup port.
Figure 39A:
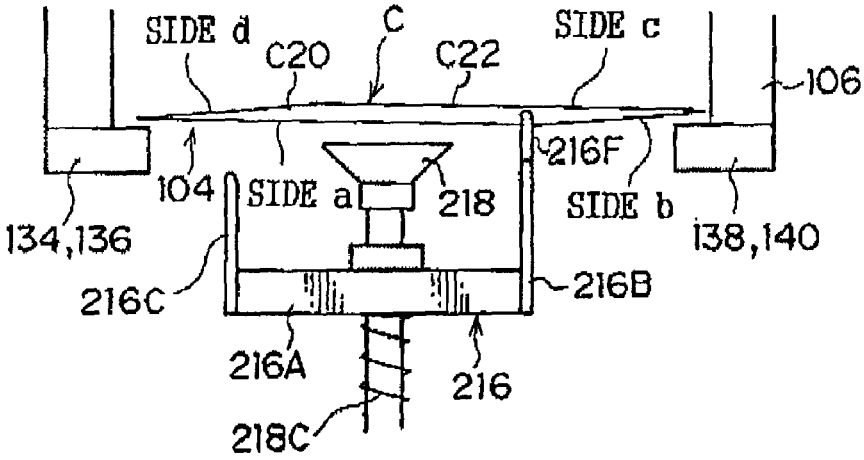
FIGS. 39A through 39C are flow charts showing a positional relation among the carton receiving portion, the suction cup and the projecting portion in a period in which the carton receiving portion approaches the carton pickup port, sucks the sack carton at the carton pickup port and departs from the carton pickup port.

Since a projecting portion 216F is formed at a front end of the guide plate 216B provided on the carton receiving portion 216, if the carton receiving portion 216 approaches the sack carton C, first, the projecting portion 216F is brought into contact with the sack carton C as shown in FIGS. 39A and 38. Here, the projecting portion 216F is provided corresponding to a position at a gap between the outside flap C22 provided on a side face a which is a side face which the suction cup 218 of the sack carton C is sucked and the inside flap C20 provided on a side face b adjacent to the side face a. Therefore, the projecting portion 216F passes through a gap between the outside flap C22 and the inside flap C20 and abuts on the outside flap C22 provided on a side face c opposing the side face a.

Figure 39B:
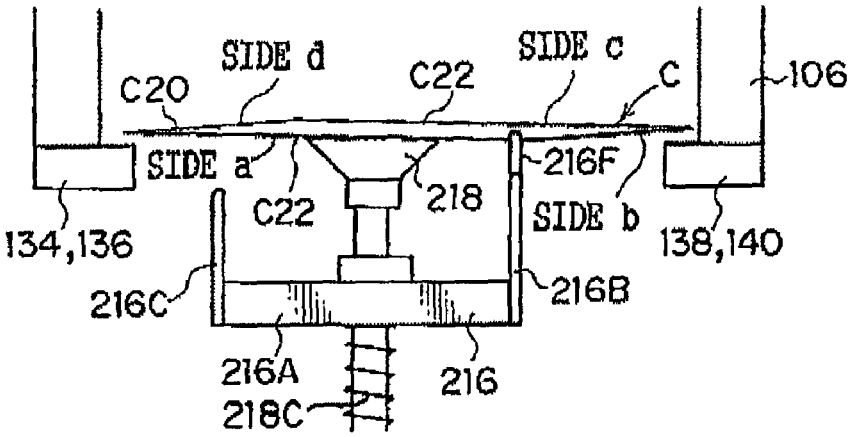

If the projecting portion 216F abuts on the outside flap C22, the carton receiving portion 216 advances from the above-described condition to inside of the supplying chute front end portion 106 and presses the sack carton C into the inside of the supplying chute front end portion 106. When the sack carton C is pressed into the inside of the supplying chute front end portion 106 by a predetermined amount, the sack carton C is pressed and held by the carton arranging plate 149 as described above. Consequently, the carton receiving portion 216 cannot advance further. Therefore, as shown in FIG. 39B, only the suction cup 218 projects from the suction cup mounting plate 216A and advances and then adheres to the side face a of the sack carton C by suction.

Figure 39C:
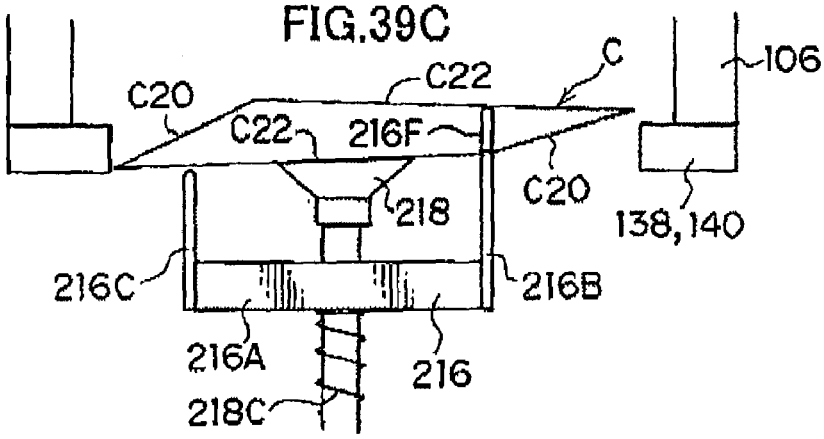

If the suction cup 218 adheres to the side face a of the sack carton C by suction, the suction cup 218 is retracted by an urging force from the spring 218C while adhering to the sack carton C as shown in FIG. 39C. Therefore, the side face a is pulled by the suction cup 218 and moved toward the suction cup mounting plate 216A, so that it abuts on edges of the guide plates 216B and 216C. When the side face a abuts to the edges of the guide plates 216B, 216C, the outside flap C22 abuts on a front end of the projecting portion 216F. Here, since the projecting portion 216F is projected from the edges of the guide plates 216B, 216C, the outside flap C22 moves in a direction leaving the side face a and therefore, the side face c adjacent to the outside flap C22 moves in a direction leaving the side face a. Consequently, a gap is formed between the side face a and the side face c, so that a slight opening is formed in the sack carton C.

By bringing the carton receiving portion 216 apart from the carton pickup port 104, the sack carton C can be taken out of the carton pickup port 104 with a condition that a slight opening is formed as shown in FIG. 39C.

Figure 40:
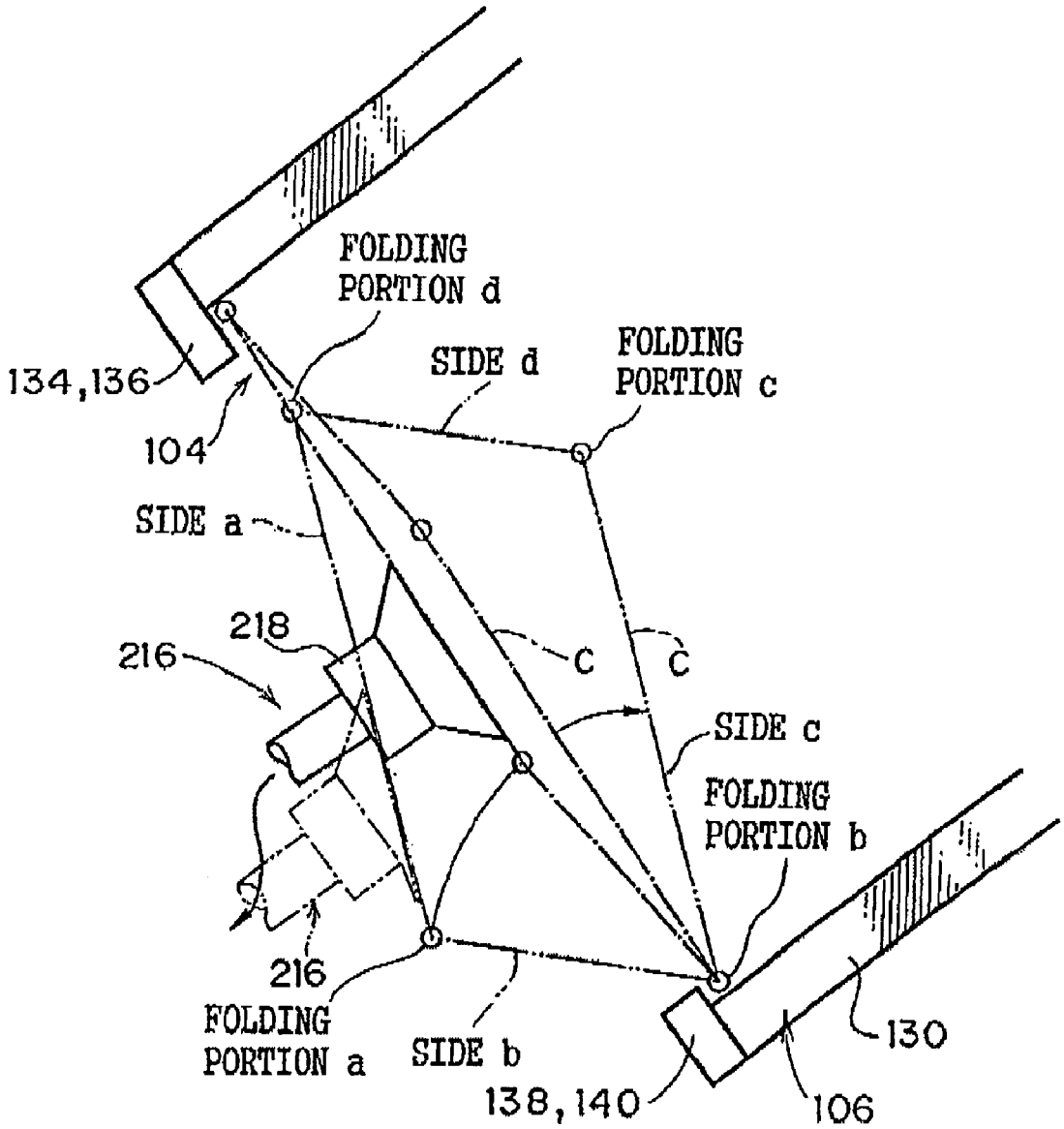
FIG. 40 is an enlarged view showing an action of the suction cup and an action of the sack carton accompanying it when the carton receiving portion departs from the carton pickup port.

FIG. 40 shows the details of an action of the suction cup 218 when the carton receiving portion 216 leaves the carton pickup port 104 and an action of the sack carton C accompanying this. Referring to FIG. 40, a solid line indicates the position of the suction cup 218 when it adheres to the sack carton C by suction while a two-dot chain line indicates the position of the suction cup 218 when the carton receiving portion 216 leaves the carton pickup port 104.

As shown in FIG. 40, the suction cup 218 keeps the sack carton C open while drawing a substantially S-shaped trajectory at a side view after it adheres to the sack carton C by suction and after that, moves linearly in a direction leaving the suction pickup port 104.

Therefore, the side face a moves toward the forward side, that is, downward to the left in FIG. 40 and at the same time, moves downward. Thus, a folding portion a located between the side face a and the side face b moves downward and toward the forward side like the side face a. Then, a folding portion d which opposes the folding portion a forming a top edge of the sack carton C moves downward. On the other hand, a folding portion b which is located between the side face b and the side face c forming a bottom edge of the sack carton C cannot move downward because it abuts the pickup port guide plate 130. Thus, as indicated with arrows, the side face b rotates to the forward side around the folding portion b and the side face c rotates to an opposite side, that is, upward to the right in FIG. 40. Therefore, since the side face a and the side face c move in directions of leaving each other, an opening is formed in the sack carton C halfway and the top edge escapes from the upper pawls 134, 136. By bringing the suction cup 218 apart from the carton pickup port 104 further from this condition, the suction cup C can be taken out without any firm contact with the upper pawls 134, 136 and the lower pawls 138, 140.

If the sack carton C is taken out of the carton pickup port 104, the crank pushing member 230 descends and then, the crank member 212 is rotated counterclockwise by an urging force from the spring 212B as indicated with two-dot chain line in FIGS. 34 and 35 and is returned to a position before the carton is received. Therefore, the suction head 204 is directed upward again and returned to the carton receiving preparation position.

If the shaft 202 is rotated by 180° from this condition, the suction head 204 moves from the carton receiving preparation position to the carton mounting position.

As shown in FIG. 36, in the carton mounting position, the pressing portion 226 of the suction head 204 moves to a position opposing the front end of the main drive rod 262 in the suction cup mounting drive unit 260.

Therefore, if the suction cup mounting drive unit 260 is actuated and the main drive rod 262 presses the pressing portion 226 toward the carton opening forming portion 6 of the cartoner 400, the carton receiving portion 216 is moved toward the carton opening forming portion 6 through the slide guide connecting member 224 fixed on the pressing portion 226. Here, because in the carton receiving portion 216, the cartoner C adheres to the suction cup 218 by suction, the cartoner C is mounted on the carton opening forming portion 6 after an opening is formed by the opening forming unit 6A halfway.

1-3 Characteristic of the Cartoner and Carton Supplying Unit According to a First Embodiment In the carton supplying unit 2, the sack carton C is accommodated in the carton supplying chute 100 such that it is located sideway of the flap portions C12, C14. Therefore, even a carton having a large header at its one end portion or an elongated carton can be loaded easily. Further, even if a carton, in which the flap portions C12, C14 have an overlapping portion and a non-overlapping portion in a folding condition and there is a difference in thickness between the folding portion a and the folding portion d, is loaded, the sack carton C is held on the carton pickup port 104 at right angle to the pickup direction. Consequently, the sack carton C is taken out stably.

Further, the sack carton C is taken out stably because the main belt conveyor 108 and the auxiliary belt conveyor 118 are controlled so that pressure applied to the upper pawls 134, 136 and the lower pawls 138, 140 are within a predetermined range.

Further, because as described above, when the sack carton C is taken out, the second, third and following cartons from the most forward side are pressed by the carton arranging plate 149 and the sack carton C is taken out with a slight opening formed, the sack carton C is prevented from making into firm contact with the upper pawls 134, 136 and the lower pawls 138, 140 thereby protecting from a damage. Further, even if an old carton or a warped carton is loaded, the sack carton C is taken out smoothly.

Further, because the carton supplying unit 2 has not only the main conveyor 108 but also the auxiliary conveyor 118, cartons each having a different thickness can be fed to the carton pickup port 1104 Stably.

Additionally, because in the carton supplying portion 200, one of a pair of the suction heads is located at the carton receiving preparation position relative to an axis inclined at 45° with respect to a horizontal plane while the other one is fixed at the carton mounting position line symmetrically to the former, reception of a carton from the carton supplying chute 100 and supply of the carton to the cartoner 400 can be carried out in parallel.

Further, because the opening is formed in the carton halfway when the sack carton C is taken out, no failure occurs in the carton opening forming portion 6 of the cartoner 400.

Because the cartoner 400 utilizes the carton supplying unit 2 in order to supply the cartons and the rotation table 4 for holding the sack carton C is made of a pair of index table 4A and index table 4B which are formed so as to be capable of approaching or leaving, it can cope with various shapes and lengths of the sack cartons flexibly.

Further, because the carton supplying unit 2, the carton opening forming portion 6, the plastic case-packed product packing portion 8, the upper lid constructing portion 10, the bottom lid constructing portion 12 and the carton discharging portion 14 are disposed around the rotation table 4, the entire apparatus can be constructed in a compact fashion.

Additionally, because the sack carton C is supplied to the carton opening forming portion 6 with one of opening portions of both the ends facing upward and the other one facing downward and after the opening is formed with this condition, the plastic case packed product is loaded through the opening portion facing upward without changing the posture of the sack carton C, the boxing and packaging can be carried out efficiently.

A Second Embodiment

Figure 41:
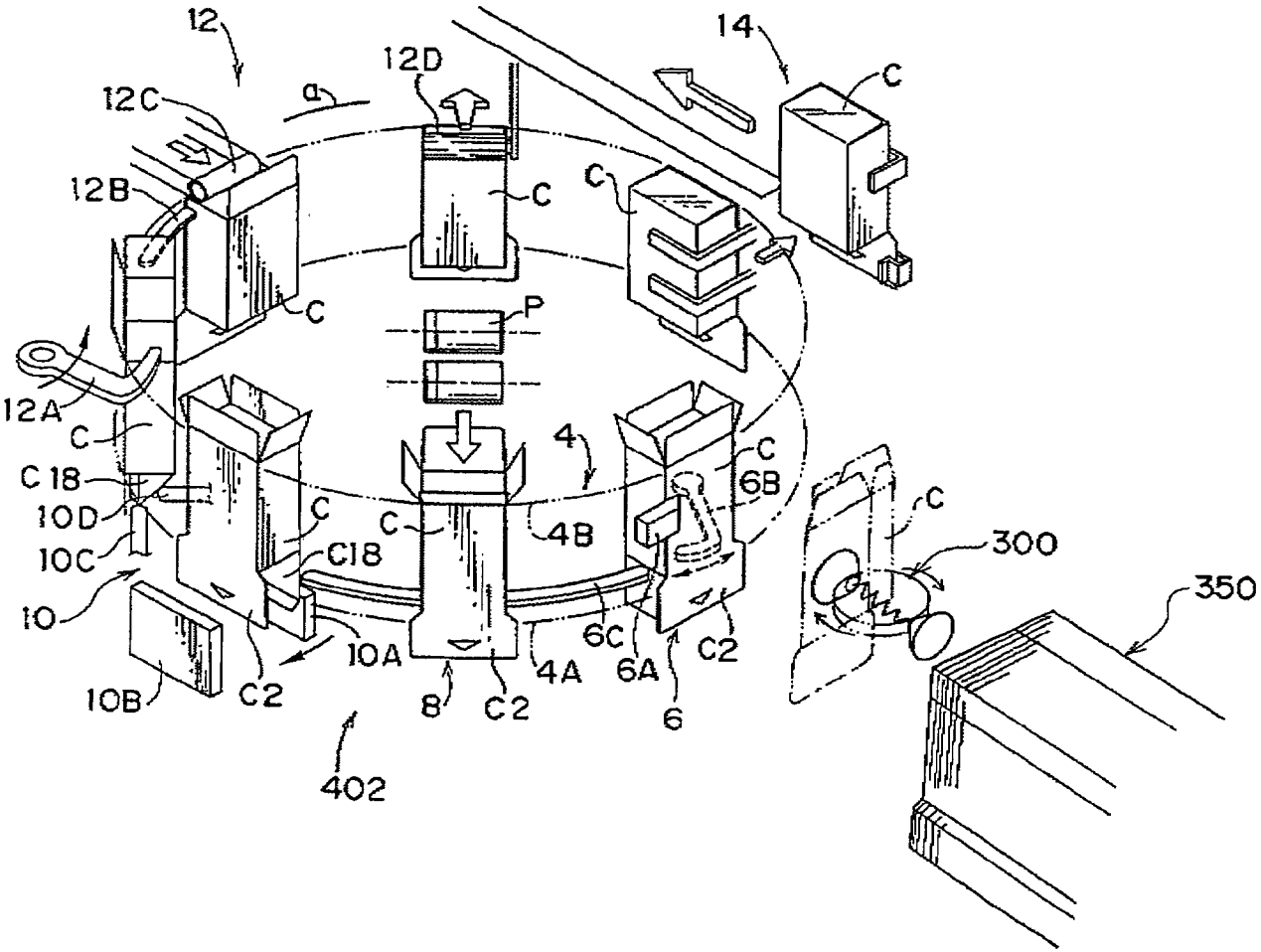
FIG. 41 is a perspective view showing a schematic structure of an example of the cartoner including the carton supplying unit according to a Second Embodiment.
Figure 42:
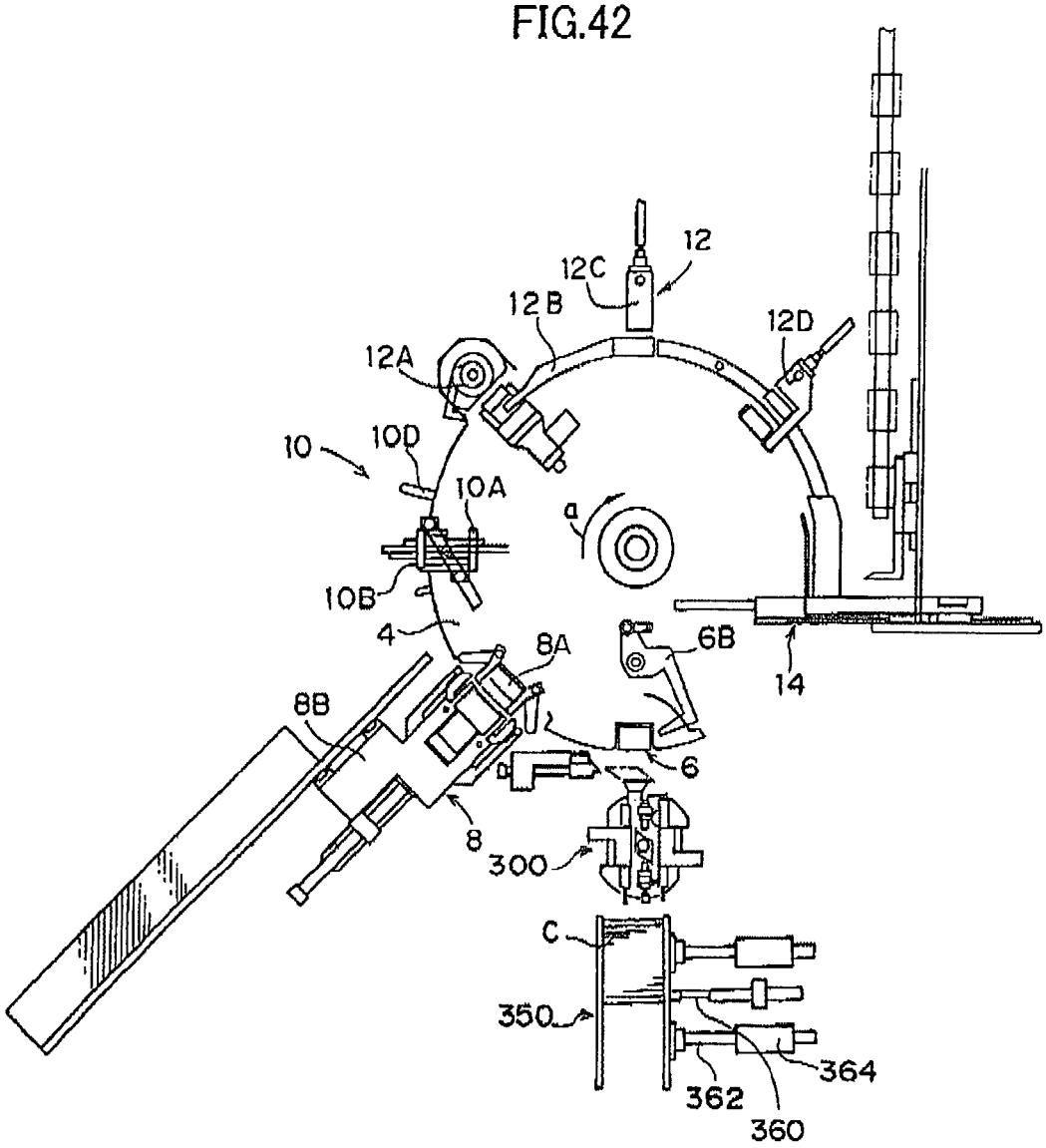
FIG. 42 is a schematic plan view of the cartoner shown in FIG. 41.

Another example of a cartoner included in the boxing apparatus related to the present invention is shown in FIGS. 41 and 42.

A cartoner 402 related to the second embodiment is an example of a cartoner incorporating a sack carton holding unit 350 and a sack carton pick-up and supplying unit 300 in place of the carton supplying chute 100 and the carton supplying portion 200 in the cartoner 400 related to the first embodiment. As shown in FIGS. 41 and 42, the cartoner 402 has the rotating table 4, the carton opening forming portion 6, the plastic case-packed product packing portion 8, the upper lid constructing portion 10, the bottom lid constructing portion 12 and the carton discharging portion 14, all of which are the same as those incorporated in the cartoner 400 of the first embodiment.

Figure 43:
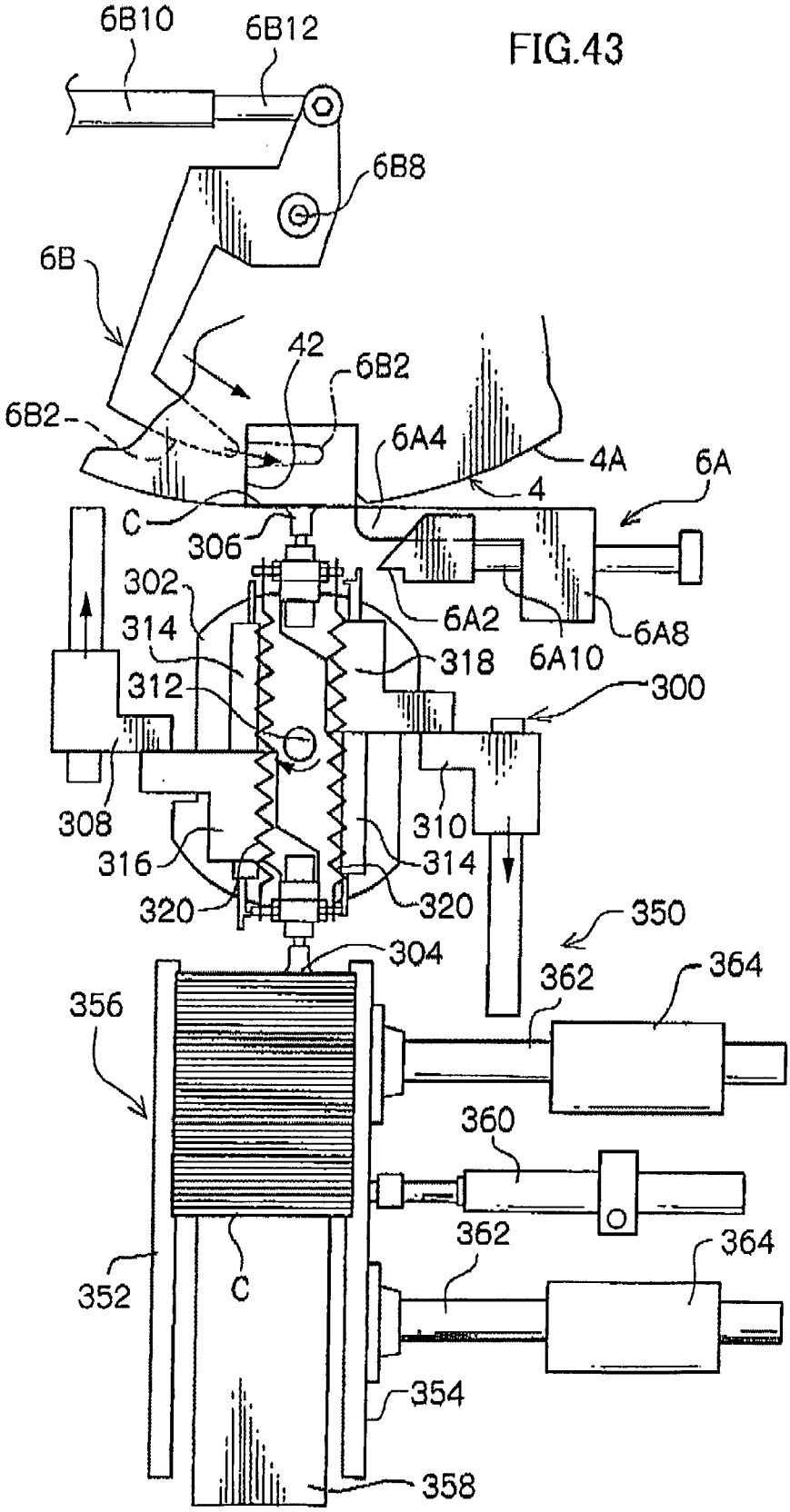
FIG. 43 is a plan view showing the detail of the carton supplying shoot and carton supplying portion included by the cartoner shown in FIG. 41.

As shown in FIG. 43, the sack carton holding unit 350 is disposed so as to face the rotating table 4. The sack carton holding unit 350 comprises a stocker 356 having a pair of guide plates 352 and 354 disposed laterally, a bottom guide plate 358 that is provided between the guide plates 352 and 354 so as to provide a bottom of the stocker 356 and to be adjustable of its height, an air cylinder 360 moving the guide plate 354 so as to approach or part from the guide plate 352, a pair of guide rods 362 guiding the guide plate 354 when moving the guide plate 354 by the air cylinder 360 and a pair of rod holding members 364 holding the guide rods 362 slidably.

In the sack carton holding unit 350, folded sack cartons C are stored in the stocker 356. Then, the height of the bottom guide 358 is adjusted in accordance with the height of the sack cartons C. At the same time, a piston of the air cylinder 360 is expanded or contracted in accordance with the width of the sack cartons C to move the guide plate 354 so as to change the width and height dimensions of the stocker 356. Thus, the width and height dimensions of the stocker 356 can be adjusted in accordance with a sack carton C having a different height or lateral dimension.

As shown in FIGS. 41 to 43, the sack carton pick-up and supplying unit 300 is disposed between the index table 4A(4B) and the sack carton holding unit 350. The sack carton pick-up and supplying unit 300 functions to pick up the sack carton C folded and stored in the stocker 356 and set the picked up sack carton C to the carton setting portion 42 of the index tables 4A and 4B.

The sack carton pick-up and supplying unit 300 has a rotating table 302, suction cups 304 and 306 that are mounted on the rotating table 302. The suction cups 304 and 306 are disposed on the rotating table 302 with an axis 312 of the rotating table 302 between them. The rotating table 302 rotates intermittently around the axis 312 by 180 degrees so that one of the suction cups 304 and 306 faces the carton setting portion 42 of the index table 4A and the other faces the stocker 356.

The suction cups 304 and 306 are fixed on sliders 316 and 318, respectively, the sliders 316 and 318 sliding on a linear guide 314 fixed on the rotating table 302. The suction cups 304 and 306 are also connected and urged by helical springs 320 so as to approach each other.

Outside of the rotating table 302, suction cup-driving levers 308 and 310 are provided. The suction cup-driving levers 308 and 310 drive the suction cups 304 and 306 against the urging forces of the helical springs 320 so that the suction cup 304 parts from the suction cup 306. The suction cup-driving levers 308 and 310 rotate with the rotating table 302. Additionally, the slider 316 on which the suction cup 304 is fixed and the slider 318 on which the suction cup 306 is fixed are pressed to the suction cup-driving levers 308 and 310, respectively by the urging force from the helical springs 320.

The sack carton pick-up and supplying unit 300 operates as follows.

Firstly, the suction cup-driving lever 308 drives the suction cup 304 to approach the stocker 356. Then, the suction cup 304 sucks a sack carton C located at the front of the stocker 356.

Then, the rotating table 302 rotates in 180 degrees around the axis 312 to and stands for a predetermined time so that the sack carton C sucked by the suction cup 304 stands at a position facing the carton setting portion 42 of the index tables 4A and 4B. The opening forming device 6A opens the sack carton C in the time when the sack carton C is standing at said position. After the sack carton C is opened, the suction cup 304 is moved toward the carton setting portion 42 and set therein by the suction cup-driving lever 308. At the same time, the suction cup 306 moves toward the stocker 356 and sucks a sack carton C located at the front of the stocker 356.

A Third Embodiment

An adhesive-injection inspection system 3300 related to the third embodiment is an example an adhesive-injection inspection system that can be disposed close to hot melt adhesive injecting gun 20 and 22 incorporated in the cartoner 400.

Figure 44:
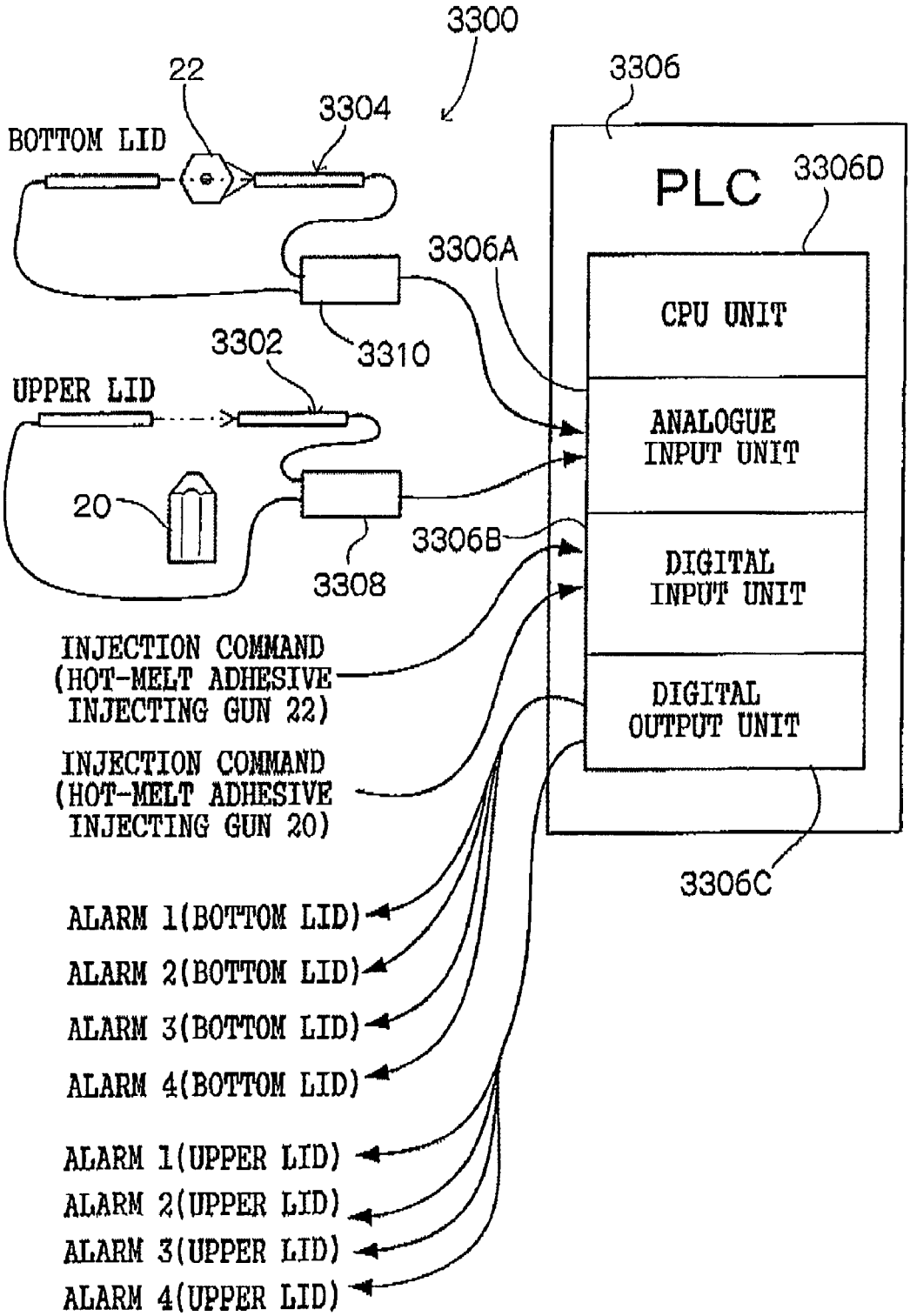
FIG. 44 is a block diagram showing an entire constitution of an adhesive-injection inspection system according to a third embodiment.

As shown in FIG. 44, the adhesive-injection inspection system 3300 incorporates an optical fiber sensor 3302 disposed close to the hot melt adhesive injecting gun 20 with a hot melt adhesive injection path from the hot melt adhesive injecting gun 20 between then, an optical fiber sensor 3304 disposed close to the hot melt adhesive injecting gun 22 with a hot melt adhesive injection path from the hot melt adhesive injecting gun 22 between then, a logical control unit (PLC) 3306 wherein analogue signal is input from the optical fiber sensors 3302 and 3304, and based on the input signal, determinates whether the hot melt adhesive is normally injected, a sensor amplifier 3308 amplifying analogue signal from the fiber sensor 3302 and input the amplified signal into the logical control unit 3306 and a sensor amplifier 3310 amplifying analogue signal from the fiber sensor 3304 and input the amplified signal into the logical control unit 3306.

Figure 45A:
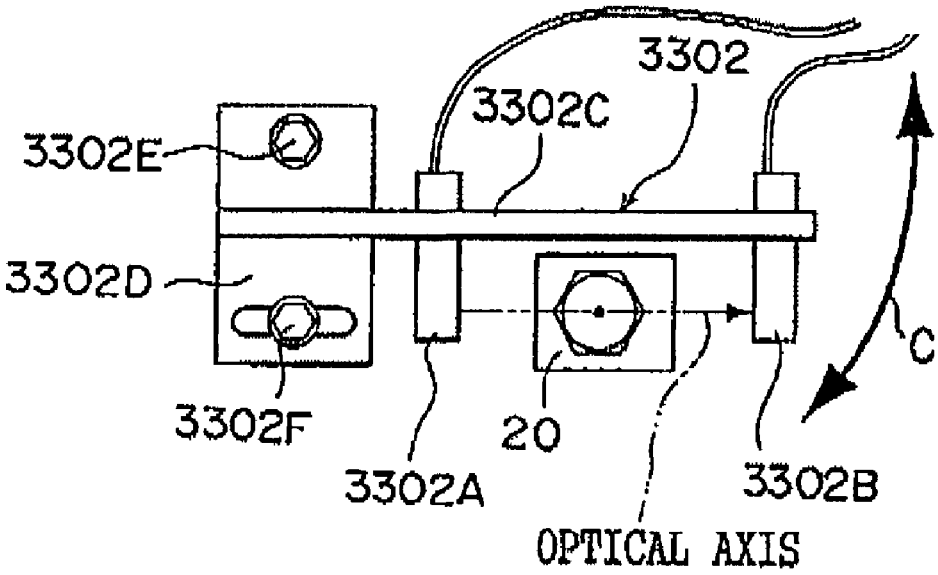
FIG. 45A is a plan view showing a structure of a hot melt adhesive-injecting gun of the adhesive-injection inspection system shown in FIG. 44.
Figure 45B:
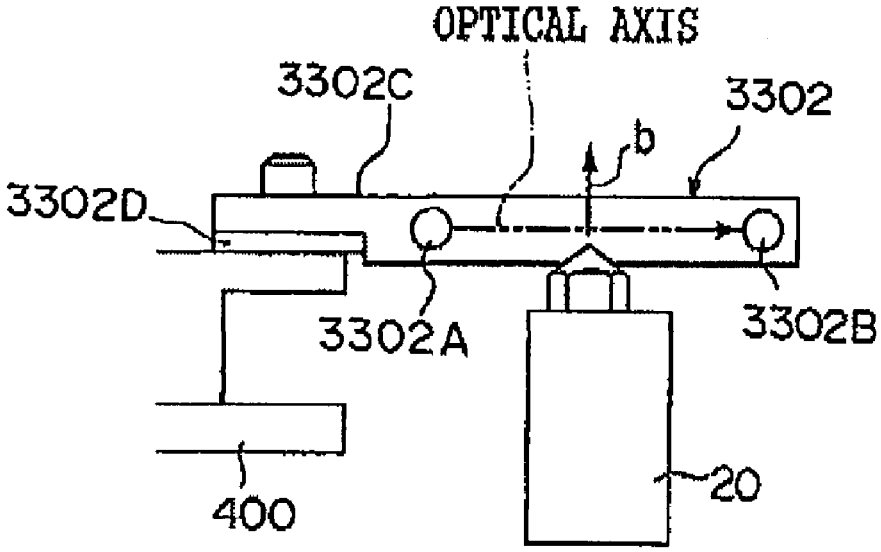
FIG. 45B is a front view of the hot melt adhesive-injecting gun shown in FIG. 45A.

FIGS. 45A and 45B show a top view and a side view of the hot melt adhesive-injecting gun 20 and the optical fiber sensor 3302, respectively.

As shown in FIGS. 45A and 45B, the optical fiber sensor 3302 incorporates a light-emitting unit 3302A emitting light to the injection path of the hot melt adhesive injected from the hot melt adhesive-injecting gun 20 and is shown by an arrow b, a light-receiving unit 3302B receiving the light from the light-emitting unit 3302A, a base 3302C holding the light-emitting unit 3302A and the light-receiving unit 3302B.

The light-emitting unit 3302A and the light-receiving unit 3302B are fixed on the base portion 3302C so that a beam emitted from the light-emitting unit 3302A hit a light-receiving device of the light-receiving unit 3302B straightly.

A flange portion 3302D is provided at one end of the base portion 3302C. The flange portion 3302D is fixed on the cartoner 400 at a location close to the hot melt adhesive-injecting gun 20 by bolts 3302E and 3302F. As shown in FIG. 45A by an arrow c, the base portion 3302D can be rotated around the bolt 3302E with the bolt 3302F loosened. Thus, by rotating the base portion 3302C with the bolts 3302E and 3302F loosened, the path of the beam from the light-emitting unit 3302A to the light-receiving unit 3302B can be adjusted to the injection path b.

Figure 46A:
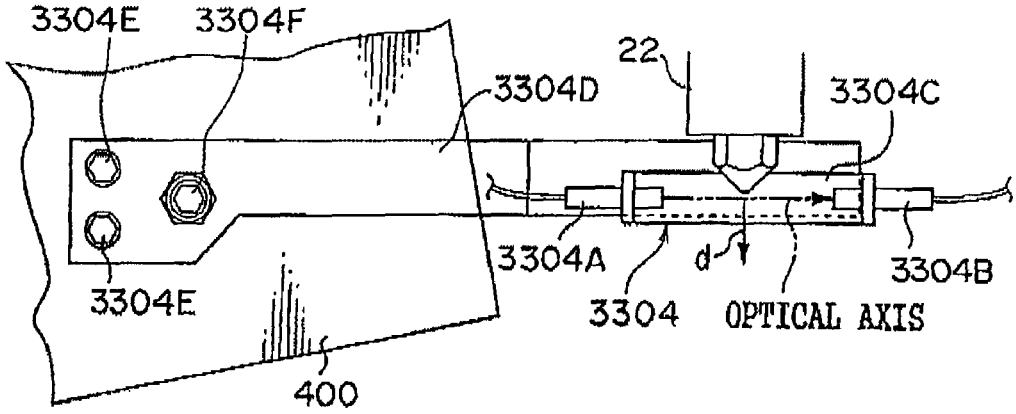
FIG. 46A is a plan view showing a structure of a hot melt adhesive-injecting gun of the adhesive-injection inspection system shown in FIG. 44.
Figure 46B:
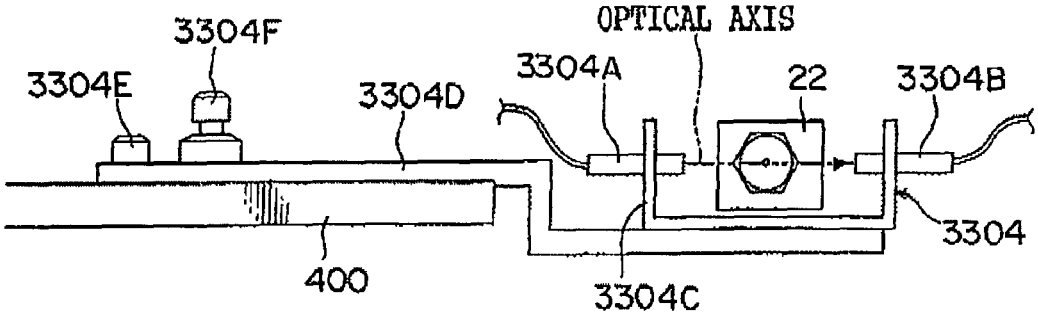
FIG. 46B is a front view of the hot melt adhesive-injecting gun of the adhesive-injection inspection system shown in FIG. 46A.

FIGS. 46A and 46B show a top view and a side view of the hot melt adhesive-injecting gun 22 and the optical fiber sensor 3304, respectively.

As shown in FIGS. 46A and 46B, the optical fiber sensor 3304 incorporates a light-emitting unit 3304A emitting light to the injection path of the hot melt adhesive injected from the hot melt adhesive-injecting gun 22 and is shown by an arrow d, a light-receiving unit 3304B receiving the light from the light-emitting unit 3304A, a base 3304C holding the light-emitting unit 3304A and the light-receiving unit 3304B.

An optical fiber sensor mount 3304D is fixed at its one end on the cartoner 400 at a location close to the hot melt adhesive-injecting gun 22 by a pair of bolts 3304E at a root portion thereof so that a tip portion thereof extends toward the hot melt adhesive-injecting gun 22. The base portion 3304C is fixed on the tip portion of the optical fiber sensor mount 3304D. At the root portion of the optical fiber sensor mount 3304D, an adjusting bolt 3304F is provided adjacent to the bolts 3304E for adjusting the height of the end portion of the optical fiber sensor mount 3304D on which the base portion 3304C is mounted. By turning the adjusting-bolt 3304F in the clockwise direction or the counter clockwise direction to raise or lower the base portion 3304C, the optical axis of the beam from the light-emitting unit 3304A to the light-receiving unit 3304B can be adjusted to the injection path d.

As shown in FIG. 44, the logical controlling device 3306 comprises an analogue input unit 3306A, digital input unit 3306B, a digital output unit 3306C and a CPU unit 3306D.

To the analogue input unit 3306A, analogue signal of light reception intensity from the optical sensors 3302 and 3304 is input through the sensor amplifiers 3308 and 3310, respectively.

To the digital input unit 3306B, injection command to the hot melt adhesive injecting guns 20 and 22 (hereinafter, only referred to 'injection command') from a controlling computer (not shown) controlling the-cartoner 400 is input.

The digital output unit 3306C outputs alarms 1 to 4 (bottom lid) relating to the hot melt adhesive injecting gun 22 and alarms 1 to 4 (upper lid) relating to the hot melt adhesive injecting gun 20 on the command from the COU unit 3306D. These alarms are displayed on an appropriate device such as a display.

The CPU unit 3306D determinates whether hot melt adhesive is normally injected by the hot melt adhesive-injecting guns 20 and 22 on the basis of the analogue signal input to the analogue input unit 3306A and the injection command input to the digital input unit 3306B and controls the digital output unit 3306C to generate the above alarms on the basis of the determination thereof.

FIG. 47 shows a flow of information and a scheme for determination.

In FIG. 47, 'injection command ON' is a signal showing that the control computer input a command to initiate injection and 'injection command OFF' is a signal showing that the control computer input a command to stop injection to the cartoner 400.

Schemes for determination and for generating alarms 1 to 4 are described below.

As shown in FIG. 47, when the signal 'injection command ON' is input into the CPU unit 3306D by the digital input unit 3306B at a step S2, the CPU unit 3306D reads the light reception intensity at the optical fiber sensor 3302 through the analogue input unit 3306A as the 'light reception intensity at light transmittance t1' at a step S4. The 'light reception intensity at light transmittance' in FIG. 47 represents the above-mentioned light reception intensity.

When the 'light reception intensity at light transmittance t1' is input, the CPU unit determinates whether the light reception intensity is not less than a predetermined value t0 at a step S6.

Figure 48A:
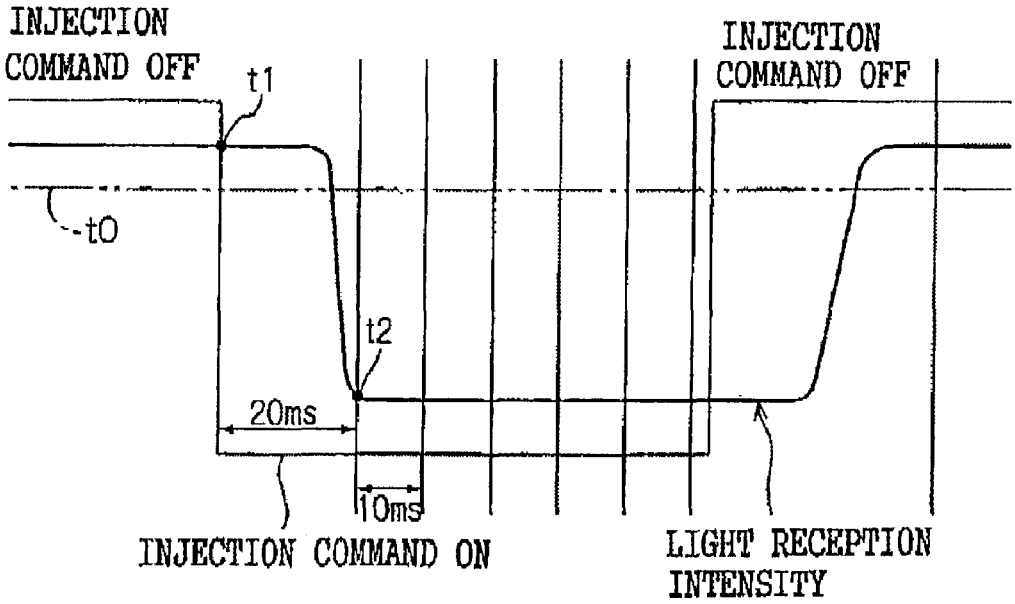
FIGS. 48A and 48B are graphs showing a relation of intensities of signals input into the above-mentioned CPU, on which basis the CPU determinates whether the intensity of the light received by an optical fiber sensor is normal before injecting hot melt adhesive.
Figure 48B:
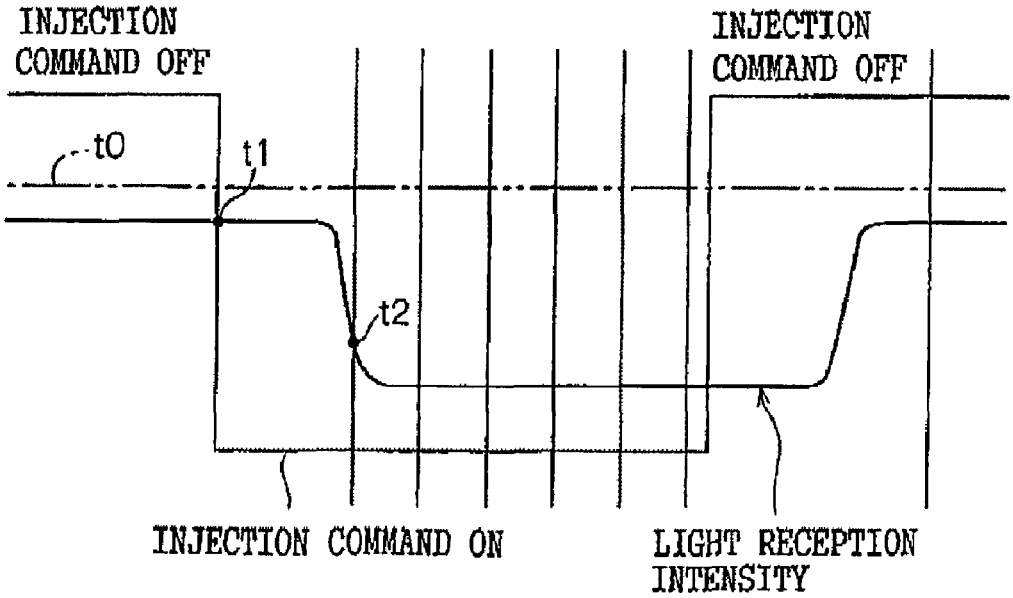

As shown in FIG. 48A, if the 'light reception intensity at light transmittance t1' is higher than the predetermined value to, the data can be interpreted that the light-emitting unit 3302A in the optical fiber sensor 3302 emits light of sufficient intensity to the light-receiving unit 3302B and that the light-receiving unit 3302B receives the light normally and thus, the CPU unit 3306D determinates that both the optical fiber sensor 3302 and the sensor amplifier 3308 function normally.

On the contrary, if the light reception intensity at light transmittance t1' is equal to or lower than the predetermined value to, the data mean that there is a possibility that the intensity of the light from the light-emitting unit 3302A is too weak, or that there would be some malfunction in the light receiving device of the light-receiving unit 3302B, or that hot melt adhesive has stuck on the light-receiving unit 3302B and the beam from the light-emitting unit 3302A is interfered. There would also be possibly some malfunction in the sensor amplifier 3308 and no analogue signal would not be input from the light-receiving unit 3302B into the analogue input 3306A. Thus, the CPU unit 3306D determinates that there would be some malfunction at least at the light-emitting unit 3302A, the light receiving unit 3302B and the sensor amplifier 3308. Based on said determination by the CPU unit 3306D, the digital output unit 3306C outputs the alarm 3 indicating that the amplifying level of the sensor amplifier 3308 is too low, then, shows the alarm 3 on a display (not shown).

When determining that the optical fiber sensor 3302 and the sensor amplifier 3308 function normally at the step S6, the CPU unit 3306D calculate an average A by averaging previous five data of 'light reception intensity at light transmittance t1' at a step S8 and store the average A into a memory.

At the hot melt adhesive injecting guns 20 and 22, there is some lag between the time when a command of injection is input and the time when injection of the hot melt adhesive is actually initiated. Thus, as shown in FIG. 47, when determining that the optical fiber sensor 3302 and the sensor amplifier 3308 function normally, at a step S10, after waiting for 20 ms, the CPU unit 3306D read a light reception intensity at the optical fiber sensor 3302. The 'light reception intensity at injection' corresponds to said light reception intensity. After reading the 'light reception intensity at injection t2', at a step S12, a level difference Δ that is a difference between the 'light reception intensity at light shading' and the 'light reception intensity at injection t2' is calculated and it is determined whether the level difference Δ is larger than a predetermined value Δd at a step S14.

Figure 49A:
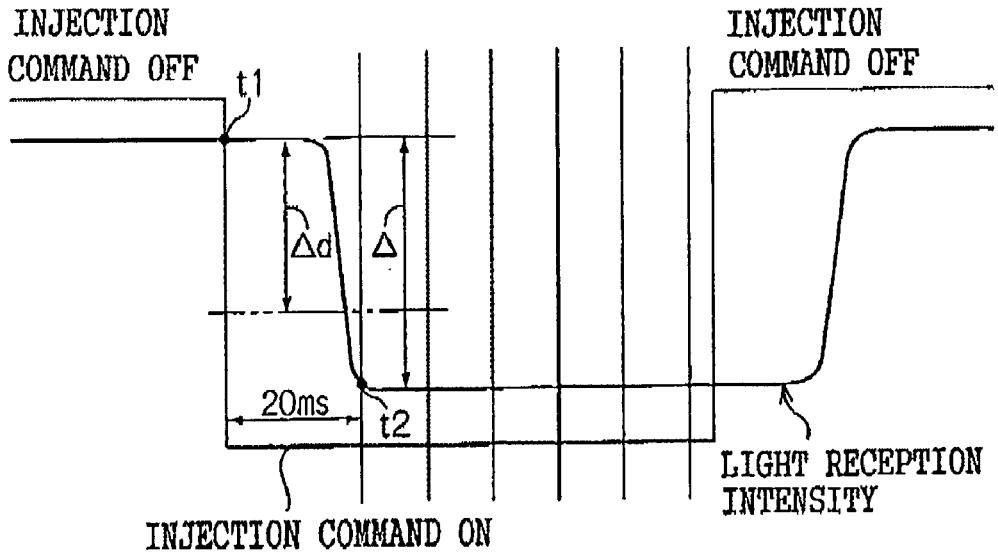
FIGS. 49A and 49B are graphs showing a relation of intensities of signals input into the CPU, on which basis the CPU determinates whether the intensity of the light received by an optical fiber sensor is normal when injection of hot melt adhesive is initiated.
Figure 49B:
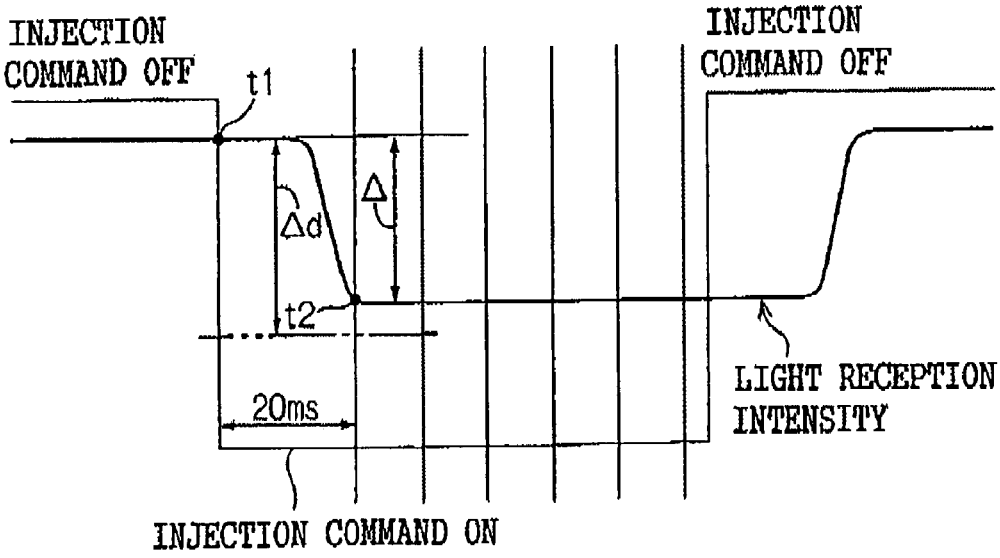

As shown in FIG. 49A, if the level difference Δ is larger than the predetermined value Δd, the CPU unit 3306D determinates that the light-emitting unit 3302A and the light-receiving unit 3302B in the optical fiber unit 3302 are functioning normally. On the other hand, as shown in FIG. 49B, if the level difference Δ is equal to or smaller than the predetermined value Δd, it can be thought that the beam from the light-emitting unit 3302A is not sufficiently shaded by the flow of hot melt adhesive injected from the hot melt adhesive injecting gun 20 or that the light receiving unit 3302B is malfunctioned and generates photoelectric current even when the beam from the light-emitting unit 3302A is sufficiently interrupted. Thus, the CPU unit 3306 determinates that at least one of the light-receiving unit 3302B and the hot melt adhesive injecting gun 20 are malfunctioned. Based upon said determination by the CPU unit 3306D, the digital output unit 3306C outputs the alarm 4 indicating that the level difference is too low, then displays the alarm 4 on the display.

When determining that both the light-receiving unit 3302B and the hot melt adhesive injecting gun 20 are functioning normally, the CPU unit 3306D calculate an average B by averaging previous five data of 'light reception intensity at injection t2' and store the average B in the memory.

Then, at a step S18, the CPU unit 3306D reads the averages A and B out of the memory and determinates a value obtained by adding the average A to the average B and dividing by 2 as a threshold value tv. However, the process for determinating the threshold value tv based upon the average A and the average B is mot limited in the above.

Figure 50A:
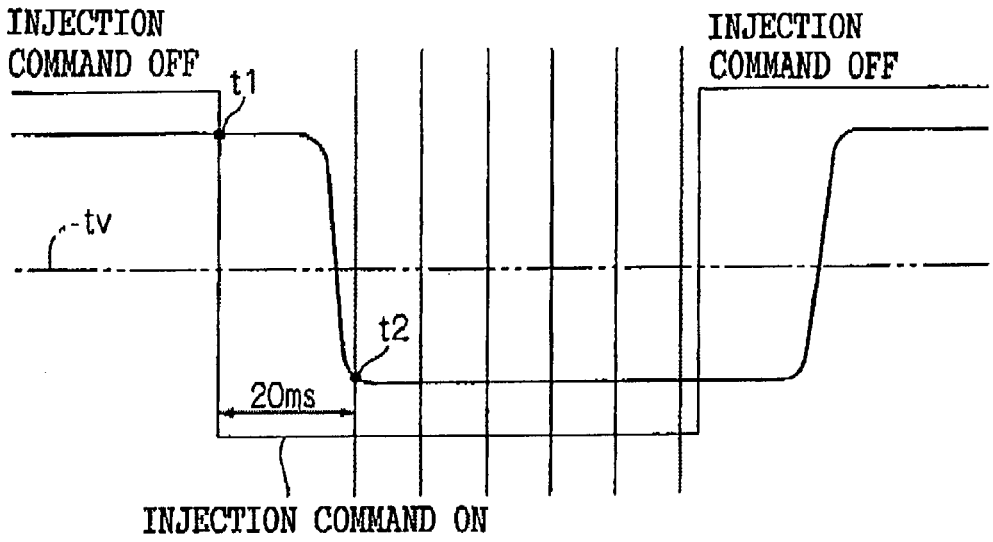
FIG. 50A is a graph showing a relation of intensities of signals input into the CPU, on which basis the CPU determinates that the hot-melt adhesive is injected in a normal quality.
Figure 50B:
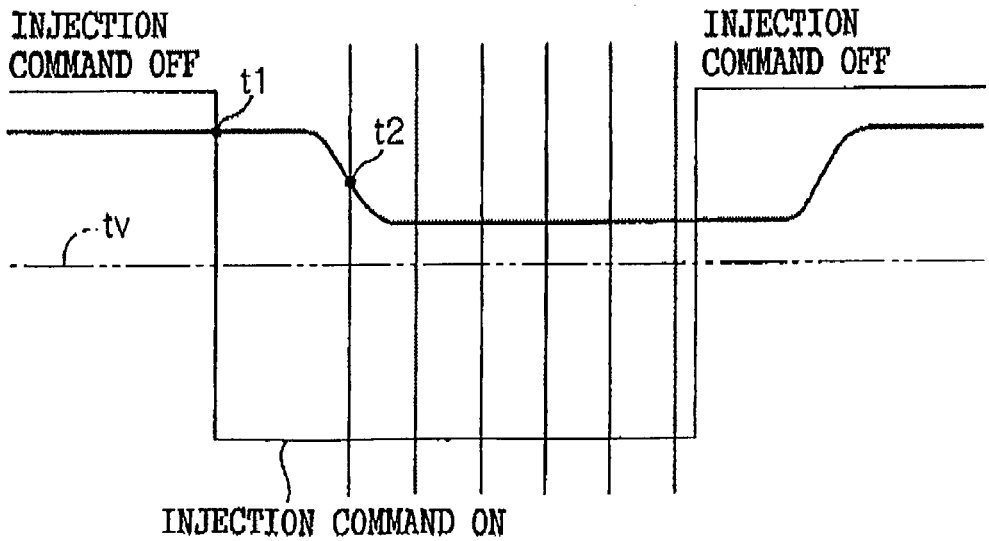
FIG. 50B is a graph showing a relation of intensities of signals input into the CPU, on which basis the CPU determinates that the hot-melt adhesive is injected in an abnormally small quality.

When the threshold value tv is determined at the step S18, the CPU unit 3306D determinates whether the first 'light reception intensity at injection t2' is lower than the threshold value. As shown in FIG. 50A, if the first 'light reception intensity at injection t2' is lower than the threshold value tv, the CPU unit 3306D determinates that the hot melt adhesive is injected in a sufficient flow since it can be thought that the beam from the light-emitting unit 3302A is sufficiently interrupted by the flow of the hot melt adhesive injected from the hot melt adhesive injecting gun 20. On the other hand, as shown in FIG. 50B, the first 'light reception intensity at injection t2' is equal to or higher than the threshold value tv, the CPU unit 3306D determinates that the hot melt adhesive is injected in an insufficient flow since it can be thought that the beam from the light-emitting unit 3302A is not sufficiently interrupted by the flow of the hot melt adhesive injected from the hot melt adhesive injecting gun 20. Then, based upon the above determination by the CPU unit 3306D, the digital output unit 3306C outputs the alarm 1 indicating that the hot melt adhesive is injected in an insufficient flow and stores said light reception intensity at injection t2' in the memory.

Figure 51:
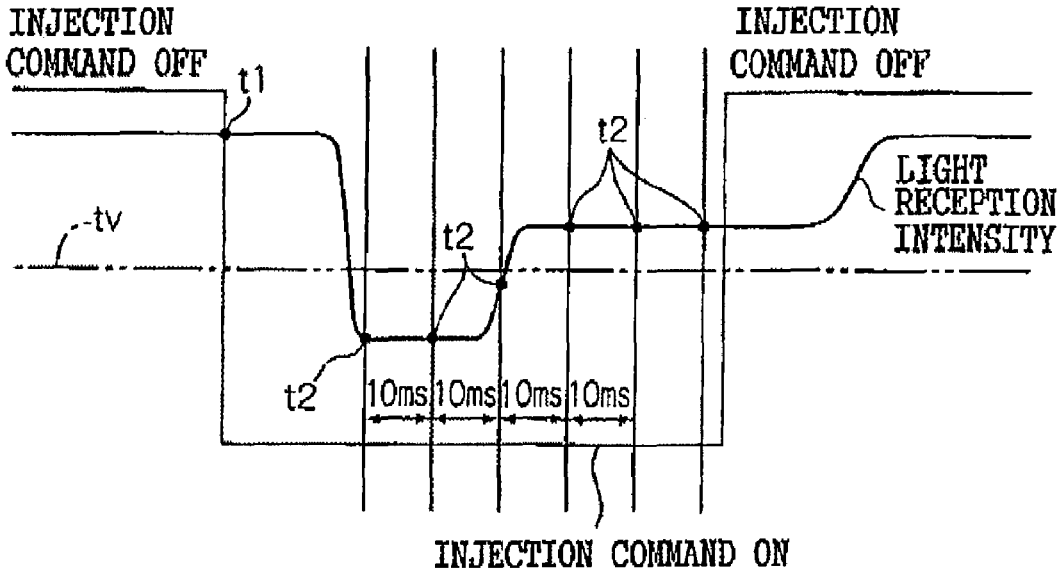
FIG. 51 is a graph showing a relation of intensities of signals input into the CPU, on which basis the CPU determinates that the hot melt adhesive is firstly injected in a normal quantity and later the injection quantity is lowered to an abnormally small quantity.

When determining that the hot melt adhesive is injected in a sufficient flow, the CPU unit 3306D waits for 10 ms and then, confirms that the injection command is still ON at a step S22. If it is confirmed that the injection command is still ON, at a step S24, the CPU unit 3306D reads out the 'light reception intensity at injection t2' through the analogue input unit 3306A and determinates whether the hot melt adhesive is injected in a sufficient flow or not at the step S20. Thus, the CPU unit 3306D repeats the steps S20, S22 and S24 in an order of step S20, step S22 and then step S24. When carrying out the steps S20, S22 and S24 repeatedly, as shown in FIG. 51, if the 'light reception intensity at injection t2' turns to be equal to or higher than the threshold value tv, the CPU unit determinates that the flow of the hot melt adhesive becomes smaller than a normal flow rate and then, the digital output unit outputs the alarm 1.

When the injection command turns from ON to OFF, the CPU unit 3306D stands without carrying out the next step. After passing 150 ms, which is a time necessary for stopping injecting the hot melt adhesive after the injection command turns OFF, at a step S26, the CPU unit 3306D read out a light reception intensity at the optical fiber sensor 3302 as a 'light reception intensity at injection stoppage t3' through the analogue input unit 3306A. At a step S28, the CPU unit 3306D determinates whether the 'light reception intensity at injection stoppage t3' is higher than a reference value td, which is determined separately from the predetermined value t0 and has a value closer to the 'light reception intensity at light transmittance t1' than the threshold value tv.

Figure 52:
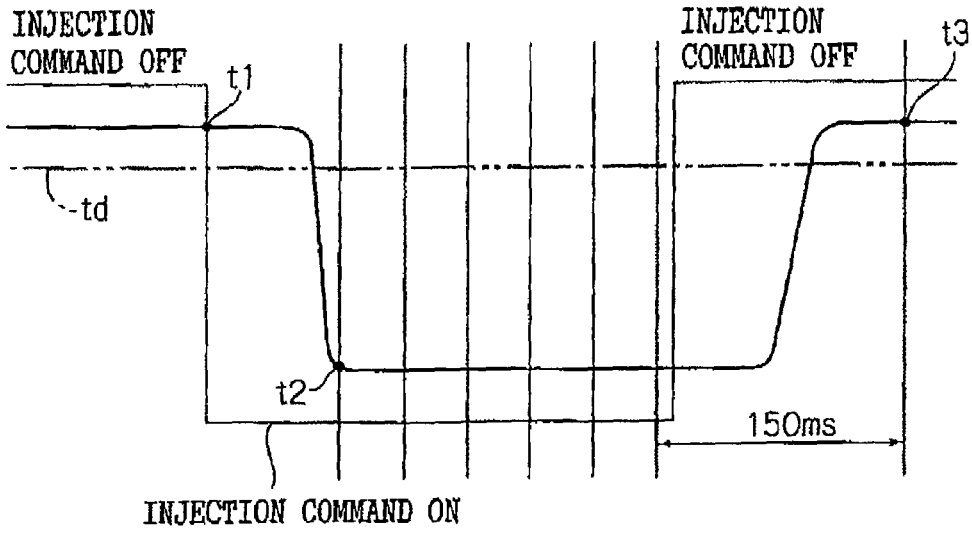
FIG. 52 is a graph showing a relation of intensities of signals input into the CPU, on which basis the CPU determinates that cobwebbing would not take place after stopping injection of the hot melt adhesive glue.

As shown in FIG. 52, if the 'light reception intensity at injection stoppage t3' is higher than the reference value td, the CPU unit 3306D determinates that hot melt adhesive injection has stopped at the hot melt adhesive injecting gun 20 without the hot melt adhesive cobwebbing since it can be thought that there is nothing interrupting the beam between the light-emitting unit 3302A and the light-receiving unit 3302B at a step S28.

Figure 53:
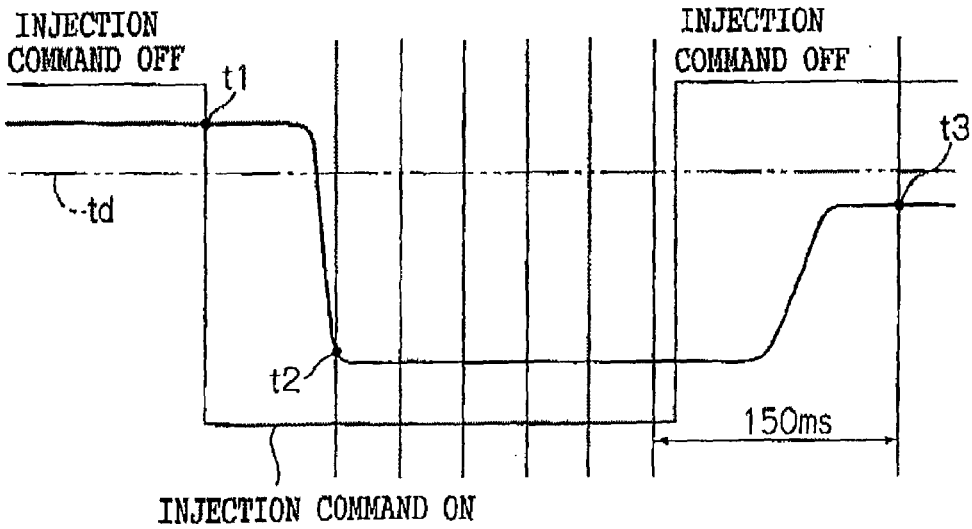
FIG. 53 is a graph showing a relation of intensities of signals input into the CPU, on which basis the CPU determinates that cobwebbing would take place after stopping injection of the hot melt adhesive glue.

On the other hand, as shown in FIG. 53, if the 'light reception intensity at injection stoppage t3' is equal to or lower than the reference value td, the CPU unit 3306D determinates that cobwebbing of the hot melt adhesive takes place at the hot melt adhesive injecting gun 20 since it can be thought that there is exist between the light-emitting unit 3302A and the light-receiving unit 3302B a flow of the hot melt adhesive hugely interrupting the beam. Then, on the basis of the above determination of the CPU unit 3306D, the digital output unit 3306C outputs the alarm 2 indicating the existence of cobwebbing and stores said 'light reception intensity at injection stoppage t3' in the memory.

Thus, the scheme of determination and outputting alarms is described. For the hot melt adhesive injecting gun, the CPU 3306 carries out determination and outputting of alarms in the same scheme from input from the optical fiber sensor 304.

According to the adhesive-injection inspection system 3300 of the third embodiment, it can be detected whether hot melt adhesive is normally injected at the hot melt adhesive injecting guns 20 and 22. When hot melt adhesive is not normally injected, alarms are output and the cartoner stops its operation. Thus, it can be prevented that a carton having flap portions C12 not glued to an outside flap C18 and having upper lid C8 left open or a carton having outside flaps C22 not glued to each other and having a bottom lid C10 left open is discharged from the carton discharging portion 14 of the cartoner 400.

Additionally, it can be detected whether cobwebbing does not take place after stopping hot melt adhesive injection and thus, it can be prevented that hot melt adhesive sticks out of an intentioned area of a sack carton C and deteriorate its quality and that the cartoner 400, the hot melt adhesive injecting gun 20 and the hot melt adhesive injecting gun 22 are stained with injected adhesive. It is also prevented that the optical fiber sensors 3302 and 3304 are stained with hot melt adhesive and sensitivity thereof deteriorates.

Further, malfunction of the optical fiber sensors 3302 and 3304 and sensor amplifies 3308 and 3310 can be easily detected.

Furthermore, different alarms are displayed for different malfunction and thus, operators can learn a type of malfunction from the type of displayed alarm and can take an appropriate measure swiftly.

A Fourth Embodiment

An example of a plastic case packed product supplying unit incorporated in the packaging system of the present invention is described in the following.

Figure 54:
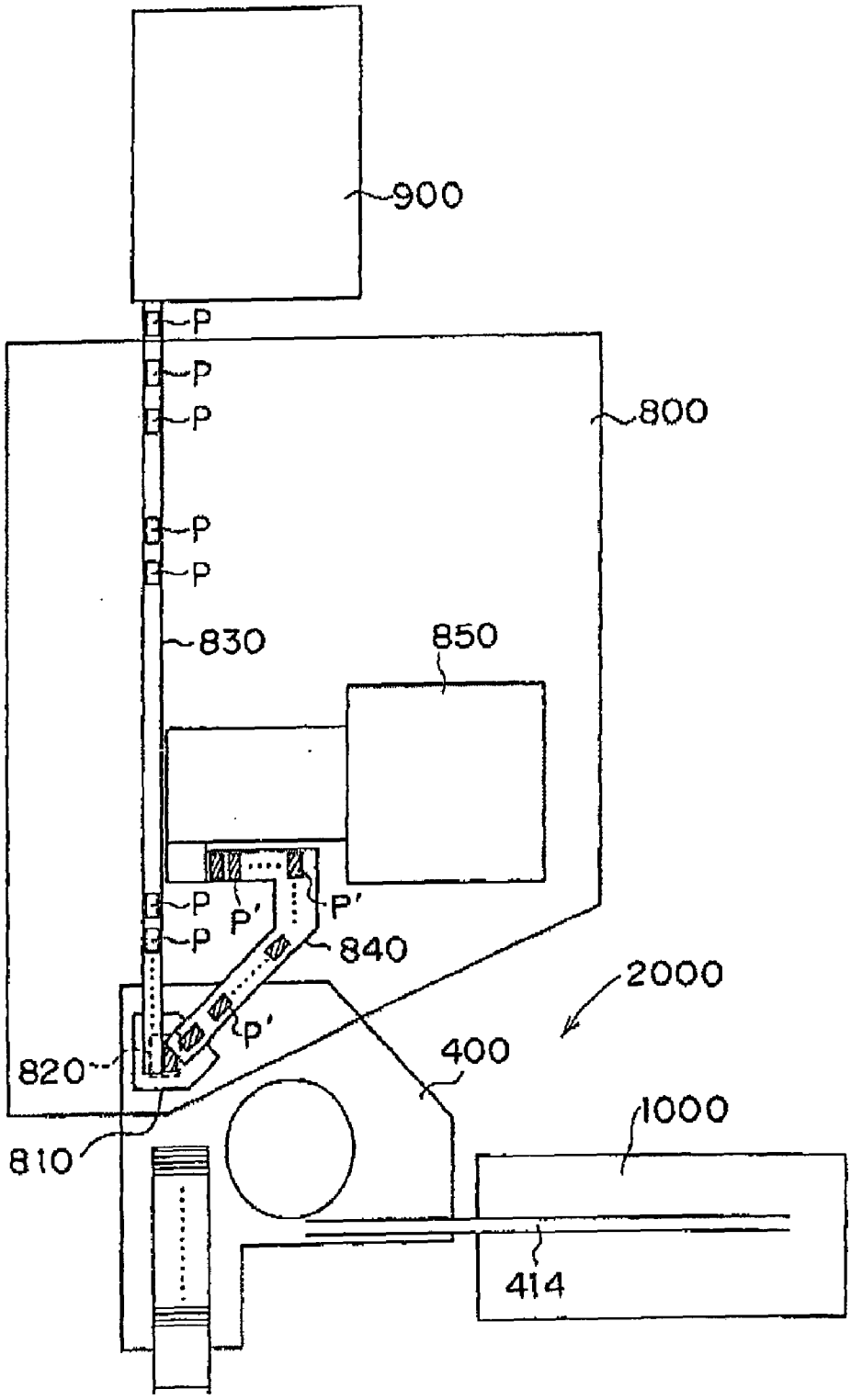
FIG. 54 is a plan view showing an entire constitution of a packaging system having a plastic case-packed product supplying apparatus relating to a fourth embodiment.

A plastic case packed product supplying unit 800 that relates to the fourth embodiment is an example of the plastic case supplying unit 8B in the cartoner 400 and is located above the cartoner 400 as shown in FIG. 54.

Figure 55:
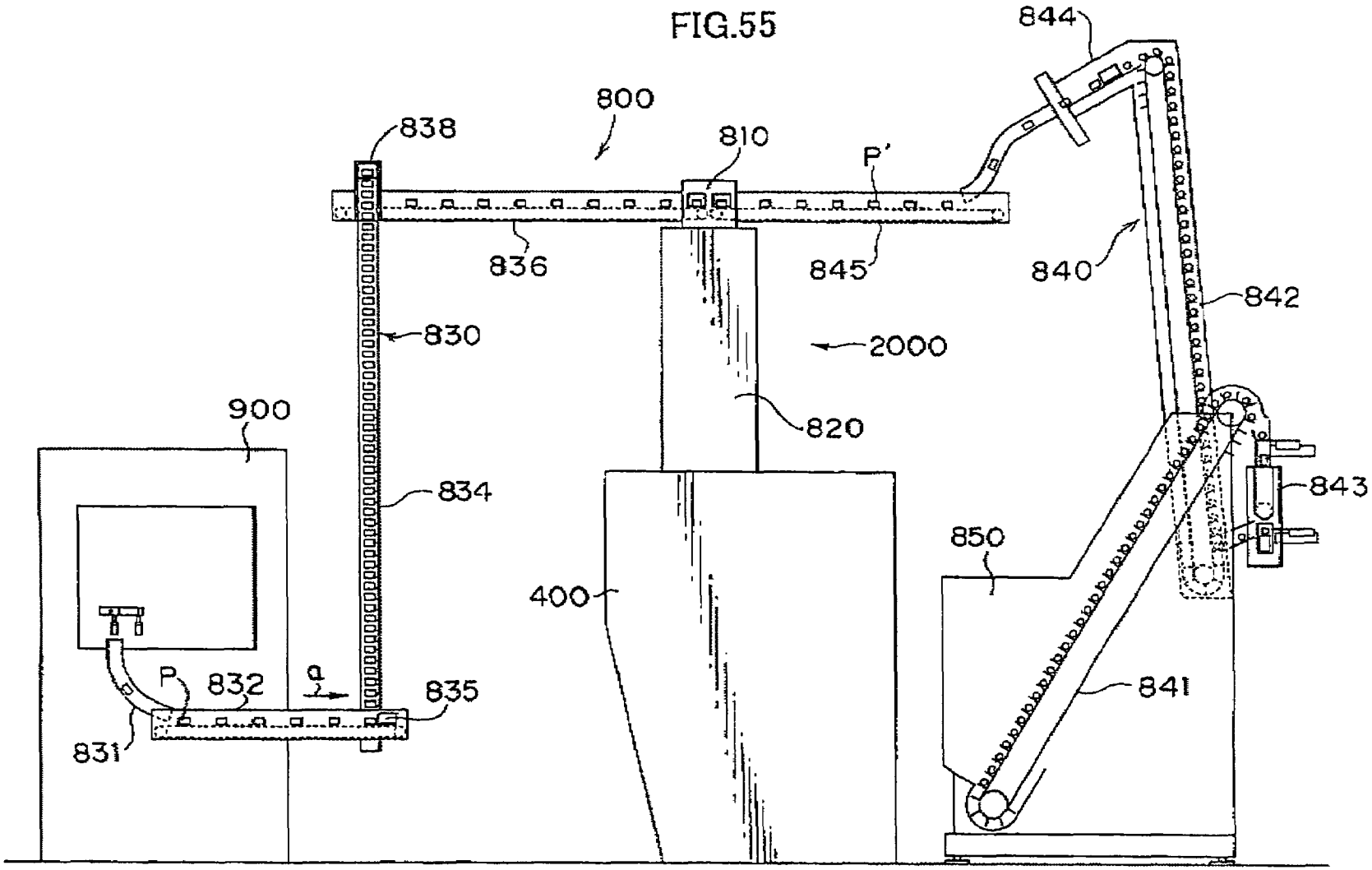
FIG. 55 is a front view showing an entire construction of a plastic case-packed product supplying apparatus shown in FIG. 54.

As shown in FIG. 55, the plastic case packed product supplying unit 800 comprises a plastic case packed product arraying portion 810 which is located above the cartoner 400 and arranges the plastic case packed product P and the plastic case packed product P' according to a predetermined array, a plastic case packed product introducing portion 820 for supplying the plastic case packed product P and the plastic case packed product P' arrayed by the plastic case packed product arraying portion 810 to the cartoner 400, a first plastic case packed product supplying line 830 for supplying the plastic case packed product P manufactured by the winding machine 900 to the plastic case packed product arraying portion 810 and a second plastic case packed product supplying line 840 for supplying the plastic case packed product P' from a plastic case packed product silo 850 accommodating the plastic case packed product P' of a different type from the plastic case packed product to the plastic case packed product arraying portion 810.

The first plastic case packed product supplying line 830 and the second plastic case packed product supplying line 840 correspond to a first introduction line and a second introduction line included by the packaging object supplying apparatus of the invention. Then, the plastic case packed product arraying portion 810 corresponds to a packaging object combination portion in the packaging object supplying apparatus and further corresponds to a distributing means. The plastic case packed product introducing portion 820 corresponds to a packaging object introduction portion in the packaging object supplying apparatus.

Hereinafter, respective components of the plastic case packed product supplying unit 800 will be described.

1-1 First Plastic Case Packed Product Supplying Line

Figures 56A, 56B:
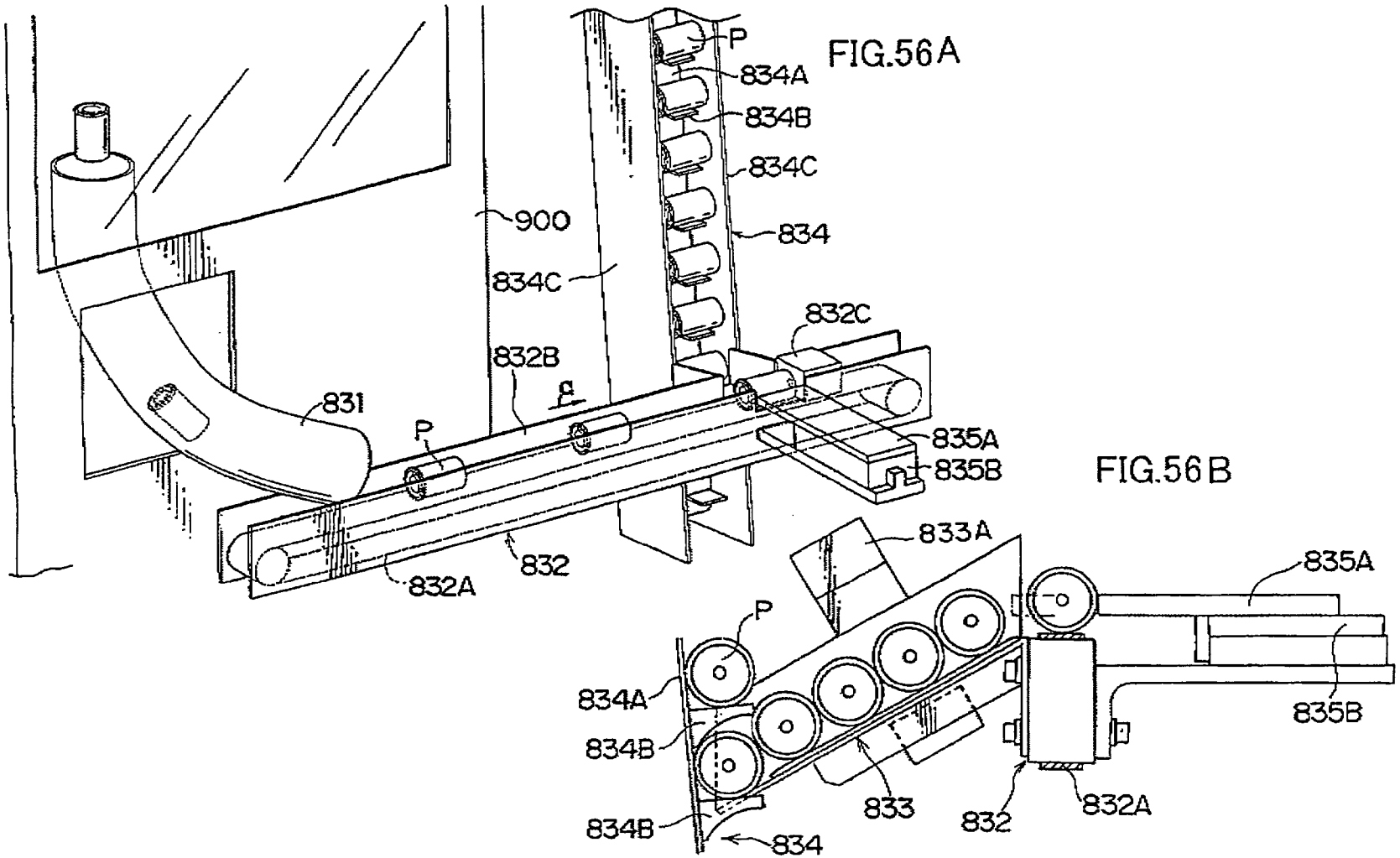
FIGS. 56A and 56B are expanded views showing a construction close to a first horizontal conveyer carrying plastic case-packed product out of a winding machine, a vertical conveyer, and an inclined chute of a first plastic case-packed product supplying line of the plastic case-packed product supplying apparatus shown in FIG. 55.

A first plastic case packed product supplying line 830, as shown in FIGS. 55, 56A and 56B, comprises a first horizontal conveyor 832 for transporting the plastic case packed product P manufactured by the winding machine 900, a vertical conveyor 834 which is located at an end portion on the downstream side with respect to a transporting direction of the first horizontal conveyor 832 and at right angle and substantially above the first horizontal conveyor 832, and a second horizontal conveyor 836 which is extended horizontally from a vertex of the vertical conveyor 834 toward the plastic case packed product arraying portion 810. a plastic case packed product direction conversion unit 838 for converting the direction of the plastic case packed product is provided between the vertical conveyor 834 and the second horizontal conveyor 836.

A pusher 835 for pushing the plastic case packed product P carried by the first conveyor to the vertical conveyor 834 is provided between the first conveyor 832 and the vertical conveyor 834.

The first plastic case packed product supplying line 830 includes a folded pipe like plastic case packed product introduction duct 831 for introducing the plastic case packed product manufactured by the winding machine 900 onto the first conveyor 832.

Hereinafter, the structure of the respective components will be described.

(A) First Horizontal Conveyor and Vertical Conveyor

The first horizontal conveyor 832 comprises a belt conveyor portion 832A for carrying the plastic case packed product P and a pair of guide plates 832B which are provided on both sides of the belt conveyor portion 832A for holding the plastic case packed product P from falling. An end portion in the downstream of the first horizontal conveyor 832 has a block type stopper 832C for stopping the plastic case packed product P carried by the belt conveyor portion 832A. The guide plate 832B has a cutout in the vicinity of the stopper 832C in order to prevent the pusher 835 from obstructing pushing of the plastic case packed product P by the pusher 835 to the vertical conveyor 834.

The vertical conveyor 834 includes a belt 834A provided substantially vertically and a shelf plate 834B provided at right angle to the front face of the belt 834A and at a specified interval. A pair of guide plates 834C are provided on both sides of the belt 834A in order to prevent the plastic case packed product P from dropping to the right or the left relative to transporting direction. As shown in FIG. 56, the plastic case packed product P is transported upward in a condition that it is mounted on the shelf plate 834B.

The pusher 835 comprises a pusher member 835A for pushing the plastic case packed product P and an air slider 835B for moving the pusher member 835A in a direction approaching the vertical conveyor 834 and in a direction leaving the vertical conveyor 834.

As shown in FIG. 56B, an inclined chute 833 descending toward the vertical conveyor 834 is disposed between the first horizontal conveyor 832 and the vertical conveyor 834. Above and the below of the inclined chute 833, a plastic case packed product detecting sensor 833A detecting whether the inclined chute 833 is filled with plastic case packed cases P is provided.

The inclined chute 833 is supplied with plastic case packed products P conveyed by the first horizontal conveyor 832 by the pusher 835 not synchronously with the vertical conveyor.

The self plates 834B are provided in a pitch that one plastic case packed product can be inserted but 2 or more plastic cases cannot be inserted between any two adjacent self plates 834B. Thus, plastic case packed products sliding down the inclined chute 833 is picked up one by one and not synchronously by the vertical conveyor 834.

(B) Plastic Case Packed Product Direction Conversion Unit

Figure 57:
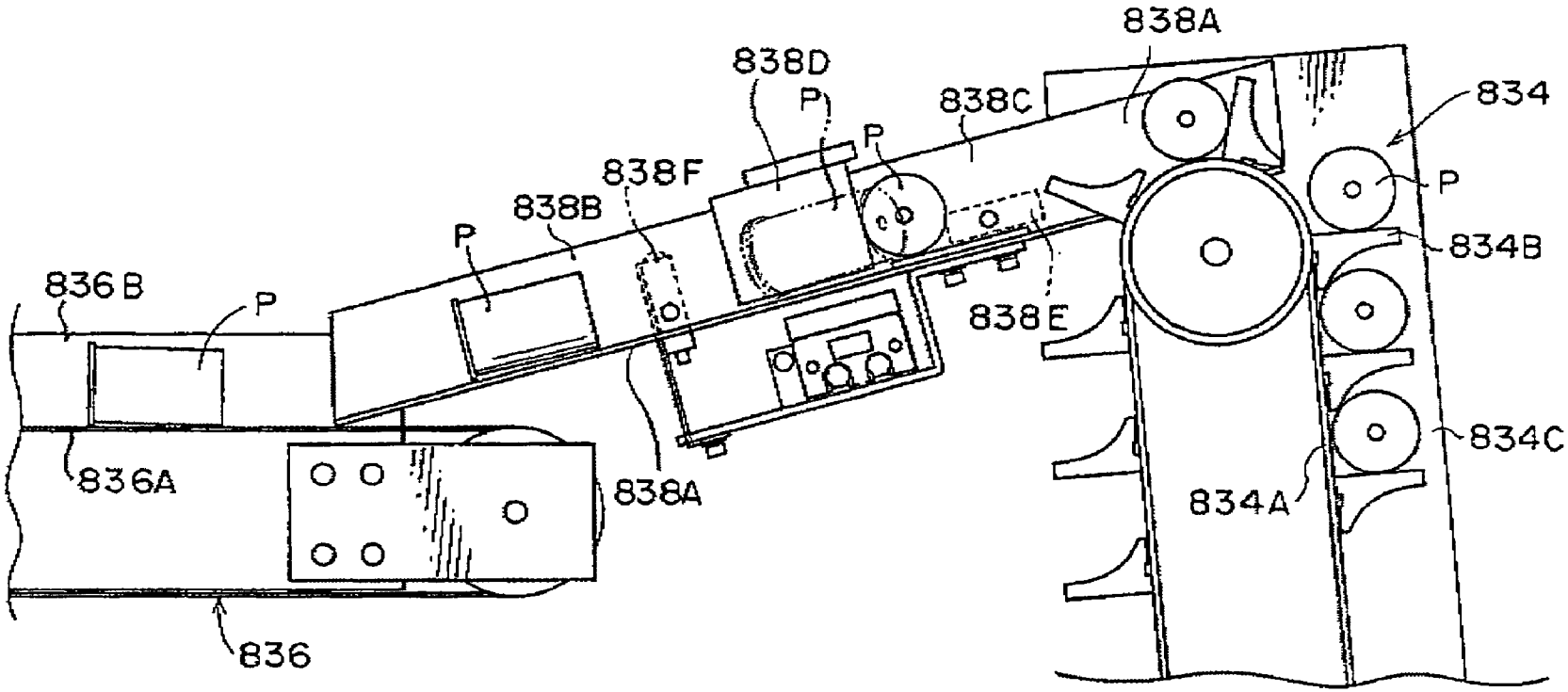
FIG. 57 is an expanded side view showing a relative location of the top portion of the vertical conveyer, plastic case-packed product-turning device, and the second horizontal conveyer of the first plastic case-packed product supplying line.
Figure 58:
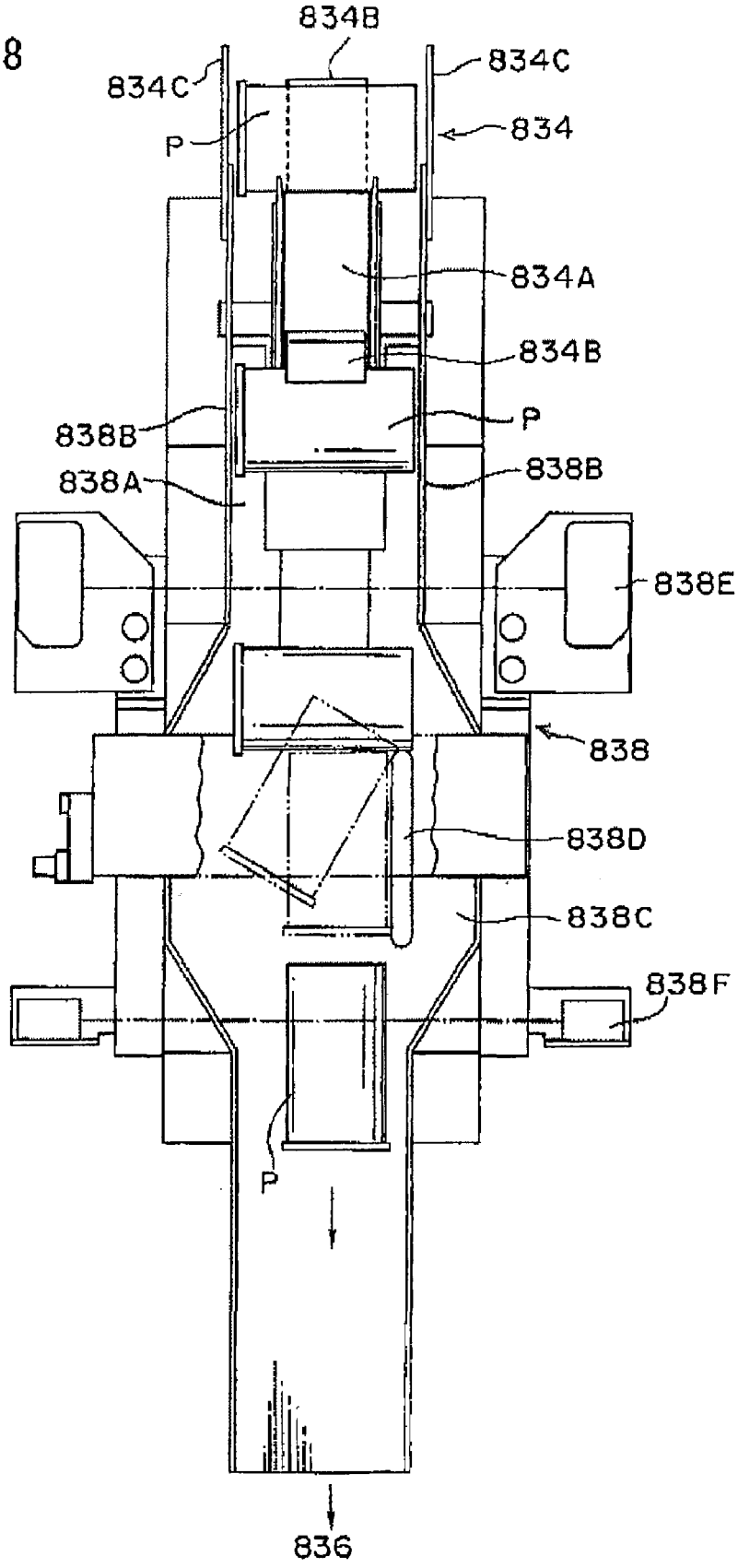
FIG. 58 is an expanded top view of the top portion of the vertical conveyer and the plastic case-packed product-turning device.

The plastic case packed product direction conversion unit 838 includes a chute portion 838A which forms a downward pitch from the vertical conveyor 834 to the second horizontal conveyor 836 as shown in FIGS. 57 and 58. Guide plates 838B are provided on both sides of the chute portion 838A. In the meantime, the guide plate 838B located forward relative to this paper surface is omitted in FIG. 57.

End portions on the upstream side and downward side relative to the transporting direction of the chute portion 838A are formed in a width enough large to allow the plastic case packed product P carried by the vertical conveyor 834 to pass through in a condition that it lies at right angle to the transporting direction. A plastic case packed product direction conversion unit 838C larger than both ends is formed in the center of the chute portion 838A.

A plastic case packed product direction conversion member 838D, which is a plate-like member provided in parallel to a drop path of the plastic case packed product P, is provided in the plastic case packed product direction conversion portion 838C. The plastic case packed product direction conversion member 838D slides laterally from the center of the chute portion 838A by an pneumatic-slider (air slider) not shown. By a setting signal from a control computer (not shown) for controlling the packaging system 2000 set in accordance with a variety of the plastic case packed products, the plastic case packed product direction conversion member 838D slides toward a predetermined position to control the direction of the plastic case packed product.

A plastic case packed product detecting portion 838E and a plastic case packed product detecting portion 838F for detecting optically whether or not the plastic case packed product P passes are provided at an inlet and an outlet of the plastic case packed product direction conversion portion 838C. The plastic case packed product detecting portion 838E and the plastic case packed product detecting portion 838F are connected to the control computer. If the plastic case packed product detecting portion 838E and the plastic case packed product detecting portion 838F detect any plastic case packed product P, the control computer judges that the plastic case packed product P has passed through the plastic case packed product direction conversion unit 838 normally and continues the operation of the plastic case packed product supplying unit 800. On the other hand, if the plastic case packed product detecting portion 838F does not detect any plastic case packed product P although the plastic case packed product detecting portion 838E detects the plastic case packed product P, the control computer judges that the plastic case packed product direction conversion portion 838C is clogged with the plastic case packed product P and stops the operation of the plastic case packed product supplying unit 800 and the winding machine 900.

The plastic case packed product P carried by the vertical conveyor 834 is introduced into the chute portion 838A of the plastic case packed product direction conversion unit 838 in a condition that it is directed at right angle relative to the transporting direction. As indicated with a solid line in FIG. 58, the introduced plastic case packed product P slips down through the chute portion 838A in the condition that it is directed in the above-described direction. If the bottom portion strikes the plastic case packed product direction conversion member 838D in the plastic case packed product direction conversion portion 838C, the plastic case packed product P is turned at 90° to a direction parallel to the falling direction as indicated with two-dot chain line in FIG. 58 and introduced out to the second horizontal conveyor 836.

As shown in FIG. 57, the second horizontal conveyor 836 comprises a belt conveyor portion 836A for transporting the plastic case packed product P and a guide plate 836B which are provided on both sides of the belt conveyor portion 836A and holds the plastic case packed product P from falling. The guide plate 836B located forward relative to this paper surface is omitted from FIG. 57.

(C) Winding Machine

Figure 59:
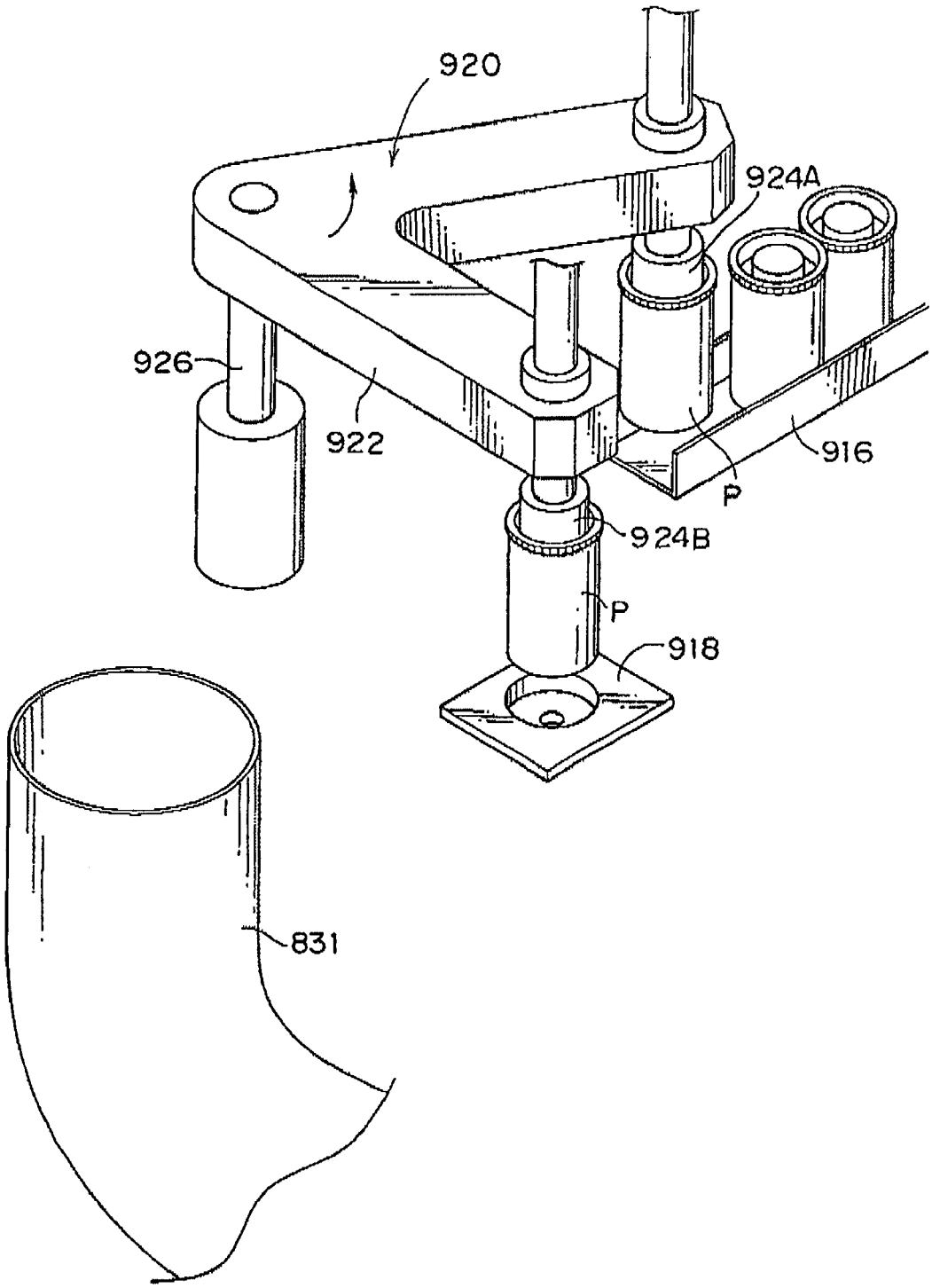
FIGS. 59 and 60 are expanded views showing a mechanism of a portion of the winding machine incorporated in the packaging system shown in FIG. 54, at which produced plastic case-packed products are carried out to the first plastic case-packed product supplying line.
Figure 60:
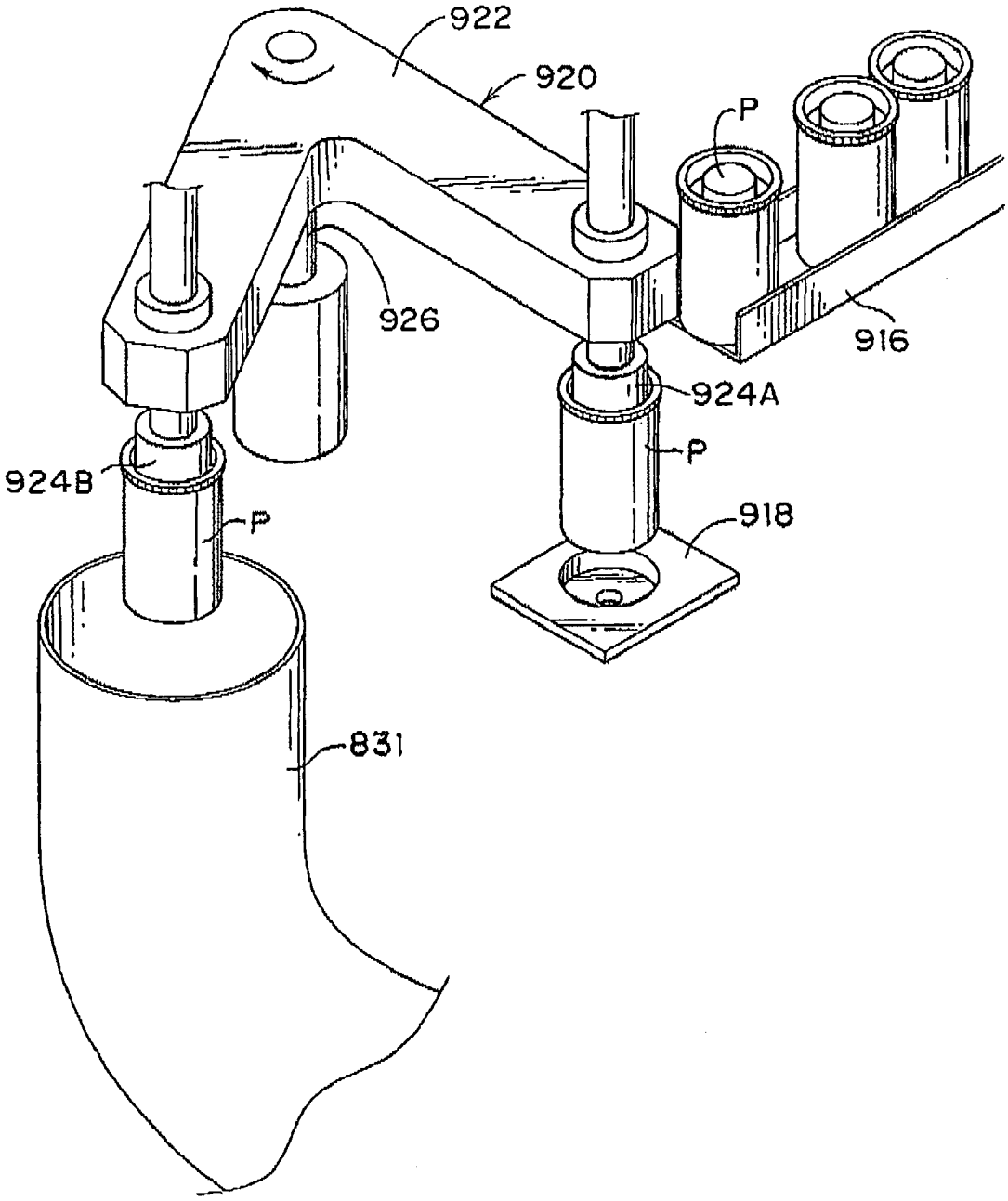

The winding machine 900, as shown in FIGS. 59 and 60, includes a plastic case packed product transporting line 916 for transporting the manufactured plastic case packed product P, an inspection portion 918 for determining whether or not the manufactured plastic case packed product P is good by measuring its height and a plastic case packed product moving unit 920 for moving the plastic case packed product which is determined to be a good product in the inspection portion 918 to an intake of the plastic case packed product introduction duct 831 at the same time when the plastic case packed product P is moved from the plastic case packed product transporting line 916 to the inspection portion 918.

The plastic case packed product moving unit 920 comprises an arm member 922 having a V shaped plan shape, a plastic case packed product suction portion 924A and a plastic case packed product suction portion 924B, which are provided on both ends of the arm member 922 for sucking the plastic case packed product P. The arm member 922 is fixed to a rotation shaft 926 provided vertically through a V-shaped bottom portion. The rotation shaft 926 is provided so as to be capable of expanding and contracting and rotated by a drive means (not shown). If the rotation shaft 926 is expanded, the arm member 922 rises and if the arm member 926 is contracted, the arm member 922 falls.

(D) Operation of First Plastic Case Packed Product Supplying Line

The plastic case packed product moving unit 920 carries a plastic case packed product P determined to be acceptable by the inspection portion 918 to an intake of the plastic case packed product introduction duct 831 at the same time when the plastic case packed product P located at an end of the plastic case packed product transporting line 916 is moved to the inspection portion 918.

Specifically, as indicated with an arrow in FIG. 59, the arm member 922 is rotated counterclockwise so as to locate both end portions of the arm member 922 over an end of the plastic case packed product transporting line 916 and the inspection portion 918. Next, the rotation shaft 926 is contracted and the arm member 922 is fallen to the end of the plastic case packed product transporting line 916 and a plastic case packed product located at the inspection portion 918. After the plastic case packed product is determinated to be good by the inspection portion 918, the plastic case packed product P located at the end of the plastic case packed product transporting line 916 is sucked at the plastic case packed product suction portion 924A and the plastic case packed product P located on the inspection portion 918 is sucked by the plastic case packed product suction portion 924B. After the plastic case packed product P is sucked, the rotation shaft 926 is expanded so as to raise the arm member 922, so that as shown in FIG. 59, the plastic case packed product P is lifted up from the plastic case packed product transporting line 916 and the inspection portion 918. After the plastic case packed product P is lifted up, the rotation shaft 926 is rotated so as to rotate the arm member 922 clockwise as indicated with an arrow in FIG. 60. If both end portions of the arm member 922 are located above the inspection portion 918 and the plastic case packed product introduction duct 831, the rotation shaft 926 is contracted so as to descend the plastic case packed product suction portion 924A and the plastic case packed product suction 924B. Then, the suctions of the plastic case packed product suction portion 924A and the plastic case packed product suction portion 924B are released, so that the plastic case packed product P sucked by the plastic case packed product suction portion 924A is placed on the inspection portion 918 while the plastic case packed product P sucked by the plastic case packed product suction portion 924B is fallen into the plastic case packed product introduction duct 831.

The plastic case packed product P fallen into the plastic case packed product introduction duct 831 is carried by the first horizontal conveyor 832 and abuts the stopper 832C and stops. The plastic case packed product P which stops because it abuts the stopper 832C is transferred to the vertical conveyor 834 by the pusher 835 and brought upward by the vertical conveyor 834. Then, that plastic case packed product P is turned at 90° by the plastic case packed product direction conversion unit 838, introduced into the second horizontal conveyor 836 and then introduced into the plastic case packed product arraying portion 810 by the second horizontal conveyor 836.

1-2 Plastic Case Packed Product Arraying Portion

As shown in FIGS. 54, 55, 61 and 62, the second horizontal conveyor 836 and the second plastic case packed product supplying line 840 included by the first plastic case packed product supplying line are provided such that they cross each other on the same horizontal plane. The plastic case packed product arraying portion 810 is provided on the aforementioned intersection point and the plastic case packed product introducing portion 820 is provided below it.

The plastic case packed product arraying portion 810 comprises a first pusher 812 for supplying a plastic case packed product P supplied from the first plastic case packed product supplying line 830 to the plastic case packed product introducing portion 820, a second pusher 813 for supplying a plastic case packed product P' supplied from the second plastic case packed product supplying line 840 to the plastic case packed product introducing portion 820, and a base 811 which holds the first pusher 812, the second pusher 813, an outlet portion of the second horizontal conveyor 836 and an outlet portion of the second plastic case packed product supplying line 840 at predetermined positions.

The first pusher 812 is provided at an outlet of the second horizontal conveyor 836 and the second pusher 813 is provided at an outlet of the second plastic case packed product supplying line 840.

The base 811 comprises a base portion 811A extended in a L shape from the second pusher 813 to the first pusher 812 and a pusher supporting portion 811B which supports the outlet portions of the first pusher 812 and the second horizontal conveyor 836. The base portion 811A is provided with a plastic case packed product introduction opening portion 811C for introducing the plastic case packed product P to the plastic case packed product introducing portion 820. A portion between the plastic case packed product introduction opening portion 811C and the second horizontal conveyor 836 at the base portion 811A is formed in a circular shape along a trajectory of the first pusher member 812C, which will be described later, of the first pusher 812 and a guide wall 811D for holding the plastic case packed product P from dropping is provided on an outside edge. A guide wall 811E and a guide wall 811F are provided on both side edge portions between the second plastic case packed product supplying line 840 and the plastic case packed product introduction opening portion 811C at the base portion 811A.

Figure 61:
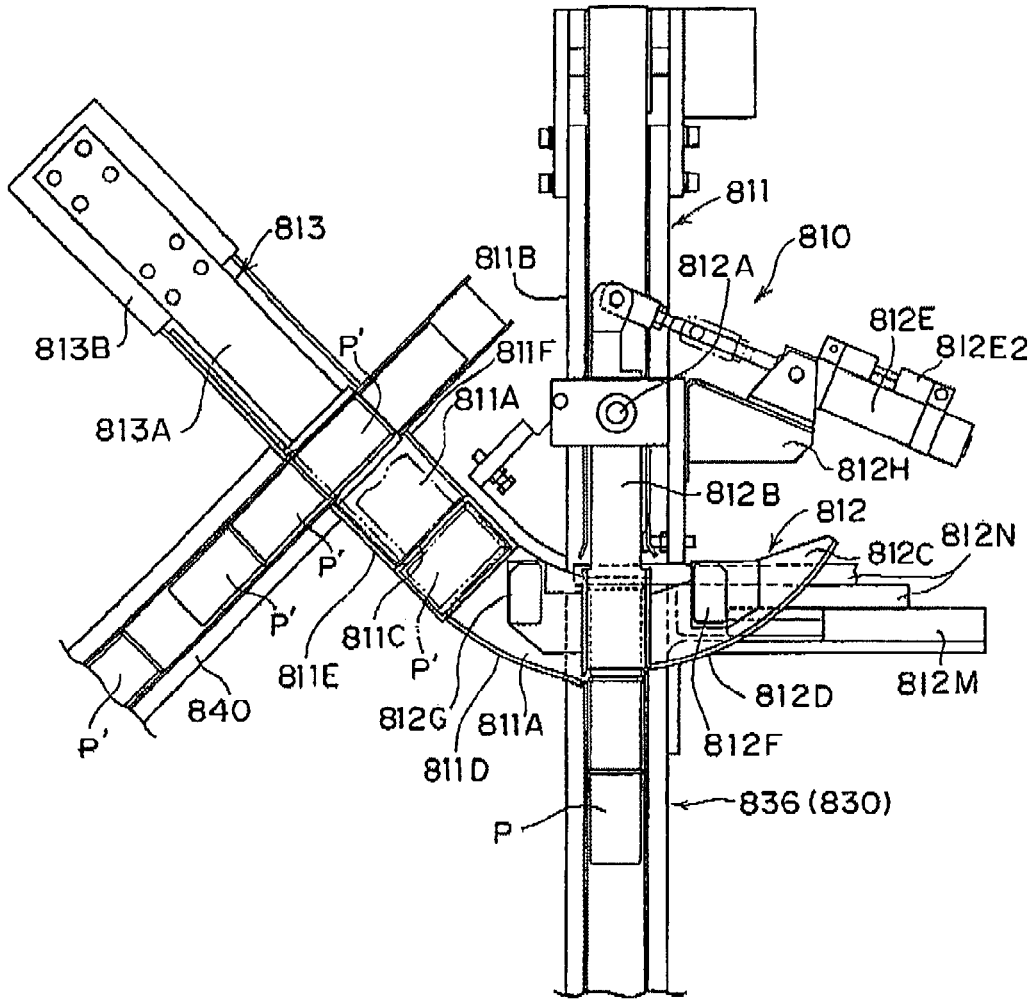
FIG. 61 is a plan view showing an entire construction of a plastic case-packed product arraying portion incorporated into the plastic case-packed product supplying apparatus shown in FIG. 55.
Figure 62:
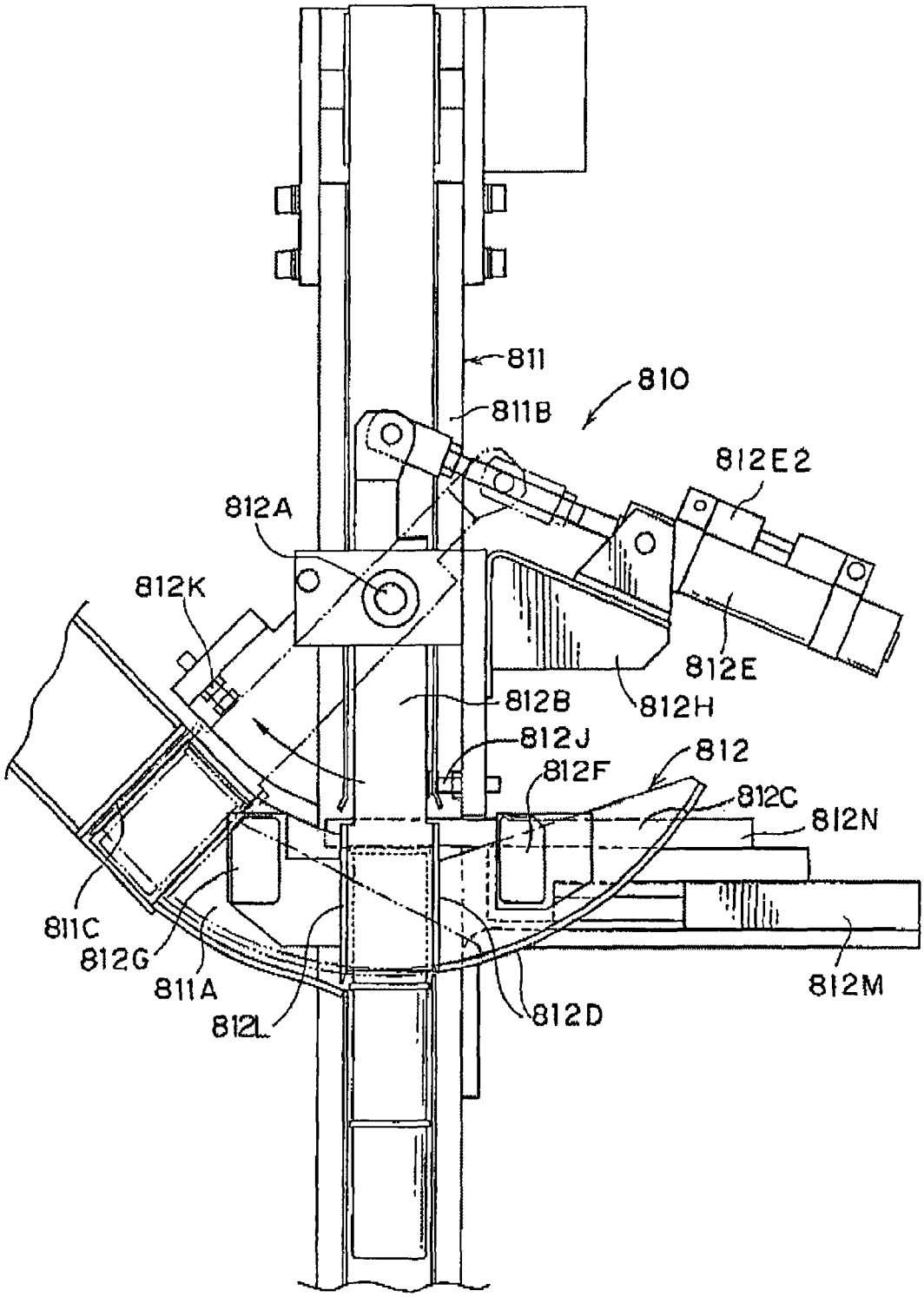
FIG. 62 is an expanded view showing the operation of the first pusher incorporated in the plastic case-packed product arraying portion shown in FIG. 61.

As shown in FIGS. 61 and 62, the first pusher 812 comprises an arm member 812B mounted at an end rotatably around a pivot 812A fixed on the pusher supporting portion 811B and a first pusher member 812C fixed on the other end of the arm member 812B. The first pusher portion 812C is entirely formed in a planar crescent shape and extended in a direction leaving the plastic case packed product introduction opening portion 811C. A cylindrical plastic case packed product stopper wall 812D formed around the pivot 812A is provided on a circular edge portion of the first pusher member 812C. The plastic case packed product stopper wall 812D is extended along the arm member 811B at an end portion on a side fixed to the arm member 811B of the first pusher member 812C, forming a portion to be mounted to the arm member 811B. On the other hand, a plastic case packed product holding wall 812L parallel to the plastic case packed product stopper wall 812D is fixed on an end portion on a side of the arm member 811B on which the first pusher 812C is fixed.

An actuator 812E for rotating the arm member 812B is mounted on the other end of the arm member 812B. The actuator 812E is mounted rotatably on the pusher supporting portion 811B through the arm member 812H. Further, an automatic switch 812E2 detecting the rotating position of the arm member 812E is provided on the actuator 812E.

The pusher supporting portion 811B has rotation range setting screw 812J and rotation range setting screw 812K for setting a rotation range of the arm member 812B.

When the arm member 812B is rotated by the actuator 812E, the first pusher member 812C is moved on the base 811 while drawing a circular trajectory so that it is located at a first position adjacent to an end of the second horizontal conveyor 836 or a second position adjacent to the plastic case packed product introduction opening portion 811C. In the meantime, the first position in which the first pusher member 812C is located is indicated with a solid line while the second position in which it is located is indicated with a two-dot chain line in FIG. 62.

At a portion of the second horizontal conveyor 836 below the first pusher 812, a stopper 812N retaining plastic case packed products P conveyed by the second horizontal conveyor 836 and a pneumatic slider 812M popping the stopper 812N onto the second horizontal conveyor 836 and retract it therefrom are provided.

Plastic case arrival detecting sensors 812F and 812G photo-electrically detecting the arrival of plastic case packed products P are provided adjacent to the stopper 812N in the upstream side therefrom so as to have the second horizontal conveyor 836 between the two sensors 812F and 812G.

The second pusher 813 has a second pusher member 813A for pushing the plastic case packed product P'. The second pusher member 813A is reciprocated on the base 811 by an air slider 813B in the direction at right angle to the second horizontal conveyor 836 and then, located at a first position adjacent to an end of the second plastic case packed product supplying line 840 and a second position adjacent to the plastic case packed product introduction opening portion 811C. In the meantime, the first position in which the second pusher 813A is located is indicated with a solid line and the second position is indicated with a two-dot chain line in FIG.

61. On a portion of the second plastic case packed product supplying line 840 downstream from the second pusher 813, a stopper 813C is disposed. The stopper 813C can be opened by an pneumatic slider.

The plastic case packed product P carried by the second horizontal conveyor 836 passes between the plastic case packed product stopper wall 811D and the plastic case packed product holding wall 812L and is stopped by being retained by the stopper 812N. Then, the arrival of the plastic case packed product P is detected by the plastic case arrival detecting sensors 812F and 812G and a direction of the plastic case packed product P is detected by a direction-detecting sensor (not shown) provided on the stopper 812N.

If the plastic case arrival detecting sensors 812F and 812G detect the arrival of the plastic case packed product P and the direction-detecting sensor provided on the stopper 812N detects that the plastic case packed product P is in a correct direction, the arm member 812B is rotated in the direction indicated with an arrow in FIG. 62 and the first pusher member 812 is moved to the second position. Consequently, the plastic case packed product P is pushed and dropped from the plastic case packed product introduction opening portion 811C to the plastic case packed product introducing portion 820.

After the plastic case packed product P drops on the plastic case packed product-introducing portion 820, the arm member 812B is rotated to an opposite direction to the aforementioned arrow, so that the first pusher member 812C is returned to the first position.

On the other hand, if the stopper 812N is opened, the plastic case product P passes between the plastic case packed product stopper wall 811D and the plastic case packed product holding wall 812L, moves into a product-collecting conveyor (not shown) located downstream from the second horizontal conveyor and discharged into a smaller silo (not shown).

While the first pusher 812 is moved from the first position to the second position and returned to the first position again, the plastic case packed product P is carried by the second horizontal conveyor 836. However, because the outlet of the second horizontal conveyor 836 is covered with the plastic case packed product stopper wall 812D if the first pusher 812 is not located at the first position, the plastic case packed product P is stopped before the plastic case packed product arraying portion 810.

If the first pusher 812 is returned to the first position, a next plastic case packed product P located most near the outlet on the second horizontal conveyor 836 is pushed out to the base 811. Then, the plastic case packed product P is pushed by the first pusher member 812C according to the above-described procedure and dropped on the plastic case packed product introduction opening portion 811C.

If a predetermined quantity of the plastic case packed products, for example, three plastic case packed products P are supplied to the plastic case packed product introducing portion 820, a plastic case packed product P' is supplied to the plastic case packed product introducing portion 820 by the second pusher 813.

The plastic case packed product P' is carried to the plastic case packed product arraying portion 810 by the second plastic case packed product supplying line 840 and abuts an end face of the second pusher member 813A located at the first position and the guide wall 811F on the base 811, and stopped.

After the plastic case packed product P' is stopped at the aforementioned position, the second pusher member 813A is moved to the second position indicated with a two-dot chain line in FIG. 61. Consequently, the plastic case packed product P' is pushed and dropped from the plastic case packed product introduction opening portion 811C to the plastic case packed product introducing portion 820.

After the plastic case packed product P' drops on the plastic case packed product introducing portion 820, the second pusher member 813A is returned to the first position.

While the second pusher member 813A is moved from the first position to the second position and returned to the first position, the plastic case packed product P' is carried by the second plastic case packed product supplying line 840. However, because the second pusher member 813A covers the outlet of the second plastic case packed product supplying line 840 when it is not located at the first position, the plastic case packed product P' is stopped before the plastic case packed product arraying portion 810.

The first pusher 812 and the second pusher 813 repeat the above-described operation so as to supply the plastic case packed product P and plastic case packed product P' to the plastic case packed product introducing portion 820 so as to obtain a predetermined combination.

1-3 Second Plastic Case Packed Product Supplying Line

Figure 63:
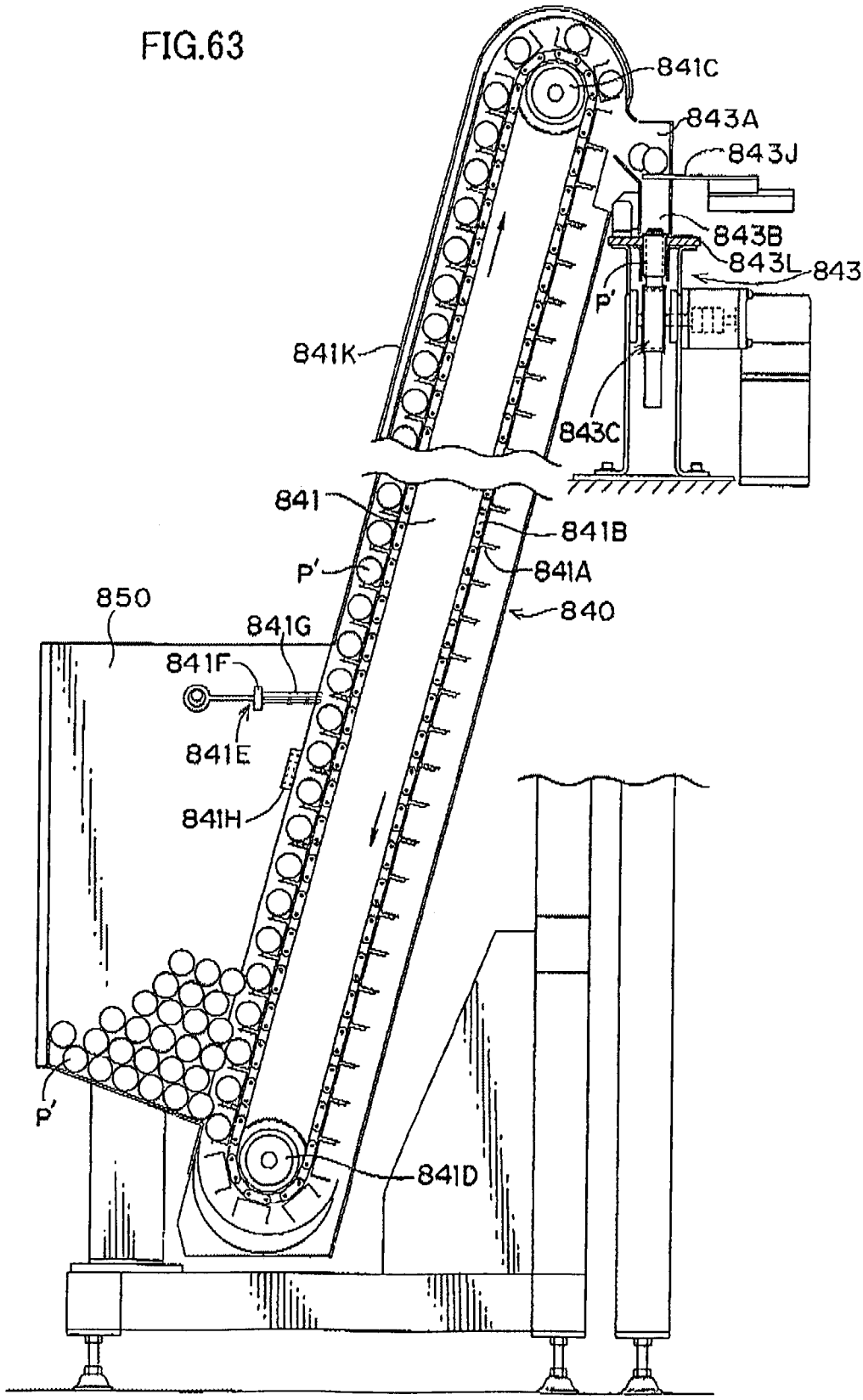
FIG. 63 is a side view showing a constitution of a lift-up conveyer and a plastic case-packed product arranging portion in the second plastic case-packed product supplying line incorporated into the plastic case-packed product supplying apparatus shown in FIG. 55.
Figure 64:
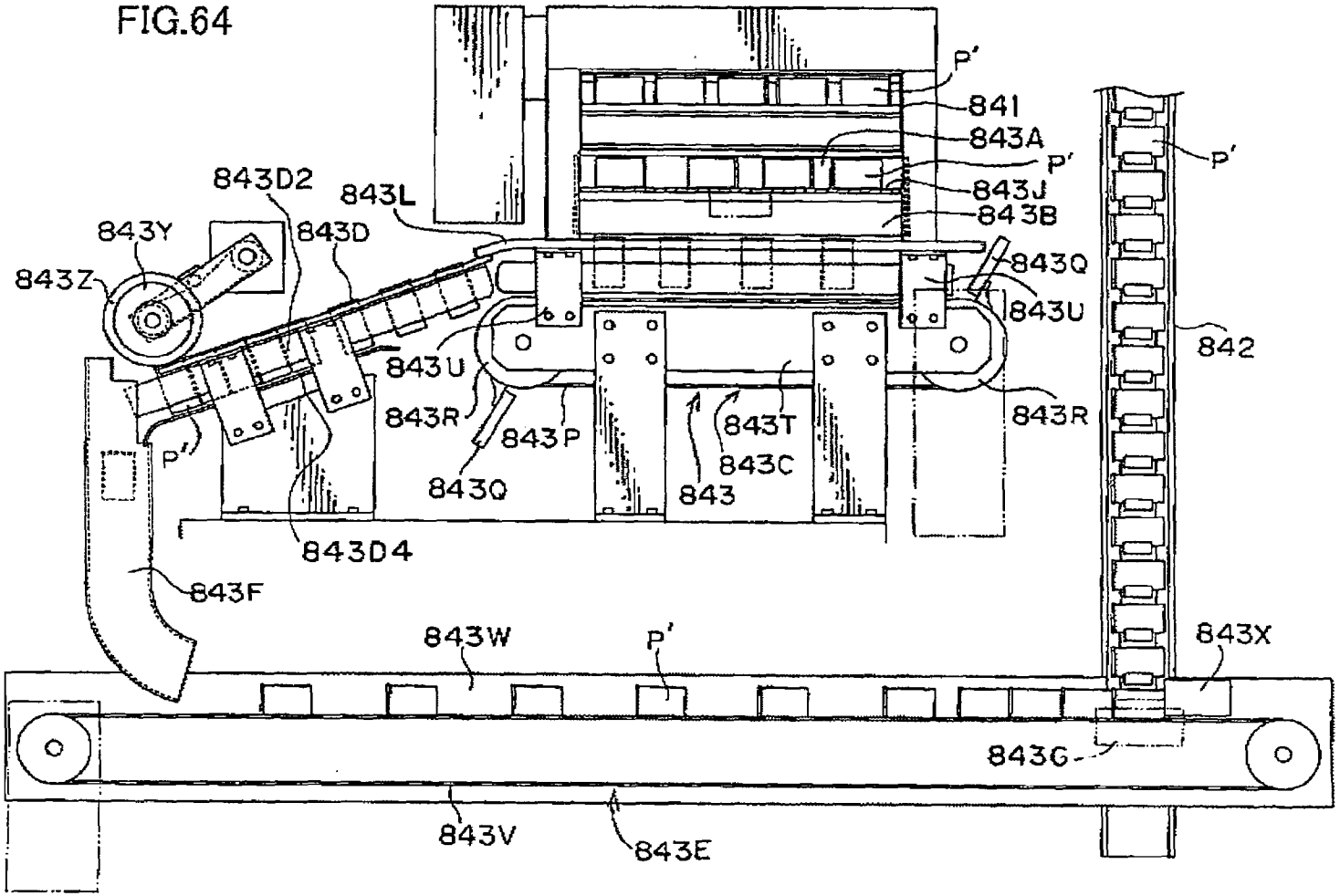
FIG. 64 is a front view showing a detailed constitution of the plastic case-packed product arranging portion incorporated in the second plastic case-packed product supplying line.

As shown in FIGS. 54, 63 and 64, the second plastic case packed product supplying line 840 comprises a lift-up conveyor 841 for grabbing the plastic case packed product P' upward from the plastic case packed product silo 850, a vertical conveyor 842 for carrying the plastic case packed product P' grabbed upward by the lift-up conveyor 841 substantially upward, a plastic case packed product arranging portion 843 which is provided between the lift-up conveyor 841 and the vertical conveyor 842 for arranging the plastic case packed product P' grabbed out by the lift-up conveyor 841 and supplying to the vertical conveyor 842, a horizontal conveyor 845 for carrying the plastic case packed product P' carried upward by the vertical conveyor 842 horizontally to the plastic case packed product arranging portion 810, and a plastic case packed product direction conversion unit 844 which is provided between the vertical conveyor 842 and the horizontal conveyor 845 for converting the direction of the plastic case packed product P' carried by the vertical conveyor 842.

(A) Lift-Up Conveyor

Figure 65:
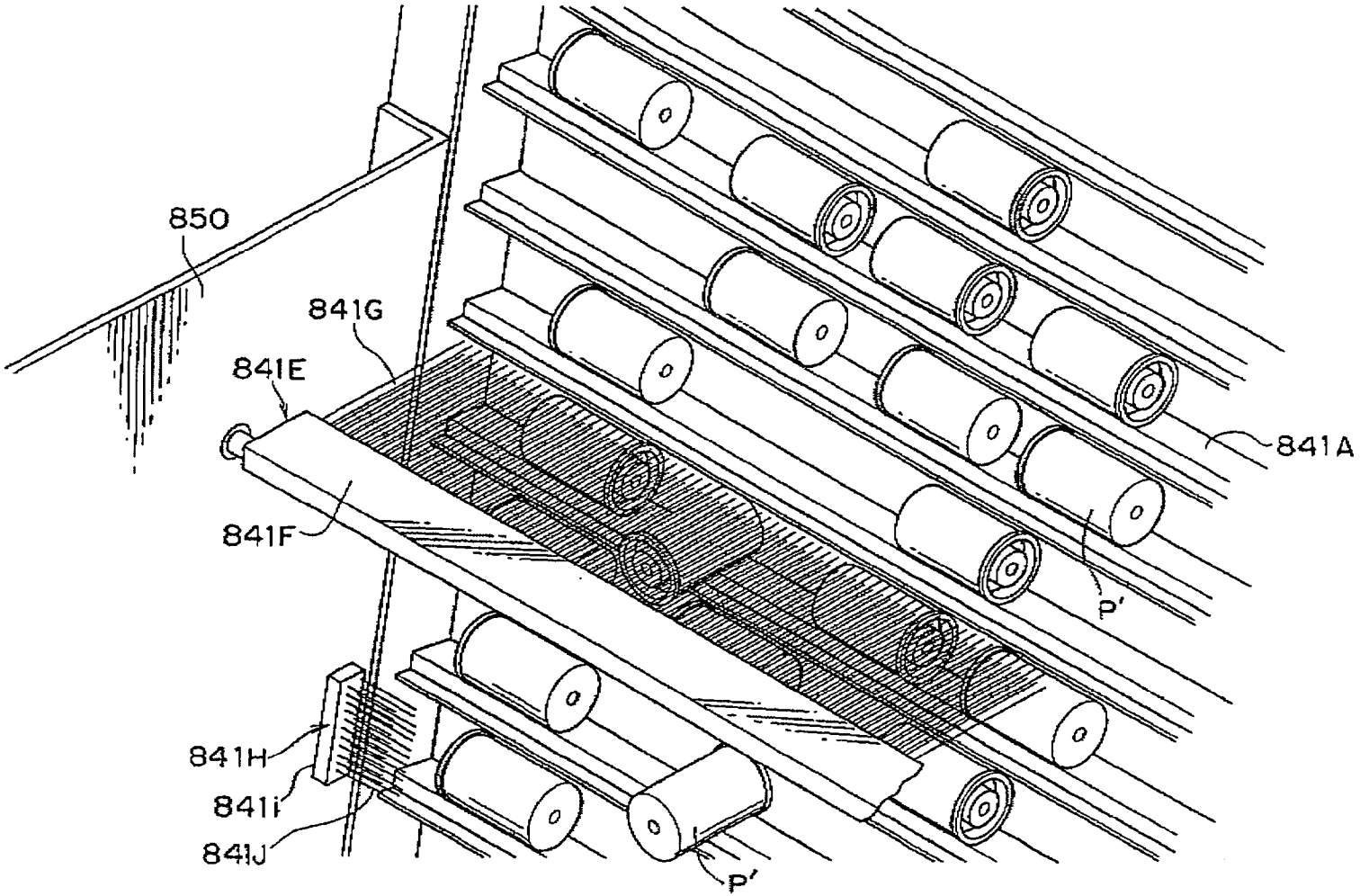
FIG. 65 is an expanded perspective view showing a detailed constitution of the lift-up conveyer incorporated in the second plastic case-packed product supplying line.
Figure 66:
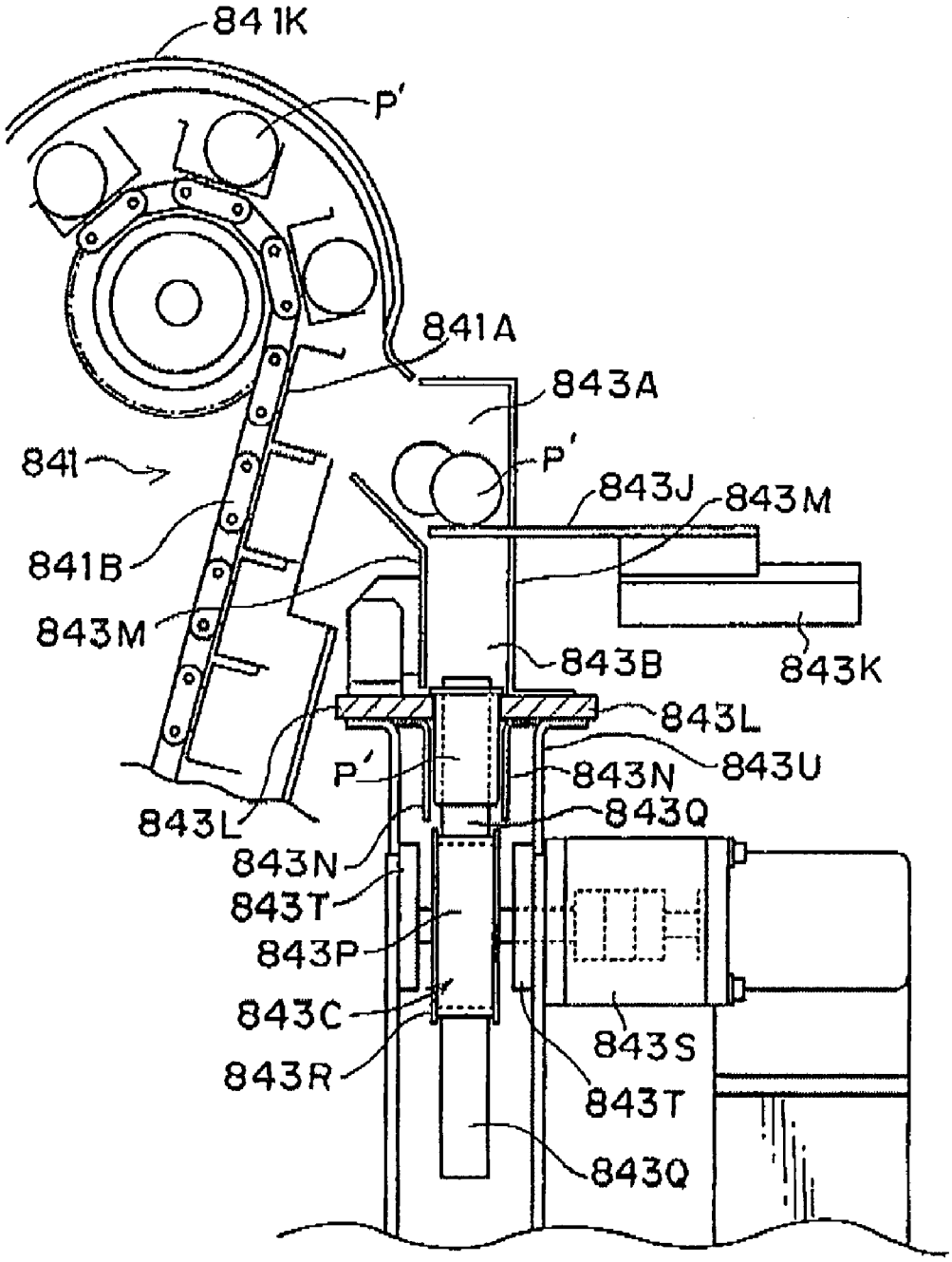
FIG. 66 is an expanded sectional view showing a detailed structure of the portion from the lift-up conveyer to the plastic case packed product arranging portion incorporated in the second plastic case-packed product supplying line.

The lift-up conveyor 841 is an elevating conveyor having a width capable of placing five or six plastic case packed products P' horizontally and its bottom end portion is located near a bottom portion of the plastic case packed product silo 850. It comprises a shelf plate 841A which is provided horizontally and grabs the plastic case packed product P' from the plastic case packed product silo 850 and a drive chain 841B on which the shelf plate 841A is fixed at a predetermined interval. As shown in FIGS. 65 and 66, the shelf plates 841A have a inverted U-shaped section and the adjacent two shelf plates 841A are fixed to the drive chain 841B such that both of them abut each other without any gap when the drive chain 841B is expanded linearly. The drive chain 841B is held by sprockets 841C and 841D provided on both ends and rotate clockwise in FIG. 63.

As shown in FIGS. 63 and 65, a horizontal brush 841E is provided from above the plastic case packed product silo 850 toward the lift-up conveyor 841. The horizontal brush 841E comprises a brush base 841F fixed within the plastic case packed product silo 850 horizontally and a brush fibers 841G stretched from the brush base 841F toward the lift-up conveyor 841. As shown in FIG. 65, the horizontal brush 841E has a function of hitting down the plastic case packed product P' placed such that it projects from the shelf plate 841A.

A vertical brush 841H is provided along a driving direction of the lift-up conveyor 841 below the horizontal brush 841E on an inner wall of the plastic case packed product silo 850. The vertical brush 841H comprises a brush base 841*i* fixed in a driving direction of the lift-up conveyor 841 and brush fibers 841J stretched from the brush base portion 841*i* toward the central portion of the lift-up conveyor 841. The vertical brush 841H has a function of hitting down the plastic case packed product P' placed on the shelf plate 841A such that it projects from both ends thereof.

A portion of the lift-up conveyor 841 above the plastic case packed product silo 850 is covered with a cover 841K in order to prevent the plastic case packed product P' grabbed from the plastic case packed product silo 850 from falling from the shelf plate 841A.

(B) Plastic Case Packed Product Arranging Portion

As shown in FIGS. 54, 63 and 66, a plastic case packed product arranging portion 843 is provided at a top end of the lift-up conveyor 841.

As shown in FIGS. 63, 64, 66 to 69, the plastic case packed product arranging portion 843 comprises a plastic case packed product introduction portion 843A, which is a chamber into which the plastic case packed product P' is introduced by the lift-up conveyor 841, a plastic case packed product direction conversion portion 843B located below the plastic case packed product introduction portion 843A and for converting the direction of a plastic case packed product P' introduced by the plastic case packed product introduction portion 843A such that its lid is directed upward, a discharge conveyor 843C located below the plastic case packed product direction conversion arranging portion 843B and for pushing the plastic case packed product P' whose direction is converted by the plastic case packed product direction conversion arranging portion 843B out of the plastic case packed product direction conversion arranging portion 843B, an inclined chute 843D for introducing the plastic case packed product P' pushed by the discharge conveyor 843C out of the plastic case packed product direction conversion arranging portion 843B, an arrangement transporting conveyor 843E which is a horizontal conveyor located below the inclined chute 843D and for moving the P packed product P' to the vertical conveyor 842, and a vertical duct 843F which is provided vertically from a terminal of the inclined chute 843D toward a beginning end of the arrangement transporting conveyor 843E and for introducing the plastic case packed product P' which slides down on the inclined chute 843D to the arrangement transporting conveyor 843E.

The inclined chute 843D has side plates 843D2 disposed so that the plastic case packed product P' can pass between them and a bottom plate 843D4 disposed between the side plates 843D2 and form a bottom of the inclined chute 843D. The bottom of the plastic case packed product P' is supported by the bottom plate 843D4. Thus, pendulous motion of the plastic case packed product P' is prohibited and the plastic case packed product P' smoothly slides down the inclined chute 843D.

A plastic case packed product stopper 843Y for holding the plastic case packed product P' which slides down on the inclined chute 843D at its bottom end and introduces into the vertical duct 843F at a predetermined time interval is provided at a bottom end of the inclined chute 843D. The plastic case packed product stopper 843Y includes a roller 843Z which presses the plastic case packed product P' from above and by rotating the roller 843Z at a predetermined time interval, the plastic case packed product P' is introduced into the vertical duct 843 at the predetermined time interval.

Figure 69:
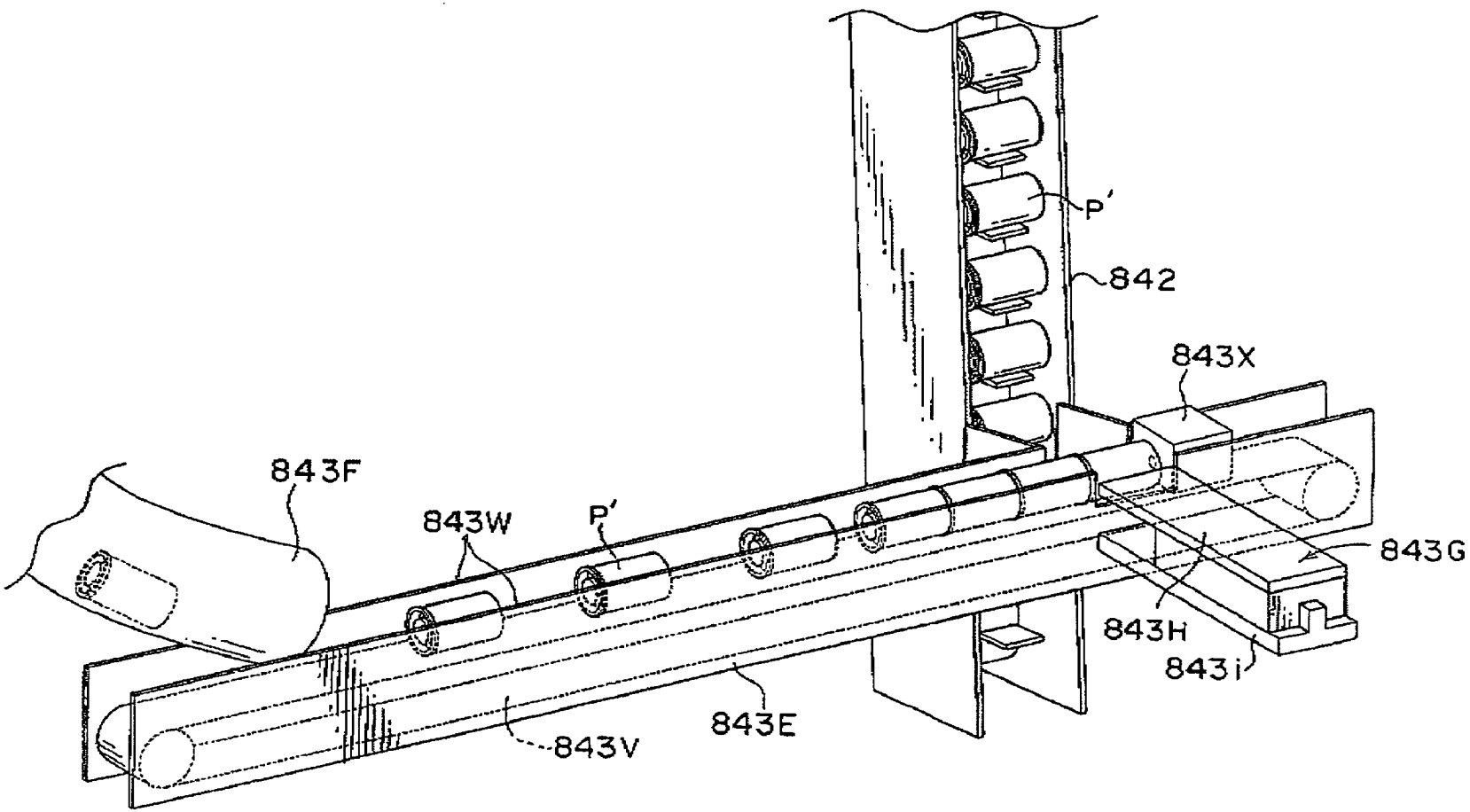
FIG. 69 is an expanded perspective view showing a constitution close to an arrangement transporting conveyer of the plastic case packed product arranging portion.

As shown in FIG. 69, a pusher 843G for transferring the plastic case packed product P' carried by the arrangement transporting conveyor 843E to the vertical conveyor 842 is provided at a terminal portion of the arrangement transporting conveyor 843E. The pusher 843G comprises a plate-like pusher plate 843H for pressing the plastic case packed product P' carried by the arrangement transporting conveyor 843E toward the vertical conveyor 842 and an air slider 843*i* for reciprocating the pusher plate 843H along a direction at right angle to the arrangement transporting conveyor 843E.

The plastic case packed product introduction portion 843A and the plastic case packed product direction conversion arranging portion 843B are partitioned by a movable partition plate 843J. As shown in FIGS. 66 and 67, the movable partition plate 843J is reciprocated by the air slider 843K in a direction approaching and leaving the lift-up conveyor 841.

As shown in FIGS. 63, 64, 66 to 68, a pair of the plate-like arranging plate 843L are provided halfway of the plastic case packed product direction conversion arranging portion 843B such that they are in parallel to each other and horizontal. An interval of the arranging plates 843L is set to a size as large as allows a flange portion of the lid portion not to be passed through although the main body of the plastic case packed product P' can pass.

A pair of the guide plates 843M are provided above the arranging plate 843L and a pair of the guide plates 843N are provided below the arranging plate 843L. An interval between the guide plates 843M is set to a size as large as allows the plastic case packed product P' to be passed through and the an interval between the guide plates N is set substantially equal to the interval between the arranging plates 843L.

As shown in FIGS. 63, 64, 66 to 68, the discharge conveyor 843C comprises a drive belt 843P which is provided just below the arranging plate 843L and the guide plate 843N and in parallel to the arranging plate 843L, a pair of paddle portions 843Q, which are provided at right angle to the drive belt 843P and at symmetrical positions to each other, a pair of pulleys 843R for holding and driving the drive belt 843P and a drive motor 843S for driving one of the pulleys 843R. The pulley 843R is held by a pair of the holding plates 843T from outside. The arranging plate 843L is fixed on the holding plate 843T through a arranging plate holding member 843U.

As shown in FIGS. 64 and 69, the arrangement transporting conveyor 843E comprises a belt conveyor portion 843V for transporting the plastic case packed product P' and a pair of guide plates 843W which are provided on both sides of the belt conveyor portion 843V for holding the plastic case packed product P from falling down. The guide plate 843W located forward relative to this paper in FIG. 64 is omitted. A stopper 843X for stopping the plastic case packed product P' in the vicinity of the pusher 843G is provided at a terminal end of the arrangement transporting conveyor 843E.

(C) Operation of Second Plastic Case Packed Product Supplying Line

Because in the lift-up conveyor 841, the drive chain 841B is rotated clockwise in FIG. 63 as described above, the shelf plate 841A is moved upward within the plastic case packed product silo 850. Therefore, the plastic case packed product P' accommodated in the plastic case packed product silo 850 is raised upward by the shelf plate 841A. Here, the plastic case packed product P' placed on the shelf plate 841 such that it is projected from an edge of the shelf plate 841A is hit downward by the horizontal brush 841E and the vertical brush 841H as shown in FIG. 65, and only the plastic case packed products P' placed horizontally on the shelf plate 841A are carried upward. When the plastic case packed products P are carried upward by the shelf plate 841A, the lid portion of some plastic case packed product P' is directed to the right to the transporting direction while that of others is directed to the left.

Figure 67A:
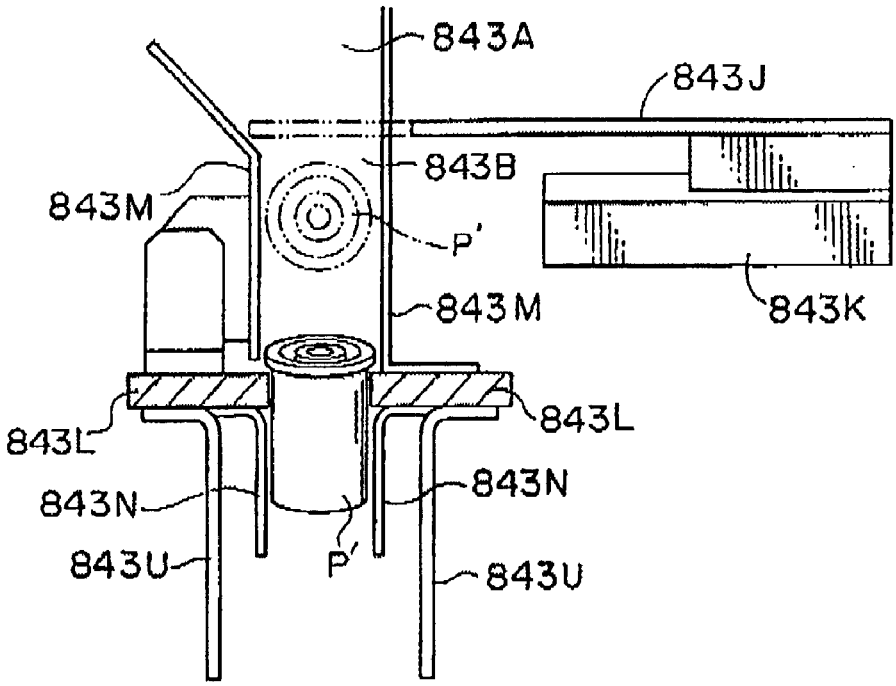
FIGS. 67A and 67B are partial expanded sectional views of the plastic case packed product arranging portion.
Figure 67B:
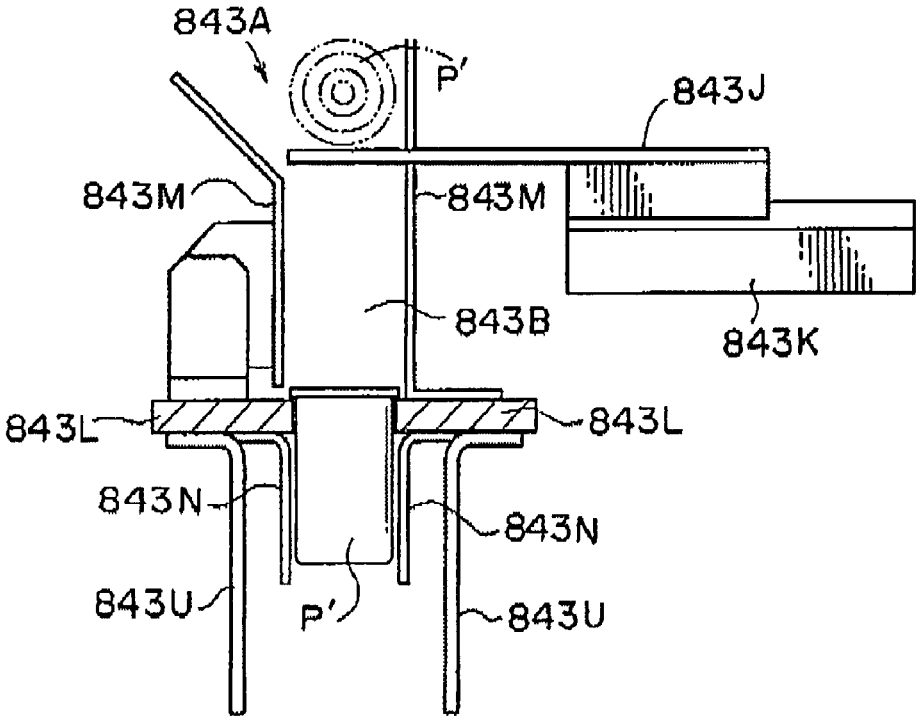

After the plastic case packed product P' carried upward by the lift-up conveyor 841 is introduced into the plastic case packed product introduction portion 843A, the movable partition plate 843J is moved so that the plastic case packed product introduction portion 843A communicates with the plastic case packed product direction conversion arranging portion 843B as shown in FIG. 67A. Therefore, all the plastic case packed products P' introduced to the plastic case packed product introduction portion 843A fall on the plastic case packed product direction conversion arranging portion 843B. It the plastic case packed product P' falls on the plastic case packed product direction conversion arranging portion 843B, the lid portion of the plastic case packed product P' is hooked by the arranging plate 843L halfway of the fall, so that the lid portion is held vertically in a condition that it is hooked by the arranging plate 843L as shown in FIG. 67B. Consequently, the direction of the plastic case packed product P' is arranged such that the lid portion is located up while its main body is located down.

Figure 68:
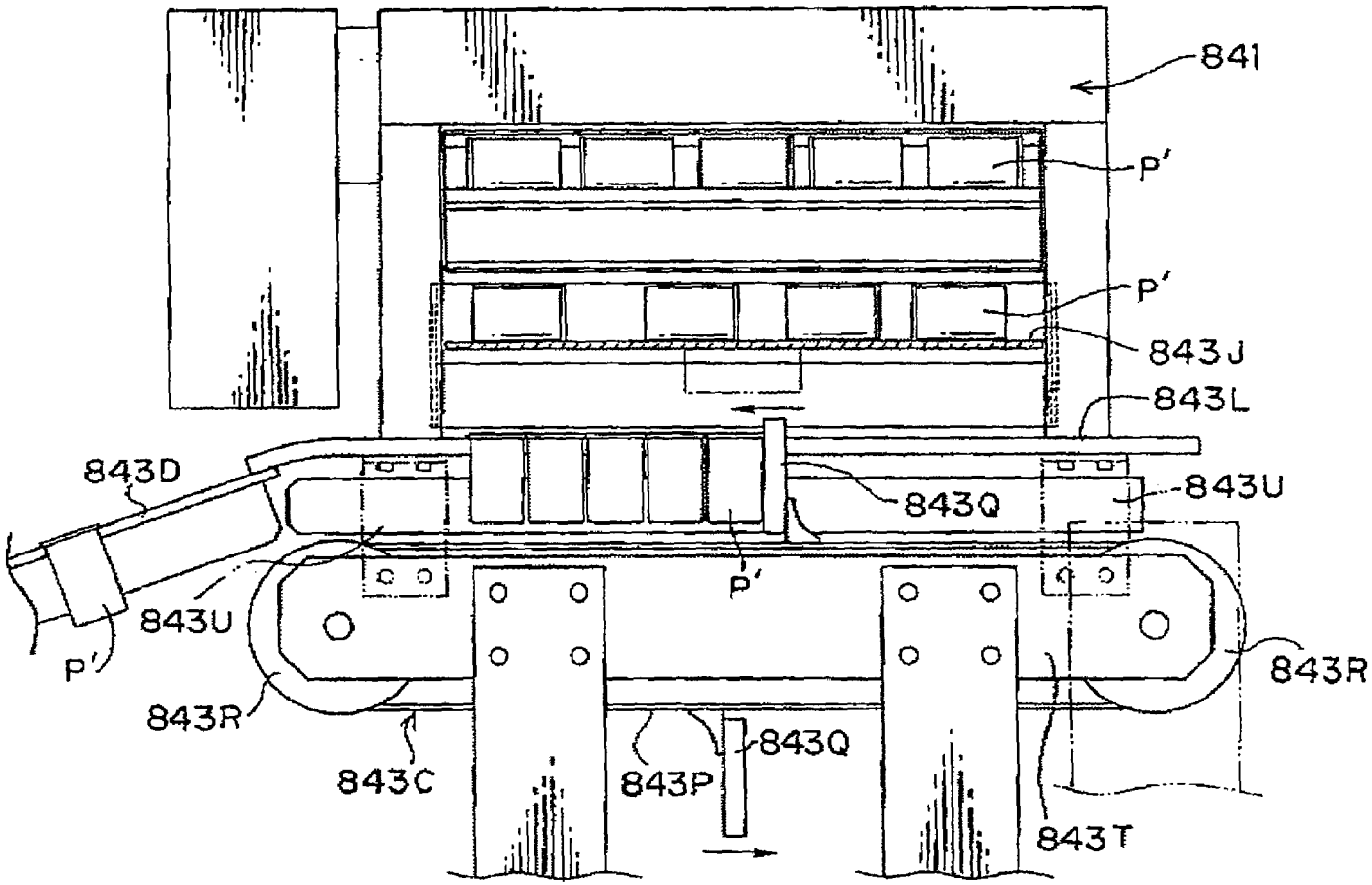
FIG. 68 is an expanded view of the plastic case packed product arranging portion carrying arranged plastic case-packed products out of the portion.

Next, if the discharge conveyor 843C is rotated counterclockwise in FIGS. 64 and 68, the paddle portion 843Q of the discharge conveyor 843C is moved to the left in FIGS. 64 and 68 between the arranging plates 843L. Therefore, the plastic case packed product P' held between the arranging plates 843L is introduced into the inclined chute 843D, in other words, discharged.

The plastic case packed product P' introduced to the inclined chute 843D slides down to a bottom end portion of the inclined chute 843D in a condition that its lid portion is directed upward and introduced to the vertical duct 843F at a predetermined interval by the plastic case packed product stopper 843Y. Therefore, the plastic case packed product P' is introduced into the vertical duct 843F in such a condition that its main body reaches it earlier than its lid portion. Then, it is introduced into the arrangement transporting conveyor 843E with this posture. Therefore, as shown in FIGS. 64 and 69, the plastic case packed product P' is carried by the arrangement transporting conveyor 843E in a posture that the main body faces the transporting direction.

The plastic case packed product P' is carried by the arrangement transporting conveyor 843E with the aforementioned posture and abuts the stopper 843X and stopped. Then, the plastic case packed product P' stopped by the stopper 843X is introduced to the vertical conveyor 842 by the pusher 843G in a condition that its transporting direction is maintained by the arrangement transporting conveyor 843E. Because the transporting direction of the vertical conveyor 842 is at right angle to the transporting direction of the arrangement transporting conveyor 843E, the plastic case packed product P' introduced to the vertical conveyor 842 is held horizontally and carried upward with its lid portion directed in a specific direction.

The plastic case packed product P' lifted up by the vertical conveyor 842 is turned in its direction by the plastic case packed product direction conversion unit 844 and introduced into the horizontal conveyor 845 such that its axial direction is along the transporting direction. Here, the plastic case packed product direction conversion unit 844 has the same structure as the plastic case packed product conversion unit 838 in the first plastic case packed product supplying line 830. Therefore, in the plastic case packed product direction conversion unit 844, the plastic case packed product P' introduced from the vertical conveyor 842 is introduced to the horizontal conveyor 845 such that its main body is directed to the transporting direction and carried to the plastic case packed product arraying portion 810.

1-4 Plastic Case Packed Product Supplying Portion

Figure 70:
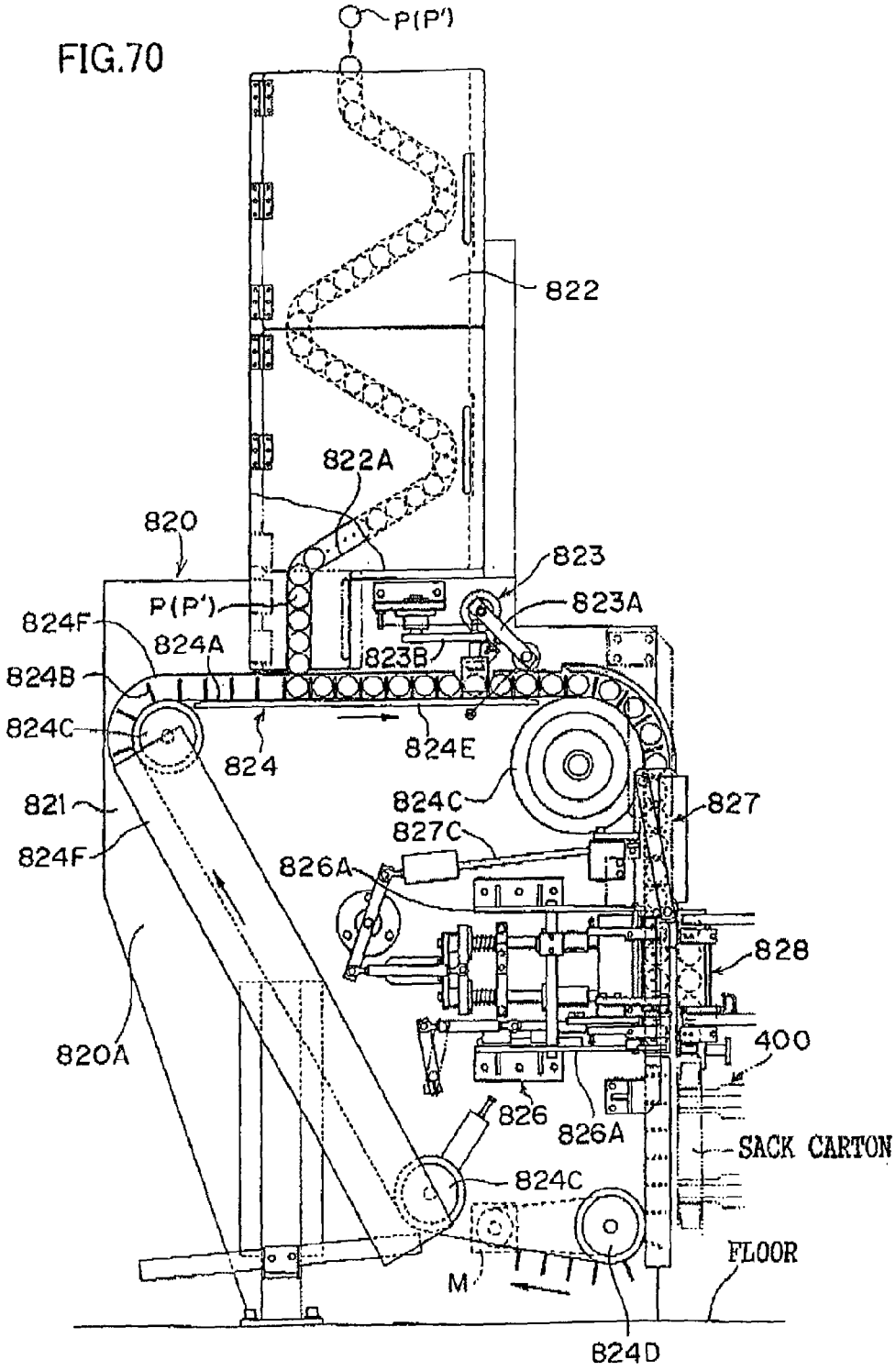
FIG. 70 is a front view showing an entire constitution of a plastic case-packed product-introducing portion of the plastic case-packed product supplying apparatus shown in FIG. 55.

As shown in FIG. 70, the plastic case packed product introducing portion 820 comprises a plastic case packed product chute 822 for transferring the plastic case packed product P and the plastic case packed product P' (hereinafter referred to as plastic case packed product P(P')) arranged by the plastic case packed product arraying portion 810 in a predetermined array downward, a nest portion 828 located above the rotation table of the cartoner 400, a transporting conveyor 824 for transporting the plastic case packed product P (P') which falls through the plastic case packed product chute 822, and a transfer portion 826 for transferring the plastic case packed product P (P') carried by the transporting conveyor 824 to the nest portion 828. The transporting conveyor 824 is provided with a direction detecting portion 827 for detecting whether or not the plastic case packed product P(P') is being transported in a conition that it is directed in a predetermined direction, this detection portion being mounted adjacent to and above the transfer portion 826.

The plastic case packed product introducing portion 820 has a plate-like base 821 erected vertically on a floor face and the plastic case packed product chute 822, the transporting conveyor 824, the transfer portion 826 and the direction detecting portion 827 are fixed at predetermined positions on the base 821. The plastic case packed product chute 822, the transporting conveyor 824, the transfer portion 826, and the direction detecting portion 827 correspond to the packaging object drop chute, the packaging object transporting means, the transfer means and the direction detection means includes by the packaging object supplying apparatus of the invention.

(A) Plastic Case Packed Product Chute

The plastic case packed product chute 822 has a zigzag-like path 822A inclined at a gradient of 30° downward. The plastic case packed product introduction opening portion 811C provided in the plastic case packed product arraying portion 810 communicates with an opening portion at a top end of the path 822A. The plastic case packed product P and plastic case packed product P' introduced from the plastic case packed product introduction opening portion 811C are introduced into the path 822A from the top end opening portion and naturally drops onto the transporting conveyor 824 with a condition that it is loaded in the path 822A without any gap as shown in FIG. 70.

(B) Transportation Conveyor

The transporting conveyor 824 is a belt conveyor for transporting the plastic case packed product P and the plastic case packed product P' by means of an iron rubber belt 824A. The iron rubber belt 824A has partitions 824B provided at a specified interval, so that the plastic case packed product P and the plastic case packed product P' are held between the adjacent two partitions. The iron rubber belt 824A is held by three driven pulleys fixed on the base 821 and a drive pulley 824D driven by a motor M and rotated clockwise as indicated with an arrow in FIG. 70 so as to carry the plastic case packed product P and plastic case packed product P' which fall naturally on the path 822A of the plastic case packed product chute 822 to the transfer portion 826. A support plate 824E which supports the iron rubber belt 824A from down in order to prevent it from being warped by a weight of the plastic case packed product P(P') is provided on a portion to be placed with the plastic case packed product P (P') of the iron rubber belt 824A.

The guide plates 824F for guiding the plastic case packed product P(P') from falling are provided on both sides of the transporting conveyor 824. The guide plate 824E located in the closer side relative to the surface of FIG. 70 is partially omitted in FIG. 70.

A transporting failure detecting portion 823 for detecting whether or not the plastic case packed product P(P') is being transported normally by the iron rubber belt 824A is provided between the plastic case packed product chute 822 and the transporting conveyor 824. The guide plate 824E located in the further side relative to the surface of FIG. 70 has a cut out at a portion adjacent to the transporting failure detecting portion 823 so as not to interfere the motion of the transporting failure detecting portion 823.

Additionally, as shown in FIG. 71, above the transporting conveyor 824 and between the base 821 and the transporting failure detecting portion 823, a plastic case packed product existence detecting sensor 825 detecting whether a plastic case packed product P (P') is between two adjacent partitions 824B is disposed.

Figure 71A:
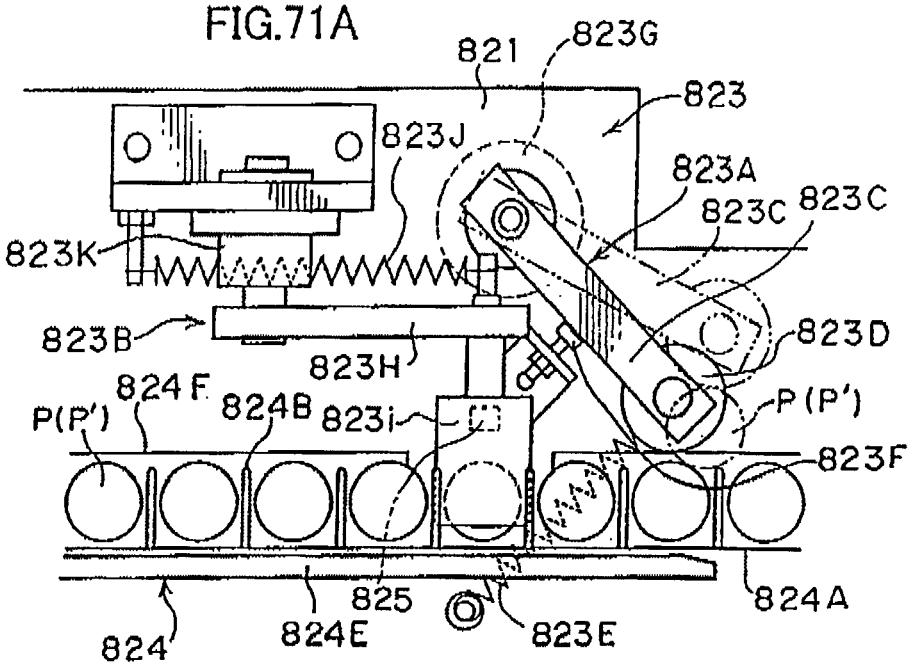
FIGS. 71A and 71B are expanded views showing a detailed constitution of a conveyance jamming-detecting portion incorporated in the plastic case-packed product-introducing portion shown in FIG. 70.
Figure 71B:
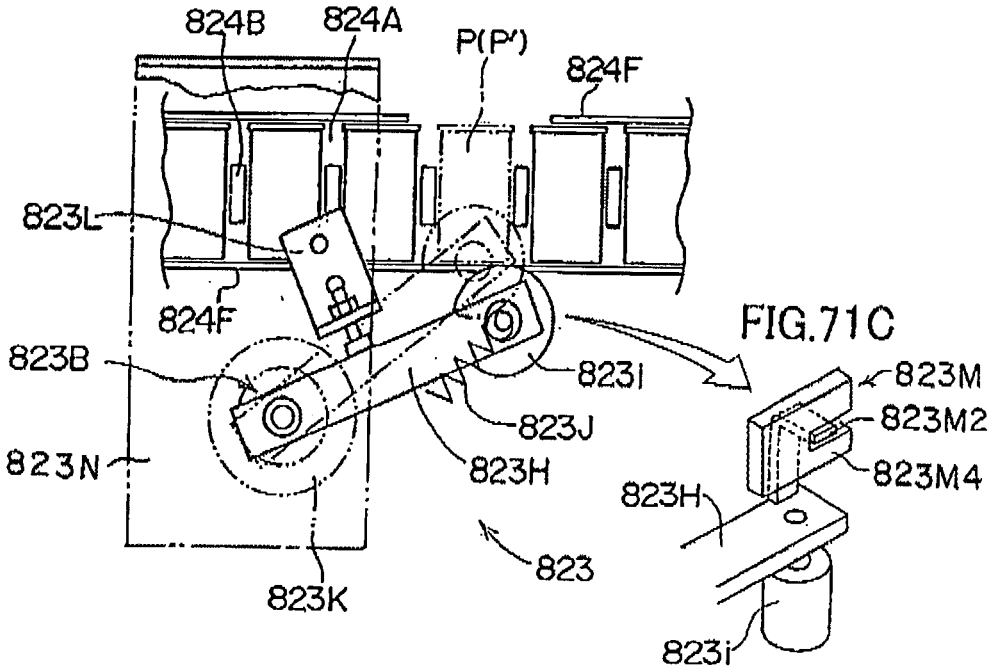
Figure 72:
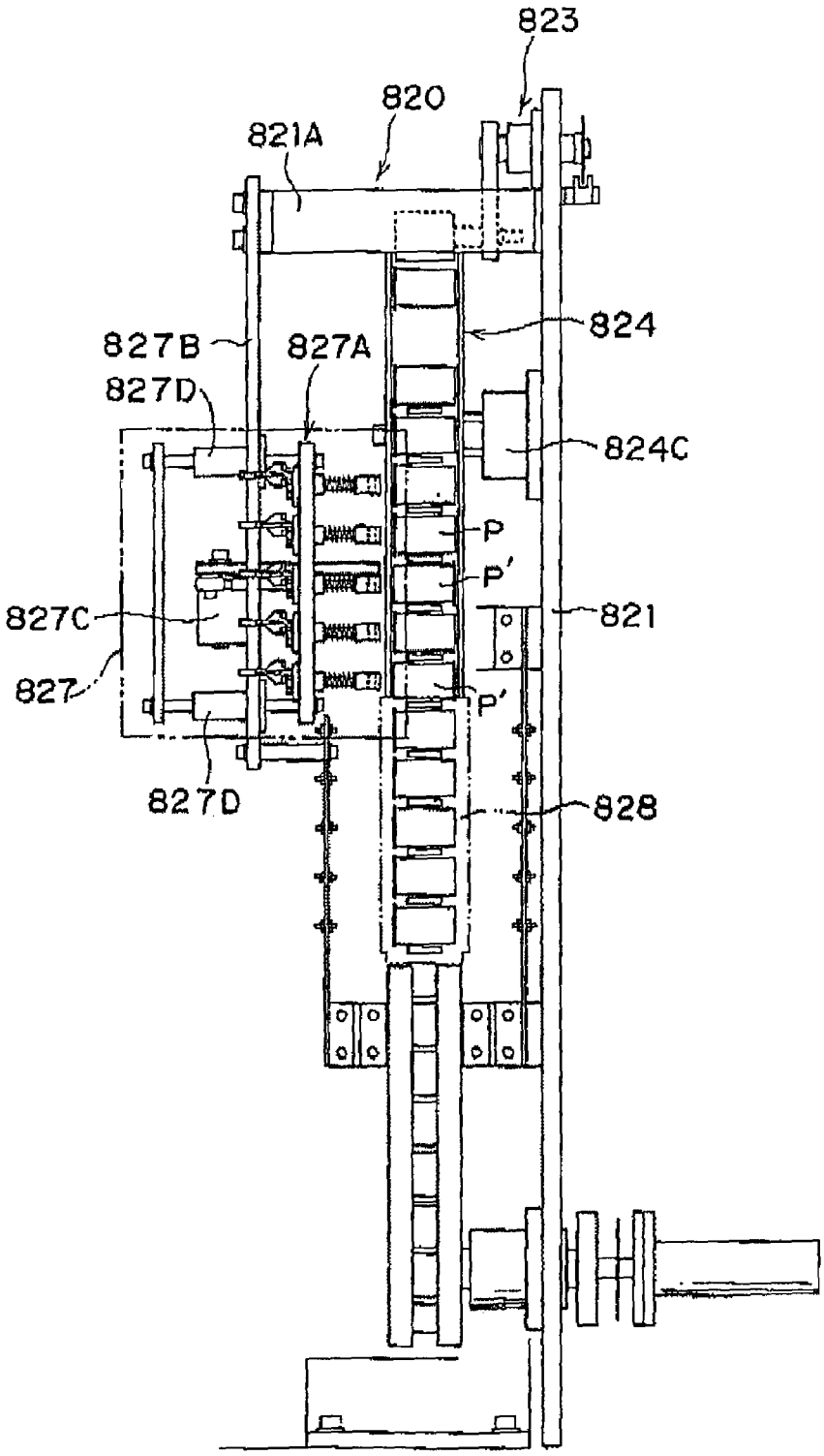
FIG. 72 is a partial side view of a direction-detecting portion included in the plastic case-packed product-introducing portion shown in FIG. 70.
Figure 73:
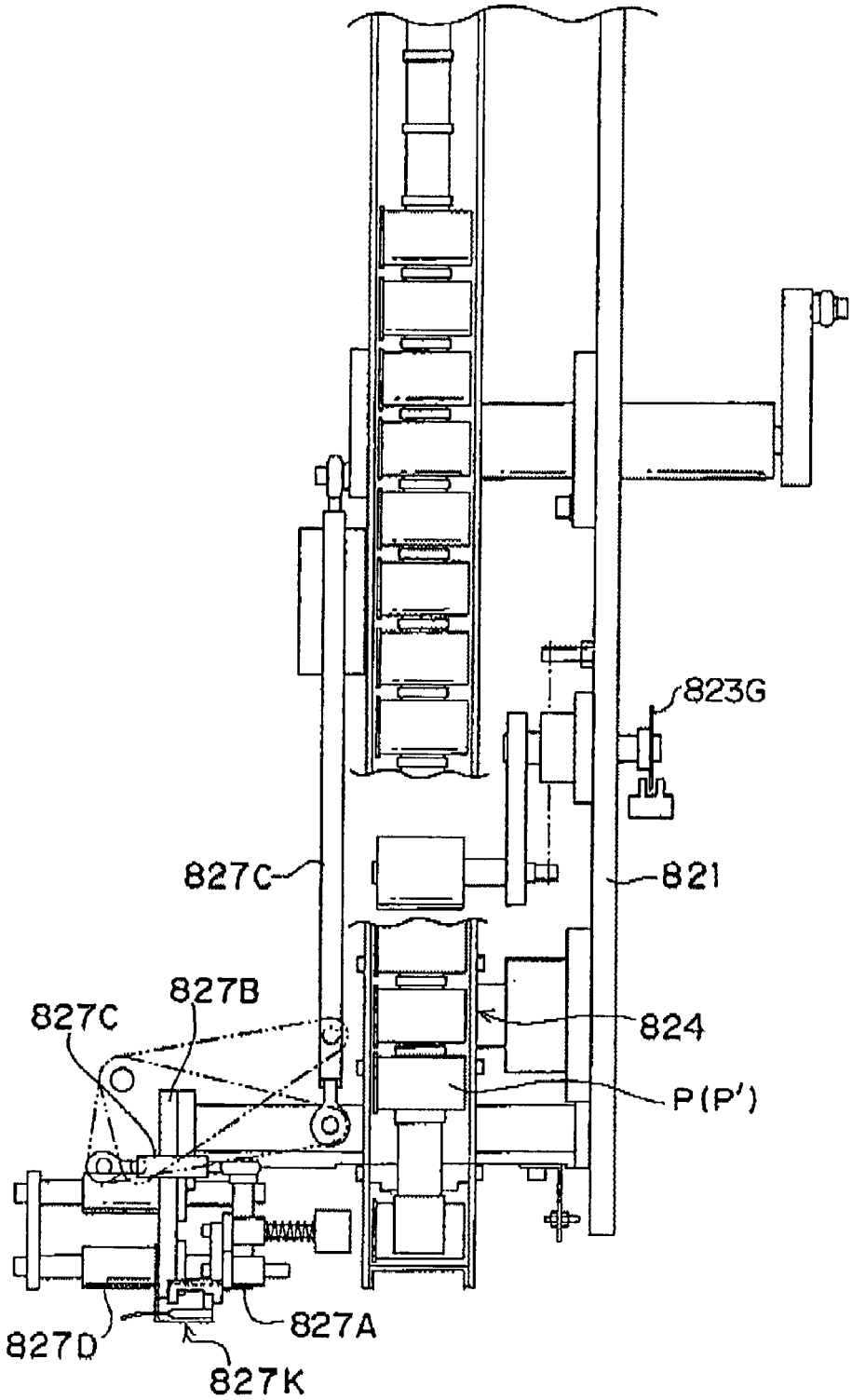
FIG. 73 is a partial plan view showing the top view of the direction-detecting portion shown in FIG. 72.

As shown in FIGS. 70 and 71, the transporting failure detecting portion 823 comprises a first failure detecting portion 823A for detecting a plastic case packed product P (P') floating from the iron rubber belt 824A among plastic case packed products P (P') transported by being held between the partitions 824B and a second failure detecting portion 823B for detecting a plastic case packed product P(P') exists between the partitions 824B without a lid. FIG. 71A shows a front view of the transporting failure detecting portion 823 and FIG. 71B shows a top view thereof. The first failure detecting portion 823A and the second failure detecting portion 823B correspond to the first transporting failure detecting means and the second transporting failure detecting means included by the packaging object supplying apparatus of the invention.

The first failure detecting portion 823A, as shown in FIG. 71A, comprises an arm member 823C one of which end is pivoted, a contact roller 823D provided rotatably at the other end of the arm member 823C, a spring 823E for urging the arm member 823C so as to rotate downward, a stopper 823F for restricting a motion of the arm member 823C from rotating downward and a detecting portion 823G for detecting the motion of the arm member 823C which tries to rotate upward. The contact roller 823D corresponds to a contact element and the arm member 823C and the spring 823E correspond to contact element urging means and the detecting portion 823G corresponds to contact element motion detecting means.

As shown in FIGS. 71A, 71B and 71C, the second failure detecting portion 823B comprises an arm member 823H one of which end is pivoted so as to rotate in the directions approaching and parting from the base 821, a contact roller 823*i* which is provided rotatably at the other end of the arm member 823H, a spring 823J for urging the arm member 823H so as to rotate in the direction approaching the base 821, a stopper 823L for restricting the motion of the arm member 823H's rotating in a direction approaching the base 821 and a detecting portion 823M for detecting the motion of arm member 823H's rotation in the direction approaching the base 821. A Supporting base 823N is horizontally disposed on the base 821 and the arm member 823H is pivoted on the supporting base 823N by a bearing 823K. The detecting portion 823M consists of a dog 823M2 attached at the tip of the arm member 823H and a sensor 823M4 detecting a position of the dog 823M2. The contact roller 823*i* corresponds to a contact element, the spring 823J and the arm member 823H correspond to contact element urging means and the detecting portion 823M corresponds to contact element motion detecting means.

When the plastic case packed product P (P') is being transported normally on the transporting conveyor 824, in the first failure detecting portion 823A, the arm member 823C urged in a direction rotating downward by the spring 823E is held at a position indicated with a solid line in FIG. 71A by the stopper 823F so as to prevent the contact roller 823D from abutting on the plastic case packed product P (P') being transported by the transporting conveyor 824. In the second failure detecting portion 823B, as indicated with a solid line in FIG. 71B, the arm member 823H is rotated by the plastic case packed product P (P') transported by the transporting conveyor 824 in a direction approaching the base 821 resisting an urging force of the spring 823J and abuts the stopper 823L.

If there takes place a transporting failure such that a plastic case packed product P (P') is transported with placing on two adjacent plastic case packed products P (P') carried by the transporting conveyor 824, as indicated with a two-dot chain line in FIG. 71A, or a plastic case packed product P (P') is floating from a correct location while transported by the transporting conveyor 824, the contact roller 823D of the first failure detecting portion 823A abuts the plastic case packed product P(P') on the adjacent two plastic case packed products P(P') or floating from the correct location and is jumped upward. Thus, the arm member 823C also rotates upward. When this motion is detected by the detecting portion 823F, the first failure detecting portion 823A detects the aforementioned transporting failure.

On the other hand, when no plastic case packed product P (P') exists between the two adjacent partitions 824B of the transporting conveyor 824 or a plastic case packed product P (P') without a lid is transported, as indicated with a two-dot chain line in FIG. 71B, the arm member 823H is rotated by the urging force from the spring 823J in the direction approaching the base 821 and touches the stopper 823L. Such a motion is detected by the detecting portion 823M and the second failure detecting portion 823B detects the aforementioned transporting failure of the plastic case packed products.

If at least one of the first failure detecting portion 823A and the second failure detecting portion 823B detects any transporting failure, the transporting failure detecting portion 823 inputs a relating signal into the control computer. If the aforementioned signal is inputted into the control computer, the entire plastic case packed product supplying unit 800 is stopped.

(C) Direction Detecting Portion

The direction detecting portion 827, as shown in FIGS. 72 to 76, comprises a direction determining dog 827A for determining which way the plastic case packed product P (P') carried by the transporting conveyor 824 is directed, a direction detecting portion base 827B which supports the direction determining dog 827A so as to be capable of advancing or retracting to the transporting conveyor 824, and a crank mechanism 827C for bring the direction determining dog 827A near or apart from the transporting conveyor 824. The direction detecting portion base 827B is fixed on the base 821 through the supporting member 821A. The direction detecting portion base 827B is provided with a pair of cylindrical guide members 827D for guiding the direction determining dog 827A in the aforementioned direction.

Figure 74:
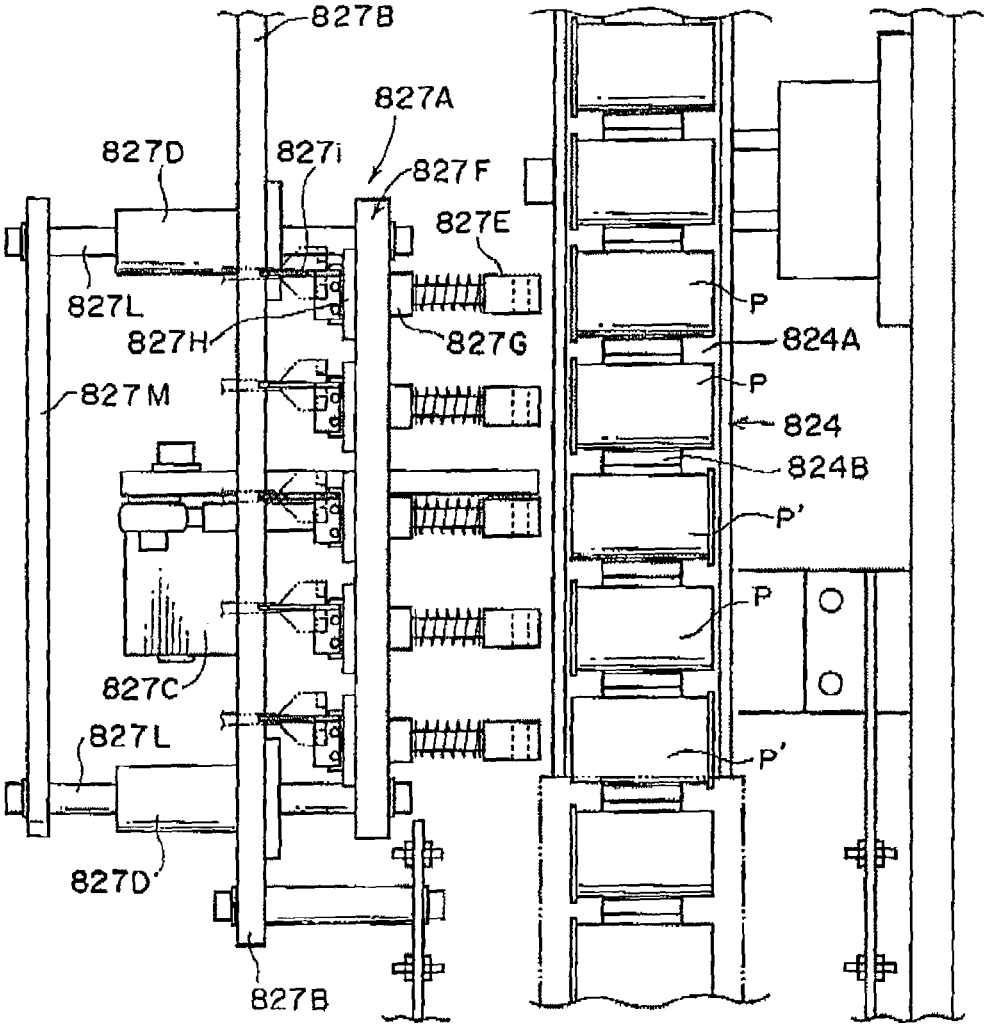
FIG. 74 is an expanded view showing a detailed constitution of the direction-detecting portion shown in FIG. 72.
Figure 75:
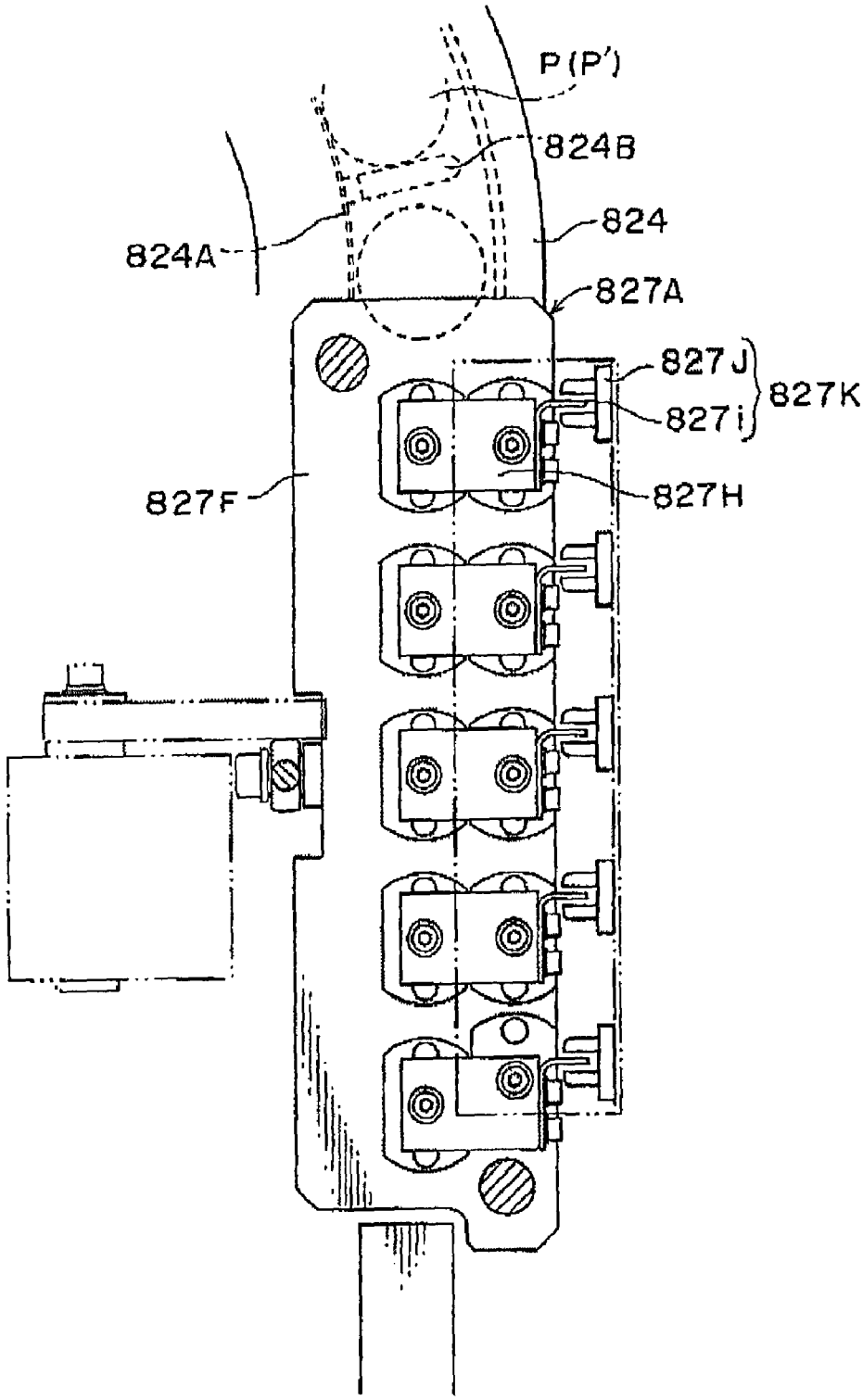
FIG. 75 is an expanded view showing a backside view of direction-detecting dogs (direction-detecting probes) incorporated in the direction-detecting portion shown in FIG. 72.

As shown in FIGS. 74 to 76, the direction determining dog 827A comprises five probe portions 827E disposed vertically, a base 827F which supports the probe portions 827E to the transporting conveyor 824 so as to be capable of advancing or retracting through a cylindrical bearing member 827G and a dog position detecting sensor 827K for detecting the position of the probe portion 827E. The bearing member 827G is fixed on a base 827F.

The dog position detecting sensor 827K is comprised of a light shielding element 827*i* and a light projecting/receiving element 827J and the light shielding element 827*i* is fixed on a rear end portion of each probe portion 827E through a mounting plate 827H and the light projecting/receiving element 827J is fixed on the direction detecting base 827B. The light projecting/receiving element 827*i* comprises a light emission device and a light receiving device for receiving light from the light emission device and the light emission device and the light receiving device are provided at positions opposing each other. The light shielding element 827*i* is a plate-like member entirely having a U-like or inverted U like plan shape as shown in FIG. 76 while its front end and rear end project to the light projecting/receiving element 827J. FIG. 76 shows a top view of the direction determining dog 827A and its surrounding portion.

The direction determining dog 827A has a pair of guide rods 827L which slides inside the guide member 827D for guiding the direction determining dog 827A in a direction approaching/leaving the transporting conveyor 824. An end of the guide rod 827L is fixed on the base 827F and the other end is fixed on a plate-like guide rod fixing member 827M.

As shown in FIG. 76, the probe portion 827E comprises a shaft portion 827E4 which slides inside one of the bearing members 827G and a cup portion 827E2 provided on a front end of the shaft portion 827E4. A mounting plate 827H is fixed on a rear end of the shaft portion 827E4. In the mounting plate 827H, a guide rod 827H' is fixed in parallel to the shaft portion 827E4. The guide rod 827H' slides inside another one of the bearing members 827G for guiding the probe portion 827E and preventing the dog position detecting sensor 827K and the probe portion 827E from rotating around the shaft portion 827E4. A coil spring 827E6 for urging the cup portion 827E2 in a direction leaving the base 827F is inserted in between the cup portion 827E2 and the bearing member 827G.

Figure 76A:
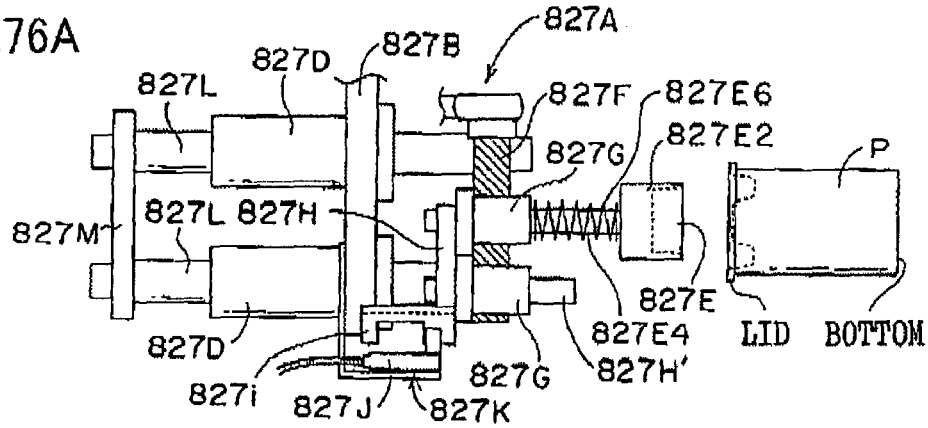
FIGS. 76A through 76D are block diagrams showing operation of the direction-detecting dogs showing in FIG. 75.

The direction determining dog 827A is located at a position far from the plastic case packed product P (P') at standby time as shown in FIGS. 74 and 76A. Because at this time, the light projecting/receiving element 827J is shielded by the light shielding element 827*i*, no light from the light emission device is detected by the light receiving device of the light projecting/receiving element 827J.

Figure 76B:
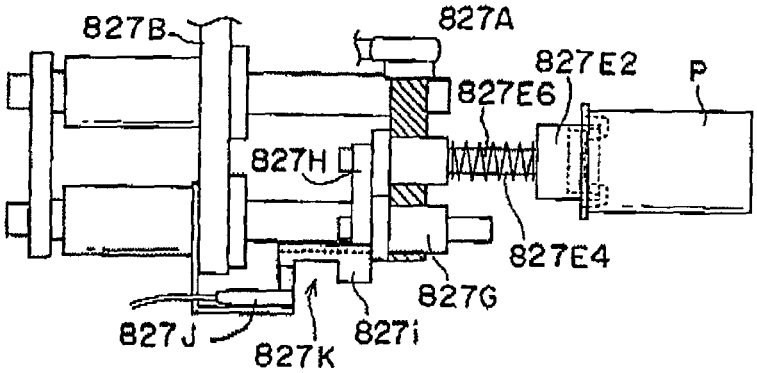
Figure 76C:
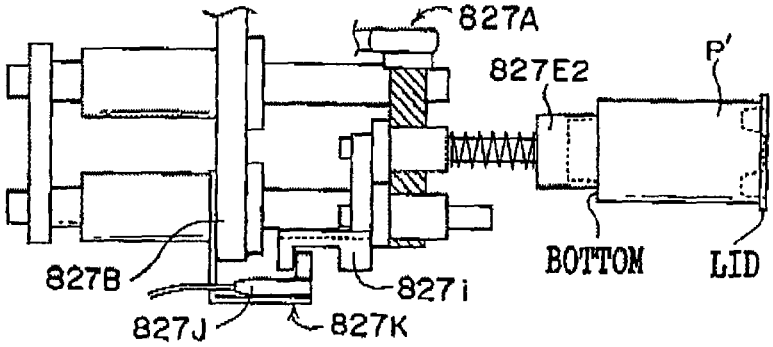

When determining the direction of the plastic case packed product P(P'), the direction determining dog 827A is advanced toward the plastic case packed product P(P') being carried by the transporting conveyor 824 as shown in FIGS. 76B and 76C.

Because the light shielding element 827*i* is advanced if the direction determining dog 827A is advanced, light from the light emission device is detected by the light receiving device in the light projecting/receiving element 827J. However, if the direction determining dog 827A is advanced to its maximum extent, no light is detected because the light projecting/receiving element 827J is shielded by the light shielding element 827*i* again as shown in FIG. 76B.

Because a circular groove is provided in the lid of the plastic case packed product P(P'), when the lid of the plastic case packed product P (P') is directed to the direction determining dog 827A, a periphery of the cup portion 827E2 is engaged with the groove in the id of the plastic case packed product P(P') if the direction determining dog 827A is advanced as shown in FIG. 76B. Because at this time, the direction determining dog 827A is located at a position where it is advanced to the maximum extent, the light projecting/receiving element 827J is shielded by the light shielding element 827*i* so that no light is detected.

On the other hand, when the bottom side of the plastic case packed product P(P') is directed to the direction determining dog 827A, if the direction determining dog 827A is advanced as shown in FIG. 76C, the periphery of the cup portion 827E2 abuts the bottom of the plastic case packed product P (P'), so that the direction determining dog 827A is stopped at a position where it is retracted from the position shown in FIG. 76B. Therefore, because the light projecting/receiving element 827J is in a condition not shielded by the light shielding element 827*i*, detection of light is carried out.

By advancing the direction determining dog 827A toward the transporting conveyor 824 in the direction detecting portion 827 and then checking whether or light detection is achieved in the light projecting/receiving element 827J provided on each probe portion 827E, the direction of the plastic case packed product P(P') can be determined.

Figure 76D:
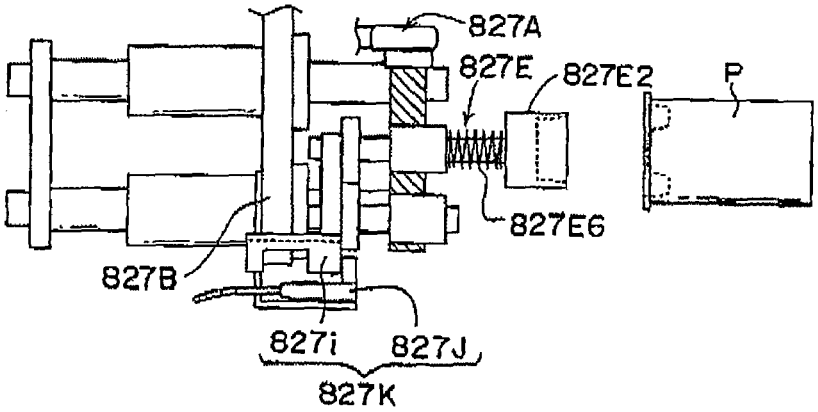

If dragging occurs between the shaft portion 827E4 and the bearing member 827G, when the direction determining dog 827A is retracted to the maximum extent as shown in FIG. 76D, the probe portion 827E is not advanced by an urging force of the coil spring 827E6 but remains at the position where it is retracted. Therefore, the light projecting/receiving element 827J is in a condition not shielded by the light shielding element 827*i*, so that light detection is carried out.

By retracting the direction determining dog 827A to the maximum extent after the direction of the plastic case packed product P(P') is determined and checking whether or not light detection is achieved in the light projecting/receiving element 827J, it is possible to see whether or not dragging occurs between the shaft portion 827E4 and the bearing member 827G.

(D) Transfer Portion and Nest Portion

Figure 77:
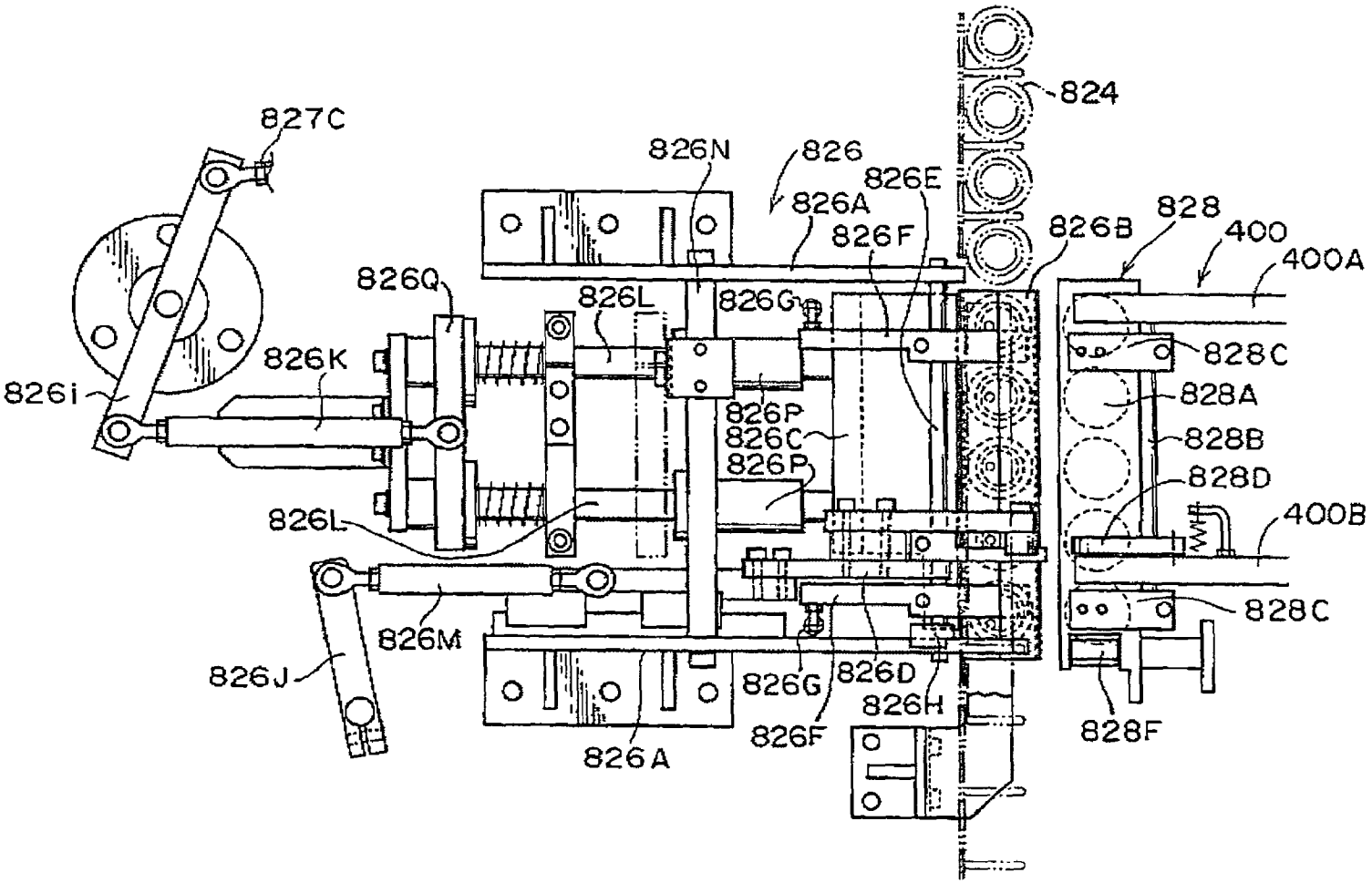
FIG. 77 is an expanded front view showing a constitution of a plastic case-packed product-delivering portion and a plastic case-packed product-accepting portion incorporated in the plastic case-packed product introducing portion shown in FIG. 70.
Figure 78:
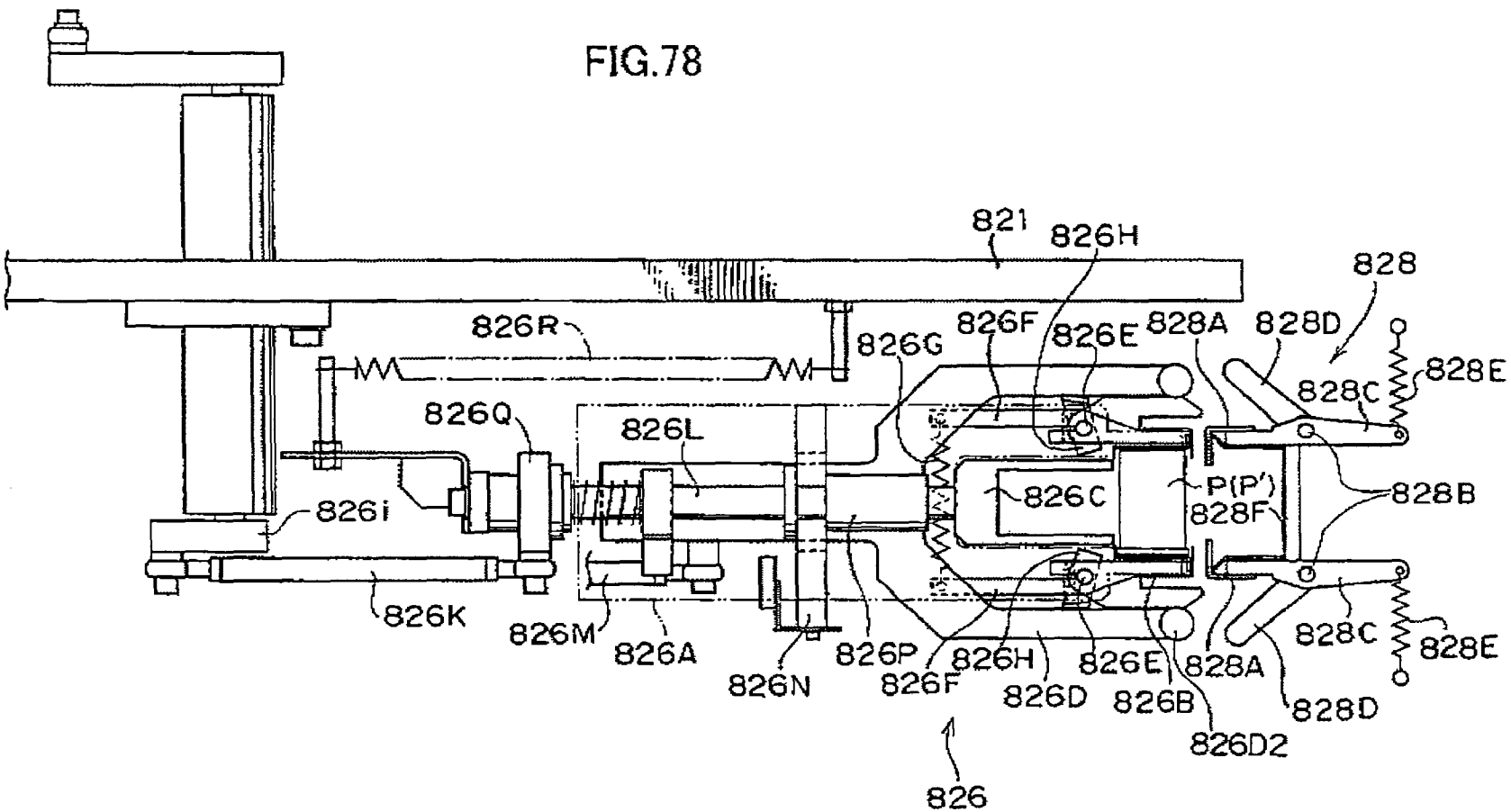
FIG. 78 is an expanded plan view showing a top view of the plastic case-packed product delivering and accepting portions shown in FIG. 77.

As shown in FIGS. 70, 77 and 78, the transfer portion comprises a pair of bases 826A (upper and lower) provided at a position opposing the nest portion 828 and fixed on the base 821, a pair of sending side opening/closing guides 826B provided at a front end of the base 826A such that it is capable of opening/closing, a plastic case packed product pusher 826C provided behind the sending side opening/closing guide 826B in the base 826A such that it is capable of advancing/retracting to/from the nest portion 828, and a guide opening/closing member 826D supported on the lower base 826A such that it is capable of advancing/retracting to/from the nest portion 828 and for opening/closing the sending side opening/closing guide 826B. FIG. 78 shows a bottom view of the transfer portion 826 and to clarify the mechanism in the base 826A, the base 826A is expressed with a two-dot chain line.

Two rotation shafts 826E for pivoting the sending side opening/closing guide 826B are provided vertically at a front end of the base 826A. Each of the sending side opening/closing guide 826B is fixed to the rotation shaft 826E through the arm member 826F. Taper is provided on an outside face at an end of a side on which the sending side opening/closing guide 826B is fixed of the arm member 826F such that it narrows as it goes toward its front end. A coil spring 826G for urging the arm member 826F in a direction opening the sending side opening/closing guide 82GB is provided at an end portion opposite to the side on which the sending side opening/closing guide 826B is fixed of the arm member 826F. A guide opening/closing restriction member 826H which engages with the lower base 826A for restricting an opening size of the sending side opening/closing guide 826B is fixed on a bottom end portion of the rotation shaft 826E. The guide opening/closing member 826D, the arm member 826F and the coil spring 826G correspond to the guide opening/closing means.

The transfer portion 826 comprises a pusher advancing/retracting crank 826*i* for advancing/retracting the plastic case packed product pusher 826C toward the nest portion 828 and a guide opening/closing member advancing/retracting crank 826J for advancing/retracting the guide opening/closing member 826D to/from the nest portion 828. A motion of the pusher advancing/retracting crank 826*i* is transmitted to the plastic case packed product pusher 826C through a pair of the rods 826L and a linking rod 826K. Similarly, the motion of the guide opening/closing member advancing/retracting crank 826J is transmitted to the guide opening/closing member 826D through the linking rod 826M. In the meantime, the rod 826L is guided by a cylindrical guide 826P fixed to a guide supporting member 826N provided vertically between upper and lower bases 826A in a direction advancing/retracting to/from a sending side opening/closing guide 826B. A linking rod mounting member 826Q is fixed on a terminal of the rod 826L and the linking rod 826K is mounted rotatably on the linking rod mounting member 826Q. An end of the coil spring 826R for urging the plastic case packed product pusher 826C to the nest portion 828 is fixed on the linking rod mounting member 826Q.

As shown in FIGS. 70, 71, 78, 79 and 80, the nest portion 828 comprises a pair of receiving side opening/closing guides 828A provided on a periphery of each of the upper table 400A and the lower table 400B located above the index table 404 on which a sack carton is to be mounted of the cartoner 400 such that they are capable of opening/closing and a plastic case packed product chute 828F which is located inside thereof and open to the transfer portion 826 with a U shaped section. The plastic case packed product chute 828F functions as a guide for guiding the plastic case packed product P(P') when the plastic case packed product is inserted into the sack carton loaded on the index table 404.

Figure 79A:
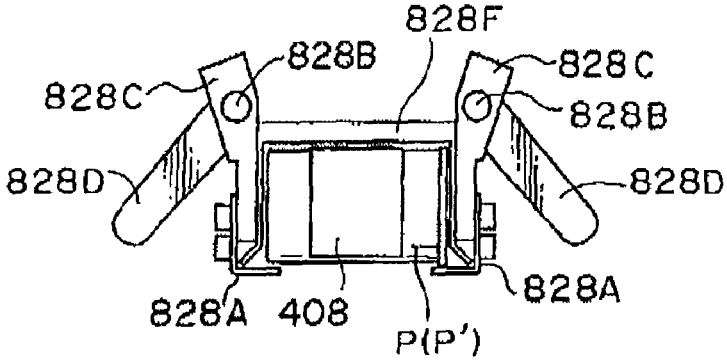
FIG. 79A is a plan view and FIG. 79B is a front view, both of which show the plastic case-packed product-accepting portion having an open-close guide closed.
Figure 79B:
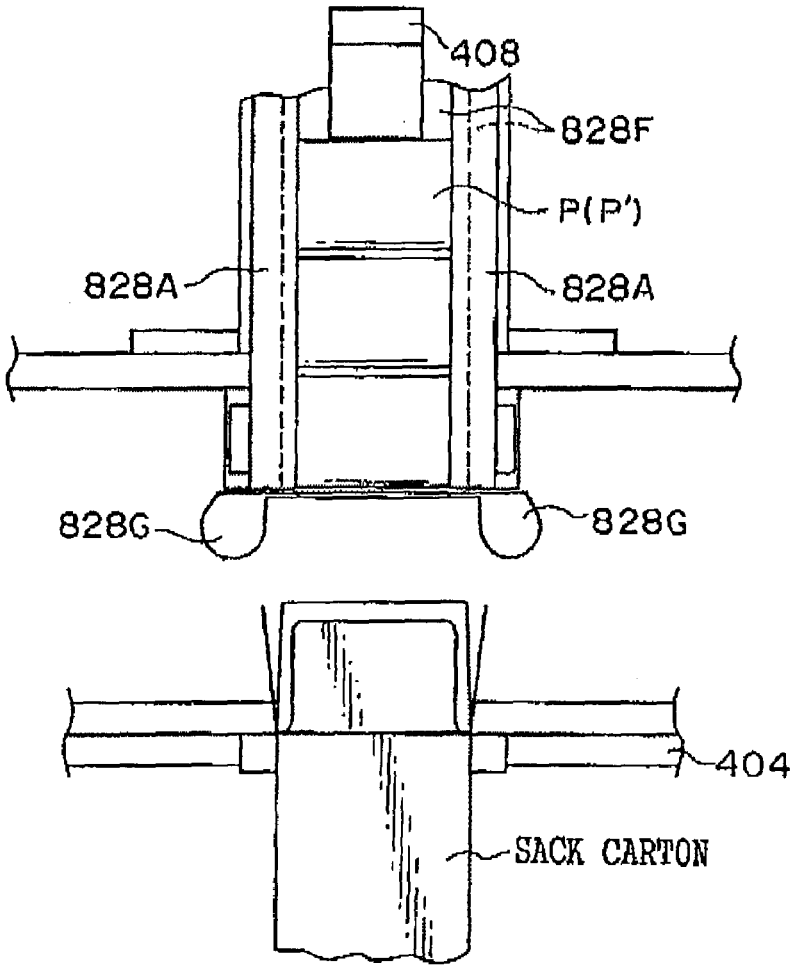
Figure 80A:
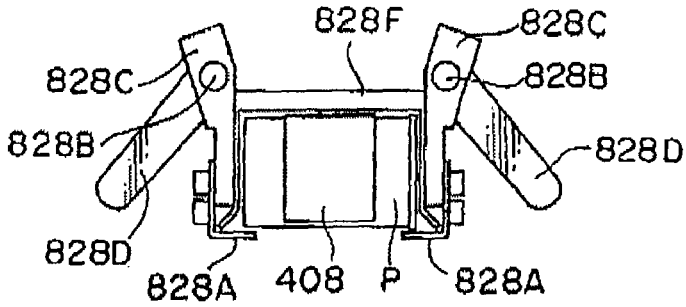
FIG. 80A is a plane vie and FIG. 80B is a front view, both of which show the plastic case-packed product-accepting portion having an open-close guide opening.

The receiving side opening/closing guide 828A is pivoted by the rotation shaft 828B between the upper table 400A and the lower table 400B. The receiving side opening/closing guide 828A is fixed on the rotation shaft 828B by the arm member 828C. A cam follower member 828D is fixed on a bottom end portion of the rotation shaft 828B such that when the guide opening/closing member 826D included by the transfer portion 826 advances to abut the cam follower member 828D, the same cam follower member 828D is opened outward to the transfer portion 826. A coil spring 828E for urging the receiving side opening/closing guide 828A in a closing direction is provided on each of an end on a side on which the receiving side opening/closing guide 828A is fixed of the arm member 828C and an end on its opposite side. FIGS. 79 and 80A show a top view of the nest portion 828 and FIGS. 79 and 80B show a view of the nest portion 828 taken from the transfer portion 826.

Figure 80B:
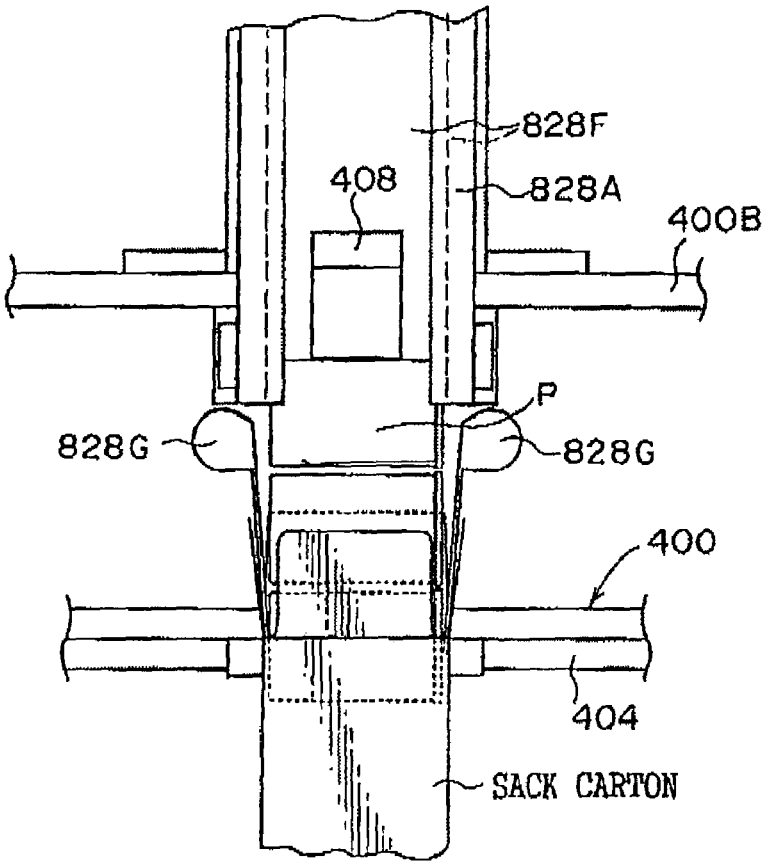

As shown in FIGS. 79 and 80B, a pair of the opening/closing guides 828G, which are capable of opening/closing, are provided below the receiving side opening/closing guide 828A. The opening/closing guide 828G is urged by a coil spring (not shown) upward, that is, in a closing direction and functions as a guide which when it is closed, forms a bottom of the plastic case packed product chute 828F and in which, when it is opened, a front end thereof abuts an inside wall of the sack carton and guides a plastic case packed product P (P') which falls through the plastic case packed product chute 828F, to the sack carton. Reference numeral 408 in FIGS. 79 and 80 denotes a plastic case packed product pusher which is vertically movable to load the plastic case packed product P (P') into the cartoner.

Figure 81A:
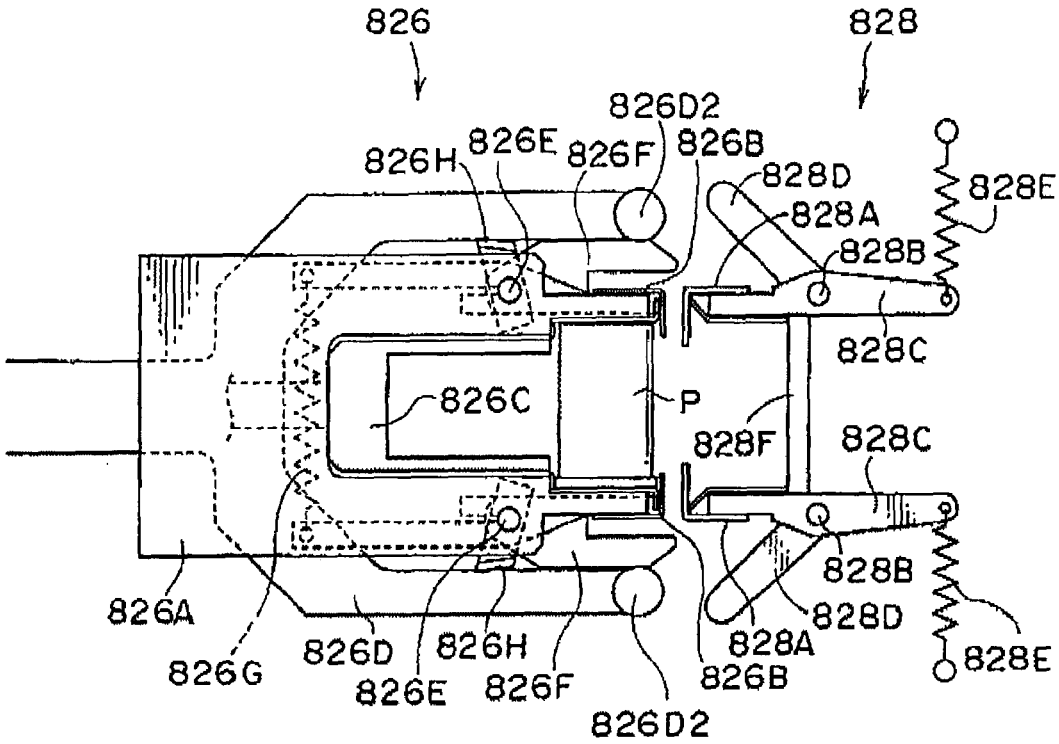
FIGS. 81A and 81B are a flow chart showing operation delivering plastic case-packed product from the plastic case-packed product-delivering portion to the plastic case-packed product-accepting portion.

Because when the transfer portion 826 is in its standby condition, as shown in FIG. 81A, the guide opening/closing member 826D remains retracted, the cylindrical cam member 826D2 provided at a front end of the guide opening/closing member 826D abuts an outside face of the arm member 826F form outside. Consequently, the arm member 826F rotates to inside resisting a urging force of the coil spring 826G so as to close the sending side opening/closing guide 826B.

Figure 81B:
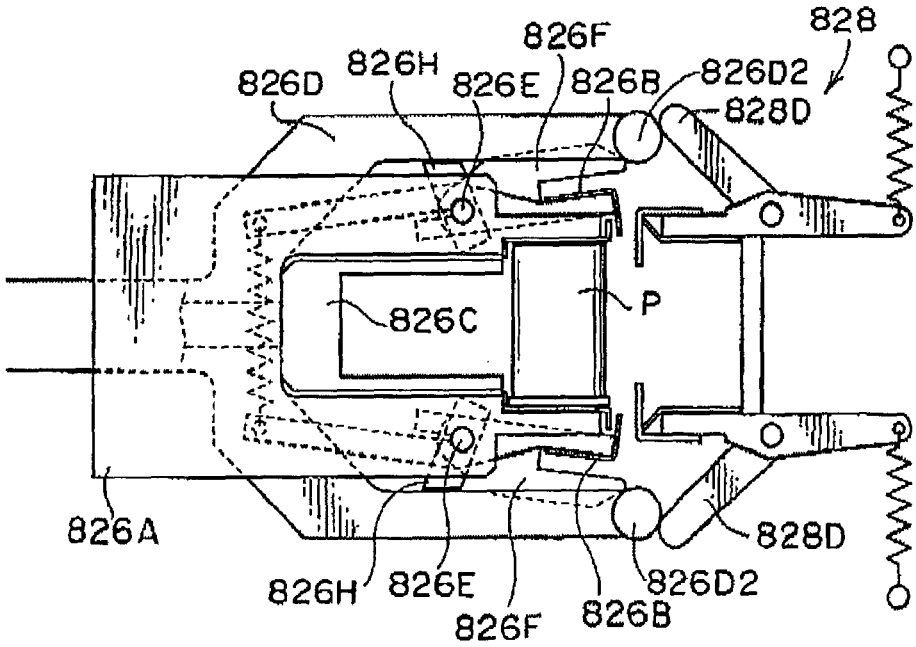

If with this condition, a predetermined quantity of the plastic case packed products P(P') are sent from the direction detecting portion 827 above and introduced into the inside of the sending side opening/closing guide 826B, the guide opening/closing member 826D is advanced to the nest portion 828. Referring to FIG. 81, FIG. 81B shows a state in which a front end of the guide opening/closing member 826D abuts the front end of the cam follower member 828D of the nest portion. 828.

When the guide opening/closing member 826D is advanced, the arm member 826F is opened outward by an urging force from the coil spring 826G as shown in FIG. 81B. Because the guide opening/closing restriction member 826H engages with the base 826A, the sending side opening/closing guide 826B opens the arm member as large as the plastic case packed product P(P') can pass and at the same time, the opening is restricted to such an extent that a front end of the arm member 826F can make a contact with the cylindrical cam member 826D.

Figure 82A:
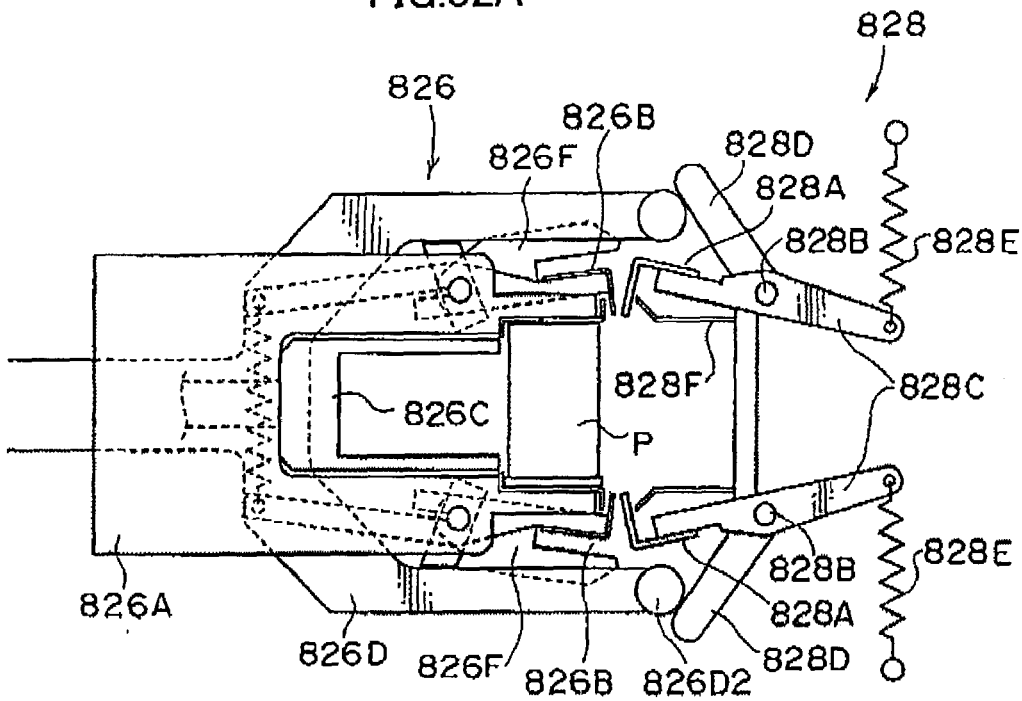
FIGS. 82A and 82B are flow charts showing operation delivering plastic case-packed product from the plastic case-packed product-delivering portion to the plastic case-packed product-accepting portion.

When the guide opening/closing member 826D is advanced further from the position shown in FIG. 81B, the cam follower member 828D is expanded further by the guide opening/closing member 826D at the nest portion 828 as shown in FIG. 82A, so that the arm member 828C is opened outward resisting an urging force of the coil spring 828E. Consequently, the receiving side opening/closing guide 828A is opened outward.

Figure 82B:
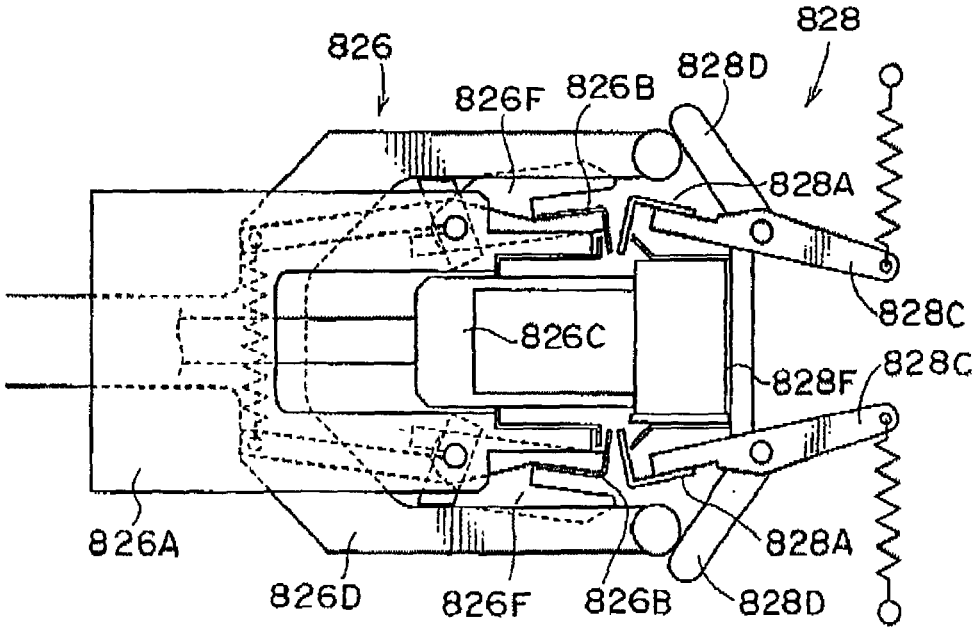

When the receiving side opening/closing guide 828A is opened outward, the plastic case packed product pusher 828C is advanced to the nest portion 828 as shown in FIG. 82B, so that the plastic case packed product P(P') inside the sending side opening/closing guide 826B is transferred to the inside of the plastic case packed product chute 828F.

If the plastic case packed product P (P') is transferred to the nest portion 828, the guide opening/closing member 826D is retracted to a position shown in FIG. 82A.

(E) Operation of the Plastic Case Packed Product Supplying Portion

The plastic case packed product P and plastic case packed product P' arrayed by the plastic case packed product arraying portion 810 in a predetermined array pass through the plastic case packed product introduction opening portion 811C and are introduced into the path 822A from a top end opening portion of the plastic case packed product chute 822 and finally drops to the transporting conveyor 824 in a condition the path 822A is filled therewith without any gap as shown in FIG. 70.

The plastic case packed product P and plastic case packed product P', after fall naturally from the plastic case packed product chute 822, are transported to the direction detecting portion 827 by the transporting conveyor 824 in a condition in which they are loaded in every interval between the partitions 824B of the transporting conveyor 824.

If the direction detecting portion 827 recognizes that the plastic case packed product P and plastic case packed product P' are arranged in a predetermined array order, for example, they forms a group of four pieces arranged like "PPP'P", they are transported to the transfer portion 826 by the transporting conveyor 824. Here, "P" indicates plastic case packed product P while "P'" indicates plastic case packed product P'.

Then, the group of the plastic case packed product P(P') is transferred to the nest portion 828 at the transfer portion 826, it is loaded in the sack carton by the cartoner 400.

1-5 Operation of Entire System

The plastic case packed product P manufactured by the winding machine 900 is transported to the plastic case packed product arraying portion 810 by the first plastic case packed product supplying line 830. At the same time, the plastic case packed product P' accommodated in the plastic case packed product silo 850 is also transported to the plastic case packed product arraying portion 810 by the second plastic case packed product supplying line 840.

In the plastic case packed product arraying portion 810, the plastic case packed product P from the winding machine 900 and plastic case packed product P' from the plastic case packed product silo 850 are transported to the plastic case packed product introducing portion 820 in a predetermined order, for example, in an array of four pieces like "PPPP'P".

The plastic case packed product introducing portion 820 transfers the plastic case packed product P and plastic case packed product P' to the cartoner 400 in a predetermined array. Therefore, in the cartoner 400, the plastic case packed product P and plastic case packed product P' are inserted into the sack carton in an order of four piece of "PPP'P".

In the plastic case packed product supplying unit of the fourth embodiment, as described above, the plastic case packed product P manufactured by the winding machine 900 and plastic case packed product P' accommodated in the plastic case packed product silo 850 are automatically combined in a predetermined array and supplied to the cartoner 400 and then packed in the sack carton.

A Fifth Embodiment

An example of the packaging system according to the invention will be described below.

1. Configuration of Packaging System

The packaging system 2000 of the fifth embodiment, as shown in FIG. 83, comprises a winding machine 900, a plastic case packed product transporting supplying unit 800, a cartoner 400, a carton arraying unit 1100, a shrink packaging unit 1200, a corrugated board casing unit 1300, and a control computer 500. The winding machine 900 and the plastic case packed product transporting supplying unit 800, the cartoner 400, the carton arraying unit 1100 and the shrink packaging unit 1200, and the corrugated board casing unit 1300 correspond to a packaging object manufacturing portion, a transporting supplying unit, a small box package forming portion, an assembly forming portion and an exterior packaging forming portion in the packaging system according to the invention. In the meantime, the carton arraying unit 1100, the shrink packaging unit 1200 and the corrugated board casing unit 1300 constitute a carton packing unit 1000.

The winding machine 900 manufactures a plastic case packed product P which is an example of a case incorporated film of the invention by making perforations in a side edge portion of a long film according to an instruction from the control computer 500, cutting a photographic film having perforations to a predetermined length, winding this photographic film around a spool, accommodating the spool around which the photographic film is wound in a cartridge, and accommodating the cartridge in a plastic made film case.

The plastic case packed product transporting supplying unit 800 has a function of supplying the plastic case packed products manufactured by the winding machine 900 to the cartoner 400 in a condition in which they are arranged in line. Additionally, it has a function of combining the plastic case packed product P manufactured by the winding machine 900 with another plastic case packed product P having a different quantity of photographable frames or a different photographic film appropriately, arraying them in a predetermined pattern and supplying to the cartoner 400. In any case, the plastic case packed product transporting supplying unit 800 supplies the plastic case packed product P manufactured by the winding machine 900 to the cartoner 400 without any deposit between the winding machine 900 and the cartoner 400. Here, "without any deposit between being manufactured and being packaged" means that a plastic case packed product P manufactured ahead by the winding machine 900 is always supplied to the cartoner 400 ahead of a plastic case packed product manufactured after (first in and first out). In other words, the plastic case packed product P is always supplied to the cartoner 400 in their manufacturing order.

The cartoner 400 manufactures a carton 700 by packing the plastic case packed products manufactured by the winding machine 900 into a sack carton.

In the carton arraying unit 1100, a predetermined quantity of the cartons 700 are arrayed in a predetermined form so as to form a carton assembly 720. If the aforementioned carton 700 is a type which should be subjected to shrink packaging, the carton assembly 720 is carried on the shrink packaging unit 1200 and if the carton 700 is a type which is not subjected to shrink packaging, the carton assembly 720 is transported directly to the corrugated board casing unit 1300.

The shrink packaging unit 1200 is provided adjacent to the carton arraying unit 1100 and has a function of forming a shrink-wrapped package 740 by shrink-packaging the carton assembly 720 transferred from the carton arraying unit 1100 and then transporting this to the corrugated board casing unit 1300.

The corrugated board casing unit 1300 has a function of packing the carton assembly 720 transported from the carton arraying unit 1100 or the shrink-wrapped package 740 transported from the shrink packaging unit 1200 in a corrugated board box in a predetermined fashion. Here, the carton 700 corresponds to the small box package under the invention, the carton assembly 720 corresponds to the small box assembly under the invention, and the shrink-wrapped package 740 corresponds to the shrink-wrapped package under the invention.

The control computer 500 has a function of controlling the carton arraying unit 1100, the shrink packaging unit 1200, the corrugated board casing unit 1300, the cartoner 400, the plastic case packed product transporting supplying unit 800 and the winding machine 900 according to a production plan inputted from the a host computer.

Hereinafter the carton arraying unit 1100, the shrink packaging unit 1200, the corrugated board casing unit 1300, the cartoner 400, the plastic case packed product transporting supplying unit 800 and the winding machine 900 will be described in detail.

1-1 Winding Machine

Figure 84:
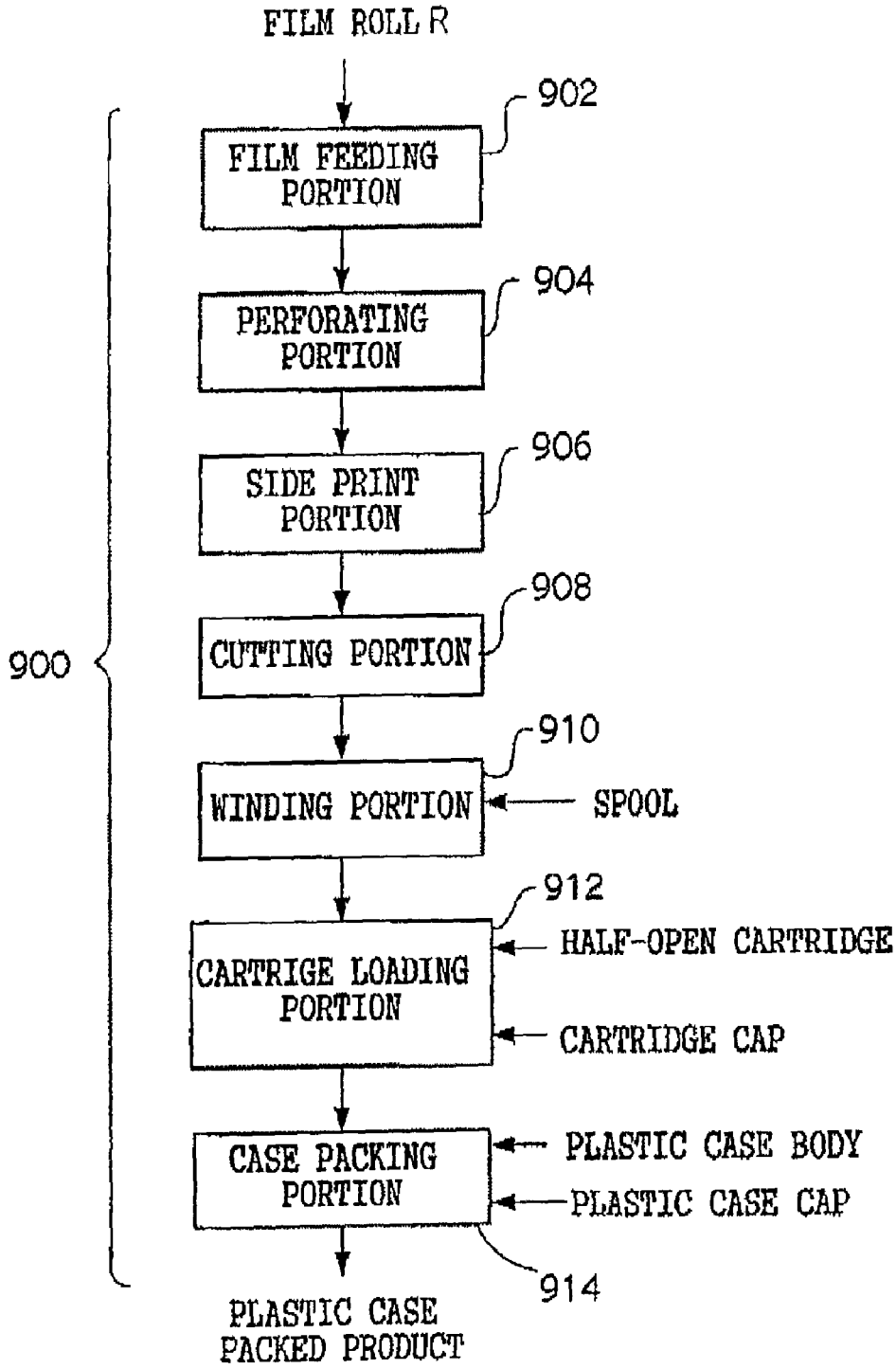
FIG. 84 is a block diagram showing a constitution of a winding machine incorporated in the packaging system shown in FIG. 83.
Figure 85:
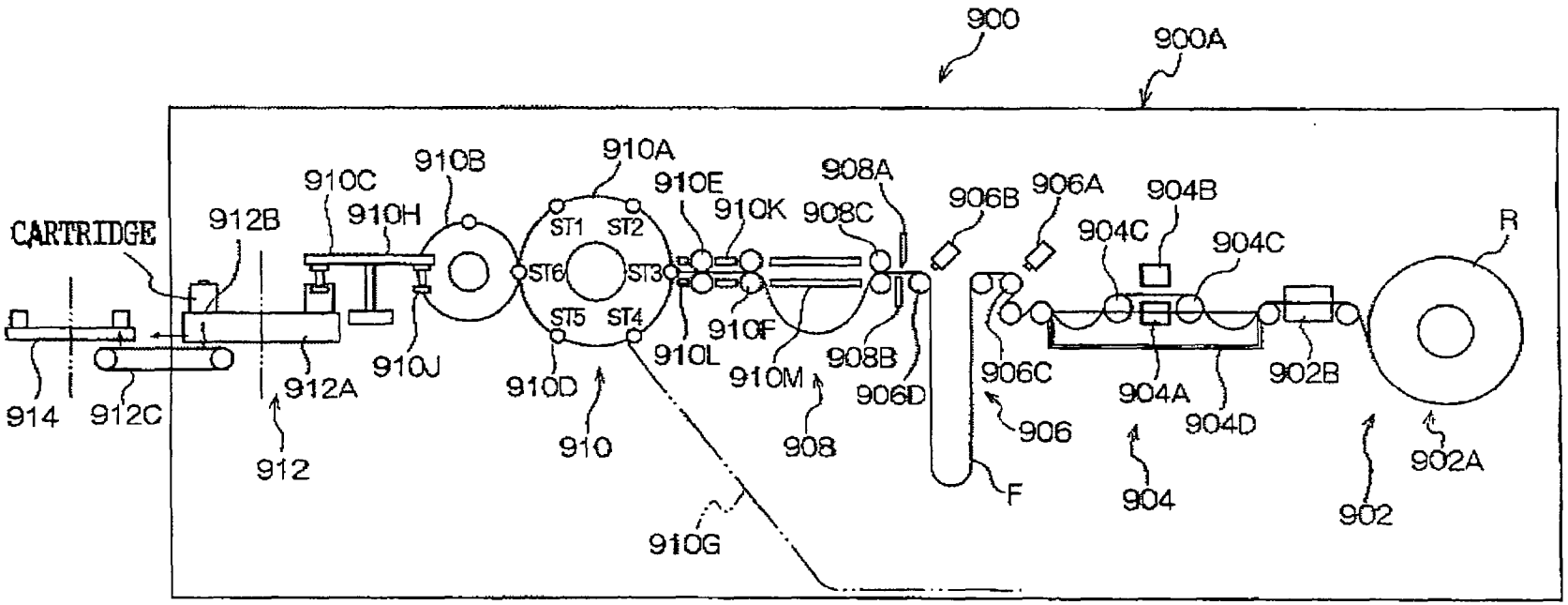
FIG. 85 is a schematic diagram showing the constitution of the winding machine incorporated in the packaging system shown in FIG. 83.

The winding machine 900, as shown in FIGS. 84 and 85, comprises a film feeding portion 902 for sending a photographic film F from a film roll R around which the long photographic film F is wound, a perforating portion 904 which makes perforations on both side edges of the photographic film F fed by the film feeding portion 902, a side print portion 906 which bakes a latent image corresponding to a film type on a side edge of the photographic film F perforated by the perforating portion 904, a cutting portion 908 for cutting the photographic film having the latent image baked on the side edge to a predetermined length on a side print portion 906, a winding portion 910 for winding the photographic film F cut to the predetermined length around a spool, a cartridge loading portion 912 for loading the photographic film F wound around the spool by the winding portion 910 into a cartridge and a case packing portion 914 for loading the cartridge loaded with the photographic film by the cartridge loading portion 912 into a plastic case so as to produce the plastic case packed product P.

The film feeding portion 902 comprises a film roll portion 902A in which a film roll R around which a long photographic film F is wound and a film joining portion 902B for joining together a terminal of the fed film roll R with a front end of a new film roll R.

The perforating portion 904 comprises a die block 904A fixed below a transporting plane for transporting the photographic film and a punch block 904B capable of rising/falling relative to the die block 904A. An intermittent feeding roller 904C is disposed on the upstream side (hereinafter referred to as "upstream side") and the downstream side (hereinafter referred to as "downstream side") along the transporting direction of the photographic film of each of the die block 904A and the punch block 904B and a suction chamber 904D is disposed below the die block 904A.

The side print portion 906 comprises a constant velocity transporting roller 906C disposed on the upstream side, a first print portion 906A disposed corresponding to the constant velocity transporting roller 906C, a constant size transporting sprocket 906D disposed on the downstream side relative to the constant velocity transporting roller 906C and a second print portion 906B disposed corresponding to the constant size transporting sprocket 906D.

The cutting portion 908 includes a movable blade 908A and a fixed blade 908B disposed so as to oppose each other vertically across the transporting path of the photographic film F. A nip roller 908C is disposed in the downstream of the movable blade 908A and the fixed blade 908B.

The winding portion 910 comprises a turn table 910A for winding the photographic film F around a spool, a transfer turn table 910B adjacent to in the downstream the winding turn table 910A, a transfer unit 910C provided adjacent to in the downstream the transfer turn table 910B and for transferring a spool around which the photographic film F is wound to the cartridge loading portion 912 and a pair of insert rollers 910E, 910F located on the upstream side of the winding turn table 910A. A guide plate 910K and an opening/closing guide plate 910L are provided between the pair of the insert rollers 910E and 910F, and between the pair of the insert rollers 910E and the winding turn table 910A. Further, a guide plate 910M is provided between the nip roller 908C and the pair of insert rollers 910F.

The winding turn table 910A is a disc rotating clockwise in FIG. 85 and six spool holding means 910D are provided on the periphery. A spool supplying station ST1, a spool positioning station ST2, a film end insertion station ST3, a reserve winding station ST4, a winding station ST5 and a transfer station ST6 are provided in a clockwise direction around the winding turn table 910A. A film guide 910G is provided below the reserve winding station ST4.

The transfer unit 910C comprises a horizontal arm member 910H rotating vertically around a rotation axis and a spool holding portion 910J provided on both ends of the horizontal arm member 910H.

The cartridge loading portion 912 includes a disc like turn table 912A in which cartridge holding portions 912B for holding a cartridge are formed at an equal interval on a periphery thereof.

In the winding machine 900, all its components except the case packing portion 914 are accommodated in a dark room so as to protect the photographic film F from outside light.

In the winding machine 900, a film roll R around which a photographic film of a predetermined type, for example, ISO400 or ISO800 is wound is automatically loaded on a film roll portion 902A of the film feeding portion 902. Then, the photographic film F is fed from the film roll R at a predetermined velocity.

The photographic film F fed from the film feeding portion 902 is fed intermittently by an intermittent feeding roller 904C and pressed against the die block 904A by a suction force of the suction chamber 904D. Therefore, the punch block 904B goes up and down relative to the die block 904A, so that perforations are formed on both side edges of the photographic film at a specified interval.

The photographic film F, after the perforations are formed by the perforating portion 904, is sent to the side print portion 906. Then, a belt-like side print latent image is formed depending on its film type on one or both side edge portions of the first print portion 906A and such latent images as a DX code, frame number figure, frame number code, product name are recorded depending on a film size of the photographic film F on the second print portion 906B.

On the other hand, in the spool supplying station ST1 of the winding portion 910, a spool is mounted on the spool holding means 910D of the winding turn table 910A.

If the spool is mounted on the spool holding means 910D, the winding turn table 910A rotates by 60° clockwise and then, a preliminary positioning of the spool is carried out by the spool positioning station ST2. Then, the winding turn table 910A rotates further by 60° clockwise so as to send the spool to a film end insertion station ST3.

If the film end insertion station ST3 is sent to the spool, an opening/closing guide plate 910L is closed so as to form a film path for the photographic film F to pass through and at the same time, the spool is nipped at ST3, so that final positioning of the spool is carried out mechanically to prepare for insertion of the photographic film.

After the predetermined latent images are formed, the photographic film F is sent to the film end insertion station ST3 by the nip roller 908C, a pair of the insert rollers 910E and a pair of the insert rollers 910F, then guided by the guide plate 910K, the opening/closing guide plate 910L and the guide plate 910M through a specified path and an end of the photographic film F is inserted into the spool located at the film end insertion station ST3.

When the end of the photographic film F is inserted into the spool in the film end insertion station ST3, the guide plate 910M is opened and the photographic film F is fed by a specified length to the turn table 910A by the nip roller 908C. Consequently, as shown in FIG. 85, a loop is formed between the nip roller 908C and a pair of the insert rollers 910F. The photographic film is cut by the movable blade 908A and the fixed blade 908B in a condition that it is held by the nip roller 908C, a pair of the insert rollers 910F, a pair of the insert rollers 910E and the guide plates 910K, 910L.

After the photographic film F is cut, the nip roller 908C, a pair of the insert rollers 910F, a pair of the insert rollers 910E and the guide plates 910K, 910L are released and the winding turn table 910A rotates further by 60° so as to carry the spool to the preliminary winding station ST4. Then, the cut photographic film F is hung above the film guide 910G.

The photographic film F is wound up to hallway in the preliminary winding station ST4. If the photographic film is wound up to halfway without any abnormality, the winding turn table 910A rotates further by 60° and the spool moves to the winding station ST5. Then, it is wound on the spool completely in the winding station ST5.

When the winding in the winding station ST5 is terminated, the winding turn table 910A rotates further by 60° so that the spool in which the photographic film F is wound is moved to the transfer station ST6. In the transfer station ST6, it is transferred to the transfer turn table 910B in a horizontal condition.

The transfer turn table 910B rotates counterclockwise in FIG. 85, changes the holding of the spool from its horizontal condition to the vertical condition while it rotates by 180° and transfers it to the transfer unit 910C.

In the transfer unit 910C, the spool received from the transfer turn table 910B is moved to the cartridge loading portion 912 in a condition that it is held by the spool holding portion 910J.

In the cartridge loading portion 912, a half open cartridge is loaded in the cartridge holding portion 912B. The spool transferred by the transfer unit 910C is loaded into the half open cartridge in the cartridge holding portion 910B. A cartridge cap is loaded in a remaining opening portion of the half open cartridge in which the spool is loaded and then crimped so as to form a cartridge.

The cartridge formed in this way is placed on the transfer conveyor 912C as indicated with an arrow in FIG. 85, transferred to the case packing portion 914 and packed in the P case main body in the case packing portion 914. Then, the P case cap is engaged in an opening portion at an end of the P case main body and then a plastic case packed product P is completed. The completed plastic case packed product P is introduced into the plastic case packed product transporting supplying unit 800.

1-2 Plastic Case Packed Product Transporting Supplying Unit

The constitution and the operation of the plastic case packed product transporting supplying unit 800 are the same as described in the fourth embodiment.

1-3 Cartoner

Figure 86:
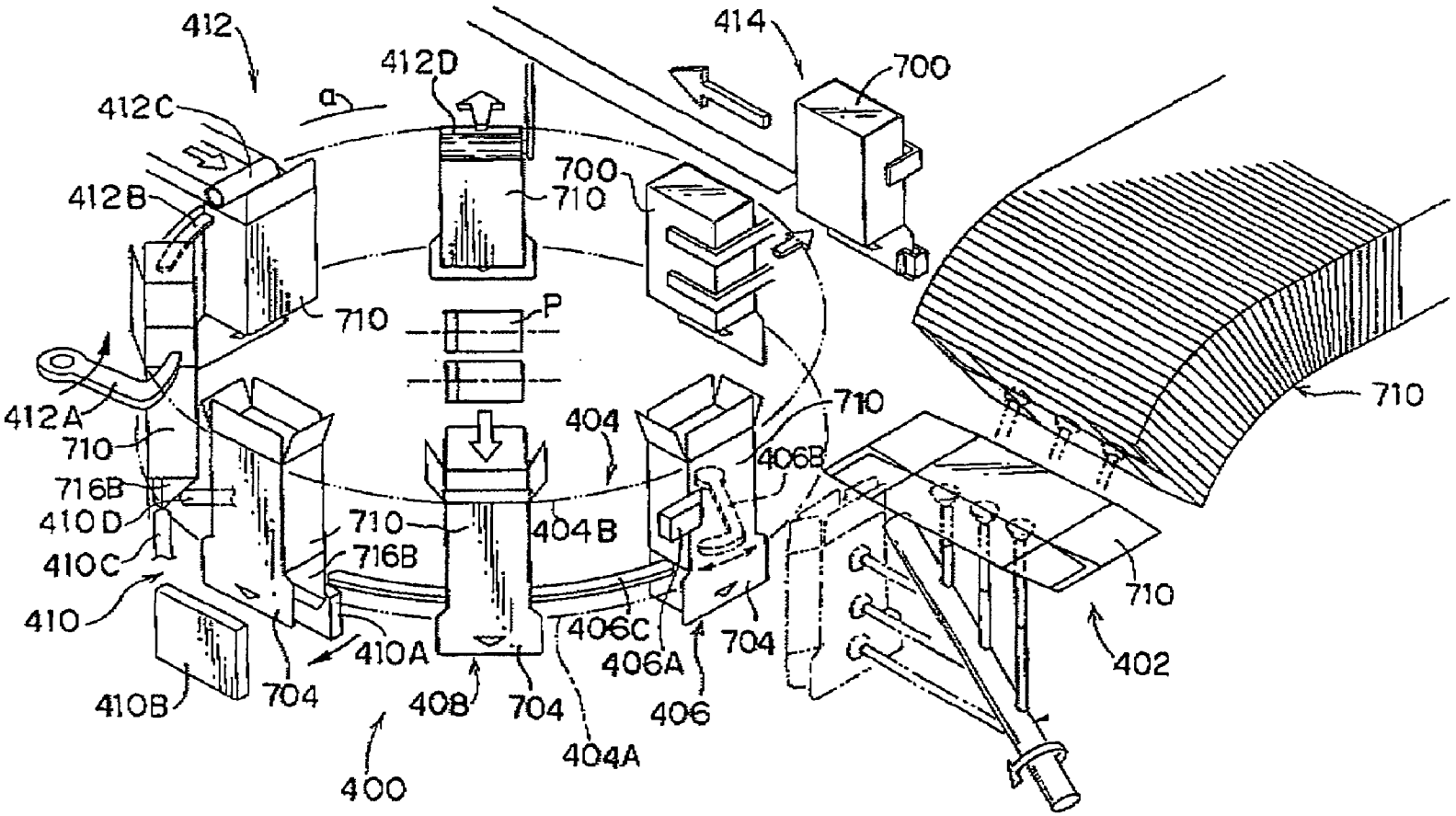
FIG. 86 is a brief perspective view showing a constitution of a cartoner incorporated in the packaging system shown in FIG. 83.

The cartoner 400 packages the plastic case packed products P (and different type plastic case packed product P') supplied from the plastic case packed product transporting supplying unit 800 into the inside of the sack carton 710, which is a foldable box body having an opening portion and a flap portion forming a lid portion for covering the opening portion on each of both ends thereof as shown in FIG. 86.

As shown in FIG. 86, the cartoner 400 comprises a carton supplying unit 402, a rotation table 404 which rotates intermittently clockwise as indicated with an arrow a with the sack carton supplied from the carton supplying unit 402 on its outer peripheral portion, a carton opening forming portion 406 in which the sack carton 710 supplied from the carton supplying unit 402 is constructed from its folding condition and mounted on the outer peripheral portion of the rotation table 404 such that an opening portion on a side having the header 704 is directed downward and a part of a flap portion on the bottom is constructed so as to cover the opening on the bottom partially, a plastic case packed product loading portion 408 which is provided adjacent to the carton opening forming portion 406 in the downstream (hereinafter referred to as "downstream") along the rotation direction a and loads a predetermined quantity of the plastic case packed products, for example, four pieces from the upper opening portion with the lower opening of the sack carton 710 partially closed, an upper lid constructing portion 410 which is provided adjacent to the plastic case packed product loading portion 408 in the downstream and forms the upper lid by constructing the remainder of the lower flap portion, a lower lid constructing portion 412 which is provided adjacent to the upper lid constructing portion 410 in the downstream and forms the lower lid for covering the upper opening portion of the sack carton 710 by constructing the upper flap portion and a carton discharging portion 414 which is provided adjacent to the lower lid constructing portion 412 in the downstream and discharges out the sack carton 710 containing the loaded plastic case packed products.

The carton supplying unit 402, the rotation table 404, the carton opening forming portion 406, the plastic case packed product loading portion 408, the upper lid constructing portion 410, the lower lid constructing portion 412, and the carton discharging portion 414 are the same as the carton supplying unit 2, the rotation table 4, the carton opening forming portion 6, the plastic case-packed product packing portion 8, the upper lid constructing portion 10, the lower lid constructing portion 12, and the carton discharging portion 14 of the cartoner relating to the fifth embodiment, respectively.

1-4 Carton Arraying Unit

As shown in FIGS. 83, 87 to 89, the carton arraying unit 1100 comprises a first conveyor 1102 for feeding cartons dispatched from the cartoner 400 one by one to a first robot 1112, a second conveyor 1104 disposed on the downstream side din a carton 700 feeding direction (hereinafter referred to as just "downstream side") of the carton arraying unit 1100 with respect to the first conveyor 1102, a third conveyor 1106 disposed on the downstream side of the second conveyor 1104, a fourth conveyor 1108 disposed on the downstream side of the third conveyor 1106, a fifth conveyor 1110 disposed on the downstream side of the fourth conveyor 1108 and extended to a product loading robot 1302, which will be described later, of the corrugated board casing unit 1300, a first robot 1112 disposed adjacent to a joint portion between the first conveyor 1102 and the second conveyor 1104, a second robot 1114 disposed above the second conveyor 1104, and a third robot 1116 disposed above the third conveyor 1106. The first conveyor 1102 to the fifth conveyor 1110 correspond to transporting means in an assembly forming portion included by the packaging system of the invention and the first robot 1112 and the second robot 1114 correspond to rotating means included by the assembly forming portion. The second conveyor 1104 corresponds to assembling means included by the assembly forming portion. The third conveyor 1106 corresponds to the assembling means and an assembly transporting means included by the assembly forming portion. The third robot 1116 corresponds to the assembly transporting means.

1-4-A First Conveyor

As shown in FIGS. 87 to 91, the first conveyor 1102 comprises a belt conveyor 1102A, a frame body 1102B for holding the belt conveyor 1102A from both sides and a guide unit 1102C for guiding the frame body 1102B vertically. FIG. 90A shows a top view of the first conveyor 1102 and FIG. 90B shows a front view thereof.

Figure 87:
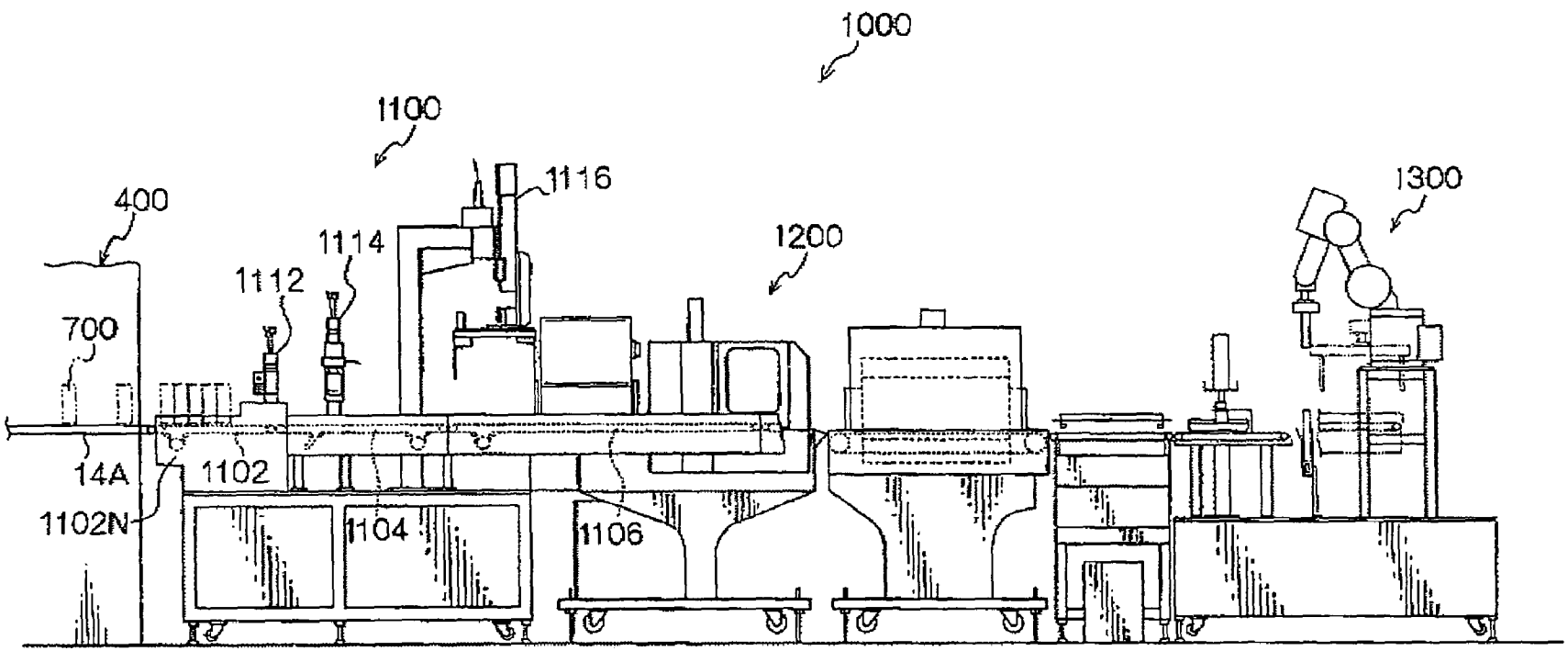
FIG. 87 is a side view showing a constitution of a carton-boxing apparatus incorporated in the packaging system shown in FIG. 83.
Figure 88:
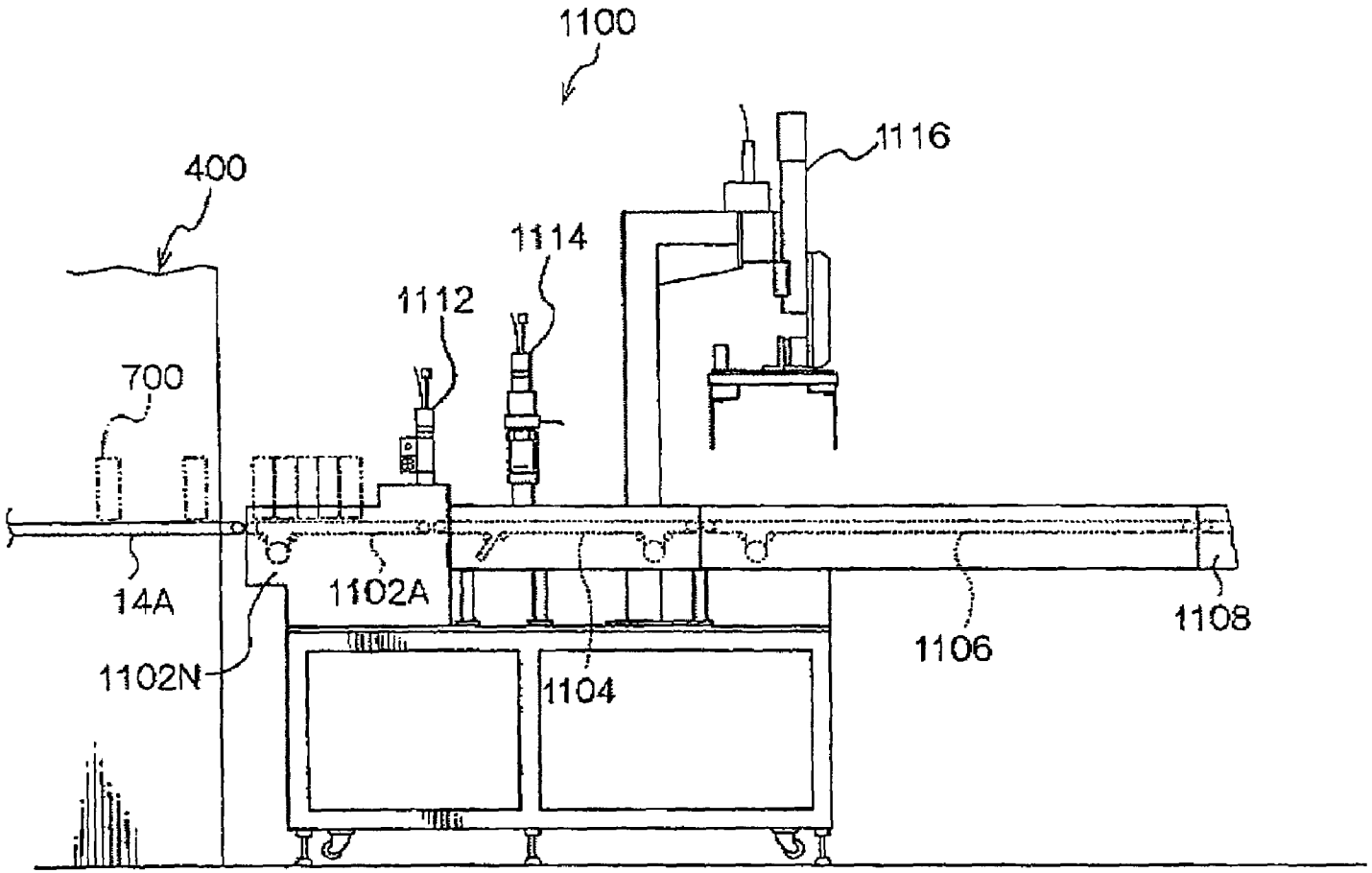
FIG. 88 is a partial side view showing a carton assembling apparatus incorporated in the carton-boxing apparatus shown in FIG. 87.

Because the cartoner 400 changes over the type of the plastic case packed product with the top face of the carton 700 as a reference level as shown in FIGS. 87 and 88, a lower conveyor 414A included by the carton discharging portion 414 descends if the height of the carton 700 is large and ascends if the height of the carton 700 is small in order to make the height of the top face of the carton always constant.

The frame body 1102B of the first conveyor 1102 is mechanically joined to the lower conveyor 414A so that it ascends or descends interlockingly with the lower conveyor 414A. Then, the belt conveyor 1102A is held such that the top face thereof coincides with the top face of the lower conveyor 414A.

Because the frame body 1102B goes up and down interlockingly with the lower conveyor 414A and the belt conveyor 1102A goes up and down accompanied therewith, feeding of the carton 700 from the cartoner 400 is carried out smoothly when the lower conveyor 414A is high or low.

The belt conveyor 1102A comprises a drive roller 1102E, four driven rollers 1102F, and a belt 1102D wound around the drive roller 1102E and the driven roller 1102F. The drive roller 1102E is driven by a drive motor 1102G. Of the four driven rollers 1102F, two ones are located at end portions of the upstream side and downstream side of the belt conveyor 1102A while the remaining two ones are located near the drive roller 1102E. The belt 1102D is formed of material having a small friction coefficient. The carton 700 sent from the cartoner 400 is placed on the top face of the belt conveyor 1102A.

Figure 89:
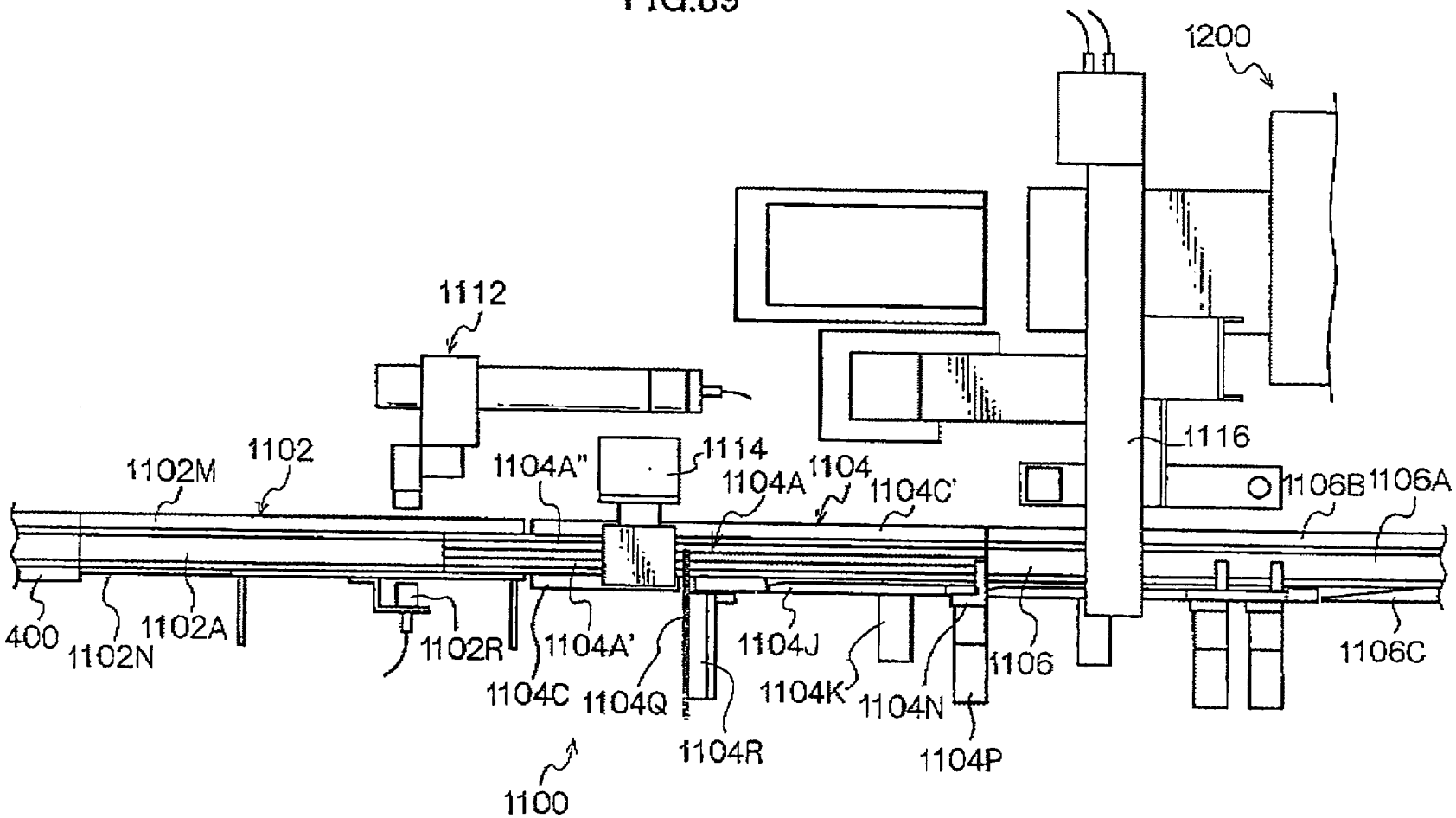
FIG. 89 is a plan view showing an entire constitution of the carton assembling apparatus and a partial constitution of a shrink packaging unit incorporated in the packaging system shown in FIG. 83.
Figure 90A:
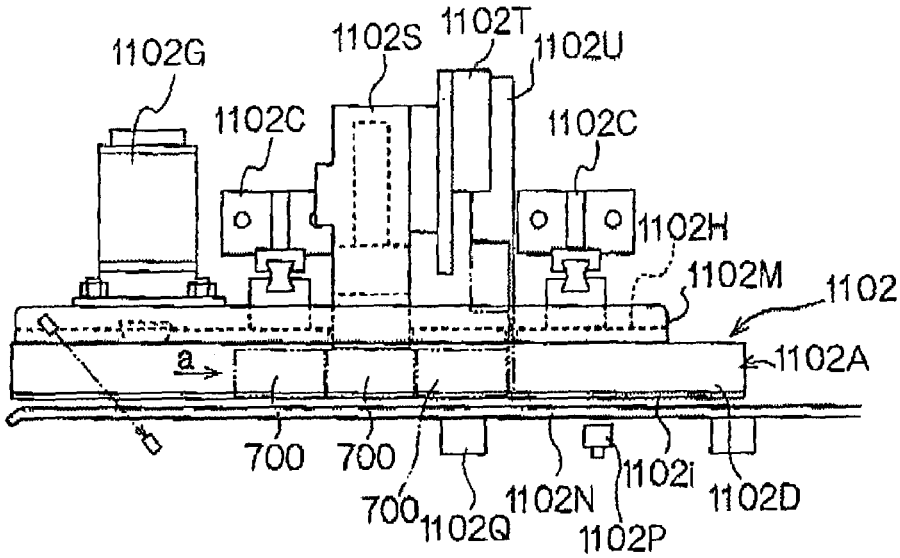
FIG. 90A is a partial plan view and FIG. 90B is a partial side view, both of which show a first conveyer incorporated in the carton assembling apparatus shown in FIGS. 88 and 89.
Figure 90B:
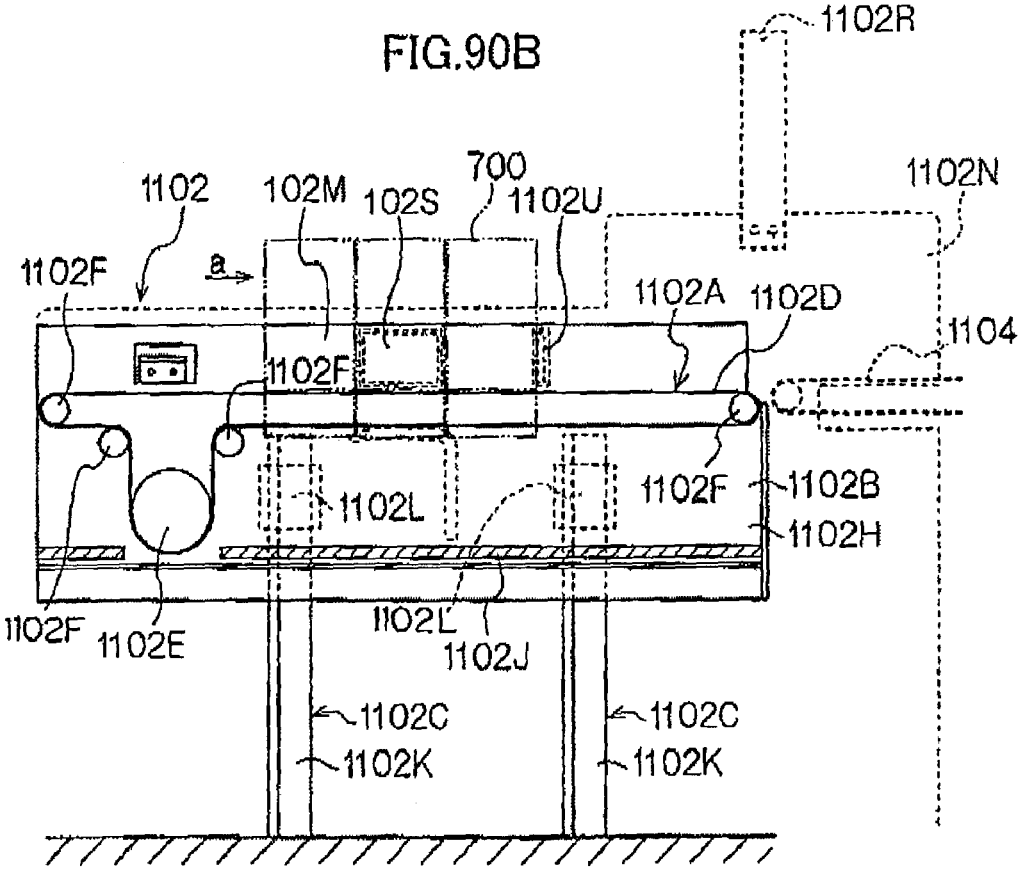

The frame body 1102B comprises a frame plate 1102H located at a position backward relative to this paper in FIG. 90, that is, on a side opposing the first robot 1112 as shown in FIG. 89, a frame plate 1102*i* located on a side opposite to the first robot 1112 across the belt conveyor 1102A, and a plate-like joining member 1102J for joining the frame plate 11102H with the frame plate 1102*i*. The drive roller 1102E and the driven roller 1102F are pivoted by the frame plate 11102H in a cantilever fashion.

Figure 91:
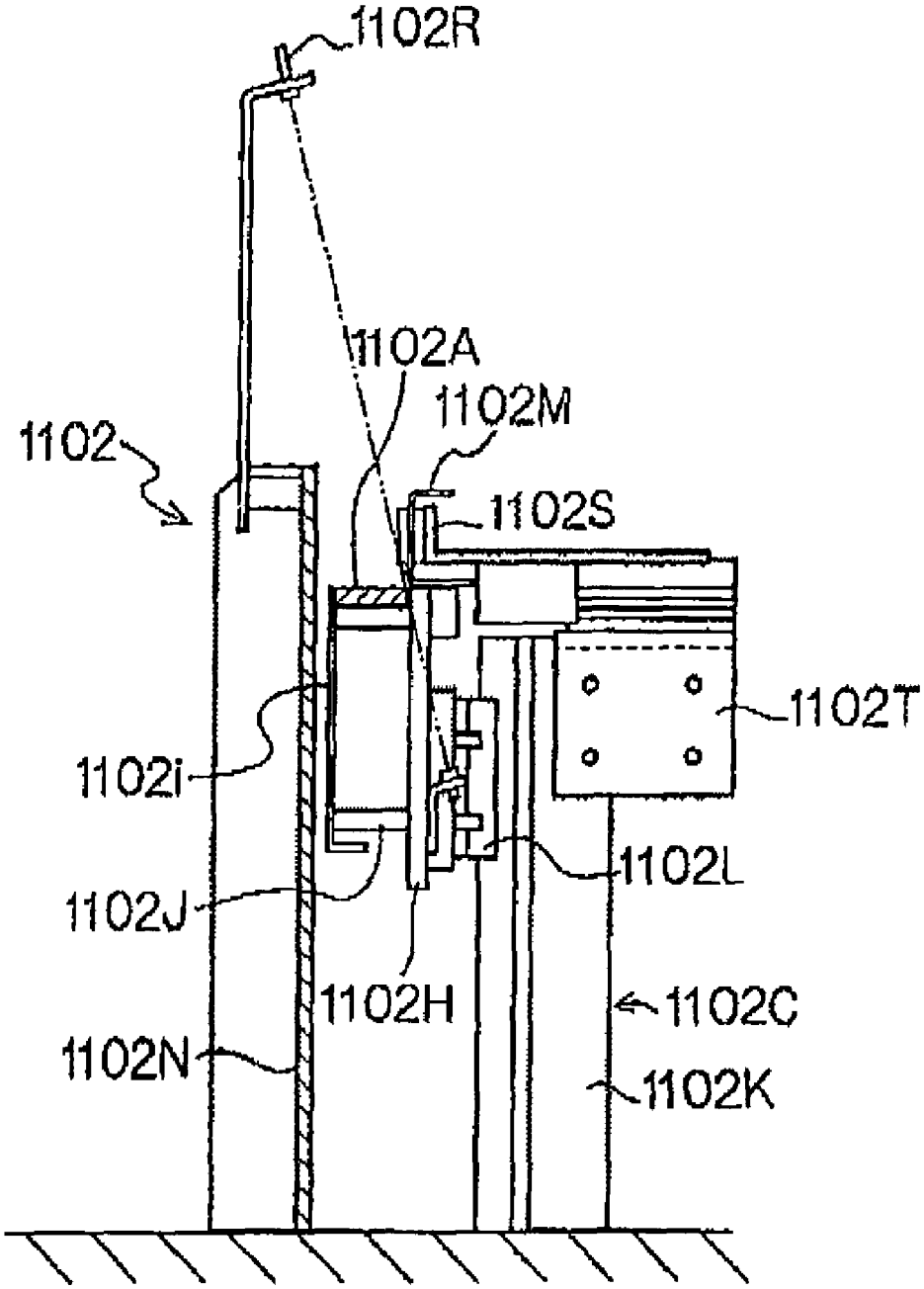
FIG. 91 shows a sectional view of the first conveyer shown in FIGS. 90A and 90B sectioned at a lane perpendicular to the conveyance direction thereof.

As shown in FIGS. 90 and 91, the guide unit 1102C comprises a pair of vertical guide rails 11102K extended vertically and a guide block 1102L which engages with the vertical guide rail 11102K for guiding a frame body vertically. The guide block 102L is fixed on the frame plate 11102H.

A guide plate 1102M having a C-shaped section is fixed on a top edge of the frame plate 1102H. On the other hand, a guide plate 1102N is erected on a side opposite to the guide plate 1102M across the belt conveyor 1102A. As shown in FIG. 91, a gap is formed between the guide plate 1102N and the frame plate 102*i*, so that a header 704 can pass through when the carton 700 with the header 704 is transported.

As shown in FIG. 90, an air slide table 1102T for driving a cutter stopper 1102U and a cutter holder 1102S is fixed in a vertical guide rail 1102K of the frame plate 1102H.

The cutter stopper 1102U and the cutter holder 1102S are driven by the air slide table 1102T in a direction projecting or retracting over/from the belt conveyor 1102A through the guide plate 1102M.

The cutter stopper 1102U is located on the downstream side in the transporting direction a (hereinafter referred to as "downstream side") of the belt conveyor 1102A with respect to the cutter holder 1102S.

The cutter stopper 1102U has a function of stopping the carton 700 at a position allowing a bar code attached to the carton 700 to be read by a bar code reader 1102Q, which will be described later.

On the other hand, the cutter holder 1102S has a function of holding a carton located in the upstream to the carton 700 stopped by the cutter stopper 1102U to prevent it from moving to the downstream side in cooperation with the guide plate 1102N.

A bar code reader 1102Q is provided at a position opposing the air slide table 1102T across the belt conveyor 1102A and a metal detector 1102P and a positioning sensor 1102R are provided on the downstream side of the bar code reader 1102Q.

The bar code reader 1102Q has a function of reading a bar code attached to the carton 700 to detect for a mixture of a different type carton.

The metal detector 1102P has a function of detecting whether or not a predetermined quantity of the plastic case packed products are packed in the carton 700.

1-4-B Second Conveyor

The second conveyor 1104 has a function of arraying the cartons 700, which are carried by the first conveyor 1102 and turned at 90° or 180° around the Y axis by the first robot, which will be described later so as to form a carton assembly 720 in which a predetermined quantity of the cartons 700 are arrayed in a predetermined style.

Figure 92:
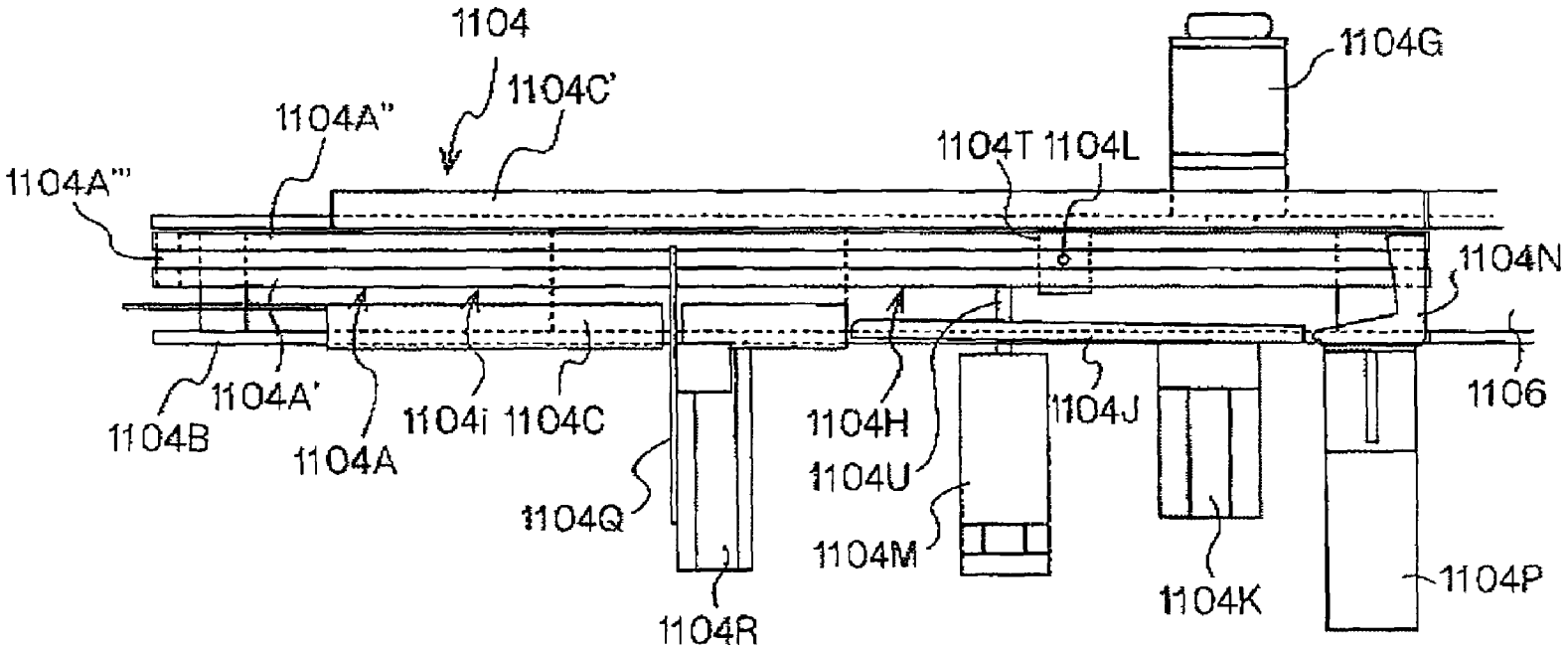
FIG. 92 is a plan view showing an entire constitution of the second conveyer incorporated in the carton-assembling apparatus shown in FIGS. 88 and 89.
Figure 93:
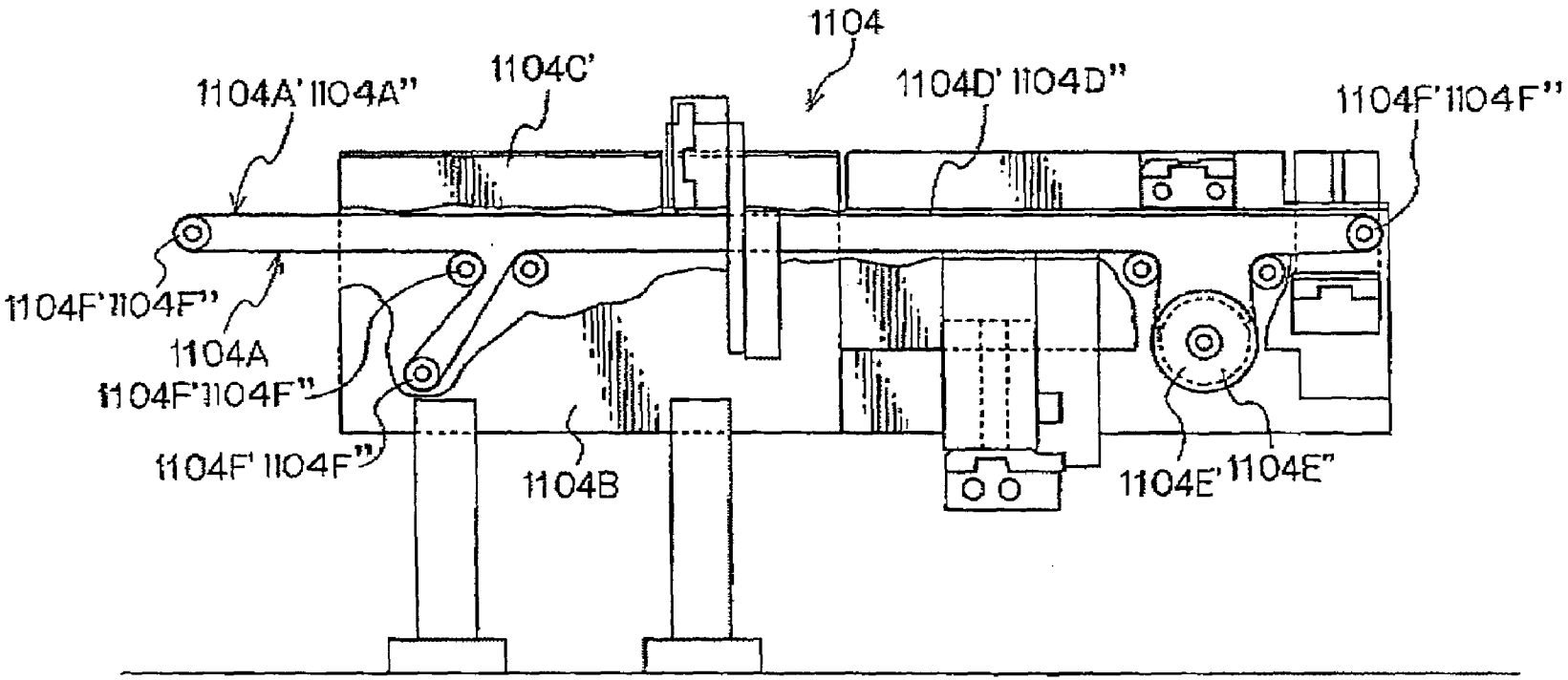
FIG. 93 is a side view of the second conveyer.

The second conveyor 1104, as shown in FIGS. 89, 92 and 93, comprises a belt conveyor unit 1104A, a supporting frame 1104B which comprises a pair of frame plates provided so as to sandwich the belt conveyor unit 1104A and a linking plate for linking these and supports the belt conveyor unit 1104A, and guide plates 1104C, 1104C' provided on a top edge of the supporting frame 1104B and for guiding the carton 700 from dropping from the belt conveyor unit 1104A. As shown in FIG. 89, the guide plate 1104C is located on a side opposite to the first robot 1112 across the belt conveyor unit 1104A and the guide plate 1104C' is located on a side opposing the first robot 1112.

As shown in FIGS. 89 and 92, the belt conveyor unit 1104A comprises two belt conveyors 1104A' and 1104A", which are adjacent to and parallel to each other.

The belt conveyor 1104A' and belt conveyor 1104A" comprise belt 1104D' and belt 1104D", drive roller 1104E' for driving the drive roller 1104D' and drive roller 1104E" for driving the belt 1104D", and a driven roller 1104F' holding the belt 1104D' and a driven roller 1104F" holding the belt 1104D", respectively. The drive roller 1104E' and the drive roller E" are driven by the drive motor 1104G. Because as shown in FIG. 93, the drive roller 1104E' has a larger outside diameter than the drive roller 1104E", the belt conveyor 1104A' on a side far from the first robot 1112 travels faster than the belt conveyor 1104A" on a side near the first robot 1112. Therefore, when the carton 700 is being carried on the belt conveyor unit 1104A, it is turned to a direction to the first robot 1112 when viewed from above. Therefore, even if the carton 700 has a header 704, the header 704 of one carton 700 automatically overlap a main body 702 of the carton 700, thereby forming a carton assembly 720, in which the cartons 700 make firm contact with each other.

The drive roller 1104E' and drive roller 1104E" and the driven roller 1104F' and driven roller 1104F" are pivoted by a frame plate on a side opposing the first robot 1112 of the frame plates which form the frame body 1104B.

An arraying portion 1104H for arraying the cartons 700 is formed on the downstream side of the belt conveyor unit 1104A, that is, near the third conveyor 1106 and an introduction portion 1104*i* for introducing the carton 700 is formed near the upstream side of the arraying portion 1104H.

Figure 94:
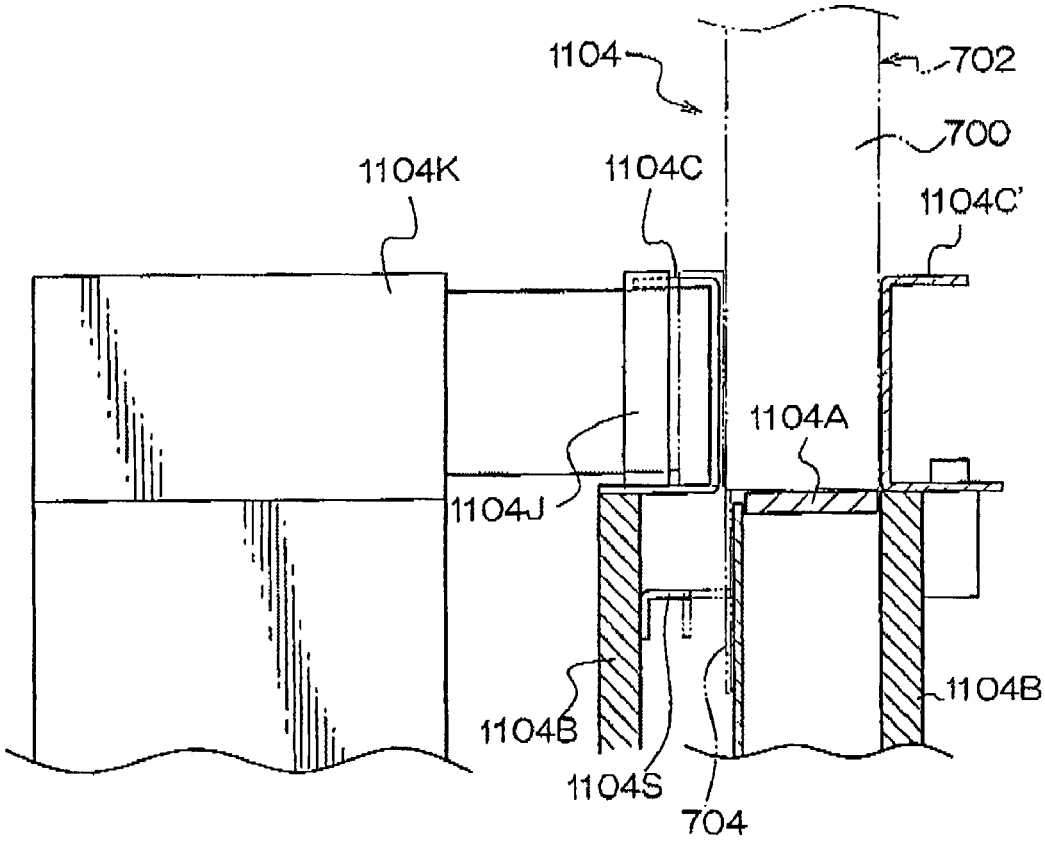
FIG. 94 shows a sectional view of the second conveyer from the downstream with respect to the conveyance direction.

As shown in FIGS. 92 to 94, a move guide plate 1104J is provided at a position opposing the guide plate 1104C' across the belt conveyor unit 1104A of the arraying portion 1104H. The move guide plate 1104J is moved by an air slide table 1104K in directions of approaching an leaving the belt conveyor unit 1104A. When the carton 700 is carried, the move guide plate 1104J is moved to the first position near the belt conveyor unit 1104A as indicated with two-dot chain line in FIG. 94 so as to hold a side face of the carton 700 for the carton 700 not to drop from the belt conveyor unit 1104A. Then, when the cartons 700 are arrayed by the arraying portion 1104H, the move guide plate 1104J is moved to the second position far from the belt conveyor unit 1104A as indicated with a solid line in FIG. 94 so that it does not make an obstacle to arrangement of the cartons 700 on the belt conveyor unit 1104A.

Figure 95:
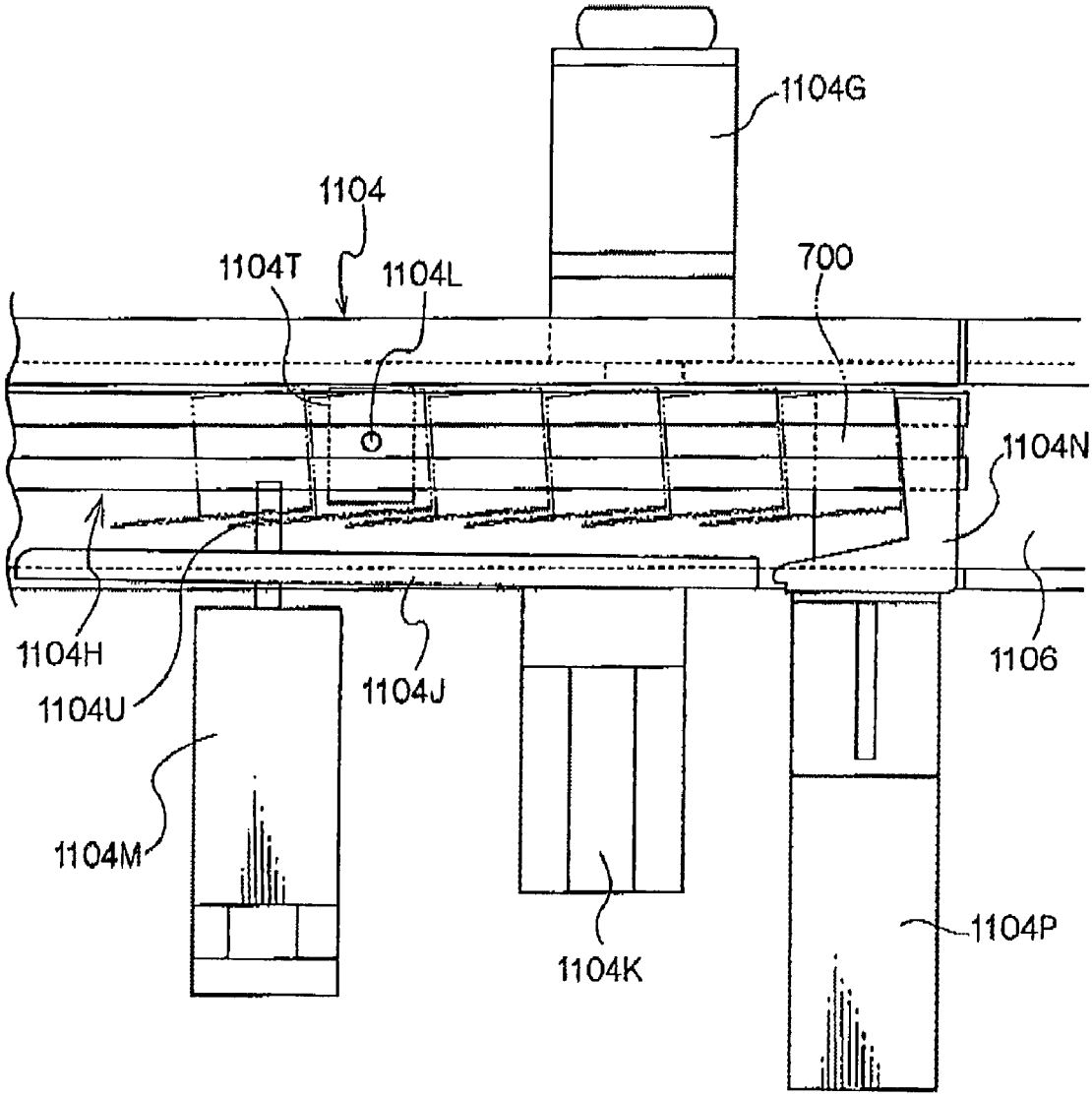
FIG. 95 is a plan view showing a detailed constitution of a downstream end portion of the second conveyer.

As shown in FIGS. 92 and 95, a stopper 1104N having a L-shaped flat configuration is provided at an end in the downstream of the second conveyor 1104. The stopper 1104N is moved along the width direction of the belt conveyor 1104A so as to project over and retract from a transporting plane of the belt conveyor unit 1104A by the air slide table 1104P. The stopper 1104N has a function of pressing the cartons 700 being carried on the transporting plane from the downstream side not to be moved to the third conveyor 1106 by projecting over the transporting plane of the belt conveyor unit 1104A.

Figure 96:
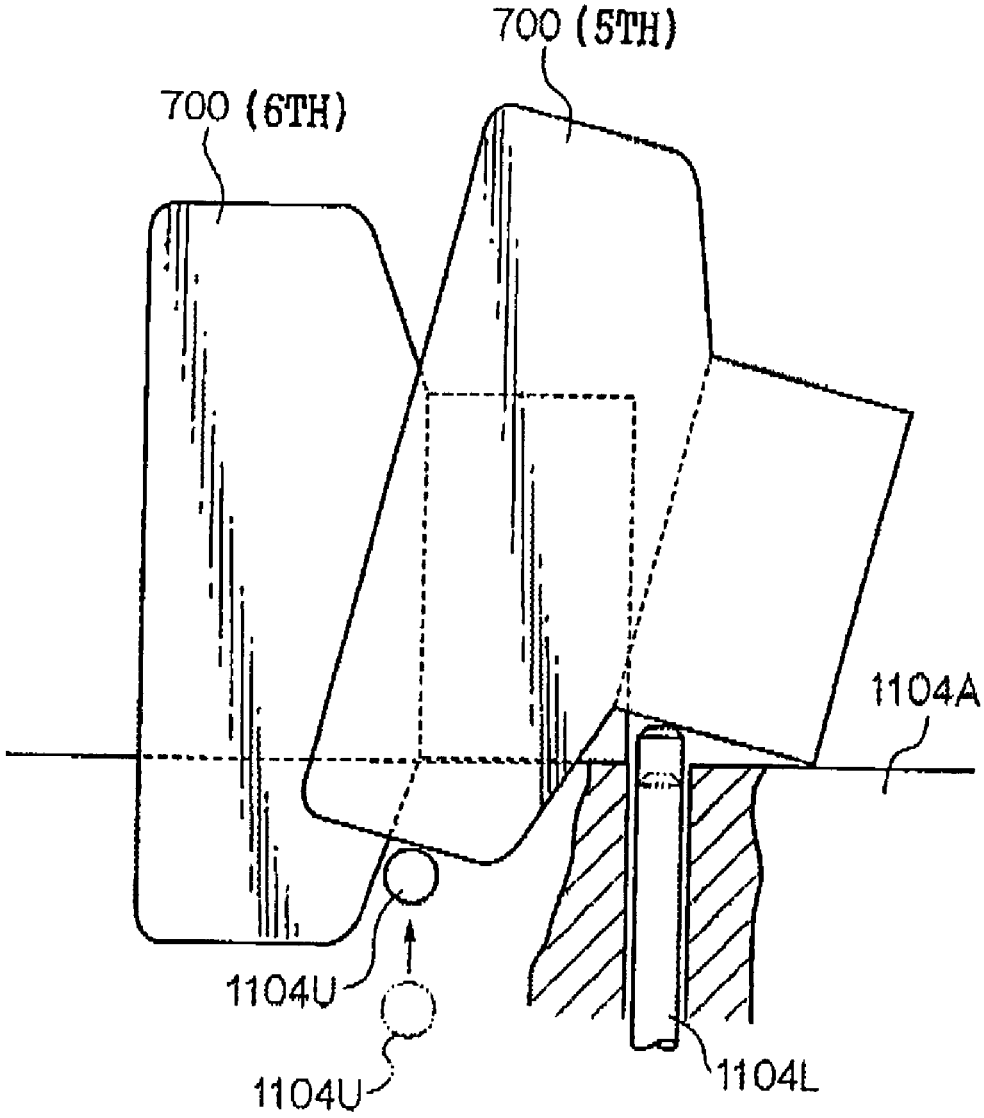
FIG. 96 is an expanded view showing a relative relation of the locations of a group of cartons (five cartons) conveyed on the second conveyer and a sixth carton that is conveyed following to the previous group of cartons (previous five cartons).

A pin 1104L is provided between the belt conveyor 1104A' and the belt conveyor 1104A" at a portion provided with the move guide plate 1104J of the belt conveyor unit 1104A. As shown in FIGS. 95 and 96, when five pieces of the cartons 700, that is, so-called 1CD products, which are the cartons 700 having the header 704 at one lid portion and contain a single plastic case packed product each, are accumulated on the belt conveyor unit 1104A by the stopper 1104N, the pin 1104L is located below the fifth carton 700 if counted from the downstream side, so that it is projected or retracted by the air slide table 1104T provided below the belt conveyor unit 1104A. Consequently, the header 704 of the fifth carton 700 does not overlap the main body 702 of the sixth carton 700. As a result, when the stopper 1104N is retracted, only the five cartons 700 are transported to the downstream side, so that they are separated from the sixth carton an cartons 700 located further in the upstream.

As shown in FIGS. 92 and 95, an auxiliary bar 1104U, which is horizontal rod-like member adjacent to the upstream side of the pin 1104L, is projected at right angle to the belt conveyor unit 1104A from the move guide plate 1104J to the belt conveyor unit 1104A. The auxiliary bar 1104U is ascended or descended by the air slide table 1104M. As shown in FIGS. 19 and 20, the auxiliary bar 1104U rises with the pin 1104L so as to push up the header 704 of the fifth carton 700, helping the carton 700 to override the pin 1104L.

The introduction portion 1104*i* has a stopper plate 1104Q, which is provided on the belt conveyor 1104A and capable of projecting/retracting along the width direction of the belt conveyor unit 1104A. The guide plate 1104C has an opening portion which allows the stopper plate 1104Q to pass through. The stopper plate 1104Q is moved along the aforementioned direction by the air slide table 1104R.

As shown in FIG. 94, a header reception guide 1104S, which is located at a first position far from the belt conveyor unit 1104A or a second position near the belt conveyor unit 1104A, is provided below the guide plate 1104C. When a 2CD product, which is a carton 700 accommodating two pieces of the plastic case packed product for photographic film and having the header 704 at one lid portion thereof, is carried, the header 704 is, as shown in FIG. 94, inserted into a gap between the belt conveyor unit 1104A and the guide plate 1104C and the 2CD product is carried on the belt conveyor unit 1104A in its upside down state. Thus, the header reception guide 1104S takes the first position indicated with a solid line in FIG. 94 not to obstruct the transporting of the 2CD product. On the other hand, because when the 1CD product is carried, the 1CD product is carried in a condition in which only one side edge of the header 704 is inserted into the gap between the belt conveyor unit 1104A and the guide plate 1104C, the header reception guide 1104S takes the second position indicated with a two-dot chain line in FIG. 94, in order to prevent the 1CD product from falling down.

1-4-C Third Conveyor

The third conveyor 1106 has a function of sorting the carton assemblies 720 formed by the second conveyor to ones which should be transported to the shrink packaging unit 1200 and ones which should be transported directly to the corrugated board casing unit 1300.

Figure 97A:
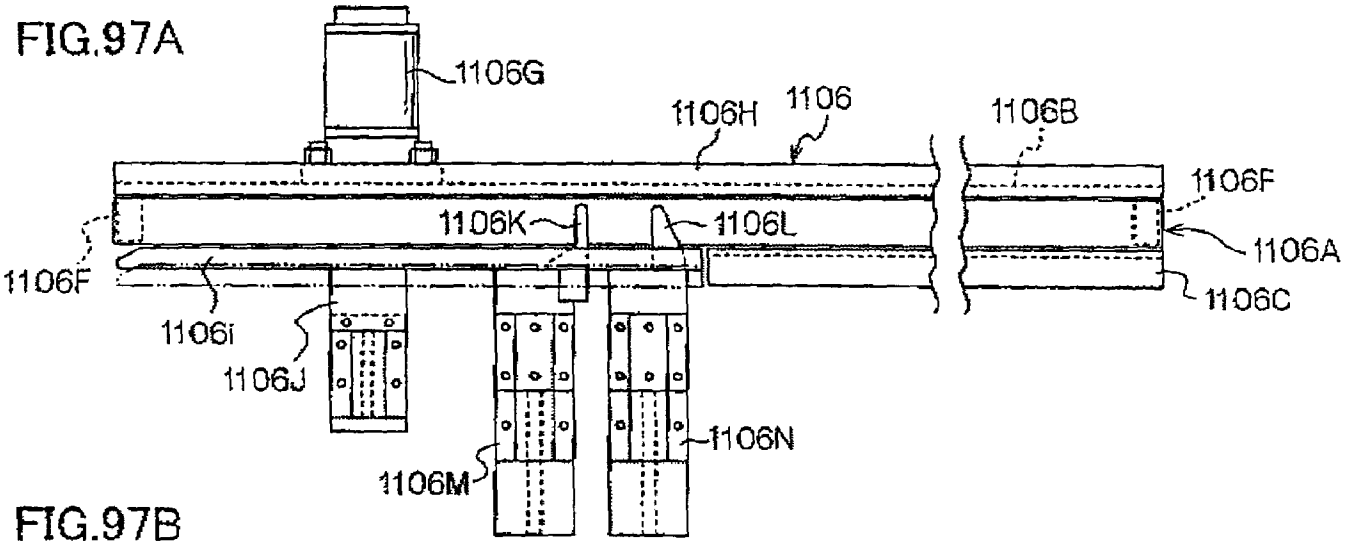
FIGS. 97A and 97B are a plan view and a side view, respectively, which show a third conveyer incorporated in the carton-assembling apparatus shown in FIGS. 88 and 89.
Figure 97B:
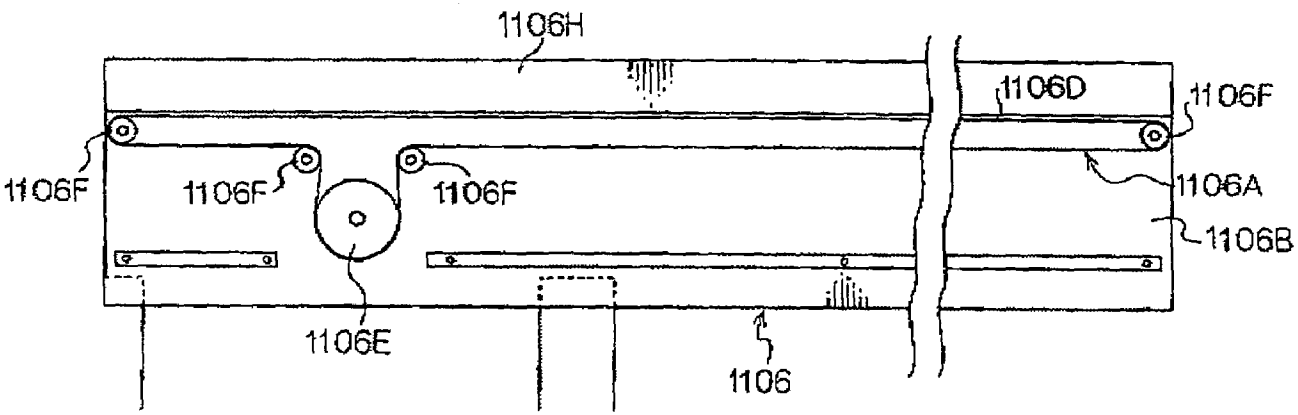

As shown in FIGS. 89 and 97, the third conveyor 1106 comprises a belt conveyor 1106A for carrying the carton 700 to the corrugated board casing unit 1300, a frame plate 1106B which supports the belt conveyor 1106A and a guide plate 1106C erected so as to oppose the frame plate 1106B across the belt conveyor 1106A. FIG. 97A shows a plan view of the third belt conveyor 1106 when seen from above and FIG. 97B shows a front view of an internal structure of the belt conveyor 1106A. The guide plate 1106C is omitted from FIG. 97B.

The belt conveyor 1104A comprises a drive roller 1106E, four driven rollers 106F and a belt 1106D which is wound around the drive roller 1106E and the driven roller 1106F. The drive roller 1106E is driven by a drive motor 1106G. The drive roller 1106E and the driven roller 1106F are pivoted by the frame plate 1106B in a cantilever style. A drive motor 1106G for driving the drive roller 1106E is fixed on a face on a side opposite to the side in which the drive roller 110GE and the driven roller 1106F are pivoted of the frame plate 1106B.

A guide plate 1106H having a C-shaped section is fixed on a top face of the frame plate 1106B.

A carton arranging plate 1106*i* is provided at an end portion on the upstream side of the third conveyor 1106, this carton arranging plate 1106*i* pressing the cartons 700 at right angle to the transporting direction after introduced in a condition that they are arrayed by the arraying portion 1104H of the second conveyor 1104 in parallel to the guide plate 1106H across the belt conveyor 1106A so as to arrange the cartons in line. As shown in FIG. 97, the carton arranging plate 1106*i* is capable of being moved in directions of approaching or leaving the belt conveyor 1106A by the air slide table 1106J. As indicated with a solid line and a two-dot chain line in FIG. 97, the carton arranging plate 1106*i* takes the first position near the belt conveyor 1106A or the second position far from the belt conveyor 1106A. The carton arranging plate 1106*i* arranges the introduced cartons 700 in line at the first position.

An opening portion which allows two stoppers 1106K and 1106L to project over the belt conveyor 1106A is provided at an end on the downstream side of the carton arranging plate 1106*i*.

The stoppers 1106K and 1106L have a function of holding any introduced carton 700 from being pushed from the upstream side and moved to the downstream side and are projected or retracted at right angle to the moving of the belt conveyor 1106A by the air slide table 1106M and the air slide table 1106N.

The guide plate 1106C is erected adjacent to the carton arranging plate 1106*i* and in the downstream thereof. The guide plate 1106C has an inverted L shaped section, so that a gap which allows the header 704 of the carton 700 to pass through is formed between the guide plate 1106C and the belt conveyor 1106A.

1-4-D Fourth Conveyor

The fourth conveyor 1108 has a function for transporting the carton assemblies 720 sorted to the ones which should be carried directly to the corrugated board casing unit 1300 by the third conveyor 1106, to the fifth conveyor 1110.

1-4-E Fifth Conveyor

The fifth conveyor 1110 has a function of recognizing the quantity of the carton assemblies 720 transported by the fourth conveyor 1108 and arranging in line the carton assemblies 720 for the product loading robot loading robot 1302 of the corrugated board casing unit 1300.

Figure 98A:
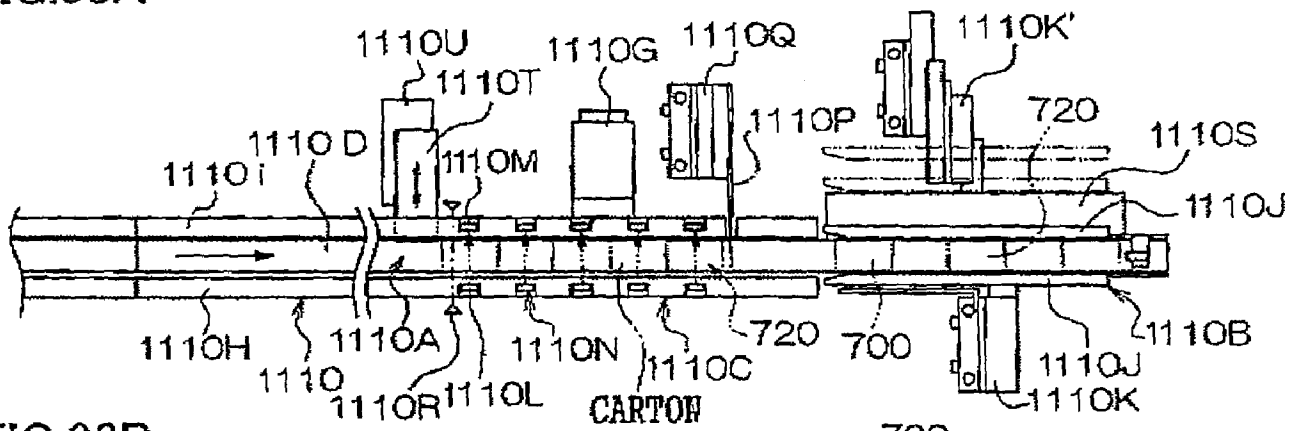
FIGS. 98A and 98B are a plan view of a fifth conveyer incorporated in the carton-assembling apparatus shown in FIGS. 88 and 89, and a side view of the fifth conveyer, respectively.
Figure 98B:
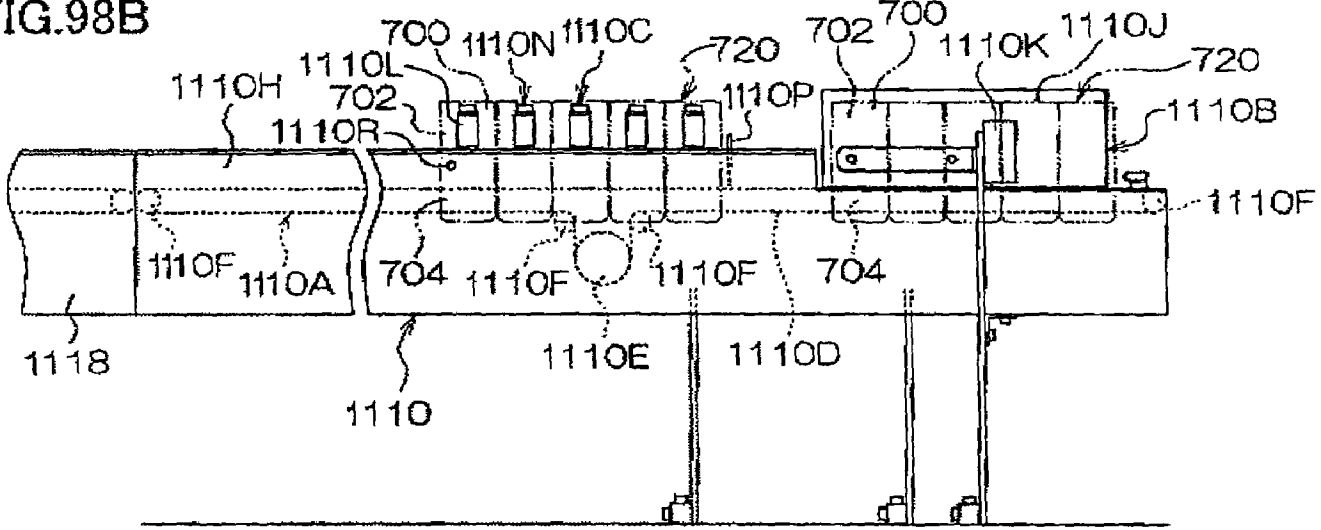

FIG. 98A shows a plan view of the fifth conveyor 1110 taken from above and FIG. 98B shows a side view thereof taken from the side. The arrow indicates a transporting direction of the carton assembly 720.

As shown in FIG. 98, the fifth conveyor 1110 comprises a belt conveyor 1110A, a carton arranging portion 1110B provided at an end on the downstream side of the belt conveyor 1110A, and a carton detecting portion 1110C provided adjacent to the upstream side of the carton arranging portion 1110B.

The belt conveyor 1110A comprises a belt 1110D, a driving roller 1110E for driving the belt 1110D and a driven roller 110F for holding the belt 1110D. The driving roller 1110E is driven by the drive motor 1110G.

A guide wall 1110H and a guide wall 1110*i* are erected on both sides of the belt conveyor 1110A. The guide wall 1110H and the guide wall 1110*i* are guides for preventing the carton assembly 720 carried by the belt conveyor 1110A from dropping from the belt 1110D. A gap is formed between the guide wall 1110H and the belt conveyor 1110A to allow the header 704 to pass through when the carton 700 having the header 704 is transported. A pair of the carton pressing plates 1110J are provided on an end portion on a side in which the carton arranging portion 1110B is provided of the belt conveyor 1110A instead of the guide wall 1110H and the guide wall 1110*i* such that they sandwich the belt conveyor 1110A. The carton pressing plate 1110J has a function of arranging the carton assemblies 720 transported by the belt conveyor 1110A along the width direction by pressing from both sides and is capable of being moved by an air slide unit 1110K and an air slide unit 1110K' provided so as to oppose each other across the belt conveyor 1110A along a direction at right angle to the transporting direction of the carton assembly 720. A table 1110S for storing the carton assemblies 720 arranged by the carton pressing plate 1110J temporarily is provided on the left side of the carton pressing plate 1110J with respect to the advancement direction in FIG. 98.

The carton detecting portion 1110C comprises five light emission portions 110L erected on a top edge of the guide wall 1110H along the transporting direction of the carton 700, a carton detecting unit 110N which is provided on the upper edge of the guide wall 1110*i* and constituted of a light-receiving unit 1110M for receiving light from each light emission portion 1110L and a stopper plate 1110P provided adjacent to the downstream side of the carton detection unit 1110N. The stopper plate 1110P is moved by the air slide unit 1110Q in the direction at right angle to the transporting direction of the carton assembly 720, projected over the belt conveyor 1110A through a slit-like opening portion formed in the guide wall 1110*i* and then pulled outward of the belt conveyor 1110A through the opening portion. A carton detecting sensor 1110R for detecting whether or not a predetermined quantity of the cartons, for example, five cartons exist in the carton detecting portion 1110C photo-electrically is provided adjacent to the light emission portion 1110L and light-receiving unit 1110M on the highest upstream.

Adjacent the upstream side of the carton detecting sensor 1110R are provided a carton holding unit 1110T capable of projecting/retracting the belt conveyor 1110A and an air slide unit 110U for moving the carton holding unit 1110T in the direction at right angle to the transporting direction of the carton 700. The carton holding unit 1110T has a function of holding the sixth carton if counted from the downstream side not so as to be carried to the downstream side in cooperation with the guide wall 1110H and introducing only a predetermined quantity, for example, five cartons 700 into the carton arranging portion 1110B.

When the carton assemblies 720 sorted to the one which should be transported directly to the corrugated board casing unit 1300 on the third conveyor 1106 are transported on the fourth conveyor 1108 and the fifth conveyor 1110, the stopper plate 1110P on the fifth conveyor 1110 is ejected on the belt conveyor 1110A as indicated with a two-dot chain line in FIG. 98.

The carton assembly 720 carried by the fourth conveyor 1108 and the fifth conveyor 1110 abuts the stopper plate 1110P and is stopped at the carton detecting unit 1110N. The carton detecting unit 1110N detects whether or not the transported carton 700 is located properly in the vertical direction depending on which light from the light emission portion 1110L is received by the light-receiving unit 1110M or interrupted.

If the carton detecting sensor 1110R detects that the fifth carton 700 is carried to the carton detecting unit 1110N, the stopper plate 1110P is retracted as indicated with a solid line in FIG. 98. At the same time, the carton holding unit 1110T is ejected on the belt conveyor 1110A so as to hold the sixth carton 700 from being moved to the carton arranging portion 1110B. Thus, only the five cartons constituting the carton assembly 720 are transported to the carton arranging portion 1110B.

The carton assembly 720 is pressed from both sides by the carton pressing plate 1110J at the carton arranging portion 1110B so as to eliminate a disorder in the direction at right angle to the transporting direction. At the same time, the carton assembly 720 is positioned. When the carton assembly 720 is formed by stacking two carton groups each composed of five cartons 700 vertically, after the first carton group is carried to the carton arranging portion 1110B, that carton group is sandwiched by the carton pressing plate 1110J and moved in the direction at right angle to the transporting direction and then placed on the table 1110S so as to inhibit from obstructing an introduction of the second carton group to the carton arranging portion 1110B.

1-4-F First Robot

Figure 99:
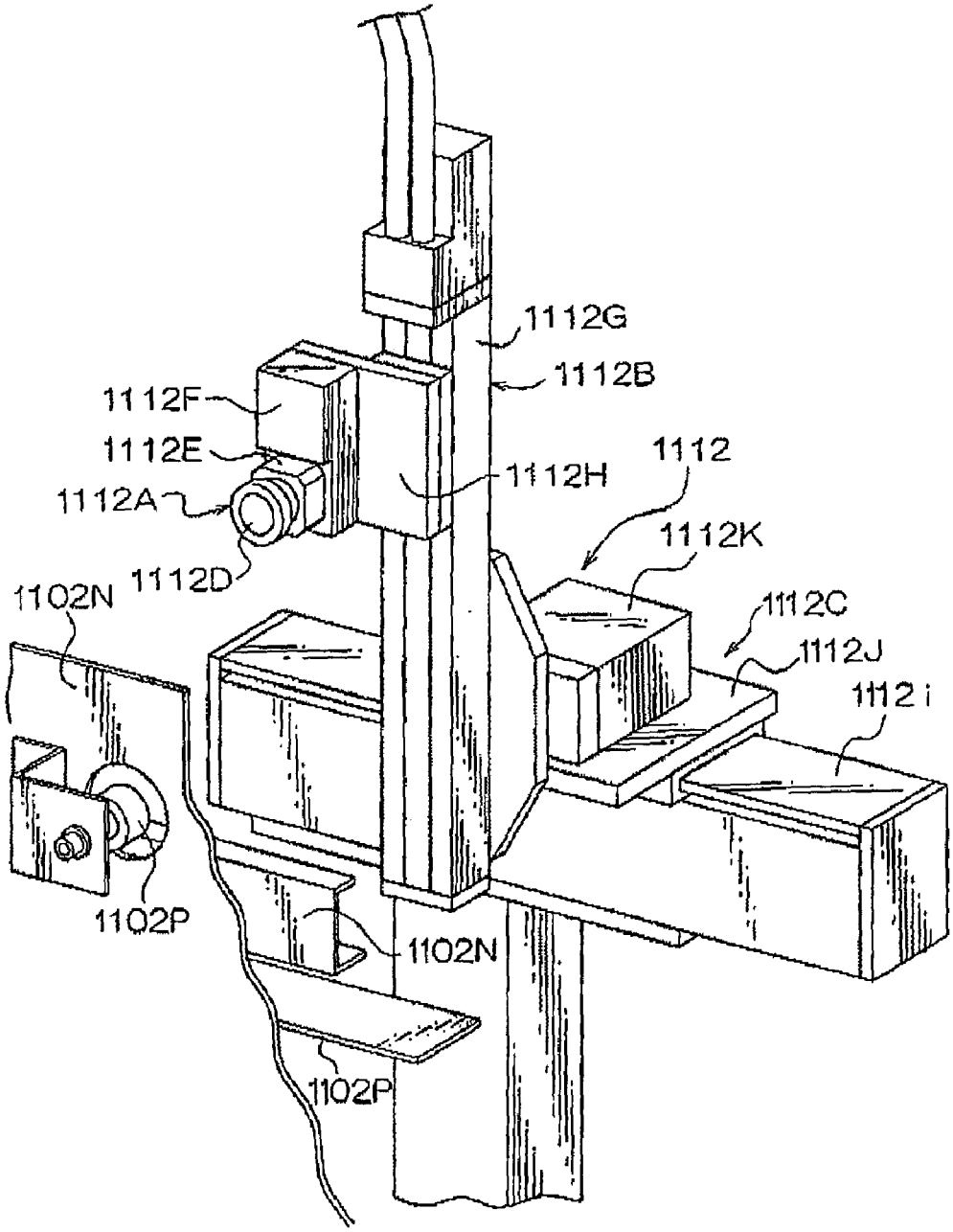
FIG. 99 is a perspective view showing a first robot incorporated in the carton-assembling apparatus shown in FIGS. 88 and 89.
Figure 100:
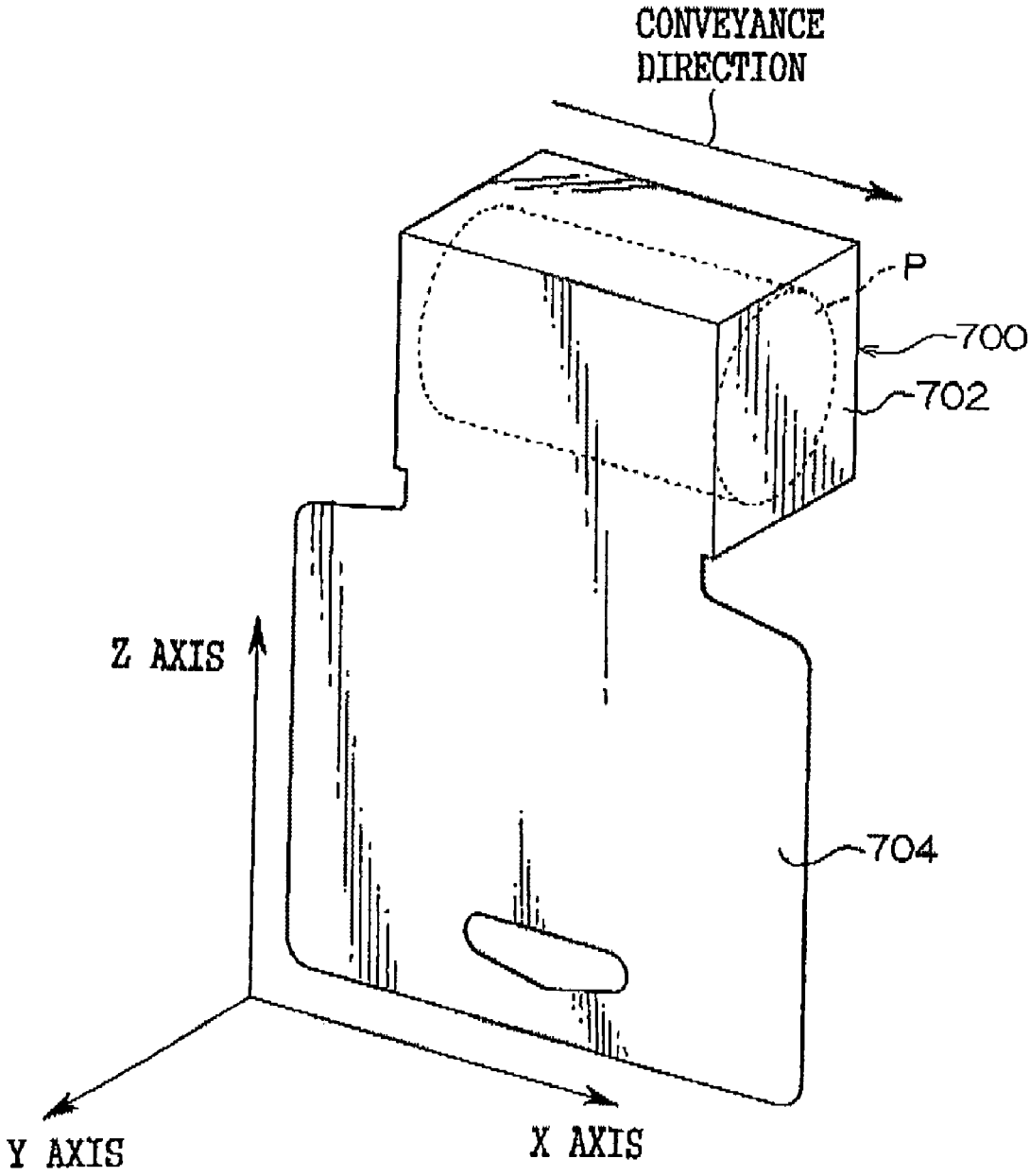
FIG. 100 is a schematic diagram showing a relation between a carton and X, Y, and Z-axis.

The first robot 1112, as shown in FIG. 99, comprises a suction/rotation portion 1112A which holds a carton 700 carried by the first conveyor 1102 by sucking a side face thereof and rotates it by 90° or 180° around the Y axis, a Z-axis guide portion 1112B for guiding the suction/rotation portion 1112A in the direction of Z-axis and an X-axis guide portion 1112C for guiding the suction/rotation portion 1112A in the direction of X-axis. As shown in FIG. 100, the X-axis is a rotation axis along the transporting direction of the carton 700, the Y-axis is a rotation axis within a horizontal plane along a direction at right angle to the Y-axis and the Z-axis is a rotation axis in a vertical direction, or in the height direction. The carton 700 shown in FIG. 100 is a 1CD product.

The suction/rotation portion 1112A comprises a suction portion 1112E having a sucker 1112D for sucking and holding the side face of the carton 700, and a base 1112F which holds the suction portion 1112E such that it is rotatable around the Y-axis with respect to its central point.

The Z-axis guide portion 1112B comprises a guide rail 1112G erected vertically and a guide block 1112H movable vertically in engagement with the guide rail 1112G. The guide block 1112H is moved through a ball screw provided vertically within the guide rail 1112G. The suction/rotation portion 1112A is fixed on the guide block 1112H.

The X-axis guide portion 1112C comprises a guide rail 1112*i* provided in parallel to the first conveyor 1102, a traveling base 1112J which travels in the direction of the X-axis in engagement with the guide rail 1112*i*, and an air slide table 1112K which is fixed on the traveling base 1112J for holding the guide rail 1112G on the Z-axis guide 1112B. The guide rail 1112G is held vertically by the air slide table 1112K and moved in directions of approaching/leaving the first conveyor 1102 in the direction of the Y-axis.

If the positioning sensor 1102R provided on the first conveyor 1102 detects a carton 700, the Z-axis guide 1112B, the X-axis guide portion 1112C and the air slide table 1112K are actuated, so that the suction/rotation portion 1112A approaches the carton 700. The sucker 1112D of the suction/rotation portion 1112A adheres to the side face of the carton 700 by suction. After the sucker 1112D adheres to the side face of the carton 700 by suction, the base 1112E is rotated by 90° or 180° or not rotated according to an instruction from the control computer 500, moved in the height direction by the Z-axis guide 1112B and at the same time, moved by the X-axis guide portion 1112C along the X-axis. Consequently, the carton 700 is moved from the first conveyor 1102To the second conveyor 1104.

After the carton 700 is placed on the second conveyor 1104, the suction/rotation portion 1112A is returned to its original position.

1-4-G Second Robot

The second robot 1114 has a function of rotating the carton 700 transported by the first conveyor 1102 and the second conveyor 1104 around the Z-axis.

Figure 101:
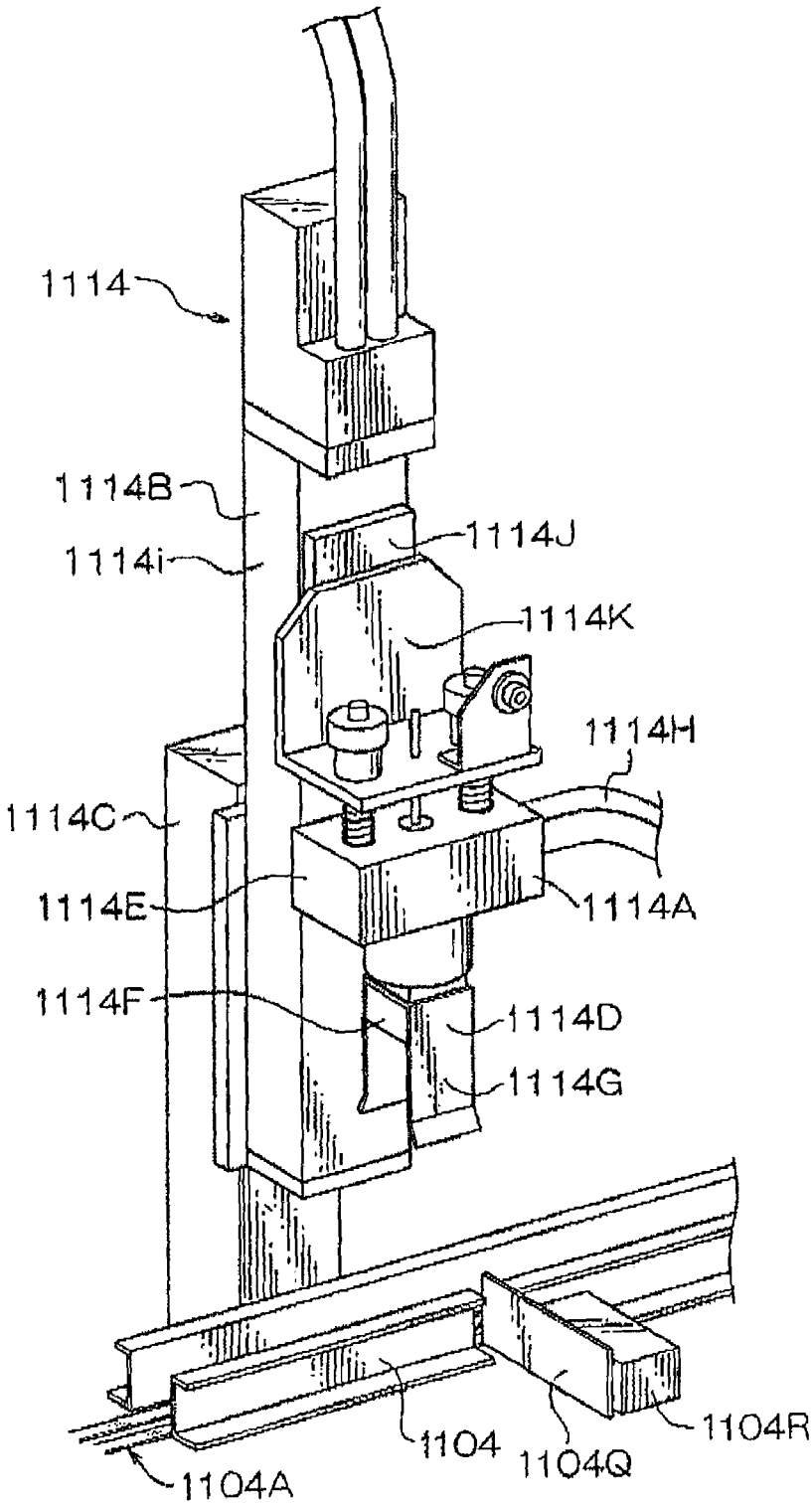
FIG. 101 is a perspective view showing a second robot incorporated in the carton-assembling apparatus shown in FIGS. 88 and 89.

The second robot 1114 is provided above the stopper plate 1104Q of the second conveyor 1104 as shown in FIGS. 89 and 101.

The second robot 1114 comprises a carton holding portion 1114A for sucking/holding the carton 700, a vertical-moving guide 1114B for guiding the carton holding portion 1114A vertically and a holding member 1114C for holding the vertical-moving guide 1114B vertically.

The carton holding portion 1114A comprises a suction holding portion 1114D for sucking/holding the carton 700, and a suction holding portion rotating motor 1114E which holds the suction holding portion 1114D rotatably around a rotation axis in the vertical direction.

The suction holding portion 1114D comprises a suction cup 1114F and a guide member 1114G for introducing the top of the carton 700 to the suction cup 1114F.

A suction pipe 1114H is connected to the suction holding portion rotating motor 1114E. The suction pipe 1114H communicates with the suction cup 1114F through a rotation shaft of the suction motor 1114E.

The vertical-moving guide 1114B comprises a guide rail 1114*i* held vertically by the holding member 1114C and a guide block 1114J which moves vertically in engagement with the guide rail 1114*i*. The suction holding portion rotating motor 1114E is fixed on the guide block 1114J through a mounting metal 1114K.

After the stopper plate 1104Q is ejected over the belt conveyor unit 1104A of the second conveyor 1104 and the carton 700 is stopped, the carton holding portion 1114A descends to the carton 700, so that the guide member 1114G engages with the top of the carton 700. If a top face of the carton 700 is sucked by the suction cup 1114F, the guide block 1114J ascends along the guide rail 1114*i* so that the carton 700 is raised. Then, the suction holding portion 1114D is also rotated by 180° by the suction holding portion rotating motor 1114E. Consequently, the carton 700 is rotated by 180° around the Z-axis. After the carton 700 is rotated by 180° around the Z-axis, the carton holding portion 1114A descends, so that the carton 700 is placed on the belt conveyor unit 1104A and then, depressurization of the suction cup 1114F is released.

1-4-H Third Robot

The third robot 1116 has a function of transporting the carton assembly 720 formed by the second conveyor 1104 to the shrink packaging unit 1200.

Figure 102:
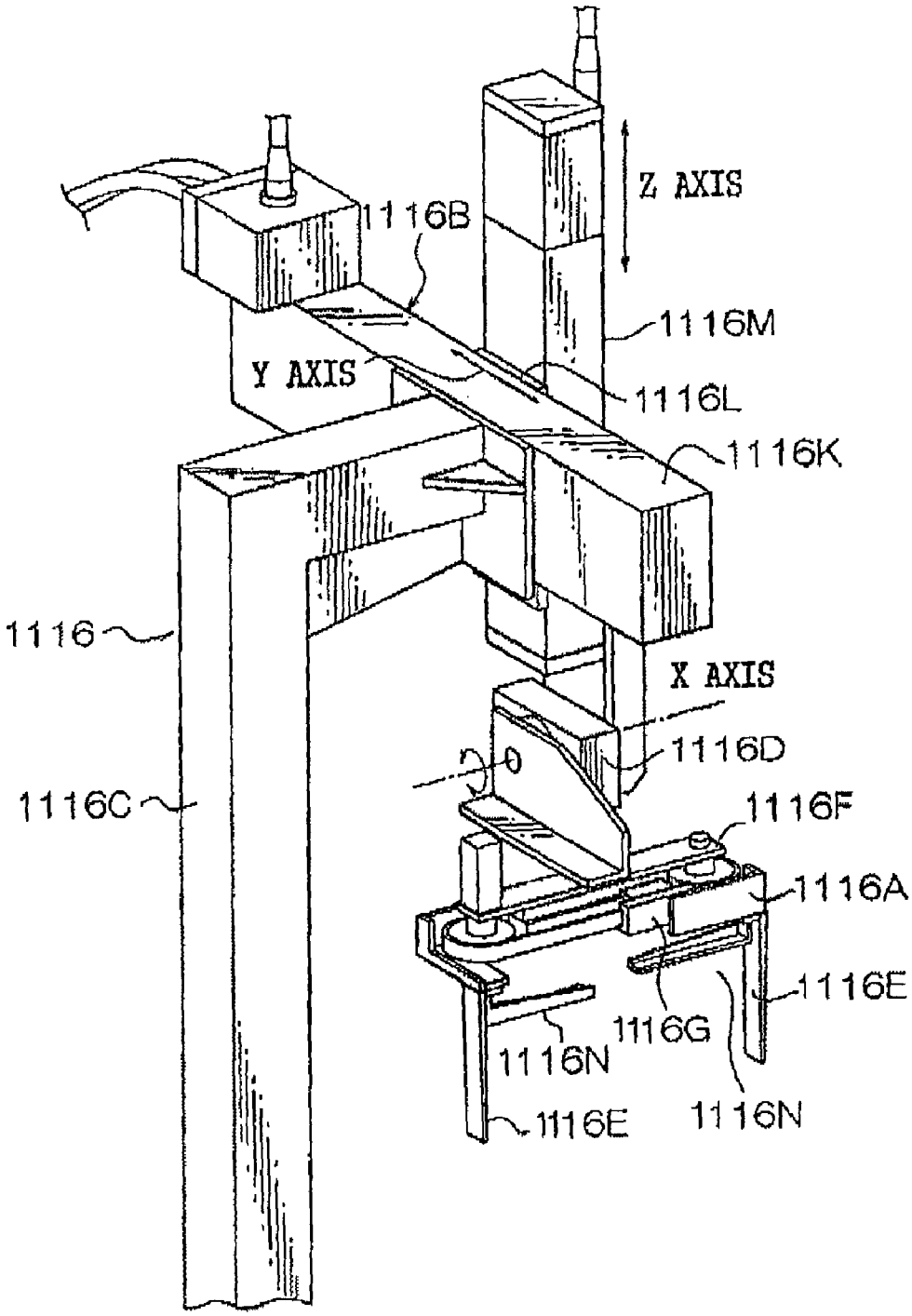
FIG. 102 is a perspective view showing a third robot incorporated in the carton-assembling apparatus shown in FIGS. 88 and 89.

As shown in FIG. 89, the third robot 1116 comprises a chuck portion 1116A which is provided adjacent to the shrink packaging unit 1200 and the third conveyor 1106 and grips the carton assembly 720 formed by arraying the cartons 700 by the second conveyor 1104 and the third conveyor 1106 as shown in FIG. 102, a guide unit 1116B for moving the chuck portion 1116A in the directions of the Y-axis and Z-axis and a column 1116C for supporting the guide unit 1116B. A chuck rotation unit 1116D for rotating the chuck portion 1116A around the X-axis is provided between the chuck portion 1116A and the guide unit 1116B.

As shown in FIG. 102, the guide unit 1116B comprises a Y-axis guide rail 1116K which is fixed on the column 1116C and extended in the direction of the Y-axis, a Y-axis guide block 1116L, which engages with the Y-axis guide rail 1116K and slides on the Y-axis guide rail 1116K in the direction of the Y-axis and a Z-axis guide rail 1116M, which is extended vertically and movable vertically with respect to the Y-axis guide block 1116L. The Y-axis guide block 1116L engages with the Z-axis guide rail 1116M and the Z-axis guide rail 1116M has a ball screw shaft (not shown) which is extended in the longitudinal direction and engages with the Y-axis guide block 1116L.

Figure 103:
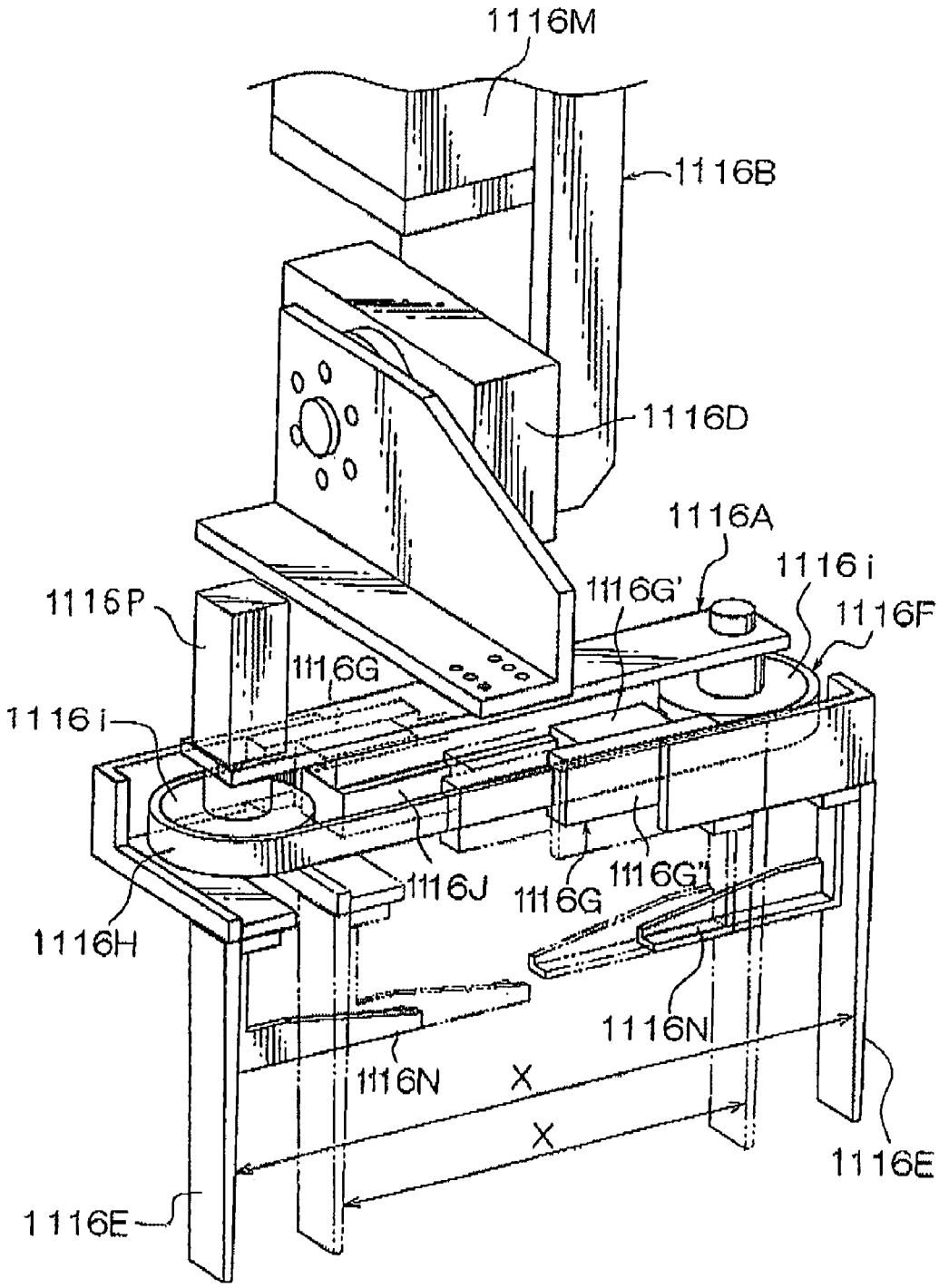
FIG. 103 is a perspective view showing a detailed constitution of a chucking unit incorporated in the third robot shown in FIG. 102.

As shown in FIGS. 102 and 103, the chuck rotation unit 1116D is provided on a bottom end of the Z-axis guide rail 1116M.

The chuck portion 1116A comprises a pair of chuck pawls 1116B for chucking the carton 700, a chuck width setting unit 1116F for setting the chuck width x of the chuck pawl 1116E and a pair of air slide units 11160 for chucking the carton 700 by bringing the chuck pawls 1116E in which the chuck width x is set by the chuck width setting unit 1116F near each other.

Each of the chuck pawls 1116B is fixed on the air slide unit 1116G. The air slide units 1116G are fixed symmetrically on a belt 1116H having the chuck width setting unit 1116F.

The carton positioning pawls 1116N are provided inside of the respective chuck pawls 1116E such that they oppose each other. The carton positioning pawl 1116N is provided at right angle to the chuck pawl 1116E and has a function of restricting the depth of gripping the carton assembly 720 by the chuck pawl 1116E.

The belt 1116H is wound around a pair of belt wheels 1116*i* and driven. Rack-like protrusions are provided on an inner peripheral face of the belt 1116H. On the other hand, thread-like protrusions, which engage the protrusions on the inner peripheral face of the belt 1116H, are provided on the outer peripheral face of the belt wheel 1116*i*. One of the belt wheels 1116*i* is rotated clockwise or counterclockwise by the motor 1116P.

A guide rail 1116J for guiding the air slide unit 1116G along the traveling direction of the belt 1116H is provided inside of the belt 1116H.

The air slide unit 1116G comprises a guide block portion 1116G' and a slide portion 1116G" which slides on the guide block portion 1116G' in parallel to the belt 1116H in engagement with the guide block portion 1116G'. The guide block portion 1116G' is fixed on the belt 1116H and slides on the guide rail 1116J in engagement with the guide rail 1116J. A pneumatic actuator (not shown) for moving the slide portion 1116G" with respect to the guide block portion 1116G' is provided between the guide block portion 1116G' and the slide portion 1116G". Further, the chuck pawl 1116E is fixed on the slide portion 1116G".

If the belt wheel 1116*i* is rotated counterclockwise in FIG. 103, the air slide units 1116G are moved in directions of leaving each other. Thus, the chuck pawls 1116E are also moved in directions of leaving each other as indicated with a solid line in FIG. 103, so that the chuck width x is enlarged. Conversely, if the belt wheel 1116*i* is rotated clockwise in FIG. 27, the air slide units 1116G are moved in directions of approaching each other, so that the chuck pawls 1116E are also moved in directions of approaching each other as indicated with a two-dot chain line in FIG. 103 thereby reducing the chuck width x.

When the carton assembly 720 is gripped by the third robot, the Y-axis guide block 1116L slides on the Y-axis guide rail 1116K in the guide unit 1116B to adjust the position of the chuck portion 1116A so as to be located above the carton assembly 720. At this time, the chuck pawl 1116E is held such that it faces downward in the vertical direction as shown in FIG. 26.

If the chuck portion 1116A is located just above the carton assembly 720, the Z-axis guide rail 1116M descends and therefore, the chuck portion 1116A also descends to the carton assembly 720.

If the carton positioning pawl 1116N included by the chuck portion 1116A abuts the carton assembly 720, the Z-axis guide rail 1116M stops descending.

Next, the belt wheel 1116*i* rotates clockwise so that the chuck pawls 1116E approach each other so as to grip the carton assembly 720. If the carton assembly 720 has the header 704, when it is gripped by the chuck pawls 1116E, the header 704 is located below and the carton positioning pawl 1116N makes a contact with a face opposite to a side containing the header 704 of the carton assembly 720.

When the chuck pawls 1116E grip the carton assembly 720, the Z-axis guide rail 1116M ascends and correspondingly, the chuck portion 1116A also ascends.

Next, the chuck portion 1116A is rotated by the chuck rotation unit 1116D around the X-axis to the left side in FIGS. 102 and 103, in other words, in the direction that the header of the gripped carton assembly 720 is directed to the shrink packaging unit 1200, until the chuck pawl 1116E is set horizontal.

If the chuck pawl 1116E is set horizontal, the Y-axis guide block 1116L slides on the Y-axis guide rail 1116K so that the chuck portion 1116A is moved upward of the shrink packaging unit 1200 along the Y-axis.

If the carton assembly 720 has no header 704 or the header 704 does not need to be folded even if that header 704 is possessed, the chuck portion 1116A descends as it is so as to place the carton assembly 720 on an introduction conveyor 1202A, which will be described later, of the shrink packaging unit 1200.

Figure 104:
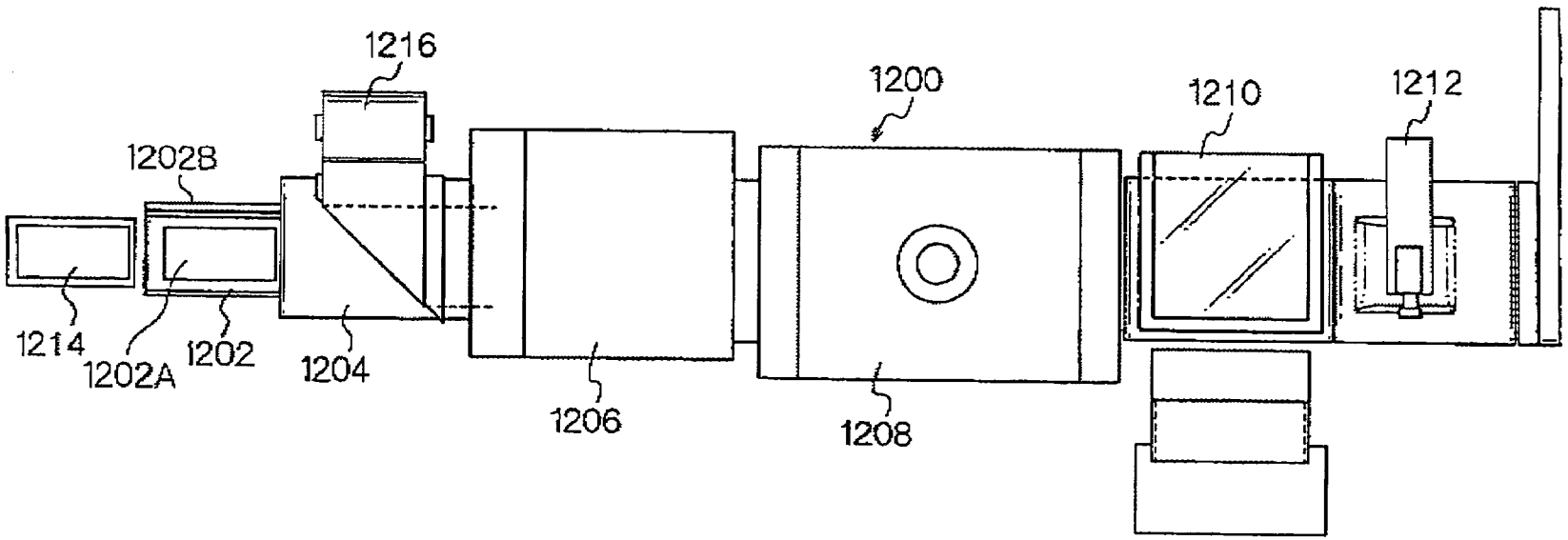
FIG. 104 is a plan view of a shrink packaging unit incorporated in the carton-boxing apparatus shown in FIG. 87.
Figure 105:
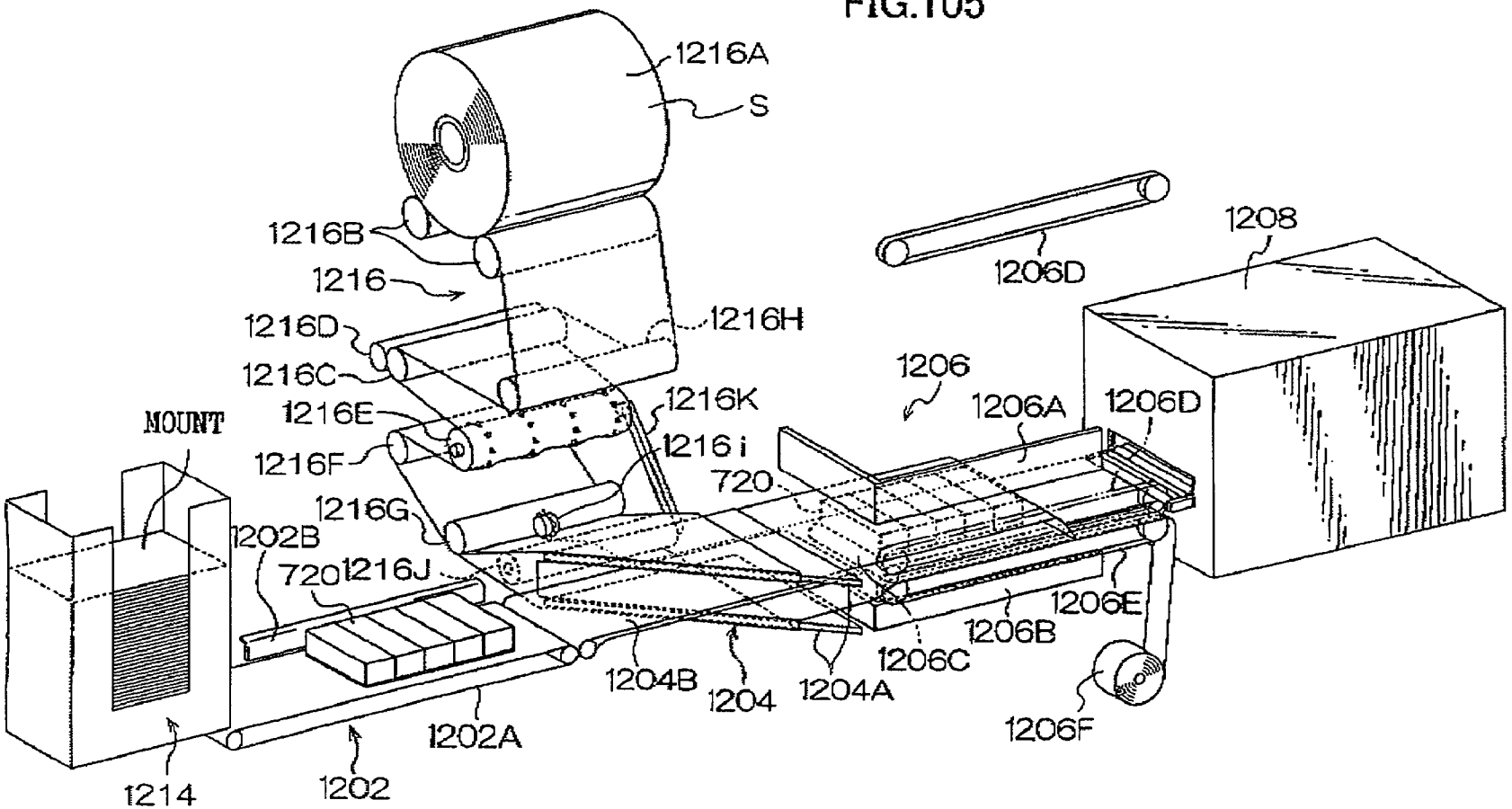
FIG. 105 is a perspective view showing a detailed constitution of an introducing conveyer, a shrink film-covering portion, a heat sealing unit, shrinking unit, a mount-supplying unit and a shrinking film-supplying unit incorporated in the a shrink packaging unit shown in FIG. 104.

Of the carton 700 constituting the carton assembly 720 has the header 704 while the header 704 needs to be folded, the chuck portion 1116A is moved in the direction of the Y-axis and brings the header 704 into a firm contact with the guide plate 202B provided along the introduction conveyor 1202A of the shrink packaging unit 1200 shown in FIGS. 104 and 105. Because the carton positioning pawl 1116N remains abutting on a face on a side opposite to the side provided with the header 704 of the carton 720 when the carton assembly 720 is gripped by the gripping pawls 1116E as described above, the header 704 is bent toward the main body 702 of the carton 700 by a force of the chuck portion 1116A of pressing the header 704 against the guide plate 202*b*. After the header 704 is bent, the chuck portion 1116A places the carton assembly 720 on the introduction conveyor 1202A.

1-5 Shrink-Packaging Unit

The shrink packaging unit 1200, as shown in FIGS. 104 and 105, comprises an introduction portion 1202, a covering portion 1204, a heat-sealing portion 1206A shrink tunnel 1208, a height arranging portion 1210, an end arranging transportation unit 1212 and a mount supplying unit 1214.

The introduction portion 1202 comprises an introduction conveyor 1202A on which the carton assembly 720 moved by the third robot 1116 is to be placed in order to transport that placed carton assembly 720 to the covering portion 1204 and a guide plate 202B provided along a side edge on a side opposite to the side facing the third robot 1116 of the introduction conveyor 1202A.

The covering portion 1204 contains a shrink film supplying portion 1216, which covers around the carton assembly 720 introduced by the introduction conveyor 1202 with shrink film supplied from the shrink film supplying portion 1216. A heat sealing portion 1206 heat-seals the shrink film along the periphery of the carton assembly 720 covered with the shrink film by the covering portion 1204 and cuts. The carton assembly 720, after the shrink film is heat-sealed by the heat sealing portion 1206, is heated in a shrink tunnel 1208 so that the shrink film is contracted or tensed to form the shrink-wrapped package 740.

The height arranging portion 1210 arranges the shrink-wrapped packages 740 formed in the shrink tunnel 1208 in line in the height direction. An end arranging transporting unit 1212 arranges the end portions of the shrink-wrapped packages after an unevenness in the height direction is removed by the height arranging portion 1210 in line and at the same time, transports to the corrugated board casing unit 1300.

When the shrink-wrapped package 740 in which the carton 700 is placed on a mount thereof is formed, the mount is supplied to the introduction conveyor 1202 from a mount supplying unit 1214.

1-5-A Introduction Conveyor, Covering Portion, Heat-Sealing Portion, Shrink Portion and the Like FIG. 105 shows the detail of the configuration of the introduction conveyor 1202, the covering portion 1204, the heat-sealing portion 1206, the shrink tunnel 1208, the mount supplying unit 1214 and the shrink film supplying portion 1216.

The shrink film supplying portion 1216 supplies a shrink film to the covering portion 1204 along a direction at right angle to the transporting of the carton assembly 720 as shown in FIG. 105.

The shrink film supplying portion 1216 comprises an original roll 1216A which shrink film original twice-folded along the longitudinal direction is wound around, a pair of film placing rollers 1216B for supporting the original roll 1216A from downward, a tension roller 1216C and a nip roller 1216D which apply a tension to the shrink film S fed from the original roll 1216A in the twice-folding condition and transport the shrink film S to the covering portion 1204, a film boring roller 1216E which is comprised of four needle-like protrusions for boring air bleeding holes which allow inside air to escape at the time of contraction by heating, in the shrink film transported by the nip roller 1216D, the needle-like holes being formed along the circumferential direction, and a pass roller 1216F and a pass roller 1216G which are located in the downstream of the film boring roller 1216E for introducing the shrink film S to the covering portion 1204. The pass roller 1216H is provided between the tension roller 1216C and the film placing roller 1216B. The pass roller 1216H applies a tension to the shrink film S and introduces the shrink film S so that a winding angle of the shrink film S to the tension roller 1216C is enlarged.

A disc-like perforation blade 1216*i* for applying perforations to an upper shrink film of the shrink film S supplied in the twice-folding condition and a perforation receiving roller 1216J which opposes the perforation blade 1216*i* across a transporting path for the shrink film to be perforated are provided between the pass roller 1216G and the covering portion 1204. A belt 1216K for transmitting a rotation force of the film boring roller 1216E to the perforation receiving roller 1216J is provided between the perforation receiving roller 1216J and the film boring roller 1216E.

The perforation blade 1216*i* is a square cut blade which is driven and rotated while pressed against the surface of the perforation receiving roller 1216J so as to press and cut the shrink film S.

The covering portion 1204 comprises a pair of triangular formers 1204A disposed in parallel and above and below a product conveyor 1204B.

The triangular former 1204A is a right-angled isosceles triangular plate-like member. Of the shrink film S supplied from the shrink film supplying portion 1216 in the twice-folding condition, a half portion located up is wound around the upper triangular former 1204A while a half portion located down is wound around the lower triangular former 1204A. The shrink film S is applied around the upper triangular former 1204A such that it passes from its top face to its lower face through its oblique side. On the other hand, the lower triangular former 1204A is loaded with the shrink film S such that it passes from the lower face to the upper face through the oblique side. Consequently, the shrink film S is opened into a C-shape from the twice-folding condition and further, its traveling direction is converted to the same direction as the transporting direction of the carton assembly 720 on the product conveyor 1204B.

The sealing portion 1206 comprises an L seal bar 1206A located above the transporting path for the carton assembly 720, an L seal bar receiver 1206B located below the L seal bar 1206A across the transporting path for the carton assembly 720, an L seal conveyor 206C disposed between the L seal bar 1206A and the L seal bar receiver 1206B and film drive chains 1206D, 1206E provided adjacent to the L seal bar 1206A.

The L seal bar 1206A has a L-shaped flat configuration and seals along the periphery of the carton assembly 720 with the shrink film S and cuts into a L shape in cooperation with the L seal bar receiver 1206B. Heat resistant rubber is bonded to a top face of the L seal bar receiver 1206B.

The film drive chains 1206D, 1206E transport the shrink film S along the transporting direction of the carton assembly 720 and the shrink film S on the L seal conveyor 1206C while nipping a side edge portion opposite to a folded side of the shrink film S. The film drive chain 1206E is driven by such an appropriate drive means as a motor and the film drive chain 1206D is driven following the film drive chain 1206E.

A shrink film take-up portion 1206F for taking up the remainder of the shrink film S left after the sealing by the L seal bar 1206A is provided adjacent to the film drive chain 1206E.

1-5-B Height Arranging Portion

Figure 106:
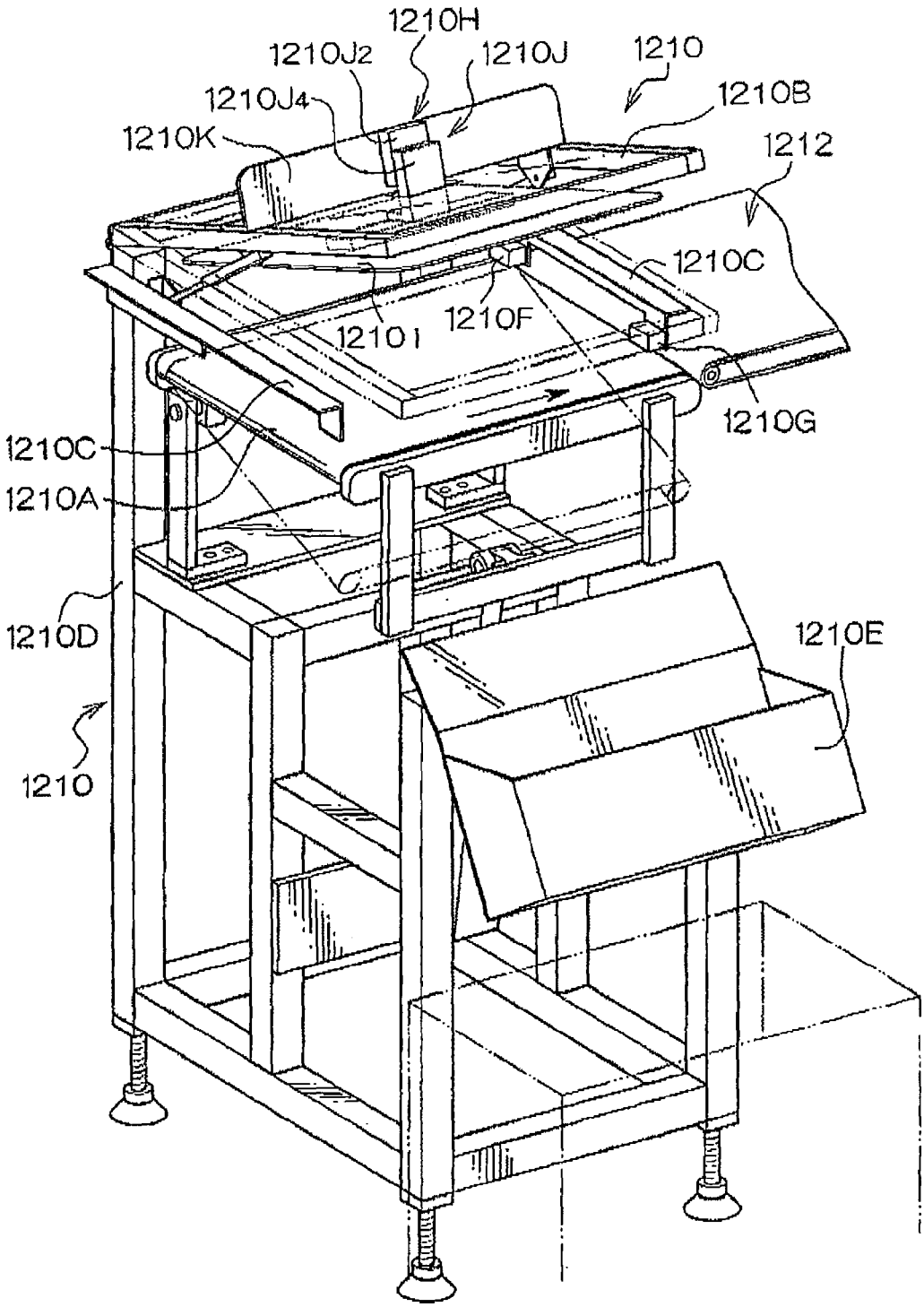
FIG. 106 is a perspective view showing a detailed constitution of a height-arranging portion incorporated in the shrink-packaging unit shown in FIG. 104.

FIG. 106 shows the detail of the configuration of the height arranging portion 1210.

As shown in FIG. 106, the height arranging portion 1210 comprises a package conveyor 1210A, a lid body 1210B which covers the package conveyor 1210A from above, and an optical inspection portion 1210C which is disposed between the package conveyor 1210A and the lid body 1210B for inspecting the shrink-wrapped package 740 placed on the package conveyor 1210A.

The package conveyor 1210A is a belt conveyor on which the shrink-wrapped package 740 formed in the shrink tunnel 1208 is placed and mounted on a supporting base 1210D so that its top face coincides with the same height as the transporting plane of the shrink-wrapped package 740 on the shrink tunnel 1208 and the end arranging transporting unit 1212. As indicated with a two-dot chain line in FIG. 106, the package conveyor 1210A is capable of rotating vertically along side edges on a side provided with the product discharging chute 1210E of the supporting base 1210D and on an opposite side.

The lid body 1210B includes a height arranging unit 1210H for arranging the heights of the shrink-wrapped packages 740 in line by pressing the shrink-wrapped packages 740 carried by the package conveyor 1210A from above.

The height arranging unit 1210H is located below the lid body 1210B and has a rectangular flat configuration and comprises a pressing pad 1210*k* for pressing the shrink-wrapped package 740 directly, an air slide unit 1210J for ascending/descending the pressing pad 1210*i* with compressed air and a base 210K for fixing the air slide unit 1210 above the lid body 1210B. The air slide unit 1210*i* is fixed on a fixing portion 1210$J_2$ fixed on the base 210K and the pressing pad 1210*k* and includes a movable portion 1210$J_4$ for sliding the fixing portion 1210$J_2$ vertically. The lid body 1210B contains a square opening portion through which the movable portion 1210$J_4$ passes.

When the shrink-wrapped package 740 is transported to below the lid body 1210B by the package conveyor 1210A, the height arranging unit 1210H descends the pressing pad 1210*i* toward the shrink-wrapped package 740 and presses the top face of the shrink-wrapped package 740. Here, because the shrink-wrapped package 740 is heated by the shrink tunnel 1208 so that it is plastic because it is just shrunk, an unevenness of the height existing just after the shrinking is removed when it is pressed by the pressing pad 1210*i*.

The product discharge chute 1210E is provided on the forward side of this paper in FIG. 106 showing the supporting base 1210D and below the package conveyor 1210A. The product discharge chute 1210E discharges the shrink-wrapped package 740 out immediately so that no shrink-wrapped package 740 is left in the shrink tunnel 120B, when the shrink-wrapped package 740 is not carried smoothly because a trouble occurs in the downstream of the height arranging portion 1210.

If any trouble occurs in the downstream, the package conveyor 1210A is rotated downward to the product discharge chute 1210E as indicated with a two-dot chain line in FIG. 106, so that the shrink-wrapped package 740 on the package conveyor 1210A falls to the product discharge chute 1210E and is discharged out.

Therefore, as long as the shrink-wrapped package 740 remains within the shrink tunnel 1208, if the shrink-wrapped package 740 is fed to the downstream in the shrink tunnel 1208, the shrink-wrapped package 740 in the shrink tunnel 1208 is discharged out through the product discharge chute 1210E.

The optical detection portion 1210C is a laser transmission type displacement sensor comprising a light projection device 1210F disposed on an outlet of the shrink-wrapped package 740 and a light receiving device 1210G disposed on a side opposite to the light projection device 1210F across the package conveyor 1210A. The light projection device 1210F emits laser beam and the light receiving device 1210G receives the laser beam from the light projection device 1210F. The light projection device 1210 and the light receiving device 1210G are disposed at the same height as the shrink-wrapped package 740 and the carton 700 on the package conveyor 1210A so as to detect a deflection in the height direction of the shrink-wrapped package 740.

1-5-C End Arranging Transporting Unit

Figure 107:
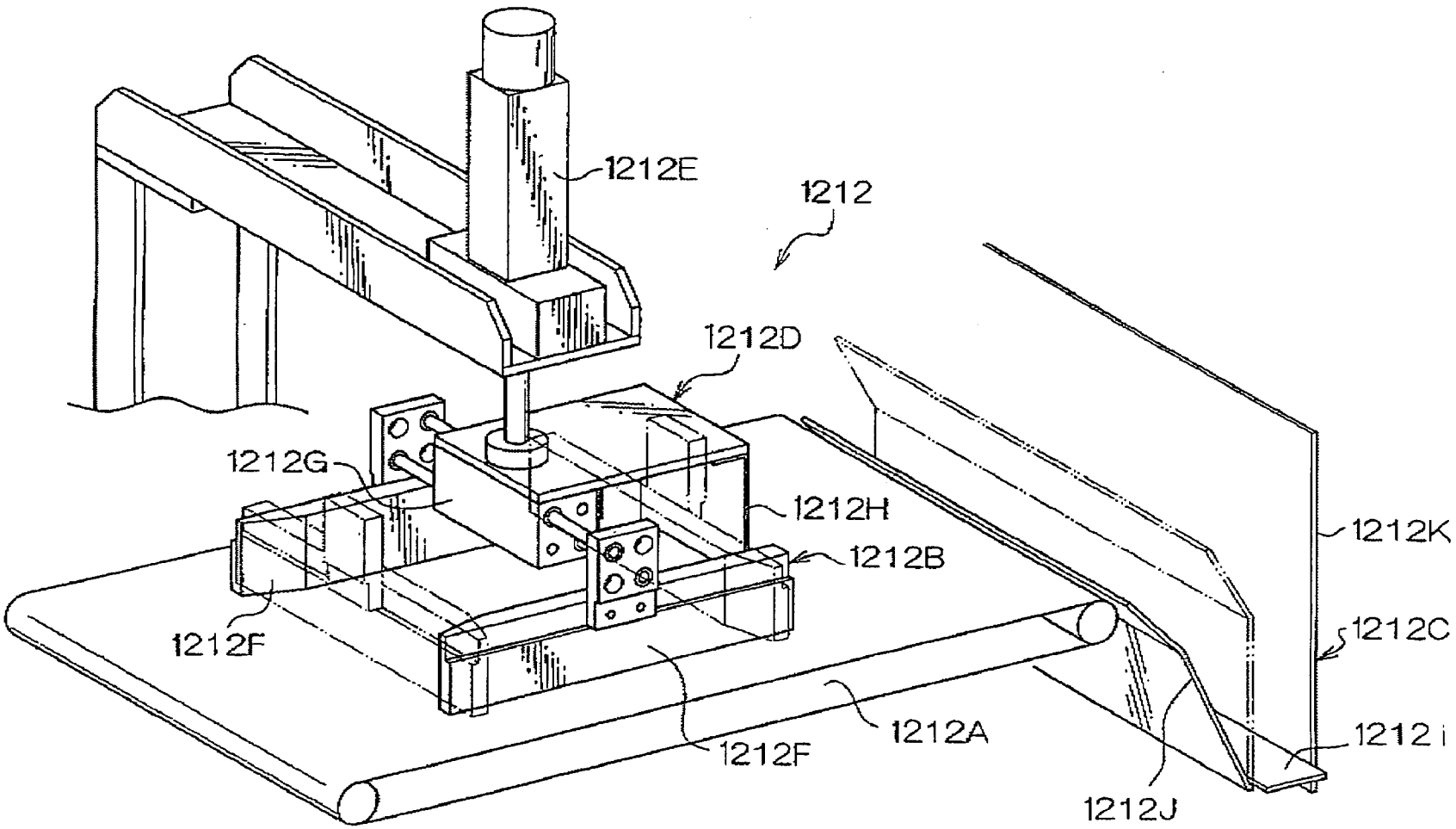
FIG. 107 is a perspective view showing a detailed constitution of an end-arranging transporting portion incorporated in the shrink-packaging unit shown in FIG. 104.

As shown in FIG. 107, the end arranging transporting unit 1212 comprises a package conveyor 1212A, a package rotation portion 1212B located above the package conveyor 1212A and a transporting chute 1212C disposed in the downstream of the package conveyor 1212A.

The package conveyor 1212A is a belt conveyor having the same width and height as the package conveyor 1210A of the height arranging portion 1210 and provided in a horizontal direction.

The package rotating portion 1212B comprises a package gripping portion 1212D for gripping the shrink-wrapped package 740 and a lift-up and down/turn actuator 1212E which lifts up and down the package gripping portion 1212D and at the same time, turns it every 90° around its vertical rotation axis as indicated with a solid line and a two-dot chain line in FIG. 107.

The package gripping portion 1212D comprises a pair of plate-like shrink-wrapped package gripping members 1212F for gripping the shrink-wrapped package 740, an actuator 1212G which holds the shrink-wrapped package gripping portions 1212F such that they oppose each other and at the same time, moves them in directions of approaching/leaving each other, and a shrink-wrapped package gripping plate 1212H which is fixed on the actuator 1212G for holding the shrink-wrapped package 740, after carried by the package conveyor 1212A, at a position which allows the shrink-wrapped package gripping portions 1212F to grip the same shrink-wrapped package 740. The rotation shaft of the lift-up and down/turn actuator 1212E is fixed on the actuator 1212G.

The transporting chute 1212C comprises a transporting conveyor 1212*i* for transporting the shrink-wrapped package 740 to the corrugated board casing unit 1300, a fall-down type drop chute 1212J for introducing the shrink-wrapped package 740 after transported by the package conveyor 1212A to the transporting conveyor 1212*i*, and a vertical guide 1212K which is a vertical wall opposing the drop chute 1212J across the transporting conveyor 1212*i*. A stopper for stopping the shrink-wrapped package 740 is provided at an end in the transporting direction of the transporting conveyor 1212*i*. The stopper has a function of positioning the shrink-wrapped package 740 in the transporting direction. The vertical guide 1212K has a function of guiding the shrink-wrapped package 740 not so as to fall from the transporting conveyor 1212*i* in cooperation with the drop chute 1212J in a standup condition and positioning the shrink-wrapped package in the direction at right angle to the transporting direction of the transporting conveyor 1212*i*.

After the deflection in the height direction is removed by the height arranging portion 1210, the shrink-wrapped package 740 is transported to the end arranging transporting unit 1212 by the package conveyor 1210A and then transported to the package rotating portion 1212B by the package conveyor 1212A and when it abuts the shrink-wrapped package gripping plate 1212H, stopped between the shrink-wrapped package gripping members 1212F.

If the shrink-wrapped package 740 should be turned at 90° before transported to the corrugated board casing unit, the actuator 1212G is actuated so that the shrink-wrapped package 740 is gripped on both sides by the shrink-wrapped package gripping members 1212F. Consequently, the deflection in the width direction of the shrink-wrapped package 740 is removed.

Next, the package gripping portion 1212D is ascended by the lift-up and down/turn actuator 1212E and the shrink-wrapped package 740 is departed from the package conveyor 1210A. Then, the package gripping portion 1212D turns at 90° around a vertical rotation axis as indicated with a two-dot chain line in FIG. 107 and then is placed on the package conveyor 1212A.

If the shrink-wrapped package 740 is placed on the package conveyor 1212A, the package gripping portion 1212D is ascended up to a position which does not obstruct transporting of the shrink-wrapped package 740 from being transported to the transporting chute 1212C.

At this time, the drop chute 1212J remains fallen against the package conveyor 1212A as indicated with a solid line in FIG. 107, thereby forming a continuous plane connecting the package conveyor 1212A to the transporting conveyor 1212*i*. Thus, the shrink-wrapped package 740 transported to the transporting chute 1212C drops to the transporting conveyor 1212*i* through the drop chute 1212J.

After the shrink-wrapped package 740 drops on the transporting conveyor 1212*i*, the drop chute 1212J stands up as indicated with a two-dot chain line in FIG. 107 so as to place the shrink-wrapped package 740 on the transporting conveyor 1212*i*.

The shrink-wrapped package 740 placed on the transporting conveyor 1212*i* is transported to the product loading robot 1302 in the corrugated board casing unit 1300.

1-6 Corrugated Board Casing Unit

Figure 108:
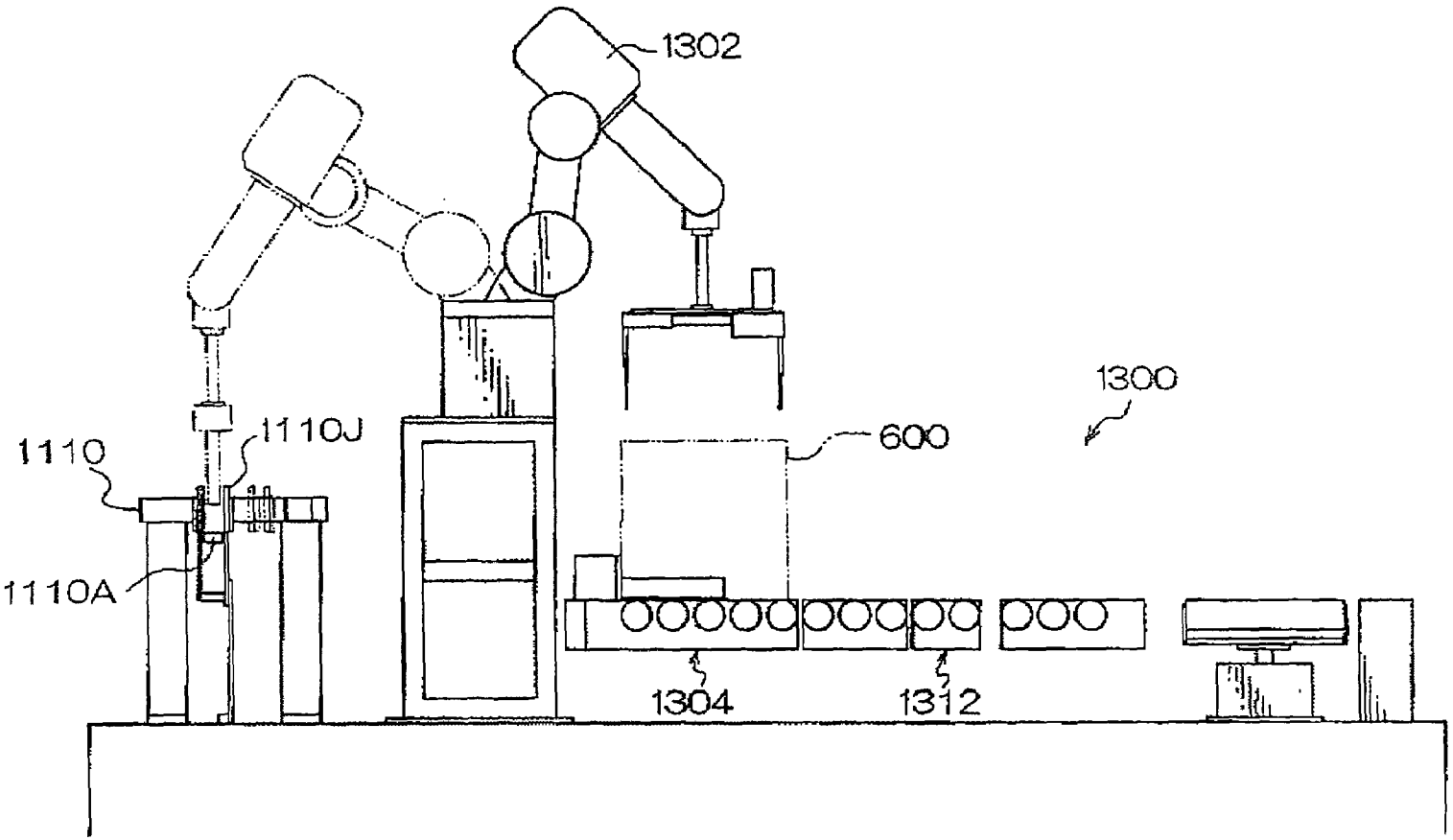
FIG. 108 is a side view showing a constitution of a corrugated board casing unit incorporated in the carton boxing apparatus shown in FIG. 87.

As shown in FIGS. 89 and 108, the corrugated board casing unit 1300 comprises a box making machine 1306 for making a construction type corrugated board box, a product loading robot 1302 for loading the carton assemblies 720 and the shrink-wrapped package 740 into the corrugated board box (hereinafter referred to as "empty corrugated board box 600" depending on a case) made by the box making machine 1306, a corrugated board box positioning portion 1304 which is provided adjacent to the product loading robot 1302 for holding the corrugated board box 600 at a predetermined position, an empty corrugated board box transporting portion 1308 for transporting the empty corrugated board box 600 to the corrugated board box positioning portion 1304, a product-packed corrugated board box transporting portion 1312 for transporting a corrugated board box (hereinafter referred to as "product packed corrugated board box 600" depending on a case) loaded with the shrink-wrapped package 740 to a box sealing machine 1310, which will be described next, the box sealing machine 1310 for sealing the product packed corrugated board box 600 after transported by the product-packed corrugated board box transporting portion 1312 and a storage conveyor 314 for discharging out the product packed corrugated board box 600 sealed by the box sealing machine 1310. The respective components will be described in detail.

1-6-A Product Loading Robot

Figure 109:
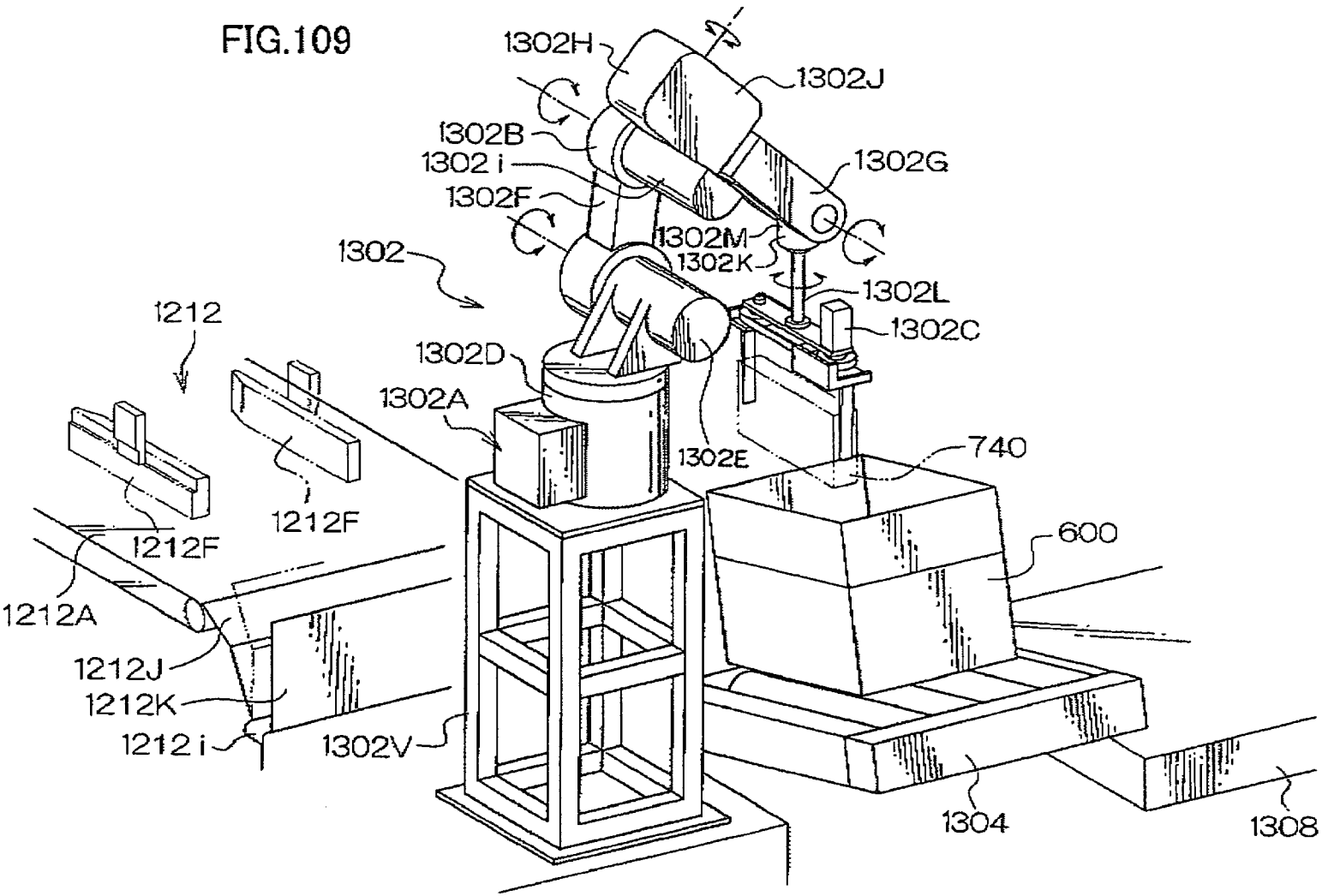
FIG. 109 is a perspective view showing a detailed constitution of a product-loading robot incorporated in the corrugated board casing unit shown in FIG. 108.

The product loading robot 1302 is a vertically multi-articular robot, which comprises, as shown in FIG. 109, a base 1302A placed on the base 1302V, an arm portion 1302B rotatable with respect to the base 1302, and a hand portion 1302C which is provided at a front end of the arm portion 1302B for gripping the carton assembly 720 or the shrink-wrapped package 740.

The base 1302A is a vertically erected cylinder, which comprises a base main body 1302D placed on the base 1302V and a horizontal cylindrical arm mounting portion 1302E located above the base main body 1302D. The arm mounting portion 1302E incorporates a motor or actuator for rotating the arm portion 1302B.

The arm portion 1302B comprises a first arm 1302F mounted rotatably on the arm mounting portion 1302E of the base 1302A, a second arm 1302G mounted on a front end of the hand portion 1302C and an articulation portion 1302H for connecting the first arm 1302F and the second arm 1302G through their end portions.

The first arm 1302F is mounted rotatably on the arm mounting portion 1302E through an end thereof and rotated around a horizontal rotation axis by a motor or an actuator in the arm mounting portion 1302E.

The articulation portion 1302H has three freedoms, which allow the second arm 1302G to rotate around three rotation axes comprised of a horizontal rotation axis and two rotation axes intersecting that horizontal rotation axis, those three rotation axes intersecting each other. The articulation portion 1302H is provided at the other end of the first arm 1302 rotatably around a horizontal rotation axis and comprises a first rotation portion 1302*i* which rotates the second arm 1302G in a vertical direction and a second rotation portion 1302J which is provided at the first rotation portion 1302*i* so as to be rotatable around a rotation axis intersecting the aforementioned rotation shaft for rotating the second arm 1302G in the right/left direction. The second arm 1302G is provided on the second rotation portion 1302J so as to be rotatable around a center line of the second arm 1302G.

A work holding portion 1302K is provided at an end portion on a side opposite to the side provided with the second rotating portion 1302J of the second arm 1302G such that it is rotatable around a rotation axis at right angle to the center line of the second arm 1302G. The work holding portion 1302K comprises a work fixing shaft 302L in which the hand portion 1302C is fixed on an end portion thereof and an arm mounting portion 1302M which is provided at the other end portion of the work fixing shaft 302L and held on the second arm 1302G rotatably. The work fixing shaft 302L is held rotatably by the arm mounting portion 1302M.

Figure 110:
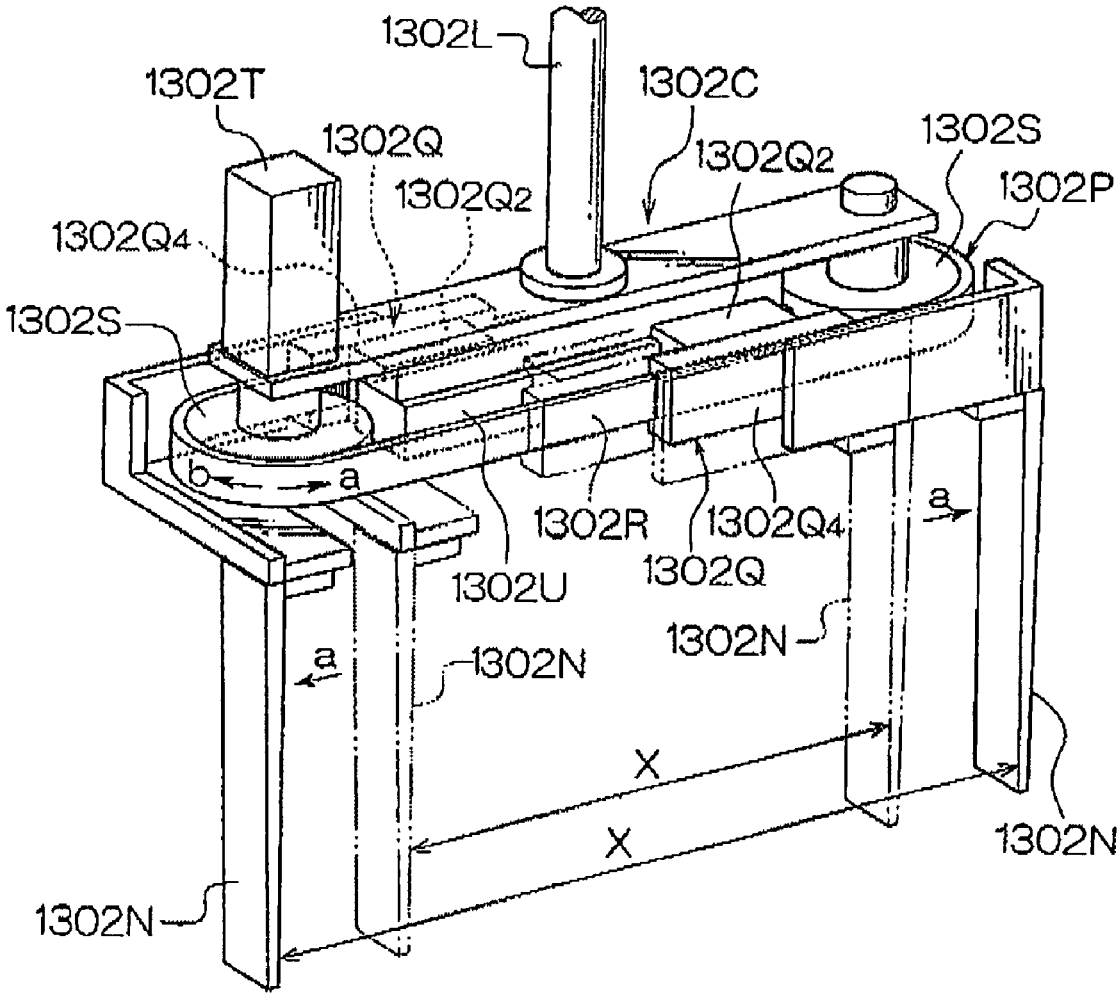

The hand portion 1302C, as shown in FIGS. 109 and 110, comprises a pair of finger-like members 1302N for gripping the carton assembly 720 or the shrink-wrapped package 740, a chuck width setting unit 1302P for setting a chuck width x of the finger-like member 1302N and a pair of air slide units 302Q for bringing the finger-like members 1302N near/apart from each other after the chuck width x is set by the chuck width setting unit 1302P.

The chuck width setting unit 1302P comprises a belt 1302R having rack-like protrusions on its inner peripheral face and a pair of belt wheels 1302S having thread-like protrusions engaging the aforementioned rack-like protrusions on its outer peripheral face. One of the belt wheels 1302S is rotated by a motor 1302T, so that the belt 1302R is also rotated. The belt 1302R includes a guide rail 1302U for guiding the air slide unit 1302Q along the traveling direction of the belt 1302R.

The air slide units 302Q are fixed symmetrically on the belt 1302R.

The air slide unit 1302Q is fixed on the belt 1302R and comprises a guide block portion $\mathbf{1302}Q_2$ which engages the guide rail 1302U and a slide portion $\mathbf{1302}Q_4$ which slides on the guide block portion $\mathbf{1302}Q_2$ in parallel to the belt 1302R. A pneumatic actuator (not shown) is provided between the guide block portion $\mathbf{1302}Q_2$ and the slide portion $\mathbf{1302}Q_4$. The finger-like member 1302N is fixed on each slide portion $\mathbf{1302}Q_4$.

Figure 111:
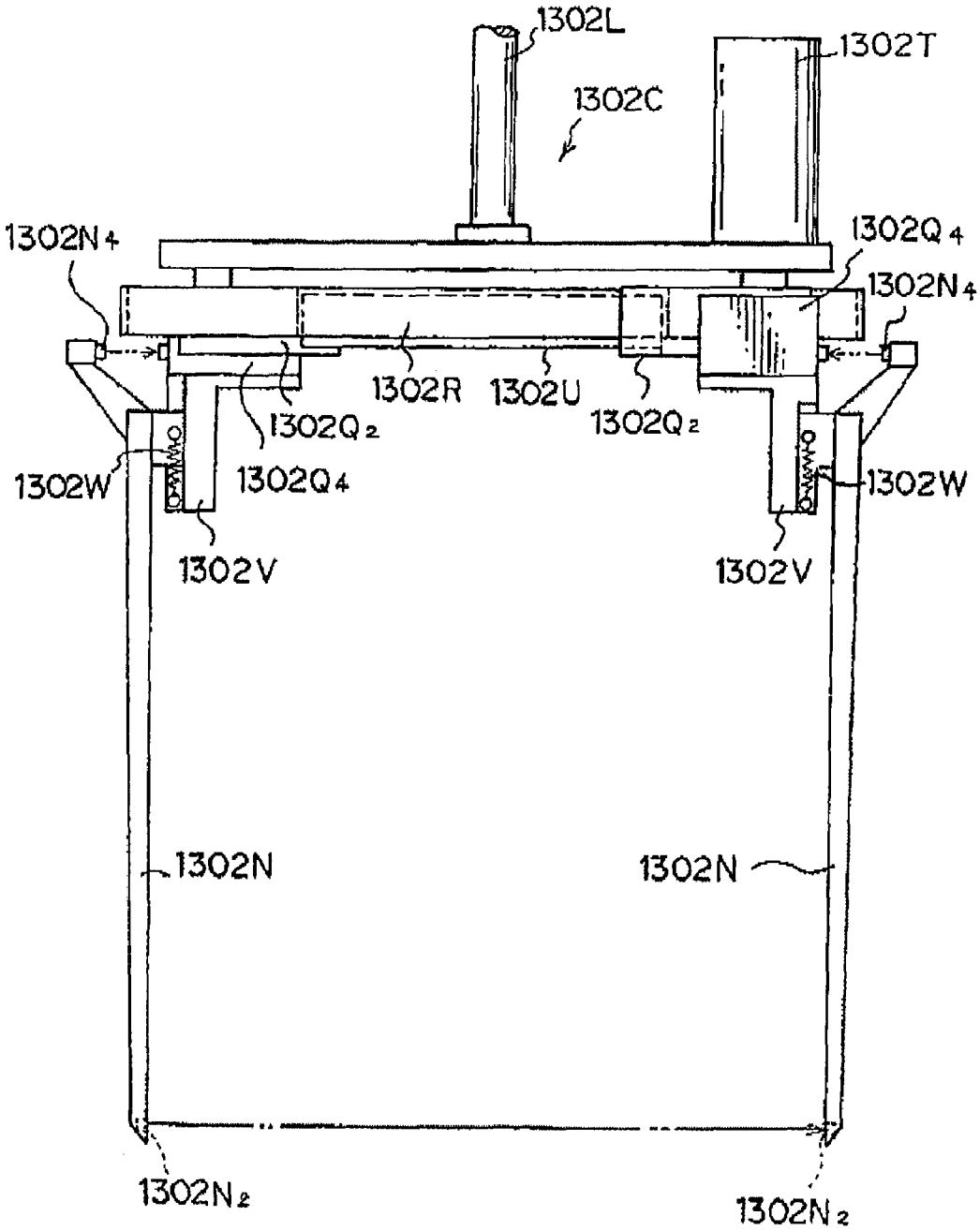

As shown in FIG. 111, the finger-like member 1302N is attached to the slide portion $\mathbf{1302}Q_4$ through the holding member 1302V. The holding member 1302V is a guide rail like member fixed on the slide portion $\mathbf{1302}Q_4$. The finger-like member 1302N is engaged with the holding member 1302V slidably in the vertical direction at its root thereof. The finger-like member 1302N is urged downward by a spring 1302W disposed between the holding member 1302V and the root of the finger-like member 1302N.

An optical sensor 1302$N_4$ is provided at a front end of the finger-like member 1302N. Further, an overload detecting sensor 1302$N_4$, which is an optical sensor, is provided between the root of the finger-like member 1302N and the holding member 1302V. The optical sensor 1302$N_2$ has a function of detecting whether or not the carton assembly 720 or the shrink-wrapped package 740 is loaded in a corrugated board box 600, which will be described later, without any abnormality. The overload detecting sensor 1302$N_2$ has a function of detecting that an overload is applied on the finger-like member 1302N by detecting that the finger-like member 1302N is moved upward.

An operation of the product loading robot's loading of the carton assembly 720 or the shrink-wrapped package 740 into the corrugated board box will be described below.

Figure 112:
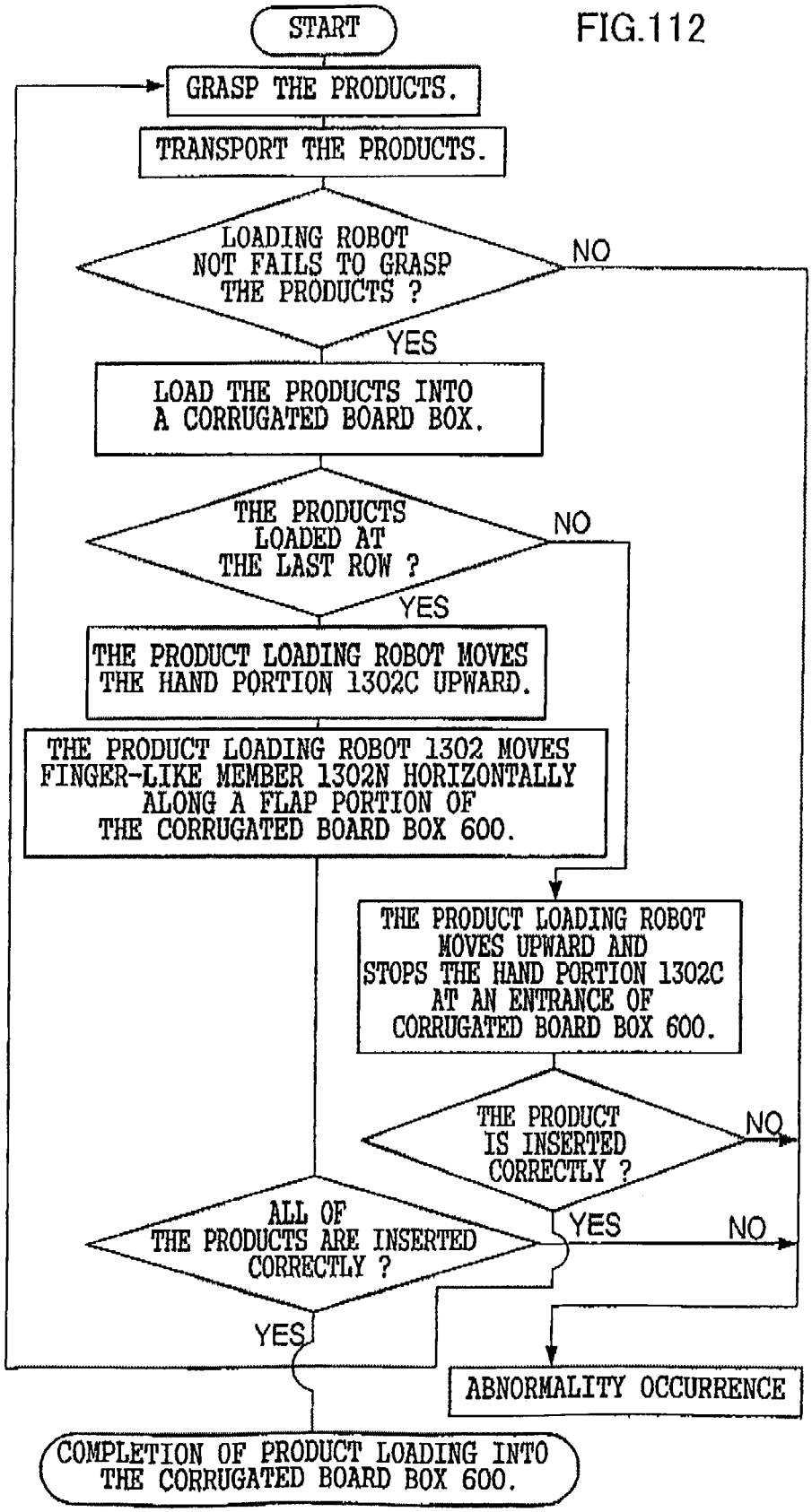

FIG. 112 shows the flow of the aforementioned operation in a flow chart.

Figure 113A:
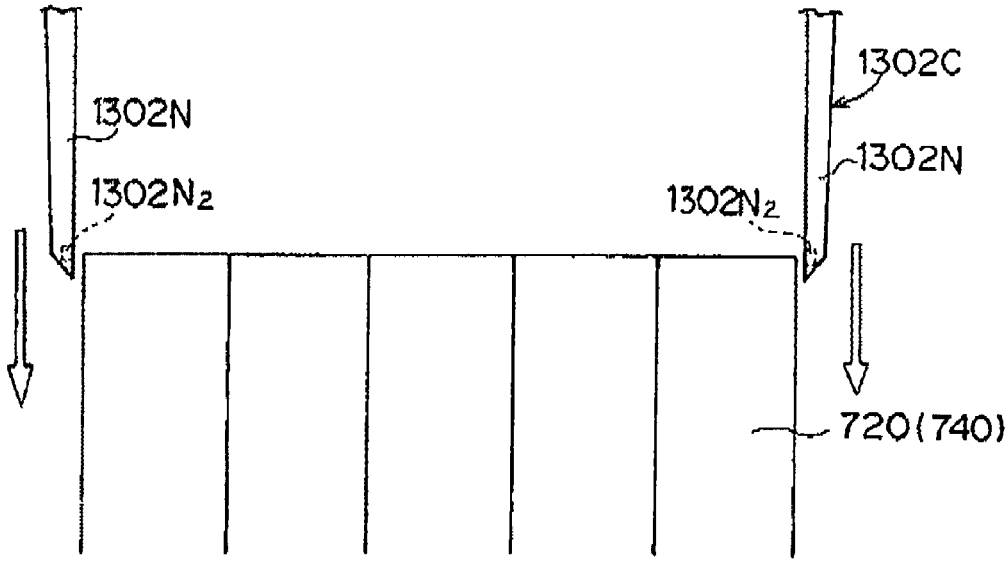
Figure 113B:
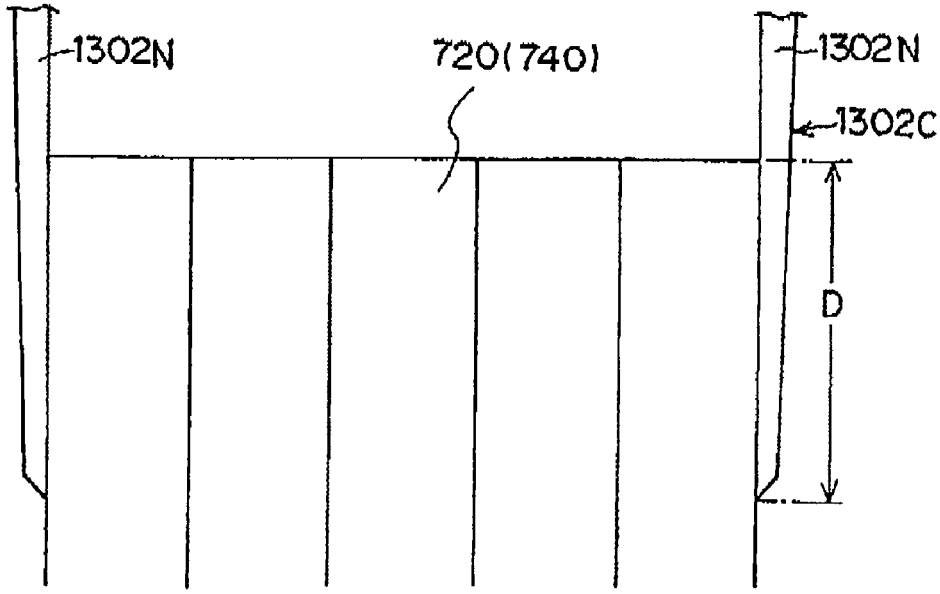

As shown in FIG. 112, the product loading robot 1302 grips the carton assembly 720 or the shrink-wrapped package 740 with its hand portion 1302C in the same procedure as that explained in chuck portion 1116A on the column "1-4-H Third robot" and then moves the hand portion 1302C gripping the carton assembly 720 or the shrink-wrapped package 740 up to near the corrugated board box 600. As shown in FIGS. 113A and 113B, the product loading robot 1302 descends the hand portion 1302C so that a front end of the finger-like member 1302N is located lower by a distance D than a top face of the carton assembly 720 or the shrink-wrapped package 740. This distance D is so set up that the carton assembly 720 or the shrink-wrapped package 740 is gripped securely by the hand portion 1302 and that a force is not concentrated to a narrow range, depending on product type.

When the hand portion 1302C grips the carton assembly 720 or the shrink-wrapped package 740, the product loading robot 1302 moves the hand portion 1302C up to near the corrugated board box 6000 so as to determine whether or not the carton assembly 720 or the shrink-wrapped package 740 is gripped properly.

When it is determined that the carton assembly 720 or the shrink-wrapped package 740 is gripped properly, the product loading robot 1302 proceeds to an operation of loading the carton assembly 720 or the shrink-wrapped package 740 into the corrugated board box 600.

On the other hand, when it is determined that the carton assembly 720 or the shrink-wrapped package 740 is not gripped properly, the product loading robot 1302 determinates that an abnormality occurs and stops its operation and then outputs an abnormality occurrence signal to the control computer 500.

When proceeding to the loading operation, the product loading robot 1302 determinates whether or not a position where the carton assembly 720 or the shrink-wrapped package 740 is loaded is at a final row of the corrugated board box 600.

Figure 114A:
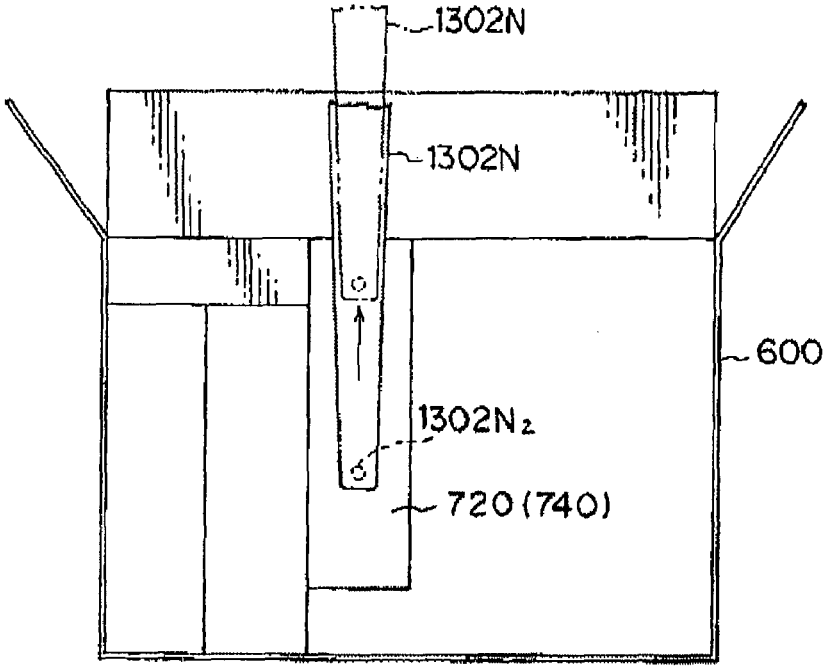
Figure 114B:
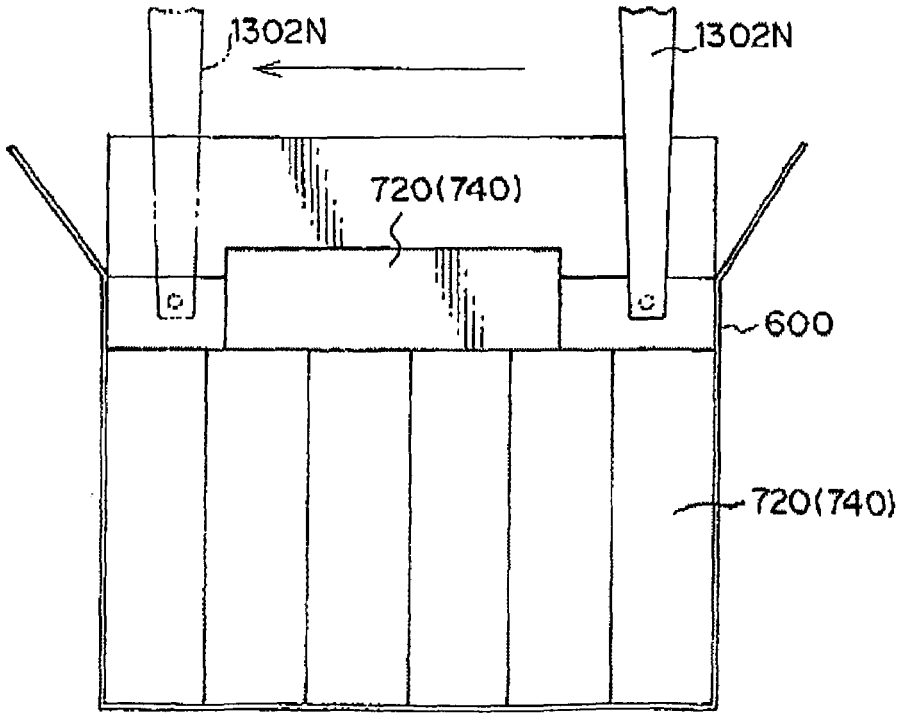

When the aforementioned insertion position is at the final row of the corrugated board box 600, after the carton assembly 720 or the shrink-wrapped package 740 is loaded, as shown in FIG. 114B, the product loading robot 1302 moves the front end of the finger-like member 1302N horizontally along a flap portion folding position of the corrugated board box 600 so as to determine whether or not the optical sensor 1302$N_2$ detects the carton assembly 720 or the shrink-wrapped package 740.

If the optical sensor 1302$N_2$ detects nothing, it is determined that the loading into the entire corrugated board box is carried out properly and then all the loading operation is terminated.

On the other hand, if the optical sensor 1302$N_2$ detects the carton assembly 720 or the shrink-wrapped package 740, it is determined that not loaded carton assembly or shrink-wrapped package 740 rides on the carton assembly 720 or the shrink-wrapped package 740 inserted in the corrugated board box 600 and all the operation is stopped and at the same time, the abnormality occurrence signal is output to the control computer 500.

Unless the insertion position is at the final row of the corrugated board box 600, the product loading robot 1302 loads the carton assembly or the shrink-wrapped package through the first or second action while preventing the hand portion 1302C, or the carton assembly 720 or the shrink-wrapped package 740 gripped by the hand portion from interfering with the flap portions of the corrugated board box 600.

As the first action, the product loading robot 1302 loads the gripped carton assembly 720 or shrink-wrapped package 740 while moving the hand portion 1302C so as to stretch the flap portion. On the other hand, as the second action, the hand portion 1302C is rotated so that the gripped carton assembly 720 or shrink-wrapped package 740 is located on a diagonal line of an opening portion of the empty corrugated board box 600 and then, the carton assembly 720 or the shrink-wrapped package 740 is loaded.

Every time when a single loading is carried out, the finger-like member 1302N is moved upward and pulled out from the corrugated board box 600. If the finger-like member 1302N reaches the flap portion folding position of the corrugated board box 600, it is stopped temporarily so as to detect whether or not the optical sensor 1302N, senses the carton assembly 720 or the shrink-wrapped package 740.

If the optical sensor 1302$N_2$ does not detect any carton assembly 720 or shrink-wrapped package 740, it is determined that the carton assembly 720 or the shrink-wrapped package 740 is loaded properly and the second loading action begins.

On the other hand, when the optical sensor 1302$N_2$ detects the carton assembly 720 or the shrink-wrapped package 740, it is determined that the loaded carton assembly 720 or shrink-wrapped package 740 is hooked and brought out of the corrugated board box 600 and all the action is stopped and then the abnormality occurrence signal is output to the control computer 500.

Further, upon insertion, whether or not the optical sensor 1302$N_4$ detects an upward motion of the finger-like member 1302N is determined. Here, if an end of the finger-like member 1302N or the carton assembly 720 or the shrink-wrapped package 740 gripped by the finger-like member 1302N abuts the carton assembly 720 or the shrink-wrapped package 740 already loaded, the finger-like member 1302N is moved upward resisting the urging force of the spring 1302W. Therefore, if the optical sensor 1302$N_4$ senses the aforementioned motion, it can be determined that the aforementioned abutting is made.

If the optical sensor 1302$N_4$ senses the above-described motion, the product loading robot 1302 stops its loading operation, raises the hand portion 1302C and stops it above the corrugated board box 600 so as to notify an operation of an occurrence of that abnormality. After that, this system waits for confirmation and restoration by the operation.

1-6-B Empty Corrugated Board Transporting Portion

Figure 115:
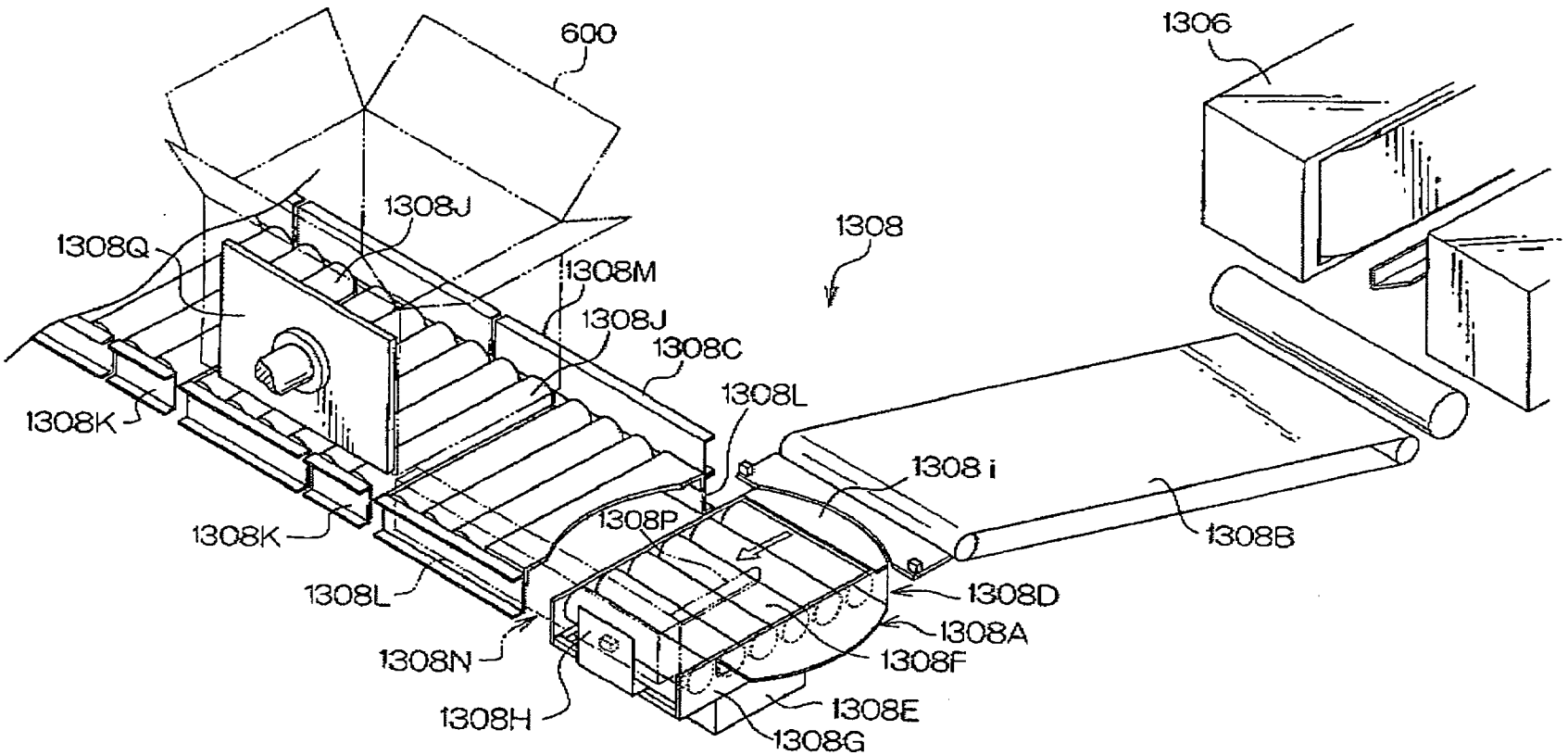
Figure 116:
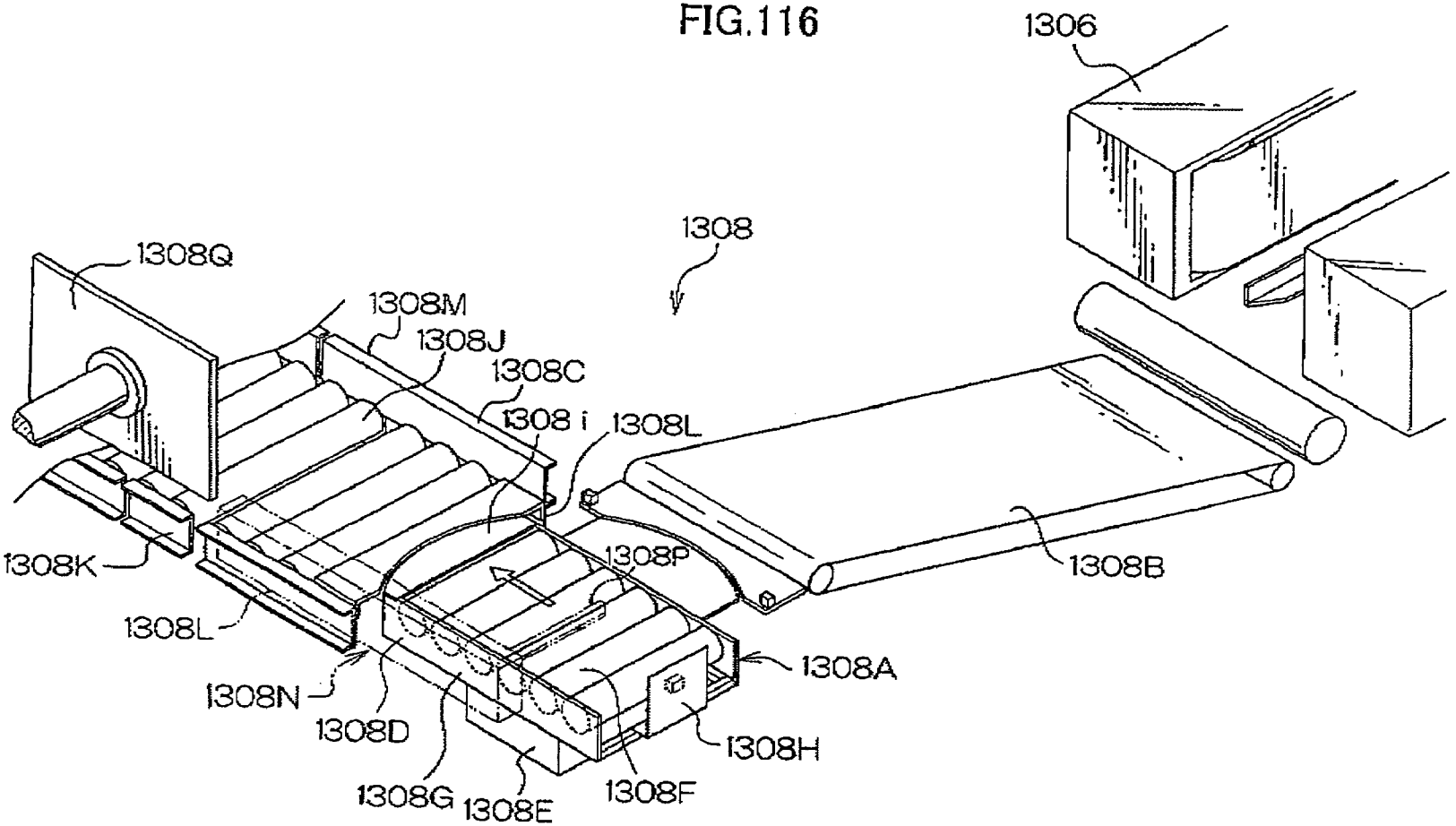

As shown in FIGS. 115 and 116, the empty corrugated board box transporting portion 1308 comprises a turn table 1308A for turning the empty corrugated board box 600 in the direction which facilitates loading of the carton assembly 720 or the shrink-wrapped package 740 by means of the product loading robot 1302, a belt conveyor 1308B for transporting the empty corrugated board box 600 made by the box making machine 1306 to the turn table 1308A and a roller conveyor 1308C for transporting the empty corrugated board box 600 turned in a predetermined direction by the turn table 1308A to the corrugated board box positioning portion 1304.

The turn table 1308A comprises a conveyor portion 1308D on which the empty corrugated board box 600 is to be loaded and a base 1308 for holding the conveyor portion 1308D rotatably.

The conveyor portion 1308D comprises six rollers 1308F disposed in parallel to each other and a frame body 1308G for supporting the roller 1308F rotatably around its axial line.

The frame body is a box whose top face is open and the roller 1308F is provided in parallel to a short side of the frame body 1308G. Thus, an empty corrugated board box 600 placed on the conveyor portion 1308D is transported along the longitudinal direction of the frame body 1308G as indicated with an arrow in FIGS. 115 and 116.

A corrugated board box stopper 1308H is provided along one of the short sides of the frame body 1308G which supports the empty corrugated board box 600 transported by the belt conveyor 1308B on the conveyor portion 1308D. On the other short side of the frame body 1308G is fixed a gangway plate 1308*i* whose outer side is formed circularly while its inner side is formed linearly.

The frame body 1308G is mounted rotatably on the base 1308E through a central portion of its bottom face. If the frame body 1308A is rotated on the base 1308E, the turn table 1308A takes the first position shown in FIG. 115 in which the gangway plate 1308*i* is located on a side of the belt conveyor 1308B while the corrugated board box stopper 1308H is rotated so as to oppose the belt conveyor 1308B across the roller 1308F or the second position as shown in FIG. 116 in which the gangway plate 1308*i* is located on a side of the roller conveyor 1308C.

The roller conveyor 1308C transports the empty corrugated board box 600 in the direction at right angle to the transporting direction of the empty corrugated board box 600 on the belt conveyor 1308B and comprises, as shown in FIGS. 115 and 116, a group of rollers 1308J disposed in the direction at right angle to the aforementioned transporting direction, frame bodies 308K, 308L for supporting the rollers 1308J rotatably and a guide rail 1308M fixed on a top edge of the frame body 1308L. A positioning pusher 1308Q, which is a plate-like member in parallel to the frame bodies 1308K, 1308L, is provided above the roller 1308J in the vicinity of the frame bodies 1308K, 1308L. The positioning pusher 1308Q is capable of moving in directions of approaching/departing from the guide rail 1308M on the roller conveyor 1308C and has a function of determining the position in the width direction of the corrugated board box 600 on the roller conveyor 1308C as shown in FIG. 115.

A corrugated board pushing unit 1308N for pushing the empty corrugated board box 600 onto the roller conveyor 1308C is provided along the turn table 1308A and the roller conveyor 1308C. The corrugated board pushing unit 1308N is projected to the roller conveyor 1308C and comprises a pushing rod 1308P for pushing out the empty corrugated board box 600 and a pushing rod guide 130L which is extended in parallel to the frame body 1308K for moving the pushing rod 1308P in the transporting direction of the roller conveyor 1308C.

An operation of the empty corrugated board box transporting portion 1308 will be described below.

An empty corrugated board box 600 made by the box making machine 1306 is transported to the turn table 1308A by the belt conveyor 1308B. Because at this time, the turn table 1308A takes the first position as shown in FIG. 115, the corrugated board box carried by the belt conveyor 1308B abuts the corrugated board box stopper 1308H and is stopped on the turn table 1308A.

After the empty corrugated board box 600 is placed on the turn table 1308A, the turn table 1308 rotates counterclockwise in FIG. 115 and takes the second position as shown in FIG. 116.

When the turn table 1308A takes the second position, the pushing rod 1308P pushes the empty corrugated board box 600 to the roller conveyor 1308C as shown in FIG. 116. Consequently, the empty corrugated board box 600 is placed on the roller conveyor 1308C. After the empty corrugated board box 600 is placed on the roller conveyor 1308C, the positioning pusher 1308Q moves to the guide rail 1308M so as to push the empty corrugated board box 600 to the guide rail 1308M. As a result, the position in the width direction of the corrugated board box 600 on the roller conveyor 1308C is determined. If the position in the width direction is determined, the corrugated board box 600 is transported to the corrugated board box positioning portion 1304 on the roller conveyor 1308C.

However, depending on the configuration and type of the empty corrugated board box 600, after it is made by the box making machine 1306 and transported/placed to/on the turn table 1308A by the belt conveyor 1308B, the empty corrugated board box may be transported to the corrugated board box positioning portion 1304 by the roller conveyor 1308C without being turned by the turn table 1308A.

1-6-C Corrugated Board Positioning Portion

Figure 117:
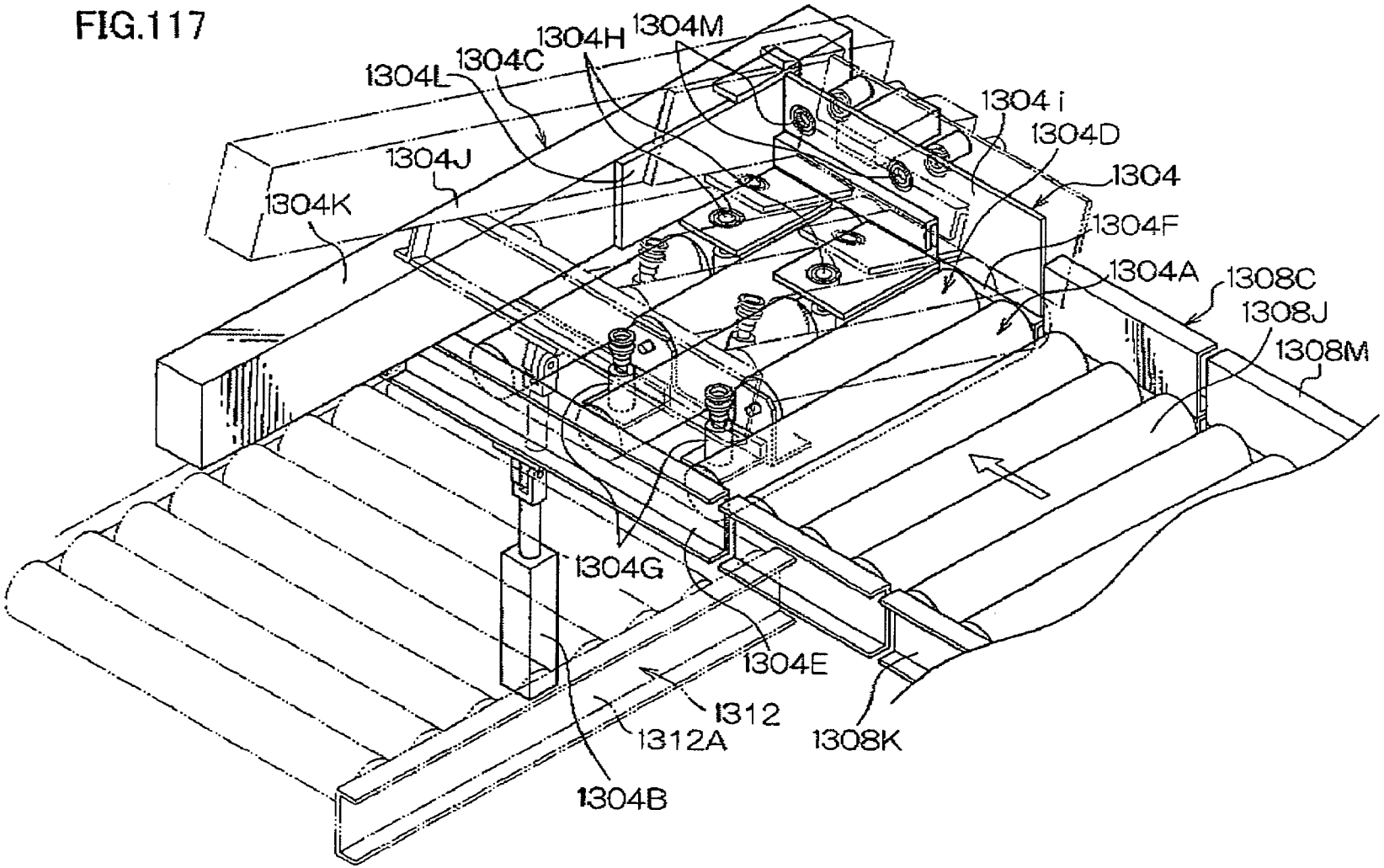

As shown in FIGS. 89 and 117, a discharge conveyor 1312A for the product-packed corrugated board box transporting portion 1312, which will be described later, is provided at right angle to the roller conveyor 1308C. Then, the corrugated board box positioning portion 1304 is provided such that it is sandwiched by the discharge conveyor 1312A and the roller conveyor 1308C.

The corrugated board box positioning portion 1304 is formed so as to be capable of inclining from its horizontal condition and comprises a corrugated board placing table 1304A which forms an end portion of the roller conveyor 1308C when it is set horizontal, as indicated with a solid line in FIG. 117, an inclination actuator 1304B for inclining the corrugated board placing table 1304A, and a discharge unit 1304C for discharging the product packed corrugated board box 600 in which the carton assembly 720 or the shrink-wrapped package 740 is loaded on the corrugated board placing table 1304A and discharging to the discharge conveyor 1312A.

The corrugated board placing table 1304A comprises five rollers 1304D provided in parallel to the roller 1308J on the roller conveyor 1308C and a pair of frame members 1304E, 1304F for supporting the roller 1304D rotatably. The frame member 1304E is located adjacent to the discharge conveyor 1312A and the frame member 1304F is located on a side opposite to the frame member 1304E across the roller 1304D. The corrugated board placing table 1304A is rotated around a bottom edge of the frame member 1304F. Therefore, at the time of inclination, as indicated with a two-dot chain line in FIG. 41, the side of the frame member 1304E is raised by the inclination actuator 1304B.

An arrow in FIG. 117 indicates a transporting direction of the empty corrugated board box 600 on the roller conveyor 1308C and the corrugated board placing table 1304A. Suckers 13040, 1304H for sucking and holding the empty corrugated board box 600 are provided adjacent to an end of four rollers located at the second-fifth positions in the transporting direction of five rollers 1304D. The sucker 1304G is fixed on the frame member 1304E adjacent to the second and fourth rollers 1304D along the transporting direction, while the sucker 1304H is fixed on the frame member 1304F adjacent to the third and fifth rollers 1304D along the transporting direction.

The discharge unit 1304C comprises a pressing plate 1304*i* for pushing out the product packed corrugated board box 600 to the discharge conveyor 1312A and a guide unit 1304J for transporting the pressing plate 1304*i* along the width direction of the corrugated board placing table 1304A. The guide unit 1304J comprises a guide rail 1304K extended in the transporting direction of the empty corrugated board box 600 on the corrugated board placing table 1304A, and a guide block 1304L which slides on the guide rail 1304K in engagement with the guide rail 1304K. The pressing plate 1304*i* is fixed on the guide block 1304L. The pressing plate 1304*i* is provided with a pair of the suckers 1304M for sucking and holding the empty corrugated board box 600.

The discharge unit 1304C is so constructed to be inclined integrally with the corrugated board placing table 1304A as indicated with a two-dot chain line in FIG. 117. The pressing plate 1304*i* is located at a standby position above the frame body 1304F as indicated with a solid line when the empty corrugated board is loaded and guides the empty corrugated board with the guide rail 1308M so as to form a guide rail for holding.

An operation of the corrugated board box positioning portion 1304 will be described below.

Initially, the corrugated board placing table 1304A is set horizontal. Therefore, the empty corrugated board box 600, after transported by the roller conveyor 304C, abuts the guide block 1304L and is stopped on the corrugated board placing table 1304A.

When the empty corrugated board box 600 is placed on the corrugated board placing table 1304A, the corrugated board placing table 1304A is inclined and the suckers 1304G, 1304H, 1304M suck the bottom face and side face of the empty corrugated board box 600 so as to fix the empty corrugated board box 600 on the corrugated board placing table 1304A.

Next, the carton assembly 720 or the shrink-wrapped package 740 is loaded into the empty corrugated board box 600 by the product loading robot 1302.

After the loading of the carton assembly 720 or the shrink-wrapped package 740 is terminated, the corrugated board placing base 304A is returned to a horizontal condition again, so that suction by the suckers 1304G, 1304H, 1304M is released. Then, they are discharged to the discharge conveyor 1312A by the discharge unit 1304C.

1-6-D Product Packed Corrugated Board Box Transporting Portion

Figure 118:
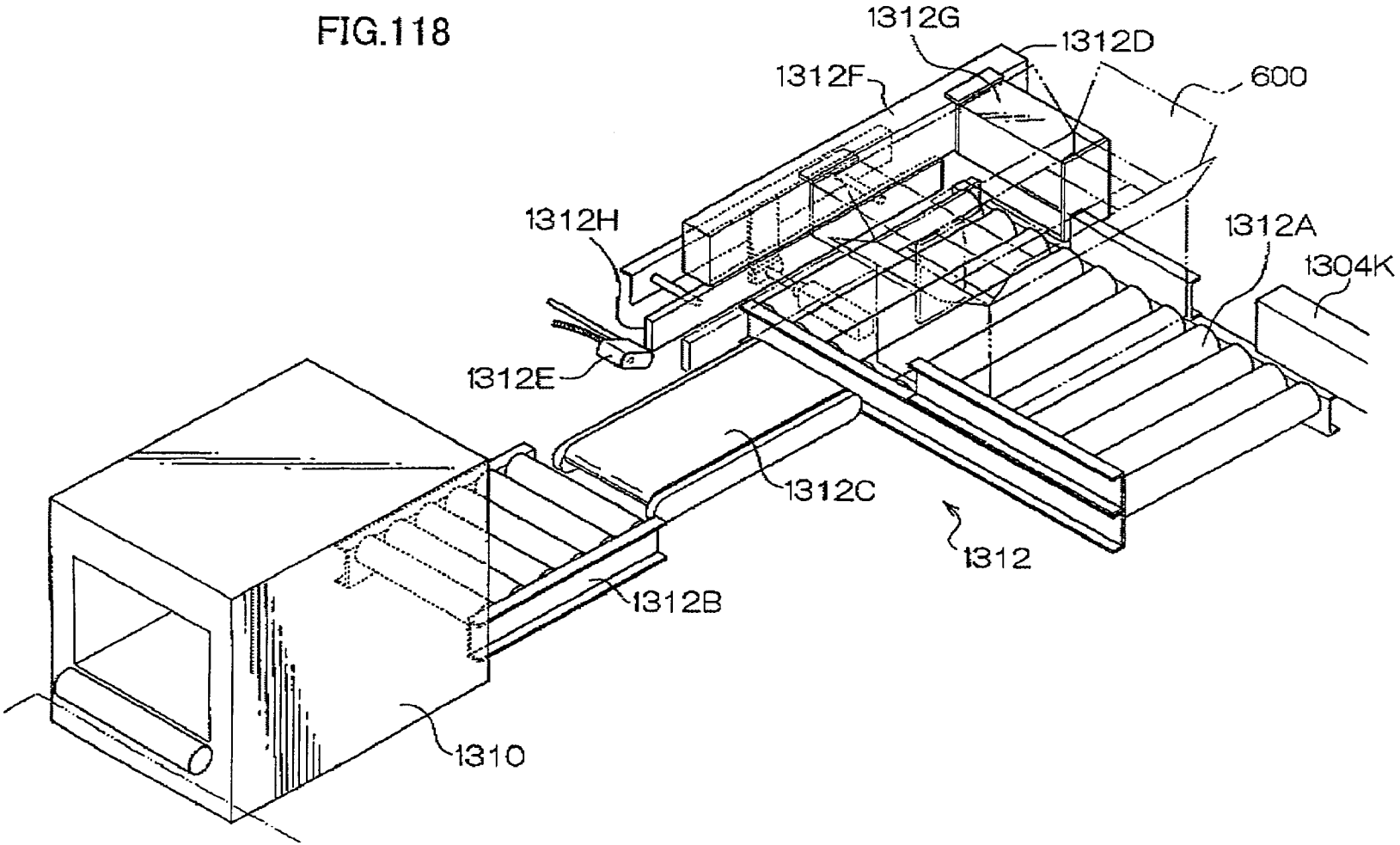

As shown in FIG. 118, the product-packed corrugated board box transporting portion 1312 comprises a discharge conveyor 1312A intersecting the roller conveyor 1308C and the corrugated board placing table 1304A, a weight detecting unit 1312B provided adjacent to the box sealing machine 1310 and a belt conveyor 1312C for introducing the product packed corrugated board box 600 discharged by the discharge conveyor 1312A to the weight detecting unit 1312B.

The discharge conveyor 1312A is a roller conveyor.

The corrugated board pressing unit 1312D is provided adjacent to the discharge conveyor 1312A and the belt conveyor 1312C and an ink jet printer 1312E is provided adjacent to the corrugated board pressing unit 1312D.

The corrugated board pressing unit 1312D comprises a guide rail 1312F extended along an edge of the discharge conveyor 1312A, and a guide block 1312G which slides on the guide rail 1312F in engagement with the guide rail 1312F as indicated with a two-dot chain line in FIG. 42. The guide block 1312G is projected to the discharge conveyor 1312A and functions as a pushing member for pushing the product packed corrugated board box 600 to the belt conveyor 1312C.

A positioning plate 1312H, which is capable of projecting/retracting to/from the discharge conveyor 1312A for positioning the product packed corrugated board box 600 discharged from the discharge conveyor 1312A on the belt conveyor 1312C properly, is provided below the guide rail 1312F. In FIG. 118, a condition in which the positioning plate 1312H is retracted is indicated with a solid line while a condition in which it is projected to the discharge conveyor 1312A is indicated with a two-dot chain line.

An operation of the product-packed corrugated board box transporting portion 1312 will be described below.

When a long side of the product packed corrugated board box 600 is at right angle to the discharge conveyor 1312A, while the discharge conveyor 1312A transports the product packed corrugated board box 600, the guide block 1312G stands by outside the discharge conveyor 1312A as shown in FIG. 118. Then, if the product packed corrugated board box 600 abuts the positioning plate 1312H, the guide block 1312G, after located at a position indicated with a solid line, slides on the guide rail 1312F and moves to the belt conveyor 1312C, so that the product packed corrugated board box 600 is pushed out to the belt conveyor 1312C.

Figure 119:
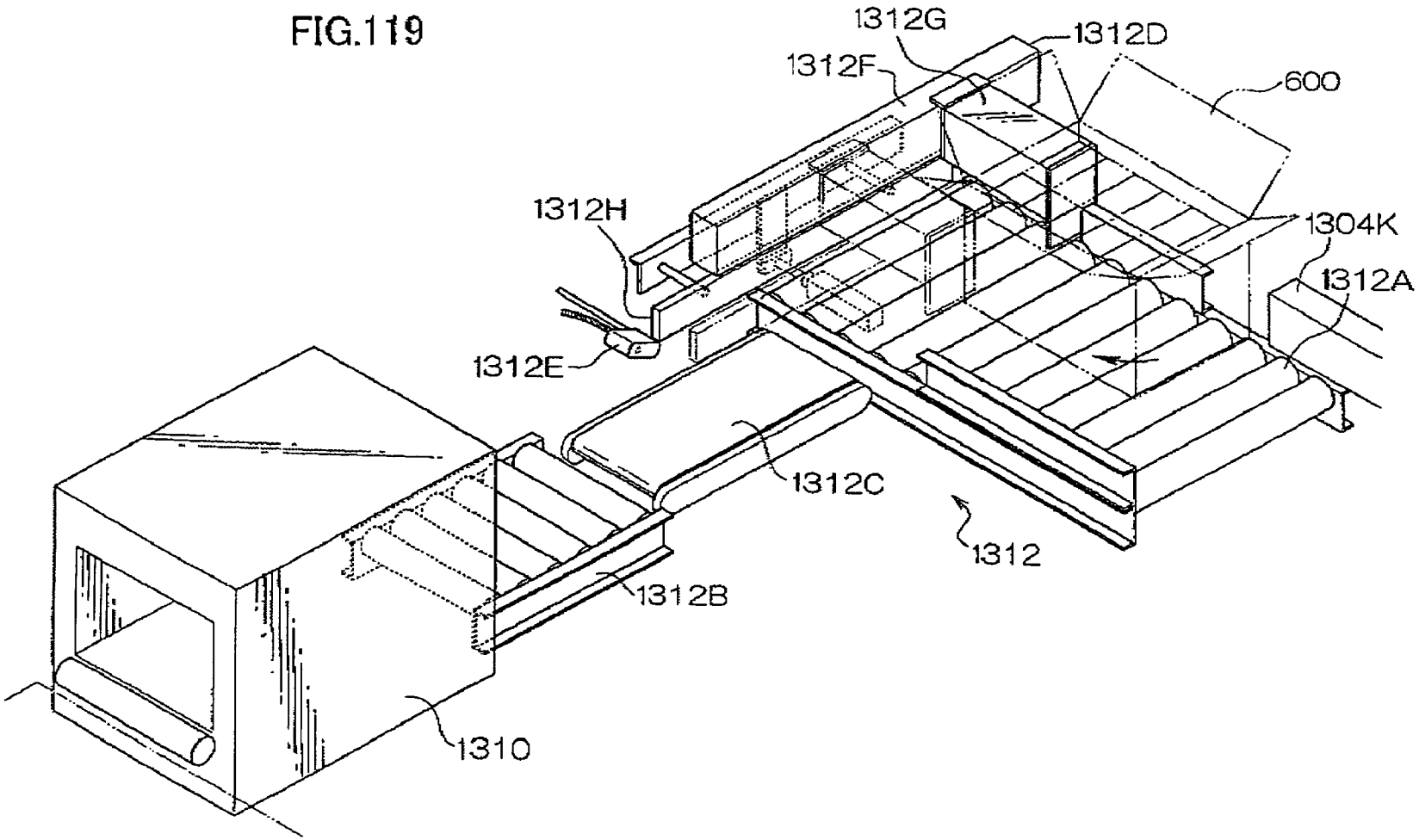

On the other hand, if the long side of the product packed corrugated board box 600 is in parallel to the discharge conveyor 1312A, the guide block 1312G moves onto a side edge on a side opposite to a side adjacent to the belt conveyor 1312C of the conveyor 1312A. If the product packed corrugated board box 600 is transported on the discharge conveyor 1312A with this condition, the guide block 1312G abuts an edge of the product packed corrugated board box 600. Consequently, the product packed corrugated board box 600 is rotated by 90° in the direction to the guide rail 1312F around the Z-axis as indicated with an arrow in FIG. 119, so that its long side is at right angle to the discharge conveyor 1312A. After the product packed corrugated board box 600 is rotated until the long side thereof is at right angle to the discharge conveyor 1312A, the product packed corrugated board box 600 is pushed out on the belt conveyor 1312C by the guide block 1312G like indicated in FIG. 42.

The product packed corrugated board box 600 pushed out to the belt conveyor 1312C is transported to the weight detection unit 1312B.

The weight detection unit 1312B detects whether or not the content packed in the product packed corrugated board box 600 is short.

The weight detection unit 1312B may determinates that the product packed corrugated board box 600 is acceptable according to a fact that the weight of the product packed corrugated board box 600 is within a predetermined range.

However, if the quantity of types or the quantity of combinations is tremendously large, a working load for determining a criterion value is large. Even in case of the same type, if part lot changes to produce a difference in the weight of the product packed corrugated board box 600, so that a value serving as a criterion changes, a working load for determining the criterion value following that change is large also. In such a case, there is a method of determining that an product packed corrugated board box 600 is acceptable if a difference between the weight of an product packed corrugated board box 600 and the weight of an product packed corrugated board box 600 just before in a certain lot containing the same products is within a preliminarily set range between upper and lower limits. According to the above-described determination method, if the range between the upper and lower limits is set up to be smaller than the weight of a single carton assembly 720 or shrink-wrapped package 740, an product packed corrugated board box 600 having insufficiency of the quantity of the packaged carton assemblies 720 or shrink-wrapped packages 740 can be removed as defective products because such an product packed corrugated board box 600 is lighter than the lower limit. Further, even if different type product packed corrugated board boxes 600 are fed through a production line, it is not necessary to reset the weight criterion.

The product packed corrugated board box 60, after determined to be acceptable by the weight inspecting unit 312B, is transported to the sealing machine 1310.

1-7 Control Computer

Figure 120:
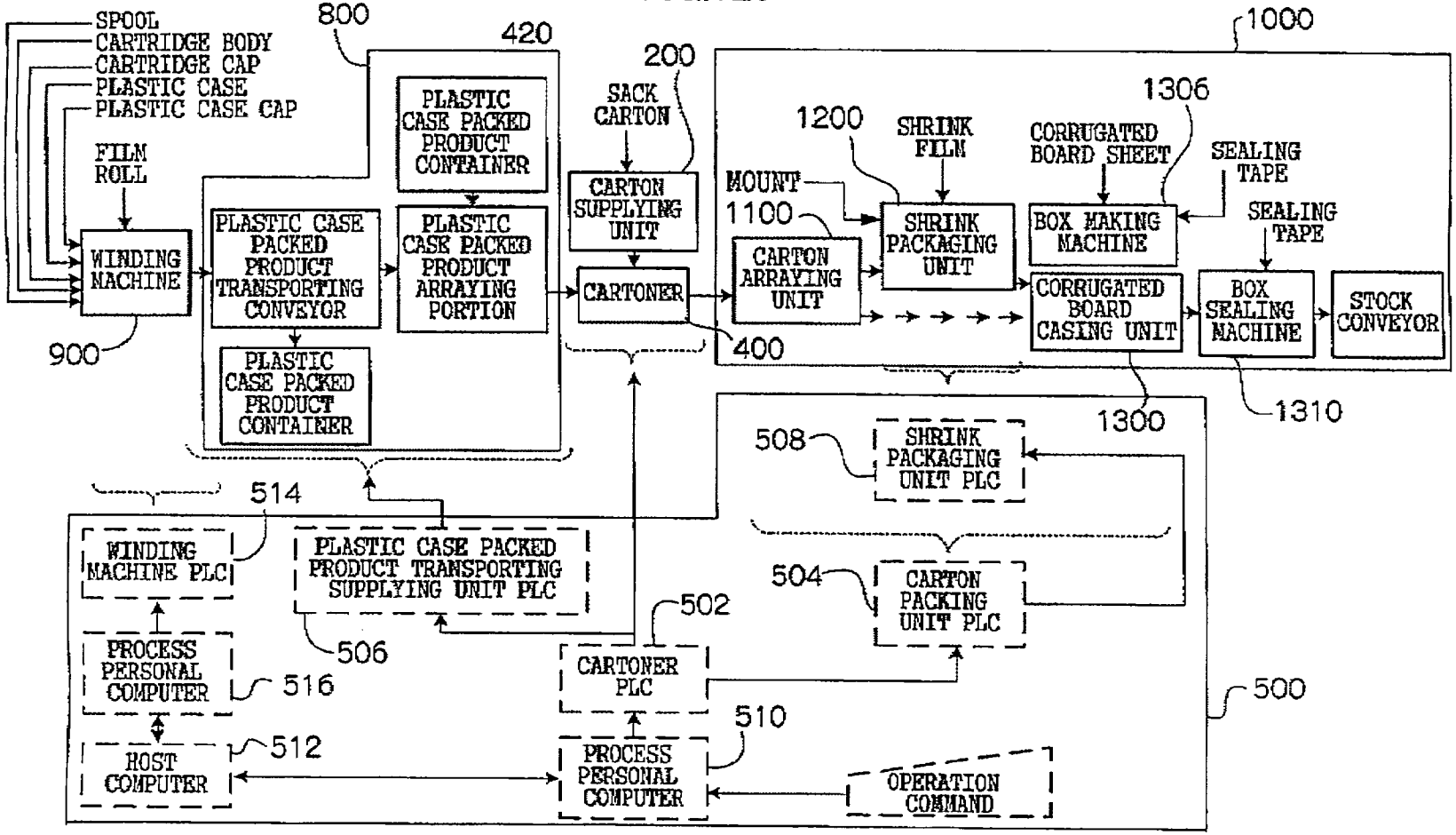

As shown in FIG. 120, the control computer 500 comprises a cartoner PLC (Programmable Logic Controller) 502 for controlling the cartoner 400, a carton packing unit PLC 504 for controlling an entire carton packing unit 1000, a P-packed transporting supplying unit PLC 506 for controlling the plastic case packed product transporting supplying unit 800, a shrink packaging unit PLC 508 for controlling the shrink packaging unit 1200 and a winding machine PLC 514 for controlling the winding machine 900.

The control computer 500 comprises a process personal computer 510 for inputting an operation instruction to the cartoner PLC 502, a process personal computer 516 for inputting an operation instruction to the winding machine PLC 514, and a host computer 512 for inputting production plan to the process personal computer 510 and the process personal computer 516.

The cartoner PLC 502, the carton packing unit PLC 504, the plastic case packed product transporting supplying unit PLC 506, the shrink packaging unit PLC 508 and the winding machine PLC 514 have a display for displaying condition setting instructions from the process personal computer 510 and the process personal computer 516 and a touch panel for inputting manufacturing condition.

If the production plan is inputted from the host computer 512 to the process personal computer 510 and the process personal computer 516, the process personal computer 510 inputs a condition setting instruction to the cartoner PLC 502 and the process personal computer 516 inputs a condition setting instruction to the winding machine PLC 514.

The cartoner PLC 502 displays the condition setting instruction inputted from the process personal computer 510 on a display.

If the cartoner PLC 502 displays the condition setting instruction on its display, an operator inputs various production condition through a display, a touch-up panel or a keyboard of the cartoner PLC 502.

The carton manufacturing/packaging condition which can be inputted to the cartoner PLC 502 includes a condition about supply of the plastic case packed product P, manufacturing of the carton 700, the carton assembly 720 and shrink-wrapped package 740, a condition about loading of the carton assembly 720 and the shrink-wrapped package 740 into the corrugated board 600.

The condition about the supply of the plastic case packed product P includes, for example, the type of the plastic case packed product to be supplied to the cartoner 400, the quantity of the plastic case packed products P per a single supply, a combination of the plastic case packed products in case where multiple kinds thereof are supplied.

The condition about the production of the carton 700 includes a formation of the sack carton 710, the quantity of the plastic case packed products which should be loaded in the sack carton 710, whether or not a different type plastic case packed product should be loaded into the sack carton and a combination of the plastic case packed products in case where different type plastic case packed products are loaded.

The condition about the carton assembly 720 and the shrink-wrapped package 740 includes the type, size and arrangement of the carton 700 and whether or not shrink should be applied to the carton assembly 720.

The condition for loading the carton assembly 720 and the shrink-wrapped package 740 into the carton assembly 720 includes loading patterns of the carton assembly 720 and the shrink-wrapped package 740, configuration of the corrugated board 600 for use and the like.

If a working instruction is inputted to the process personal computer 510, the process personal computer 510 inputs the condition setting instruction into the cartoner PLC 502 based on the above-described working instruction.

The cartoner PLC 502 controls the cartoner 400 based on a manufacturing condition of the carton 700 included in the inputted production condition. At the same time, the condition about the supply of the plastic case packed product is inputted to the plastic case packed product transporting supplying unit PLC 506. The condition about the carton assembly 720 and the shrink-wrapped package 740 and the condition about loading of the carton assembly 720 and the shrink-wrapped package 740 into the corrugated board 600 are inputted to the carton packing unit PLC 504. The plastic case packed product transporting supplying unit PLC 506 controls the plastic case packed product transporting supplying unit 800 based on the production condition inputted from the cartoner PLC 502. The carton packing unit PLC 504 controls the carton arraying unit 1100 of the carton packing unit 1000 and the corrugated board casing unit 1300 based on the production condition inputted from the cartoner PLC 502 and at the same time, controls the shrink packaging unit 1200 through the shrink packaging unit PLC 508 if the aforementioned production condition contains an instruction for manufacturing the shrink-wrapped package 740 by shrink-packaging the carton assembly 720.

By inputting the production condition into the cartoner PLC 502, units included in the plastic case packed product transporting supplying unit 800, specifically, the plastic case packed product transporting supplying unit 800, the cartoner 400, the carton arraying unit 1100, the shrink packaging unit 1200, and the corrugated board casing unit 1300 can be set up about their conditions and controlled.

By inputting production conditions independently through the display, touch-up panel, and keyboard, the plastic case packed product transporting supplying unit PLC 506, the carton packing unit PLC 504, and the shrink packaging unit PLC 508 can control the plastic case packed product transporting supplying unit 800, the carton arraying unit 1100, the corrugated board casing unit 1300, and the shrink packaging unit 1200 independently.

On the other hand, the winding machine PLC 514 displays a condition setting instruction inputted from the process personal computer 516 on a display like the cartoner PLC 502.

If the display of the winding machine PLC 514 displays the condition setting instruction, the operator inputs the plastic case packed product manufacturing condition about the plastic case packed products through the display, touch-up panel and keyboard. The plastic case packed product manufacturing condition includes condition about sensitivity and number of frames, a spool for use, a single-side opening cartridge, a cartridge cap, plastic case main body and plastic case. If these conditions are inputted to the winding machine PLC 514, the winding machine PLC 514 controls the winding machine 900 based on the inputted manufacturing condition.

Thus, if the production condition is inputted to the winding machine PLC 514, that condition is set up in the winding machine 900, so that the winding machine 900 is controlled independently of the plastic case packed product transporting supplying unit 800 and other units.

2. Corrugated Board Box 2-1 Configuration of Corrugated Board Box

According to the invention, the corrugated board box for use in the carton packing unit 1000 is classified to a corrugated board box having the partition and a corrugated board box having no partition.

Figure 121:
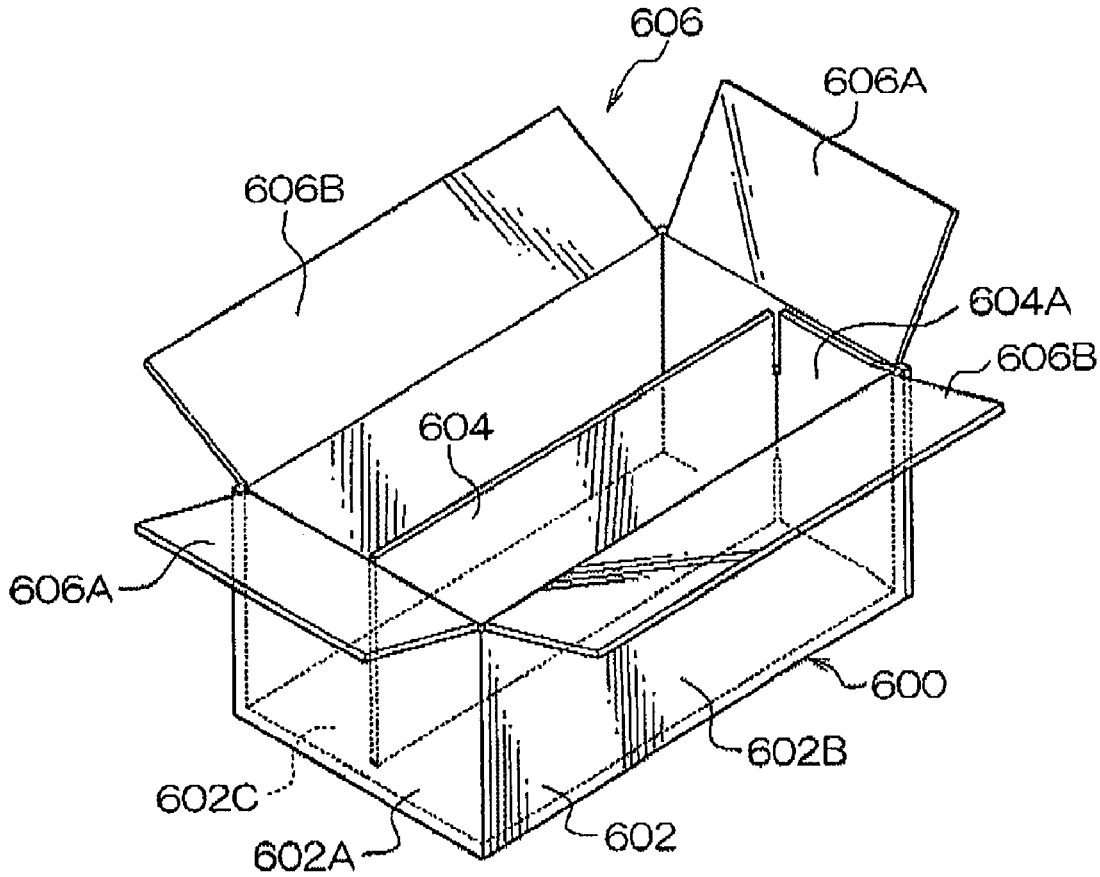
Figure 122:
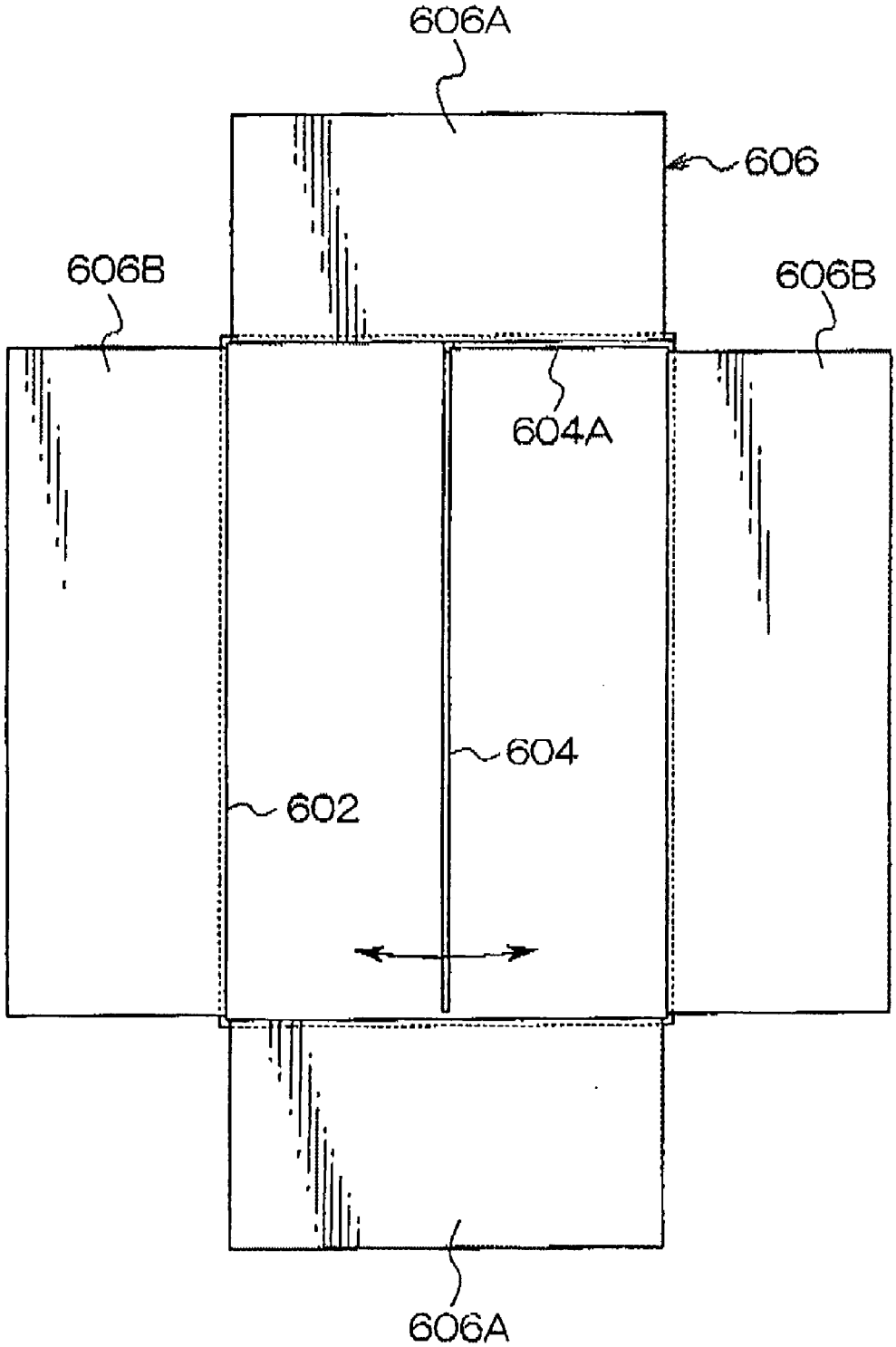
Figure 123:
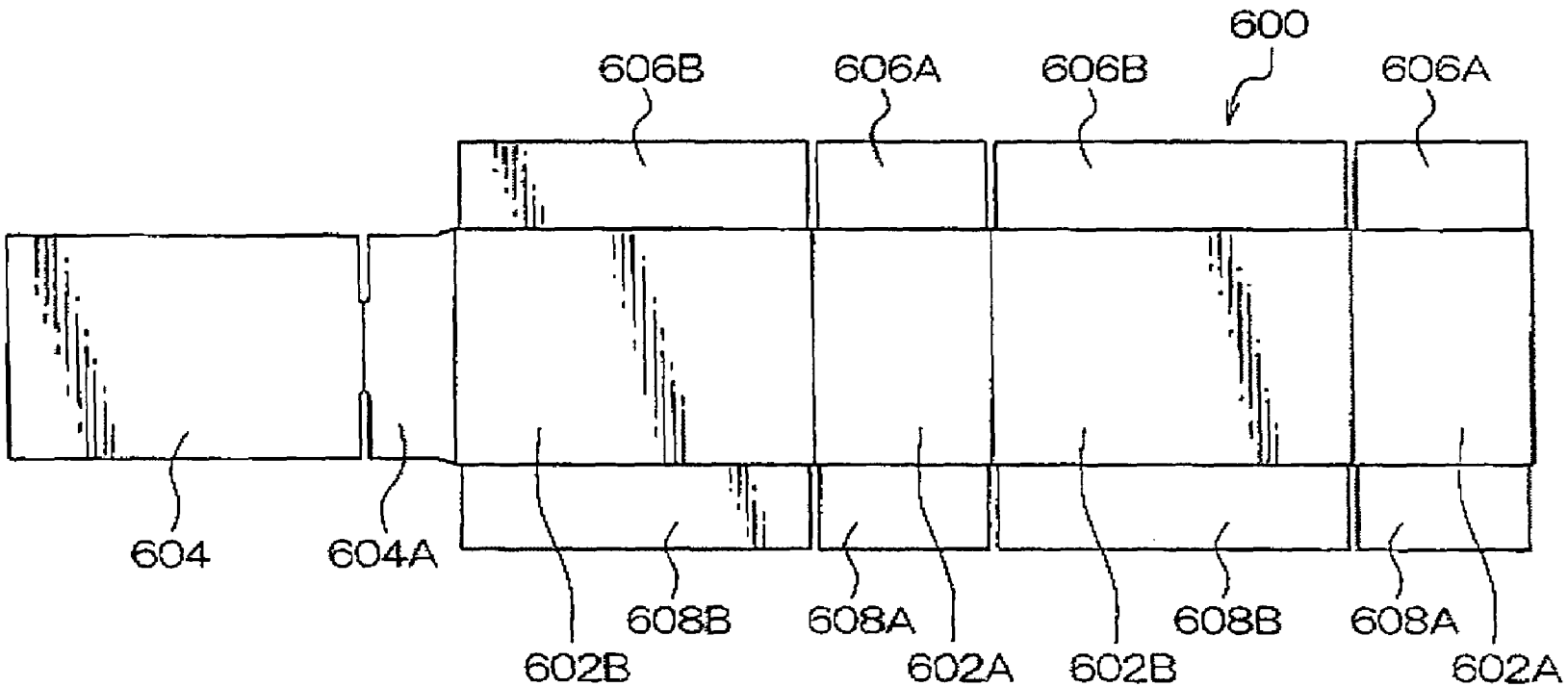

FIGS. 121 and 122 show an example of the corrugated board box having the partition and FIG. 123 shows a development diagram thereof.

As shown in FIGS. 121 to 123, the corrugated board box 600 comprises a rectangular solid main body 602 whose top face is open, a partition 604 for dividing the interior of the main body 602 to two sections and four flap portions 606 provided on a top edge of the main body 602 for forming a lid portion for covering the opening portion when they are folded.

The main body 602 comprises a bottom face 602C, a width-direction side plate 602A which forms a side face in the width direction and a length-direction side plate 602B which forms a side face in the longitudinal direction.

Inside flaps 606A, which are located inside when folded, of the four flap portions 606 are provided on a top edge of the width direction side plate 602A of the corrugated board main body 602 and outside flaps 606B, which are located outside when folded, are provided on the top edge of the length-direction side edge 602B.

The partition 604 is extended along the longitudinal direction of the main body 602 and fixed on one of the width-direction side plate 602A at its proximal portion 604A. A vertical cutout is made between the partition 604 and the proximal portion 604A. Instead of providing with a cutout at the root portion as shown in FIGS. 124 and 125, it is permissible to provide with perforations in the vertical direction in FIGS. 124 and 125. The cutout or perforations at the root portion of the partition functions a hinge.

An end portion on an opposite side to the root portion, which is an end portion on the side having the proximal portion 604A of the partition 604, that is, a front end portion is not fixed on an inner wall face of the main body 602.

The height of the partition 604 is so set that a gap of 5 to 10 m is formed between the bottom and the lid of the corrugated board box 600 when the lid is formed by folding the flap portions 606.

Therefore, the front end portion of the partition 604 is movable freely along the width direction inside the main body 602 as indicated with both arrows in FIG. 122.

As shown in FIG. 123, bottom face flap portions 60BA, 6088, which form the bottom face 602C when folded, are provided on an opposite side to the side provided with the flap portion 606 of the width-direction side plate 602A and the length-direction side edge 602B.

FIG. 126 shows a procedure for loading such a shrink-wrapped package 740 and a carton assembly 720 into the corrugated board box 600. FIGS. 50A to 50H show the order of loading the product.

The corrugated board box 600 is partitioned to two rooms, a small room 600A and a small room 600B along the length side thereof by the partition 604.

Figure 126F:
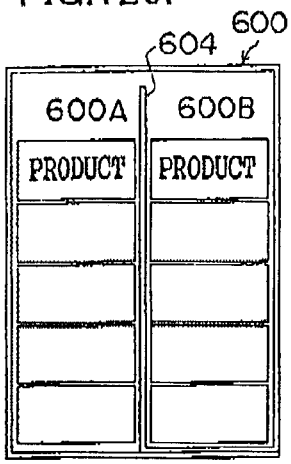
Figure 126D:
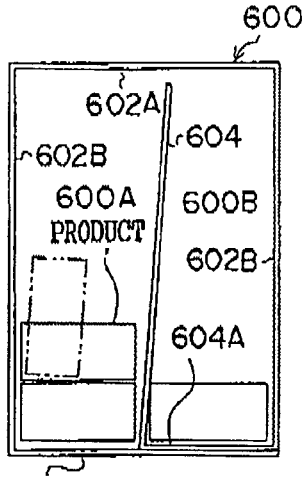
Figure 126A:
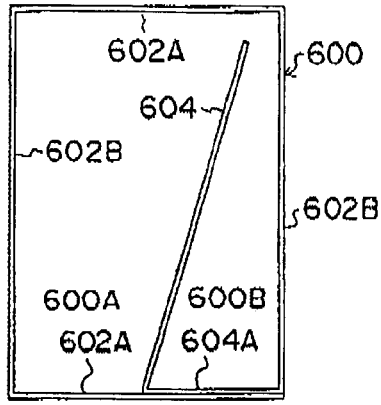
Figure 126G:
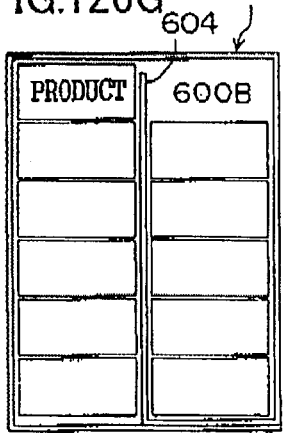
Figure 126E:
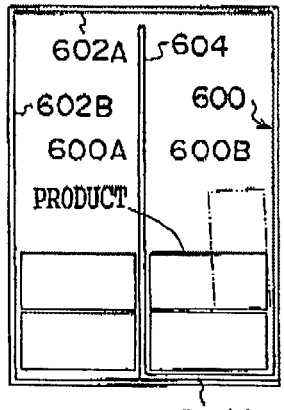
Figure 126B:
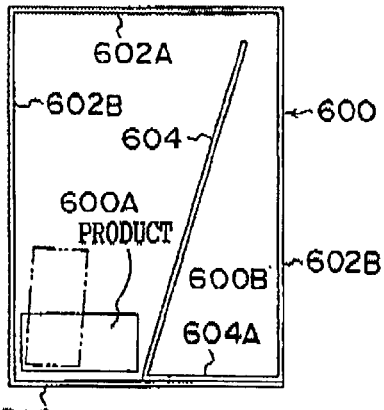

As shown in FIG. 126B, an initial product is loaded to near the root portion of the partition 604 in the small room 600A. The aforementioned product is loaded along the length-direction side plate 602B on the side in which the small room 600A is formed as indicated with two-dot chain line in FIG. 126B and then, rotated to the width-direction side plate 602A on the side in which the partition 604 is fixed as indicated with a solid line.

Figure 126H:
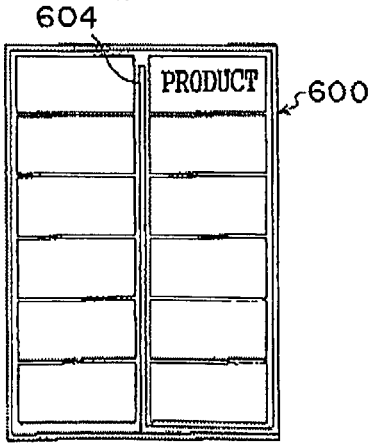
Figure 126C:
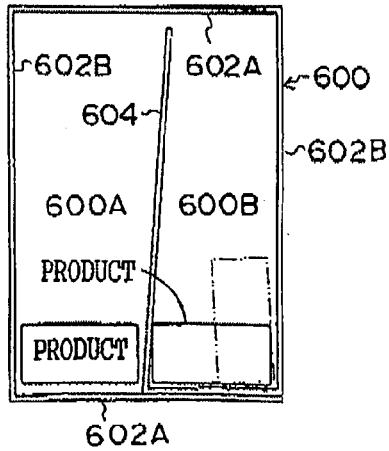

A second product is loaded on a side in which the proximal portion 604A of the partition 604 in the small room 600B is located as shown in FIG. 126C. The product is loaded along the length-direction side plate 602B on the side in which the small room 600B is formed as indicated with a two-dot chain line in FIG. 126C and then, rotated to the proximal portion 604A of the partition 604 as indicated with a solid line.

A third product is loaded to a position adjacent to the initial product in the small room 600A as indicated in FIG. 126D. The aforementioned product is loaded along the length-direction side plate 602B as indicated with a two-dot chain line in FIG. 126B and then, rotated to a position adjacent to the initial product.

A fourth product is inserted into a position adjacent to the initial product in the small room 600B as indicated in FIG. 126E. The aforementioned product is loaded along the length-direction side plate 602B on the side in which the small room 600B is formed as indicated with a two-dot chain line in FIG. 126E, and next, rotated to the initial product as indicated with a solid line.

In this way, products are loaded into the small rooms 600A, 600B alternately and the partition 604 is fixed in the center of the corrugated board box 600 by the loaded products.

When the final products are loaded into each of the small rooms 600A, 600B, the final product is loaded into the small room 600A as indicated in FIGS. 126F and 126G, and then the final product is loaded into the small room 600B as indicated in FIG. 126H.

Although an example in which the product is loaded into the small room 600B after the product is loaded into the small room 600A first has been described, conversely, it is permissible to load the product into the small room 600B and then load the product into the small room 600A.

3. Carton

A carton 700, which can be loaded into a corrugated board box by a carton boxing unit 1000, can accommodate 1 to 5 plastic case packed products.

Some carton 700 is composed of only a box-type main body 702 having no header as shown in FIGS. 128 to 131, while some carton 702 has a header 704 attached to the main body 704 as shown in FIGS. 132 to 139.

The carton 700 having the header 704 includes an example in which as shown in FIGS. 132 to 135, a header 704 having the same width as the main body 702 is provided on an end portion of the main body 702, an example in which as shown in FIGS. 136 and 137, a header 704 having a larger width than the main body 702 is provided on an end portion of the main body 702, an example in which as shown in FIGS. 138 and 139, a header 704 is provided along the side edge of the main body 702.

4. Operation 4-1 Procedure for Manufacturing of Plastic Case Packed Product and Carton and Carton Packaging FIG. 127 shows a flow of various products in the packaging system 2000.

If production plan is inputted to the process personal computers 510, 516 from the host computer 512 as described about the control computer 500, the process personal computer 510 and the process computer 516 output the condition setting instruction to the winding machine 514.

After the operator inputs the plastic case packed product manufacturing condition to the winding machine PLC 514, a film roll, spool, single-side opening cartridge, cartridge cap, plastic case and plastic case cap are automatically supplied continuously to the winding machine 900 according to the plastic case packed product manufacturing condition and then, the plastic case packed products are produced.

On the other hand, if the operator inputs carton manufacturing/packaging condition into the cartoner PLC 502, the plastic case packed product transporting supplying unit 800, the cartoner 400, the carton arraying unit 1100, the shrink packaging unit 1200 and the corrugated board casing unit 1300 are controlled according to the carton manufacturing/packaging condition, so that a process from loading the plastic case packed product into the sack carton 710 to loading of the carton assembly 720 or the shrink-wrapped package 740 into the corrugated board box 600 is controlled as a sequential process.

The winding machine 900 is controlled independently of the plastic case packed product transporting supplying unit 800 and subsequent units.

When packaging of a plastic case packed product $P_1$, which is a type of the plastic case packed product, is terminated and packaging of a plastic case packed product $P_2$, which is a new type of the plastic case packed product, is started, the manufacturing condition for the cartoner PLC 502 is maintained at a condition corresponding to the plastic case packed product $P_1$ until a last product packed corrugated board box 600 is discharged out of the corrugated board casing unit 1300.

After the last product packed corrugated board box 600 is discharged out of the corrugated board casing unit 1300, it is verified that no material used for production and packaging of the plastic case packed product $P_1$ or no product is left in the sequential units of the packaging system 2000 and if such material or product is left, it is removed.

After it is verified that no material or product is left as a result of the above-described verification, a new condition about packaging of the plastic case packed product 2 is inputted to the cartoner PLC 502 and next, a new condition about manufacturing of the plastic case packed product $P_2$ is inputted to the winding machine PLC 514 and finally, the manufacturing and packaging of the plastic case packed product $P_2$ is started.

Instead of inputting the new manufacturing condition into the cartoner PLC 502 so as to execute the verification securely, it is permissible to set up new conditions for respective units included in the plastic case packed product transporting supplying unit 800.

4-2 Carton Packaging Procedure

The procedures for arraying the carton 700 in the carton packing unit 1000 included by the packaging system of the fifth embodiment so as to form the carton assembly 720 or the shrink-wrapped package 740 and packaging into the corrugated board box will be exemplified.

4-2-A Boxing Procedure Example 1

The boxing procedure will be explained about the carton 700 shown in FIG. 136, which accommodates only a single plastic case packed product and has a header 704 having a larger width than the main body 702.

As shown in FIG. 140A, the carton 700 is discharged out of the cartoner 400 with the header 704 facing downward.

If the carton arraying unit 1100 receives the control instruction, it rotates the carton 700, after transported by the first conveyor 1102 Under a condition shown in FIG. 140A, by 90° such that the header 704 is located on the upstream side relative to the transporting direction by the first robot 1112 as shown in FIG. 140B.

The cartons 700, after rotated by 90°, are arrayed on the second conveyor 1104 Such that the header 704 overlaps the main body 702 as shown in FIGS. 140C and 140D so as to form a carton assembly 720 composed of five cartons 700.

The carton assemblies 720 formed by the second conveyor 1104 are transported to the third conveyor 1106 and arrayed there. As shown in FIG. 140D, the carton assembly 720 is gripped with the chuck pawls 1116E included by the third robot 1116 from both sides and brought up and then, rotated such that the header is set horizontal and finally, the carton assembly 720 is transported onto the introduction conveyor 1202 in the shrink packaging unit 1200. Because a mount is already supplied to the introduction conveyor 1202 from the mount supplying unit 1214 according to an instruction from the control computer 500, the carton assembly 720 is descended to the introduction conveyor 1202 by the third robot 1116 and placed on the mount as shown in FIG. 140F.

After placed on the mount, the carton assembly is introduced to the covering portion 1204 by the introduction conveyor 1202 and covered with shrink film from both faces. After that, the carton assembly passes through the heat sealing portion 1206 And the shrink tunnel 1208, so that as shown in FIG. 140G, shrink packaging is performed so as to form the shrink-wrapped package 740.

The shrink-wrapped package 740 is inspected by the height arranging portion 1210 and their ends are arranged in line by the end arranging transporting unit 1212. Then, they are transported to the corrugated board box positioning portion 1304 of the corrugated board casing unit 1300 by the transporting conveyor 1212*i*.

In the corrugated board box positioning portion 1304, the shrink-wrapped package 740 is loaded in the empty corrugated board box 600 by the product loading robot 1302 according to the procedure shown in FIG. 126.

4-2-B Boxing Procedure 2

The procedure for arraying the carton 700 shown in FIG. 133, which accommodates three plastic case packed products and has the header 704 having the same width as that of the main body 702 will be explained below.

Figure 141A:
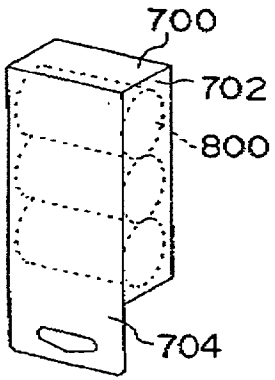

As shown in FIG. 141A, the carton 700 is discharged from the cartoner 400 with the header 704 facing downward and transported by the first conveyor 1102 of the carton arraying unit 1100.

The carton arraying unit 1100 transports the carton 700 after transported by the first conveyor 1102 To the second conveyor 1104 without turning it in the first robot 1112.

Figure 141B:
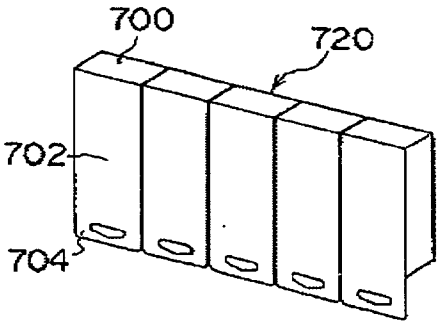

The second conveyor 1104 forms the carton assembly 720 by arraying five pieces of the cartons 700 after transported by the first conveyor 1102, as shown in FIG. 141B.

Figure 141C:
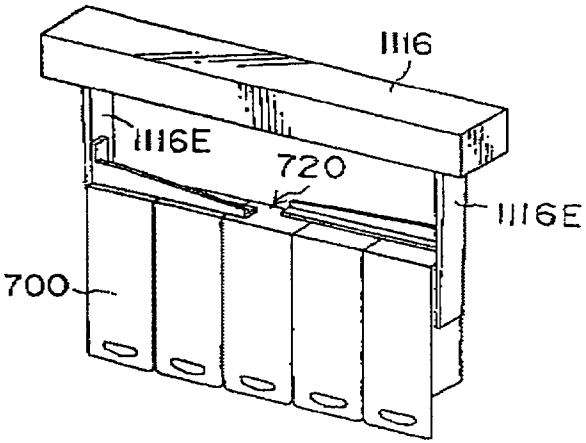

The carton assembly 720 formed by the second conveyor 1104 is transported to the third conveyor 1106 and arrayed there. As shown in FIG. 141C, the carton assembly 720 is gripped with the chuck pawls 1116E of the third robot 1116 and brought up with the header 704 facing downward.

Figure 141D:
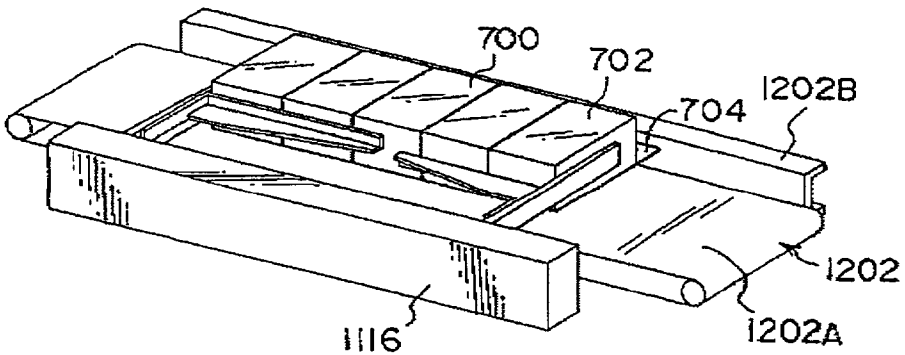
Figure 141E:
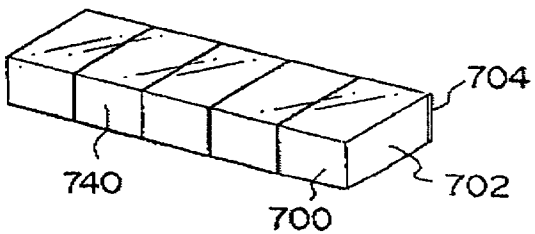

Next, as shown in FIG. 141D, in the third robot 1116, the chuck rotation unit 1116D is rotated so as to rotate the chuck portion 1116A until the chuck pawl 1116E is set horizontal. Then, the chuck portion 1116A is carried to just above the introduction conveyor 1202 of the shrink packaging unit 1200 by the guide unit 1116B. The chuck portion 1116A is moved to the guide plate 202B above the introduction conveyor 1202. Consequently, the header portion 704 is made into a firm contact with the guide portion 1202B and folded toward the main body 702 of the carton 700. In the shrink packaging unit, the carton assembly 720 is transported through the covering portion 1204, the heat-sealing portion 1206 and the shrink tunnel 1208 successively with the header 704 in a folded condition, so that shrink packaging is performed so as to form the shrink-wrapped package 740.

The shrink-wrapped package 740 is transported to the corrugated board casing unit 1300 through the height arranging portion 1210 and the end arranging transporting unit 1212 successively and loaded in the empty corrugated board box 600 by the product loading robot 1302 according to the procedure shown in FIG. 126.

4-2-C Boxing Procedure 3

The carton 700 shown in FIG. 132, which accommodates two piece of the plastic case packed products and has the header 704 having the same width as the main body 702, will be explained below.

Figures 142A, 142B, 142C, 142D, 142E, 142F, 142G:
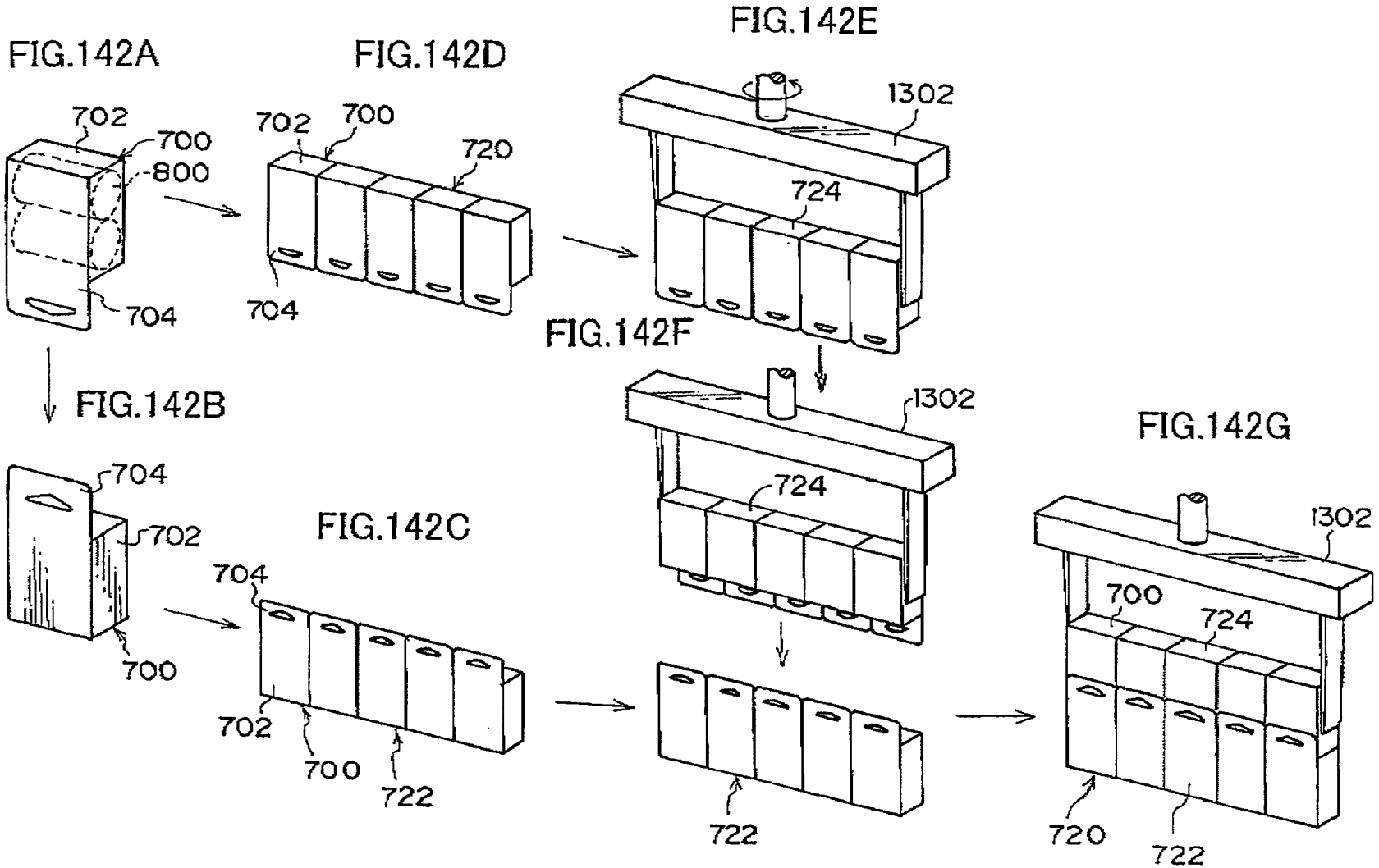

As shown in FIG. 142A, the carton 700 is discharged from the cartoner 400 with the header 704 facing downward and transported by the first conveyor 1102 of the carton arraying unit 1100.

The carton arraying unit 1100 rotates initial five cartons 700 by 180° by means of the first robot 1112 and places them on the second conveyor 1104 as shown in FIG. 142B.

In the second conveyor 1104, as shown in FIG. 142C, five pieces of the cartons 700 are arrayed with the header 704 facing upward so as to form the first carton group 722. The first carton group 722 is passed through the third conveyor 1106 and the fourth conveyor 1108 to the fifth conveyor 1110 and stopped by the carton arranging portion 1110B. The first carton group 722 stopped by the carton arranging portion 1110B is carried to the table 1110S by the carton pressing plate 1110J. If the first carton group 722 is transported onto the table 1110S, the pressing plate 1110J on the right side in the transporting direction is returned to its original position thereby not obstructing transporting of next five cartons into the carton arranging portion 1110B.

On the other hand, as shown in FIG. 142D, the next five pieces are placed on the second conveyor 1104 without being rotated by the first robot 1112, so that the five pieces are arrayed on the second conveyor 1104 with the header 704 facing upward. In this way, the second carton group 724 is formed. The second carton group 724 is transported to the fifth conveyor 1110 through the third conveyor 1106 and the fourth conveyor 1108 and stopped by the carton arranging portion 1110B.

As shown in FIG. 142E, the second carton group 724, after stopped by the carton arranging portion 1110B, is raised by the product loading robot 1302 and next, rotated by 180° around its vertical axis as shown in FIG. 142F. Consequently, the header 704 of the second carton group 724 is directed downward and located at a position opposing the header 704 of the first carton group 722. Next, as shown in FIG. 142G, the second carton group 724 is placed on the first carton group 722 by the product loading robot 1302 and the carton assembly, composed of 10 cartons 700, is formed at an end of the fifth conveyor 1110.

The carton assembly 720 formed in this way is pressed from both its faces by the carton pressing plate 1110J so as to form a neat shape and brought upward by the product loading robot 1302 through both end faces and then, loaded into a corrugated board box at the corrugated board box positioning portion 1304.

4-2-D Boxing Procedure Example 4

The procedure for arraying and boxing the carton 700 shown in FIG. 138, which accommodate three pieces of the plastic case packed products and has the header 704 on a side edge of the main body 702, will be explained below.

Figures 143A, 143B, 143C, 143D, 143E, 143F, 143G, 143H:
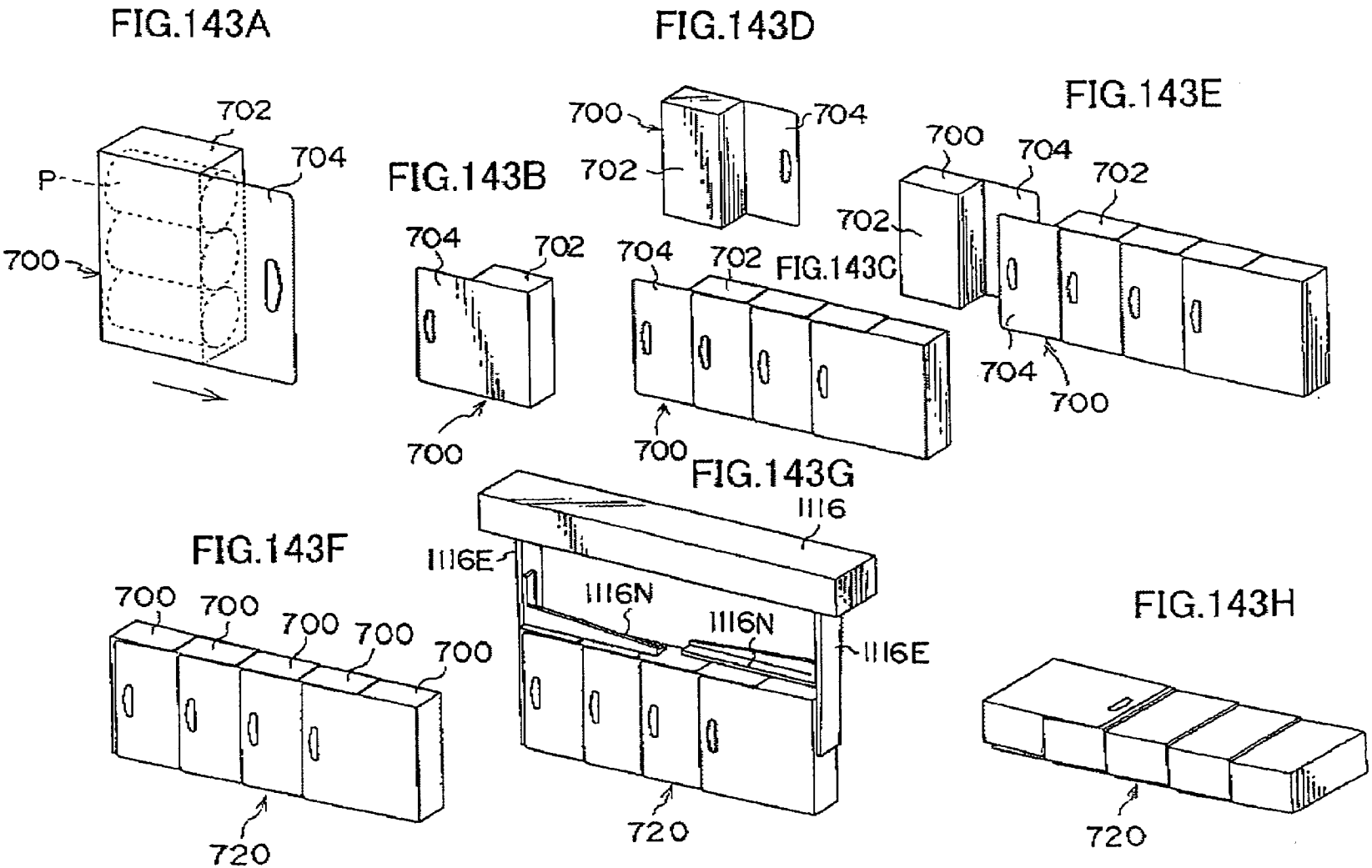

As shown in FIG. 143A, the carton 700 is discharged from the cartoner 400 with the header 704 directed in the transporting direction and in a condition that it is located forward relative to this paper in FIG. 143 and transported by the first conveyor 1102 of the carton arraying unit 1100.

As shown in FIG. 143B, the five cartons 700, after transported by the first conveyor 1102, are rotated by 180° by the first robot 1112 of the carton arraying unit 1100 and placed on the second conveyor 1104Such that the header 704 is directed in the direction opposite to the transporting direction. As shown in FIG. 143C, of the five cartons 700, the initial four pieces are advanced on the second conveyor 1104 with the header 704 located forward relative to this paper in FIG. 143 and arrayed so that the header 704 and the main body 702 overlap each other. On the other hand, as shown in FIG. 143D, the five cartons 700 are rotated by 180° around its vertical axis by the second robot 1114 while they are being carried by the second conveyor 1104 So that the header 704 is directed in the transporting direction and located backward relative to this paper in FIG. 143. As shown in FIGS. 143E and 143F, the fourth and fifth cartons 700 are combined so that the header 704 of the fifth carton makes contact with the main body 702 of the fourth carton 700 while the main body 702 of the fifth carton makes contact with the header 704 of the fourth carton 700, thereby forming the carton assembly 720.

Side faces of the carton assemblies 720 formed by the second conveyor 1104 are arranged in line by the third conveyor 1106 and as shown in FIG. 143G, those carton assemblies 720 are transported to the shrink packaging unit 1200 by the third robot 1116 and shrink-wrapping packaged.

The packaging system 2000 of the fifth embodiment is capable of automatically coping with the cartons 700 in which the quantity of the plastic case packed products accommodated inside thereof and the position and size of the header 704 are different. If the sizes of the main body 702 and the header 704 of the carton 700 are different, the quantity and combination of the cartons 700 are often different. In such a case also, this packaging system is capable of automatically forming the carton assembly 720 by combining a predetermined quantity of the cartons 700 in a predetermined combination.

The carton assembly 720 is packed into a corrugated board box as it is in some case or shrink-wrapped and packed in a box in some case. In this case, this packaging system is capable of automatically separating a carton assembly which should be shrink-wrapped and the one which should not after the carton assembly is formed by combining the cartons 700.

When boxing the carton assembly 720 or the shrink package 740, they need to be packaged in different patterns depending on the configuration and size of the carton 700. In this case, this packaging system is capable of automatically coping with the aforementioned pattern.

Thus, the packaging system 2000 is capable of executing entire process including manufacturing of the plastic case packed product P by the winding machine 900, manufacturing of the carton 700 by the cartoner 400, formation of the carton assembly 720 or the shrink-wrapped package 740 by the carton packing unit 1000 and packaging into the corrugated board box 600 sequentially. Therefore, a stock of the plastic case packed products P on a process can be eliminated. Accordingly, the period up to shipment can be reduced largely.

Further, the film rolls R supplied to the winding machine 900 flow through the winding machine 900, the plastic case packed product transporting supplying unit 800, the cartoner 400, the carton arraying unit 1100, the shrink-wrapping unit 200 and the corrugated board casing unit 1300 without any deposit halfway and stored in the corrugated board box 600 as a plastic case packed product P containing the carton 700 based on the principle "first-in first-out". Therefore, it is possible to specify which carton 700 or which corrugated board box 600 is loaded a specific film roll R situated at which position.

Accordingly, if any abnormality in terms of performance is found out in films after they pass the packaging system and are packaged in a corrugated board box, the range of the cartons 700 or the product packed corrugated board boxes 600 which should be collected and abandoned can be specified with a small range. Additionally, if a trouble is found out in the market, it is easy to specify a problem by tracking its production process.

What is claimed is:

1. A packaging object supplying apparatus for supplying packaging objects to a packaging unit for packaging in a predetermined fashion, comprising:

a packaging object combining portion for forming a combination of the packaging objects by combining two or more different kinds of the packaging objects in a predetermined quantity thereof in a predetermined arrangement; and a packaging object introducing portion for introducing the packaging objects combined by the packaging object combining portion to the packaging unit, wherein said apparatus supplies two kinds of the packaging objects to the packaging unit by combining the packaging objects in a predetermined arrangement, wherein the packaging object combining portion includes a first introduction line for introducing a first packaging object and a second introduction line for introducing a second packaging object, and the first packaging object introduced from the first introduction line and the second packaging object introduced from the second introduction line are introduced to the packaging object introduction portion according to the predetermined arrangement so as to form a combination of the first and second packaging objects, wherein the packaging object combining portion comprises sorting means for sorting the first packaging object introduced from the first introduction line and the second packaging object introduced from the second introduction line so that the first and the second packaging objects are introduced to the packaging object introduction portion in accordance with the predetermined arrangement, said apparatus further comprising: a packaging object falling chute through which the first and the second packaging objects that are sorted by the sorting means fall in an order set by the sorting means; and packaging object transporting means for transporting the first and the second packaging objects falling through the packaging object falling chute to the packaging unit, wherein the packaging object transporting means comprises packaging object holding means for holding each of the first and the second packaging objects, wherein the packaging object transporting means includes:

a first transporting failure detecting means detecting a failure of the packaging object in the packaging object transporting means and a second transporting failure detecting means for detecting a packaging object placed on two packaging objects held by the packaging object holding means.

2. A packaging object supplying apparatus according to claim 1, wherein:

each of the first transporting failure detecting means and the second transporting failure detecting means includes a contact element disposed in the vicinity of the packaging object transporting means, contact element urging means for urging the contact element in an approaching direction toward the packaging object transporting means, and contact element motion detecting means for detecting a motion of the contact element, the first transporting failure detecting means detects that no packaging object is held by the packaging object holding means by detecting a motion of the contact element, approaching the packaging object transporting means, by the contact element motion detecting means, and the second transporting failure detecting means detects that no packaging object is held by the packaging object holding means by detecting a motion of the contact element, parting from the packaging object transporting means, by the contact element motion detecting means.

3. A packaging object supplying apparatus according to claim 1, wherein transfer means for transferring a packaging object transported by the packaging object transporting means to the packaging unit is provided at a terminal portion of the packaging object transporting means, the packaging unit including a receiving-side opening/closing guide that receives a packaging object transferred by the transfer means, and is capable of opening/closing, the transfer means comprising:

a feeding-side opening/closing guide that is capable of opening/closing and is provided so as to surround the packaging object transporting means and oppose the receiving-side opening/closing guide;

guide opening/closing means for opening/closing the feeding-side opening/closing guide and the receiving-side opening/closing guide; and pushing means for pushing a packaging object from the packaging object transporting means to the receiving-side opening/closing guide in a state in which the feeding-side opening/closing guide and the receiving-side opening/closing guide are open.

4. A packaging object supplying apparatus according to claim 1, wherein the packaging object transporting means includes direction detecting means for detecting whether or not the packaging objects are introduced to the packaging unit in a predetermined direction.

5. A packaging object supplying apparatus according to claim 4, wherein the direction detecting means includes probing means which moves until it comes into contact with the packaging objects, and moving amount detecting means for detecting a moving amount of the probing means.

* * * * *